United States Patent [19]

Hoover et al.

[11] 4,308,959

[45] Jan. 5, 1982

[54] ROLL SORTING APPARATUS

[75] Inventors: Michael C. Hoover; Charles R. Brazell; Shyam B. Mehta; James F. Lockett; Elias H. Codding, all of Houston, Tex.

[73] Assignee: Geosource Inc., Houston, Tex.

[21] Appl. No.: 43,694

[22] Filed: May 30, 1979

[51] Int. Cl.[3] ..... B07C 5/342

[52] U.S. Cl. ..... 209/563; 209/587; 209/939; 209/701; 250/223 R; 356/72; 358/106

[58] Field of Search ..... 209/563–565, 209/576, 577, 580–582, 587, 939, 701; 250/223 R; 356/72, 237, 426; 358/106

[56] References Cited

U.S. PATENT DOCUMENTS

| | | | |
|---|---|---|---|
| 3,975,262 | 8/1976 | Sherwood | 209/564 |
| 4,095,696 | 6/1978 | Sherwood | 209/581 X |
| 4,122,951 | 10/1978 | Alaminos | 209/939 |
| 4,147,619 | 4/1979 | Wassmer et al. | 209/914 |
| 4,163,991 | 8/1979 | Burrig | 358/106 X |

OTHER PUBLICATIONS

R. G. Neuhauser, "The Silicon-Target Vidicon," 6-1-7-76, RCA Manual.

*Primary Examiner*—Joseph J. Rolla
*Attorney, Agent, or Firm*—Arnold, White & Durkee

[57] ABSTRACT

An apparatus for sorting articles based upon the presence of defects on the surface thereof is characterized by a roller conveyor carrying a random array of articles in transverse channels defined between adjacent rollers. As the conveyor is advanced through a viewed area the articles are simultaneously rotated such that electrical images are formed of the portions of the surface of each article within a viewing zone defined in each channel during a given time frame. The viewing zones advance a predetermined distance through the viewed are in synchronization with the scanning of the electrical images. A characteristic signal for the portion of the electrical image corresponding to each article is developed and output to a processor. The processor generates a classification signal representative of the acceptability of each article based upon the percentage of total surface of area or number of defects on the surface each article.

86 Claims, 66 Drawing Figures

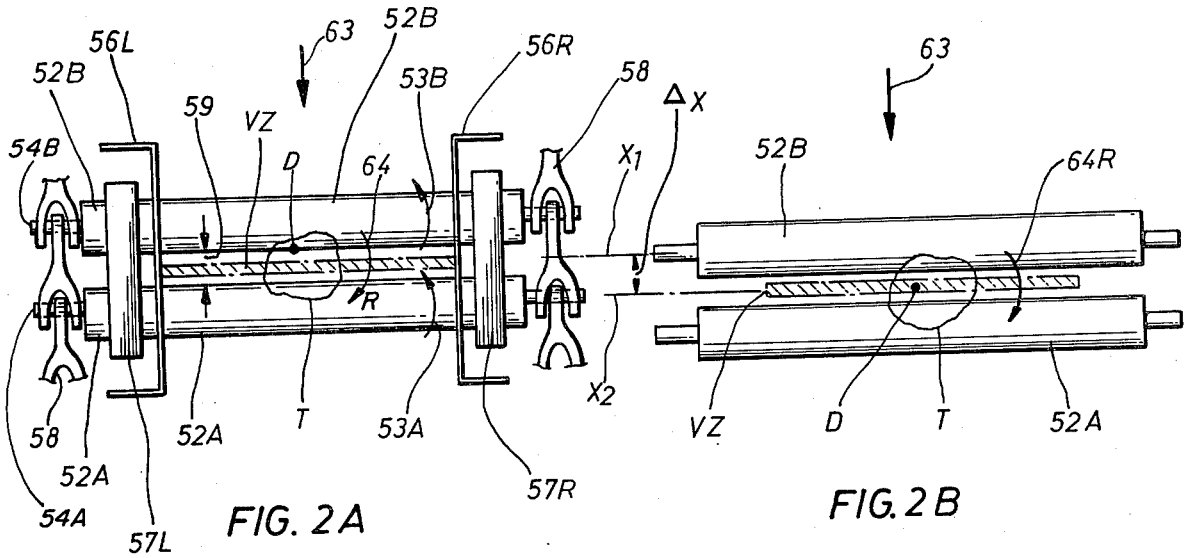
FIG. 2A
FIG. 2B
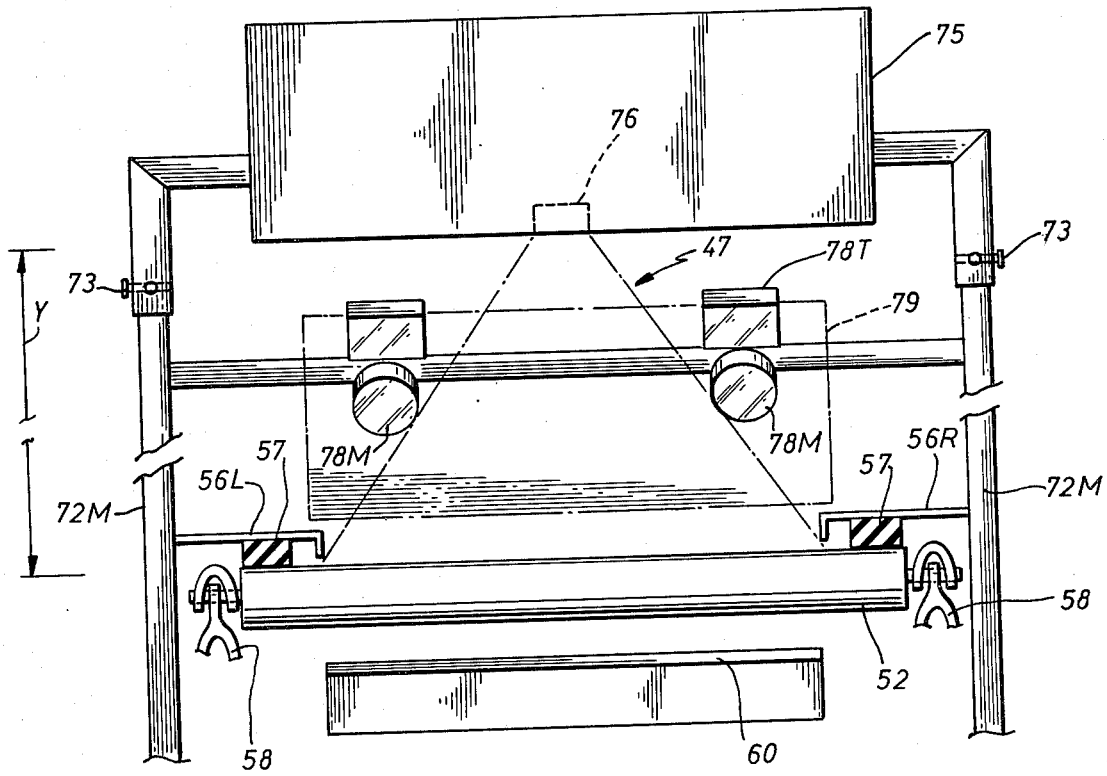
FIG. 1C

| FRAME NUMBER DURING CYCLE → / LINE OF INTEREST (LINE NUMBER) ↓ | | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 |
| | 9 | 10 | 11 | 12 | 13 | 14 | 15 | 16 | 17 | 18 | 19 | 20 | 21 | 22 | 23 | 24 | 25 | 26 | 27 | 28 | 29 |
| | 30 | 31 | 32 | 33 | 34 | 35 | 36 | 37 | 38 | 39 | 40 | 41 | 42 | 43 | 44 | 45 | 46 | 47 | 48 | 49 | 50 |
| | 51 | 52 | 53 | 54 | 55 | 56 | 57 | 58 | 59 | 60 | 61 | 62 | 63 | 64 | 65 | 66 | 67 | 68 | 69 | 70 | 71 |
| | 72 | 73 | 74 | 75 | 76 | 77 | 78 | 79 | 80 | 81 | 82 | 83 | 84 | 85 | 86 | 87 | 88 | 89 | 90 | 91 | 92 |

FIG. 6A
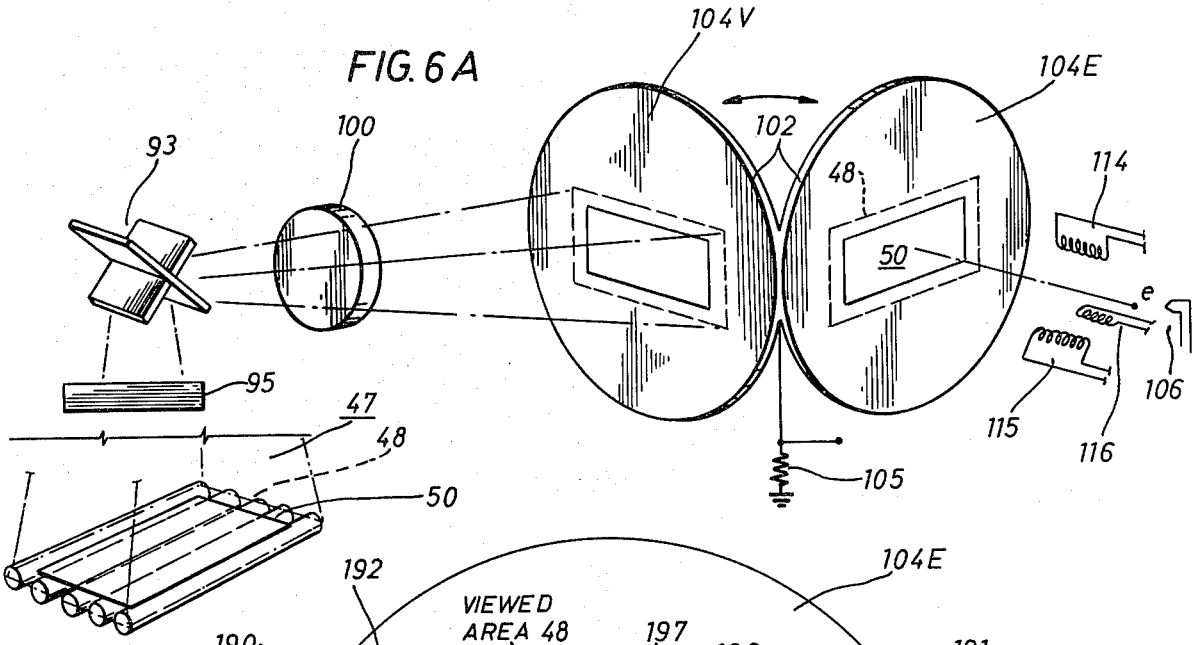
FIG. 6B
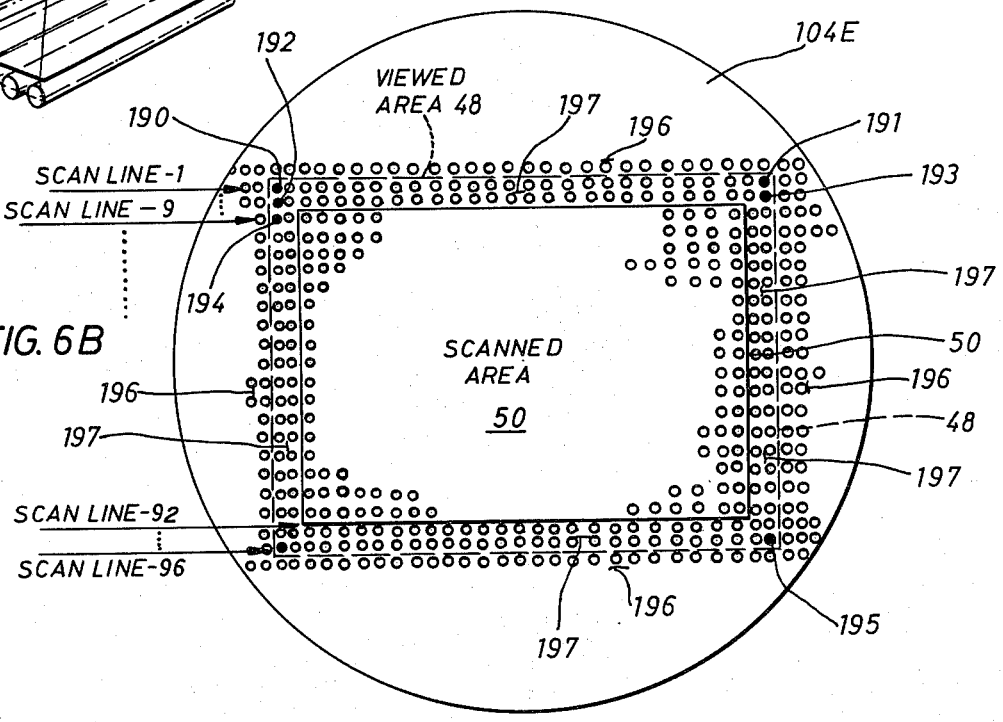
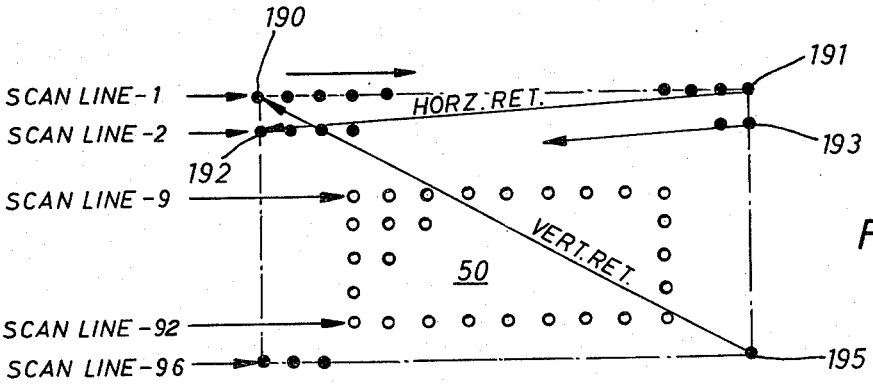
FIG. 6C

FROM FIG. 7A
VERT. RETRACE
BLANKING
HORIZ. SWEEP
CLAMP
DRIVER BOARD CONN. TO 176
CNT UP CLR
CARRY DN LOAD
CNT UP CLR
LOAD DN
74LS76
WINDOW
CLAMP
END OF FRAME
STROBE
TO DMA 181

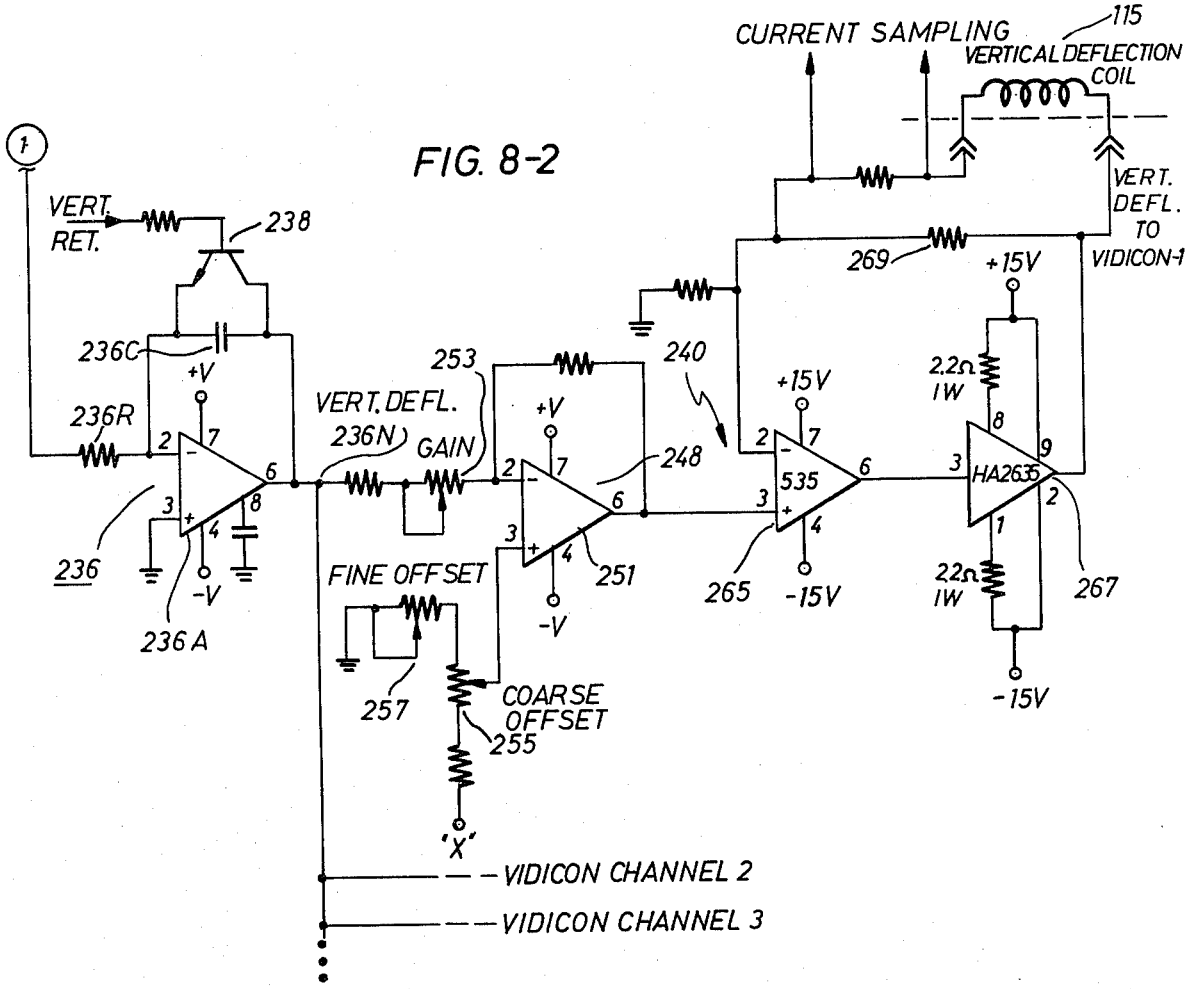
FIG. 8-2
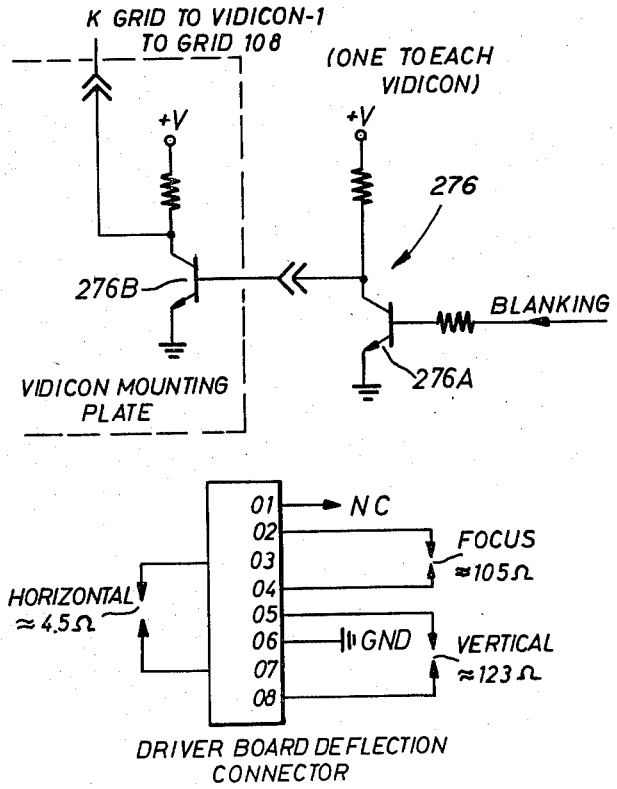
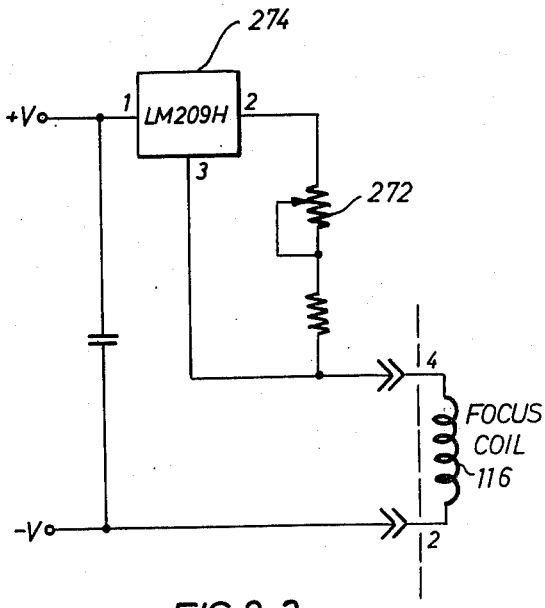
FIG. 8-3

178
TO 179
GREEN VIDEO
RED VIDEO
I R
VIDEO
288
2N4123
2N4123
+12V
+12V
286
CA3028
287
287A
10R
R
R
-V
287Z
287C
287F
COARSE CLASSIFIER CONTROL
ORANGE
PINK
RED (+)
YELLOW
GREEN (-)
ON FRONT PANEL
FINE CLASSIFIER CONTROL
ON FRONT PANEL
284
1/2 2N4045
1/2 2N4045
+12V
22K
5pfd
4.7μfd
100K
-12V
285
282G
284NG
105G
TARGET VOLTAGE
280G
+20
282R
284NR
105R
280R
+20
284NI
282I
105I
280I
+20
INPUT #1 GREEN VIDEO FROM VIDICON 92G
INPUT #2 RED VIDEO FROM VIDICON 92R
INPUT #3 INFRA/RED VIDEO FROM VIDICON 92I CLAMP
GREEN VIDEO
FROM PREAMP 178
RED VIDEO
179
304
300G
300R
302G
302R
306G
306R
308G
308R
309G
309R
310G
310R
311G
311R
312
314
316
324G
324R
326
326A
326B
C1
C2
D1
D2
D3
D4
D5
D6
+V
-V

SCAN LINE S
A1
A2
A3
IR WAVEFORM INPUT OF 334 t
SIGNAL FROM# 334-7 ON LINE 338 ta
tc
t
VOLTAGE PEAK 2
VOLTAGE PEAK 1
P % OF PEAK
P % OF PEAK

LINE 348
LINE 361
tg1
tg2
OUTPUT OF 364 tb
td
tf
OUTPUT OF 366 tb
td
te
tf

ART. DET.
338
367
340
ta
tb
tg1
tc
td
te
tf
tg2

MAIN POWER SUPPLY
110 VOLT
60 Hz
(LINE FREQ.)
T
6.3 V
370
174
RECTIFIED (OR
SECOND HARMONIC
OF LINE FREQ.)
371
371A
372
372A
372B
373
373A
374
374A
375
376
376A
376B
SE/60
382
70A
I/O
SE-A
MAN
+V

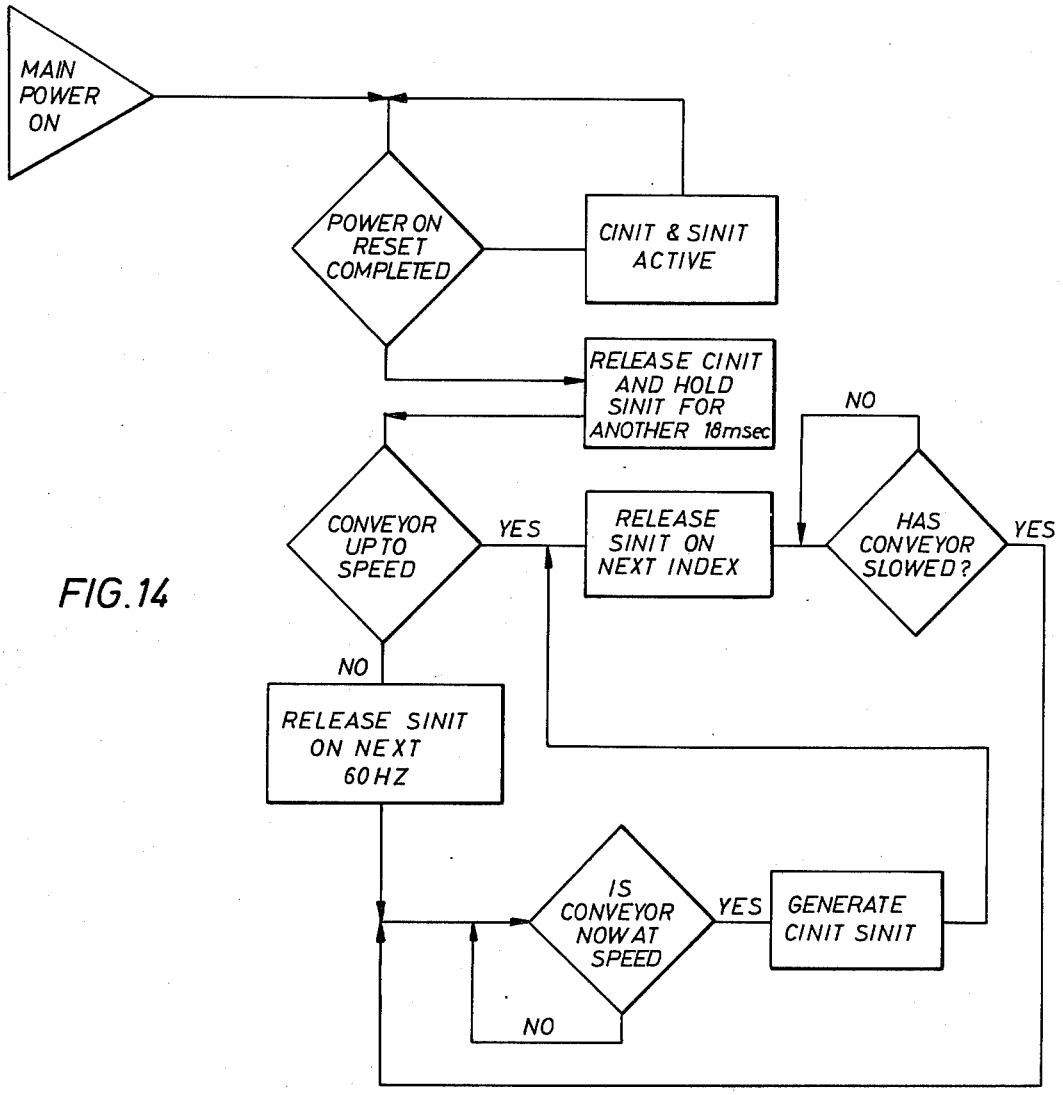
FIG. 14
FIG. 23
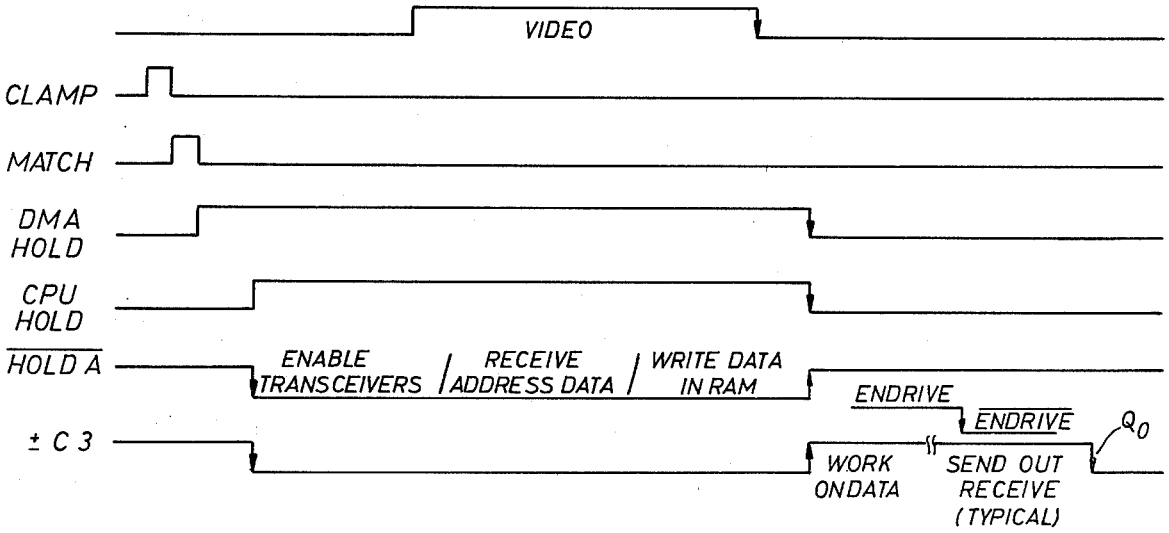

| CYCLE ORDER OF CPU'S | FIRST CYCLE — FRAMES 1-21 | SECOND CYCLE — FRAMES 22-42 | THIRD CYCLE — FRAMES 43-63 | FOURTH CYCLE — FRAMES 64-84 | FIFTH CYCLE — FRAMES 85-105 | SIXTH CYCLE — FRAMES 106-126 | SEVENTH CYCLE — FRAMES 127-147 | • • • |
|---|---|---|---|---|---|---|---|---|
| | 1 | 2 | 3 | 4 | 1 | 2 | 3 | • • • |
| | — | 1 | 2 | 3 | 4 | 1 | 2 | • • • |
| | — | — | 1 | 2 | 3 | 4 | 1 | • • • |
| | — | — | — | 1 | 2 | 3 | 4 | • • • |

SINIT
$\overline{SINIT}$
436A
436B
432B
419A
419B
434
438B
438A
432A
EOC
430
428
424
426
422
MATCH
+V
408
411
407
470 pfd
1K
420
M
CK1
QA
QB
QC
CK2
SE
IN
A
B
C
D
TO CPU's
416D
416C
416B
416A
418
414B
414A
414
412
419A
LOAD
CNT UP
CLR
CNT DN
STEERING
FROM 410A-$\overline{Q}$ FIG.20B
FROM FIG.20B
402B
402A
IN
OUT
B3
B2
B1
B0
A3
A2
A1
A0
404
406A
406B
CAR RY
CNT UP
LD
CNT DN
CLR
CNT. DN
400B
400A
401A
401B
401
CLAMP
$\overline{CLAMP}$
TO FIG. 20B
421
END OF FRAME 578
+V
464A
464B
504
538
CLK
CLK G
STB
CLAMP
LATCH
506C
552A
502
496A
442D
526
516A
516B
540
580
524
553A
506D
514A
580A
536
518A
518B
542
552B
506E
514B
514
530
520A
520B
544
553B
506F
514C
528
512
522A
522B
546
510
522
534
532
560
506G
506B
514D
TO FIG. 20B TO FIG. 19
FROM FIG. 19
FROM FIG. 20A
FROM 179
VIDEO CONN.
STEERING
STROBE
WRITE
WINDOW
FORCE SEND
STORE
LATCH
SEND
SENT LAST
CLAMP
ART. DET.
BLACK
RATIO
YELLOW
(SEND)(LATCH)
(LATCH+SEND)
STB

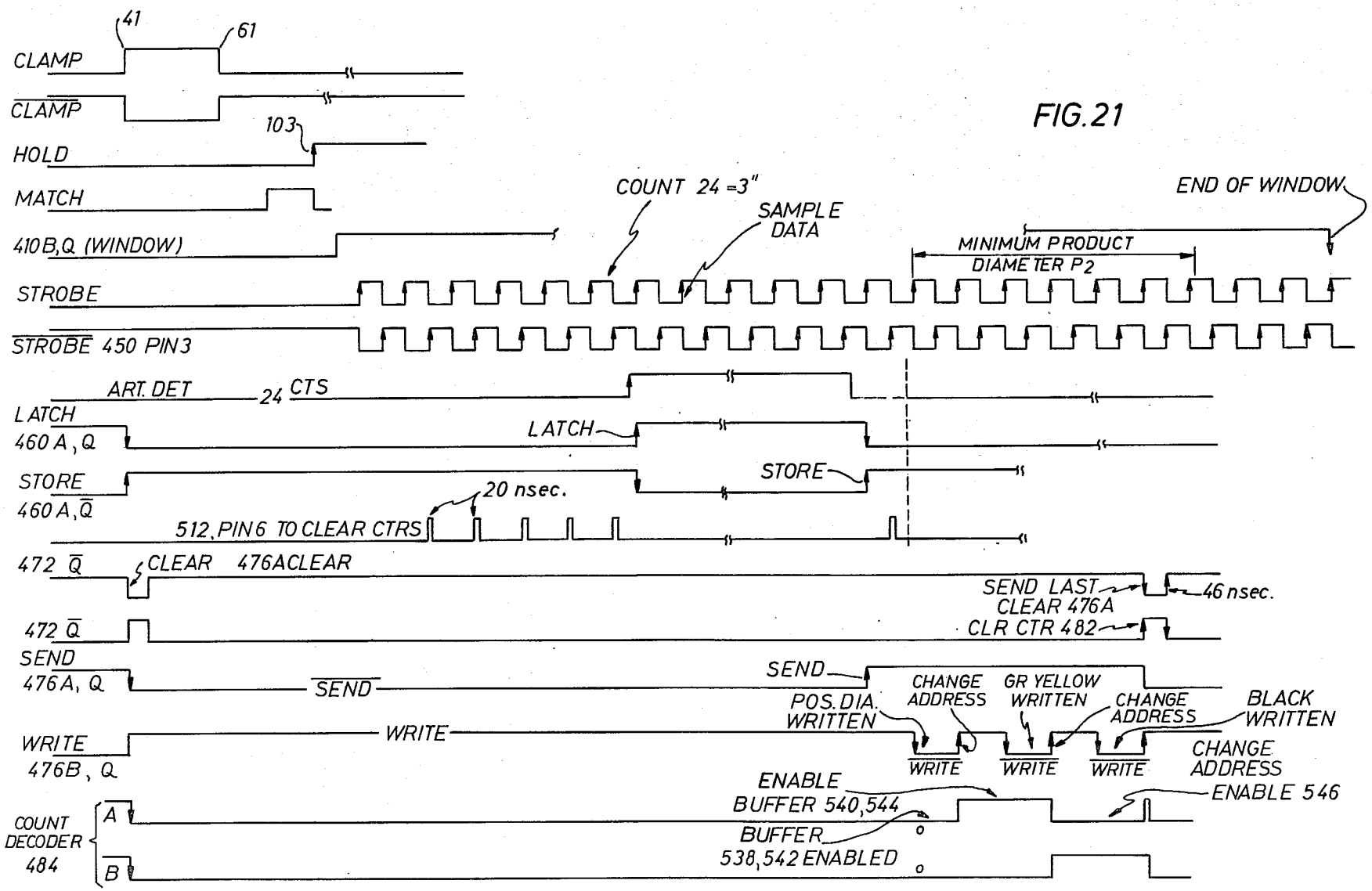
FIG. 21
END OF WINDOW
MINIMUM PRODUCT DIAMETER P2
SAMPLE DATA
COUNT 24 =3"
STROBE
STROBE 450 PIN 3
ART. DET
24 CTS
LATCH
LATCH 460 A, Q
STORE
STORE 460 A, Q
20 nsec.
512, PIN 6 TO CLEAR CTRS
CLEAR 476A CLEAR
472 Q
SEND LAST CLEAR 476A
CLR CTR 482
46 nsec.
472 Q
SEND
SEND 476A, Q
SEND
POS. DIA. WRITTEN
CHANGE ADDRESS
GR YELLOW WRITTEN
CHANGE ADDRESS
BLACK WRITTEN
WRITE
WRITE 476B, Q
WRITE
WRITE
WRITE
CHANGE ADDRESS
ENABLE 546
ENABLE BUFFER 540, 544
BUFFER 538, 542 ENABLED
COUNT DECODER 484
A
B
CLAMP
CLAMP
HOLD
MATCH
410 B, Q (WINDOW)
41
61
103

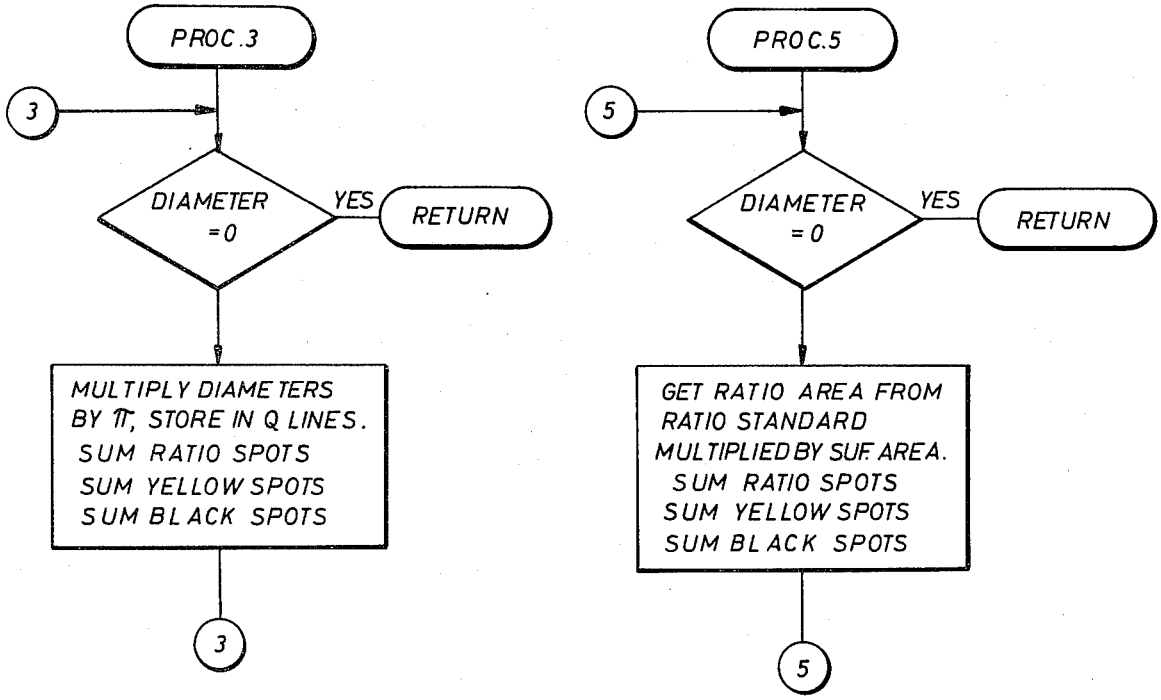
FIG. 25B
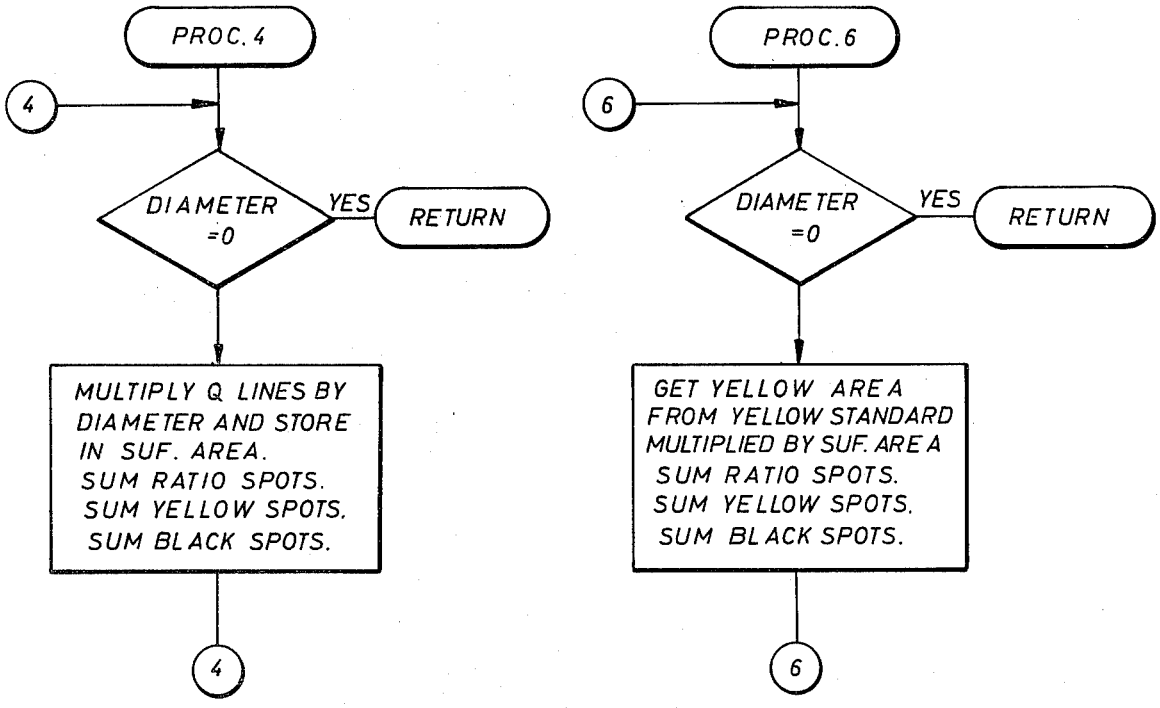

SOFTWARE TASKS

1.) KEEP RUNNING TOTAL OF DEFECTS ("SPOTS" OR COUNT)
2.) CALCULATE SURFACE AREA (SUF. AREA)
3.) CALCULATE NUMBER OF LINES TO SCAN
4.) FIND AVERAGE DIAMETER
5.) FIND SURFACE AREA TIMES STANDARDS (= ALLOWABLE DEFECTIVE AREA)
6.) TRACK ON LAST INCH OF TRANSLATION
7.) DETERMINE ACCEPTABILITY BY COMPARING SPOTS TO ALLOWABLE DEFECTIVE AREA
8.) DETERMINE WHICH EJECTOR TO FIRE
9.) OUTPUT ARTICLE-REJECT SIGNALS TO FIRE EJECTORS
10.) CLEAR RAM FOR NEXT VIEWING ZONE

FIG.25D

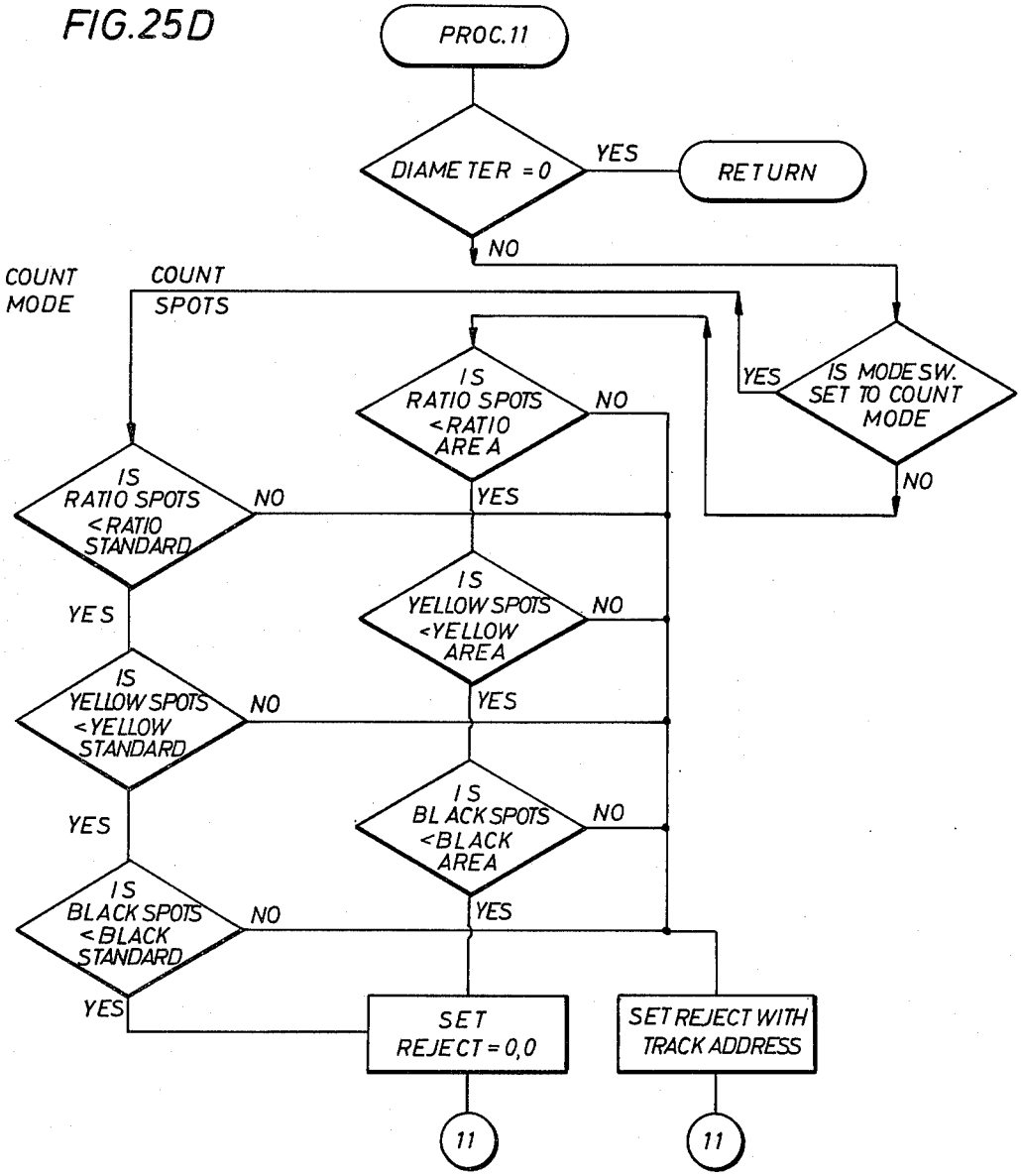

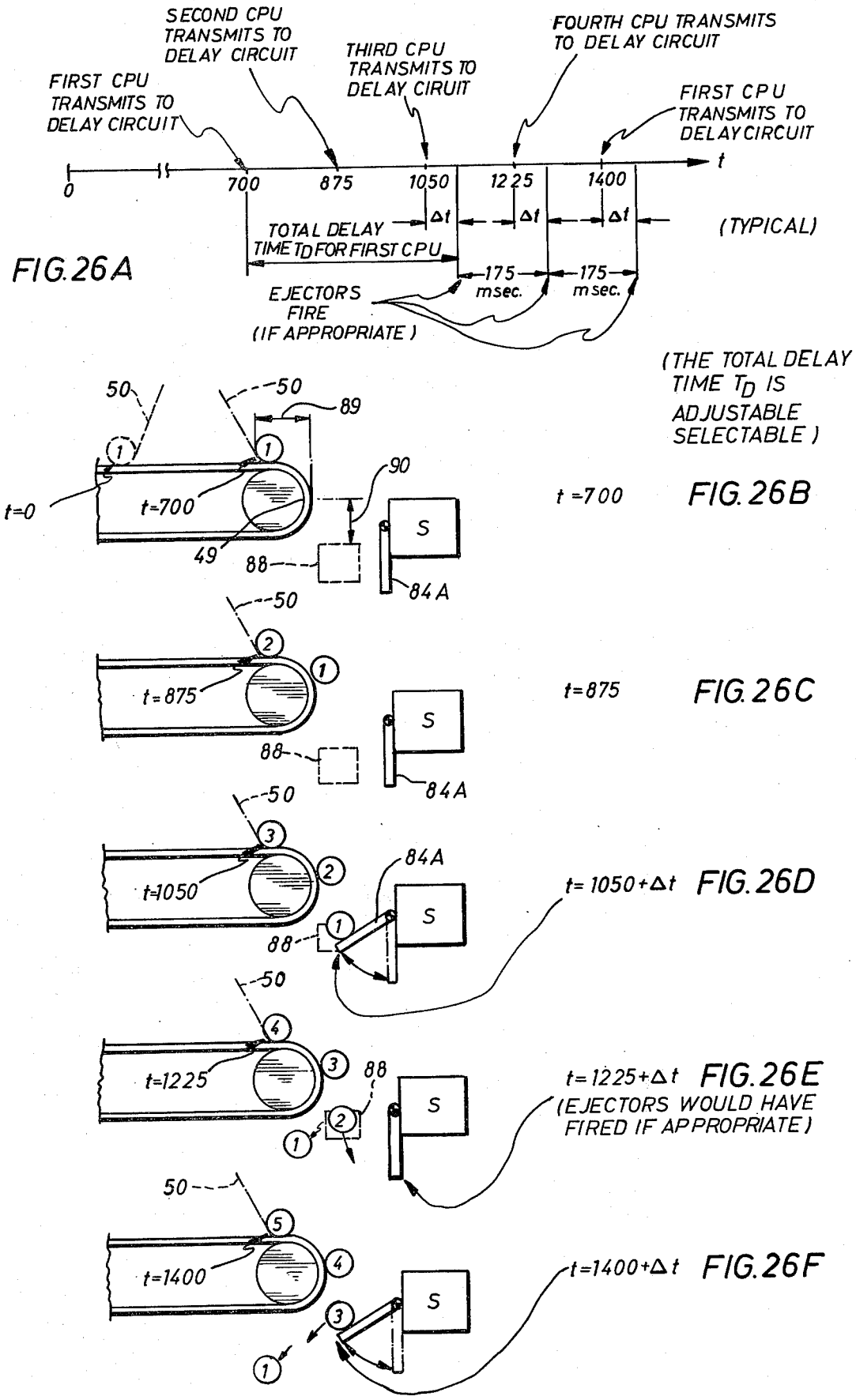
SECOND CPU TRANSMITS TO DELAY CIRCUIT
THIRD CPU TRANSMITS TO DELAY CIRUIT
FOURTH CPU TRANSMITS TO DELAY CIRCUIT
FIRST CPU TRANSMITS TO DELAY CIRCUIT
FIRST CPU TRANSMITS TO DELAY CIRCUIT
t
0
700
875
1050
1225
1400
Δt
Δt
Δt
(TYPICAL)
TOTAL DELAY TIME TD FOR FIRST CPU
175 msec.
175 msec.
EJECTORS FIRE (IF APPROPRIATE)
(THE TOTAL DELAY TIME TD IS ADJUSTABLE SELECTABLE)
FIG. 26A
50
89
90
t=0
t=700
49
88
S
84A
t=700
FIG. 26B
t=875
t=875
FIG. 26C
t=1050
84A
t=1050+Δt
FIG. 26D
t=1225
88
t=1225+Δt
FIG. 26E
(EJECTORS WOULD HAVE FIRED IF APPROPRIATE)
t=1400
t=1400+Δt
FIG. 26F END OF FRAME
+V
712
714
183
TO FIG. 27B
745
748A
704
702
706
708
710
716
724
718
698
688B
696
694
SINIT
692
690
747B
748B
747A
686
688A
652
653
654
654A
662A
662B
650A
650B
658
660
656
664
666A
670
184

TO DRIVER CHANNELS S FIG. 28
FROM FIG. 27A 734B
734A
738B
738A
730
668
726
682
728A
728B
UP
680A
680B
744
743A
743B
743C
748A
678
678A
678B
676
675
672
666A
666B
666N
670
683
732A
732B
736
739
731
722
724
718
720
DATA
WR
W I/O
CLK
CLR
D
Q
P
+V

ROLL SORTING APPARATUS

CROSS-REFERENCE TO RELATED APPLICATION

Subject matter disclosed herein is disclosed and claimed in the copending application of Louis L. Andry and Michael C. Hoover, titled Trichromatic Beam Splitter, filed contemporaneously herewith, assigned to the assignee of the instant invention.

BACKGROUND OF THE INVENTION

1. Field of the Invention

This invention relates to a sorting apparatus adapted to scan the entire surface of articles randomly disposed on a roller conveyor as the conveyor is moved through a viewed area and to classify each article on the basis of surface defects or blemishes.

2. Description of the Prior Art

It is a difficult task to sort relatively large objects for surface defects or blemishes. The problems presented by such a sorting task are different in some respects than those encountered when classifying articles on the basis of their color and reflectivity. For example, it is usually sufficient for a color sort to pass the articles being sorted through a viewed area so that light at predetermined color wavelengths which is reflected from the articles may be gathered by a suitable optical system. The light is converted into electrical signals representing the intensity of the reflected color wavelengths and classification occurs on that basis. Examples of bichromatic sorting apparatus include U.S. Pat. No. 3,980,181 (Hoover et al.), U.S. Pat. No. 4,088,227 (Lockett) and U.S. Pat. No. 4,134,498 (Jones et al.) each assigned to the assignee of the present invention. The apparatus disclosed in U.S. Pat. No. 2,803,754, U.S. Pat. No. 2,908,375, U.S. Pat. No. 2,908,388, U.S. Pat. No. 2,966,264, and U.S. Pat. No. 3,012,666 (all to Cox), all assigned to the assignee of the present invention, are exemplary of another bichromatic color sorter useful to classify articles (as lemons or other citrus fruits) on the basis of color and reflectivity.

In contrast, to adequately perform a sort for surface blemishes or defects, it is necessary that the entire surface area and not merely a portion thereof be scrutinized. Typically, objects which are examined for surface defects or blemishes usually present a curved surface and exhibit at least one axis of rotation (either spherical or elliptical). As such, these articles are susceptible to rolling and the earliest prior art attempts at surface defect sorting utilized manual labor to rotate the articles over an array of roller elements. As the articles are manually rotated over the rollers, the entire surface area thereof is exposed to the inspection of the laborer, and if a surface blemish or defect appears, the article is removed.

It is apparent that the manual scheme carries with it many drawbacks, among which are the imprecision of the sort, the variance between classifications by laborers, the relatively low throughput and, as labor costs escalate, the relatively high cost. It is not surprising, therefore, that the art sought ways to automatically scan the entire surface of the article and classify the article on the basis of surface defects. One such effort is the apparatus disclosed in U.S. Pat. No. 3,382,975 (Hoover), also assigned to the assignee of the present invention, which relates to an apparatus wherein articles to be sorted (potatoes) are pumped through a column of water past a series of multiple detectors disposed circumferentially about the column.

The concept of individually conveying articles past the scanning and ejecting zones (as exemplified by the last-cited patent) is carried over in other prior art systems. Usually sorting systems wherein the articles are individually conveyed require extensive mechanical feeding and article orienting systems adapted to provide an array of singulated article streams through the scanning and ejecting zones. Believed typical of such prior art apparatus, wherein roller elements are used to rotate the surface area of the article, is U.S. Pat. No. 4,122,951 (Alaminos). This patent also appears noteworthy for its disclosure of the use of a television camera for generating a video signal concerning the existence of blemishes on the surface of each article in the highly singulated array of articles passing through an observation zone.

SUMMARY OF THE INVENTION

This invention relates to a sorting apparatus where each article in a stream of articles is sorted for surface defects and blemishes and articles classified as unacceptable are removed from the stream. The articles to be sorted are deposited randomly upon an article conveyor. The conveyor includes a plurality of rollers each adapted to rotate about a central axis. Each conveyor cooperates with a next-adjacent roller to define a transverse channel in which the articles are carried. The rotation of the rollers is imparted to the articles and the surface of each article is rotated through a viewing zone defined within each channel as the conveyor is driven by a synchronous motor at a predetermined speed through a viewed area. The viewed area is illuminated by suitable illuminating elements.

Within the viewed area, light reflected from the surface of each article is detected against a non-reflective background member by an optical arrangement including a lens and beam splitter. The beam splitter operates to trifurcate the light reflected thereinto into three ray paths. Filters are provided and the appropriately filtered light impinges upon the visual image plane defined by the surface of a photoconductive target in each of a plurality of vidicon tubes.

The filtered light incident on the vidicon target creates on an electrical image plane (the opposite side of the target) an electrical image of light reflected from the viewed area. The electrical image plane is scanned by a scanning electron beam sweeping thereacross. The frequency at which the electrical image plane is swept is governed in accordance with the speed at which the conveyor is moved through the viewed area and also in accordance with the rectified 60 Hz. line frequency and the optimum operating parameters of the vidicon. The electron beam scans the electrical image plane at a rate synchronized with the rate at which the motor advances the conveyor. Hence, the sweeping of the electrical image plane defines a number of "frames" representative of the image of the viewing zones as the viewing zones are moved at a predetermined speed through the viewed area. A frame comprises a complete scan of the electrical image plane and return. The frequency of the frames is determined by the zero-crossings of a rectified line signal, which line signal is also applied to the synchronous motor. The occurrence of each time frame is therefore synchronized with the second harmonic of the line frequency and with the rate at which the conveyor is moved through the viewed area.

During each time frame, electrical characteristic signals are generated representative of the physical characteristic of the portion of the surface of each article within each viewing zone within the viewed area. Since the viewed area is sized to accommodate a plurality of viewing zones, the characteristic signals generated from a scan of the portion of each electrical image plane corresponding to each viewing zone are selected by a selector arrangement and transmitted to the appropriate processing unit to monitor the articles within a predetermined one of the viewing zones. During each frame, the selector arrangement selects the portion of each electrical image whose characteristic signals are to be transmitted and the appropriate processing unit to which the signals are to be transmitted, each in accordance with a predetermined sequence.

The processing unit, operable under the control of a program, processes, tabulates and stores an indication as to the proportion of the surface area of each article within the viewing zone to which it is assigned whereon the physical characteristic signal falls below a predetermined threshold. When the electrical image of the entire surface of each article has been scanned, the processing unit generates a classification based upon a comparison of the indication and a predetermined reference standard. The standard may be expressed either as a percentage of the total surface area or as a count of the number of segments of the article's surface whereon the physical characteristic falls below the threshold. If the indication stored by the processor for an article exceeds the standard, the article is rejected.

When the viewing zone leaves the viewed area, the processing unit outputs to a delay network a signal regarding the acceptability of each article. The processing unit is reassigned to monitor another viewing zone, while the acceptability signals are stored for a delay time period until the articles classified as unacceptable enter an ejection zone. The delay network actuates the appropriate ones of an ejector element array and an ejector arm is extended into the ejection zone for a time sufficient to deflect an unacceptably classified article therefrom.

A front panel is also provided whereby the operator may select the desired classification mode (either a percentage of total area or a count of segments of the article's surface) and reference standard. The standard may be altered during a sort. A battery backup is provided to store the standard while the apparatus is not in use (e.g., overnight) so that the sort may be resumed at the same standard.

It is believed advantageous to sort a random array of articles deposited on an article conveyor and to eliminate from the article stream those articles which exhibit unacceptable surface defects or blemishes. The elimination of the requirement that the articles be highly singulated or channelized in the direction of conveyor motion is believed advantageous since expensive and complicated feed mechanisms would be unnecessary. Article throughout is also enhanced.

It is also believed to be of advantage to utilize the principle of rotating the surface of the article in order to scan the entire surface area thereof. This is believed advantageously accomplished through the utilization of a roller conveyor to carry articles to be sorted randomly across transverse channels and to rotate the articles through a viewing zone defined in each channel as the conveyor advances the viewing zones through a viewed area.

BRIEF DESCRIPTION OF THE DRAWINGS

The invention will be more fully understood from the following detailed description thereof taken in connection with the accompanying drawings, which form a part of this application, and in which:

FIGS. 1A, 1B and 1C are, respectively, a side elevational view, a top view and an end view of a roll sorting apparatus in accordance with the invention;

FIGS. 2A and 2B are highly stylized pictorial representations illustrating the manner in which articles to be sorted are rotated through a viewing zone simultaneously with the displacement of the viewing zone through a viewed area;

FIGS. 6A–6C are highly stylized pictorial representations of the photosensitive target of a vidicon tube used in a roll sorting apparatus of the instant invention, including the electron beam scanning pattern;

FIG. 12A is a highly stylized pictorial representation of the physical location of articles within a viewing zone and the location of a scan line thereacross;

FIGS. 12B-1 through 12B-6 are timing diagrams of the operation of the article detect circuit shown in a portion of FIG. 11;

FIG. 14 is a flow diagram of the functions performed by the portion of the synchronizing circuit shown in FIG. 13;

FIG. 21 is a timing diagram of the operations performed by the circuitry shown in the schematic diagram of FIG. 20;

FIG. 23 is a timing diagram of the operation of the processing unit shown in FIG. 22;

FIGS. 25A through 25E are the flow chart of the program for the processing unit of FIG. 22;

FIGS. 26A through 26F are a series of highly stylized pictorial representations of the principle of operation of the delay circuit as depicted against a time reference;

DESCRIPTION OF THE PREFERRED EMBODIMENT

Figure 1A:
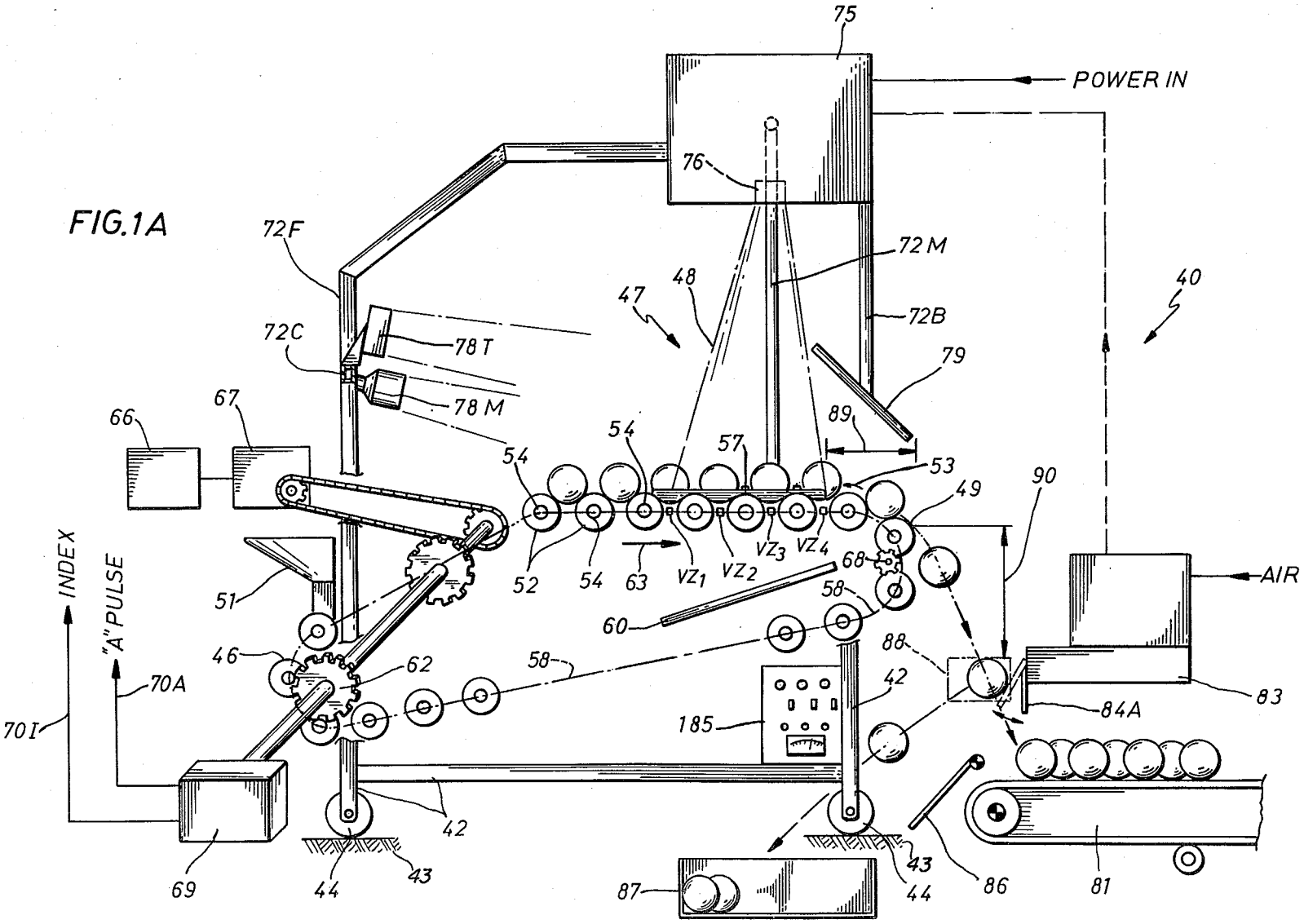

Throughout the following description similar reference numerals refer to similar elements in all figures of the drawings.

Figure 1B:
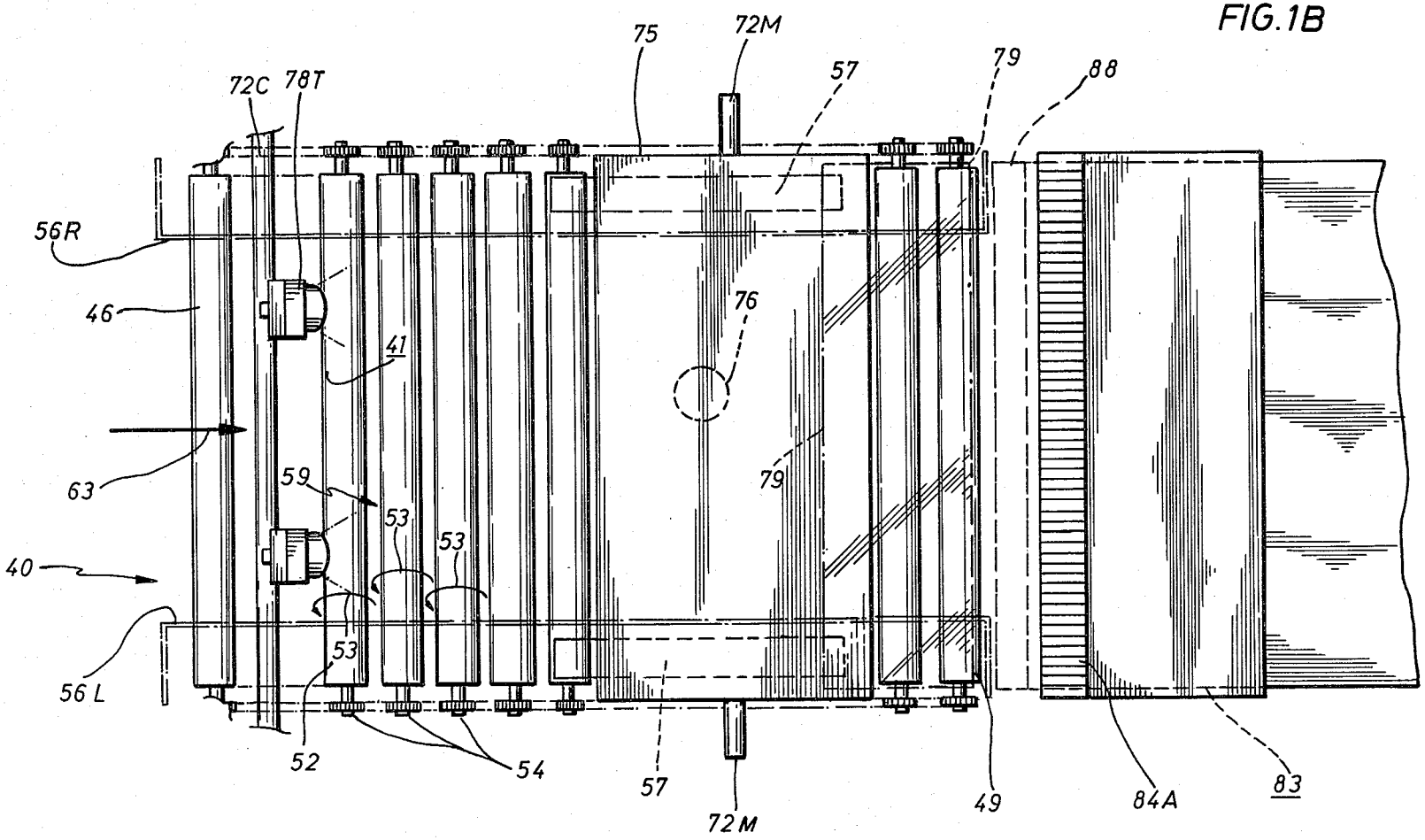

With reference to FIGS. 1A, 1B and 1C, respectively shown are a side elevational view, a top view and an end view of a roll sorting apparatus 40 in accordance with the teachings of this invention. The roll sorting apparatus 40 includes a conveyor 41 supported on suitable support braces and struts 42 on a work floor 43. The apparatus 40 may be provided with wheels 44 (which may or may not be engageable with tracks) whereby the apparatus 40 may be moved into and out of its operating position on the work floor. The conveyor 41 provides a suitable arrangement for conveying articles to be sorted, typically tomatoes or other comestibles, from an inlet end 46, through an illuminated region 47 which contains a viewed area 48, to a discharge end 49. (As will be discussed, within the viewed area 48 is defined a scanned area 50 (FIG. 6) for a purpose to be made clear herein.) The articles to be sorted are introduced onto the inlet end 46 of the conveyor 41 from a hopper 51 (shown schematically in FIG. 14) in a random manner. Of course, other conveyance devices, as another conveyor or an auger, may be used to randomly discharge articles onto the inlet end 46 of the conveyor 41.

A sorting apparatus in accordance with the instant invention is utilized to sort randomly disposed articles which exhibit the geometrical characteristics of a curved surface (either spherical, elliptical or cylindrical) and at least one axis of rotation. One of the capabilities of the apparatus is to sort and classify articles on the basis of surface blemishes or defects thereon. Typically, the apparatus 40 is able to be utilized to sort comestible articles but it is to be understood that the apparatus 40 may also be used to classify non-comestible articles exhibiting the above-noted geometrical characteristics. As examples of the comestible articles able to be sorted by the apparatus 40 are those which are substantially spherical: as oranges, grapefruit, English walnuts, and cherries; those which are substantially elliptical: as tomatoes, lemons, tangerines, olives, peanuts and apples; and those which are substantially cylindrical: as potatoes, sweet potatoes, sweet corn-on-the-cob and perhaps carrots and peppers.

The conveyor 41 includes an array of rollers 52, each roller 52 being rotatable in a direction 53 with respect to its central shaft 54.

In the preferred embodiment of the invention the conveyor includes forty-eight rollers 52, although any predetermined number of rollers, consistent with the length of the conveyor, may be used. The appropriate minimum number of rollers 52 which would comprise the conveyor 41 is twenty-eight. This number would permit four rollers for loading in the area of the hopper or other conveyance device, four within the viewed area, six on each end of the viewed area and eight for return. In any event, no matter how many rollers are utilized in a particular embodiment of the invention, it is believed helpful that the number of rollers be divisible by four, although this limitation is not necessary or required for the successful operation of the apparatus 40.

In order to define a clearance gap of sufficient dimension to insure integrity of the video signal (as is discussed herein) each roller is fabricated of plastic and is gray in color. The rollers are preferably 1.9 inches in diameter and thirty-two inches in transverse width measured between bumpers 56L and 56R with a transverse dimension of forty-two inches overall. A roller friction drive arrangement 57 bears against the rollers 52 under the bumpers 56. The ends of the roller shafts 54 are fixedly connected to a chain drive 58. As seen best in FIG. 1C, the friction drive 57L and 57R are each attached to the bumpers 56L and 56R, respectively. The friction drive 57 is thus fixed with respect to the rollers 52 as the rollers 52 are dragged by the chain drive 58 thereunder. As is discussed in connection with FIG. 2, this has a beneficial effect of rotating the rollers in the direction 53 while the articles carried on the rollers are rotated in an opposite direction as the conveyor is advanced longitudinally.

The rollers 52 are preferably connected such that a transverse gap or channel 59 of approximately three-tenths of an inch is defined between adjacent rollers. The gap 59 is provided so that light reflected from the articles may be detected against a non-reflective background plate 60 supported beneath the rollers in the viewed area 48 and may be minimally affected by the rollers. The plate 60 may be inclined, if desired. The channel 59 and the rollers 52 are sized so that the light reflected from articles within the viewing zones (as defined herein) is detected against the non-reflective background throughout the full transverse dimension of the viewing zone.

The links of the chain drive 58 are engageable by the teeth of a sprocket wheel 62, the rotation of which causes the array of rollers 52 to be translated longitudinally in a direction 63. The conveyor 41 thus defines an endless roller conveyor system. In areas of restricted physical space, the conveyor 41 may be angulated slightly adjacent the inlet end 46 to accommodate the apparatus 40 in a confined physical space. The incline also aids in keeping articles randomly deposited on the conveyor 41 only one layer deep.

It should be noted that in those places where any mechanical or electrical dimensions are provided herein, the purpose is to impart an appreciation of the physical size and operating parameters of the roll sorting apparatus 40 and the dimensions are not to be construed in any way as limiting the scope of the invention.

Figures 1, 2, 3, 4, 11:
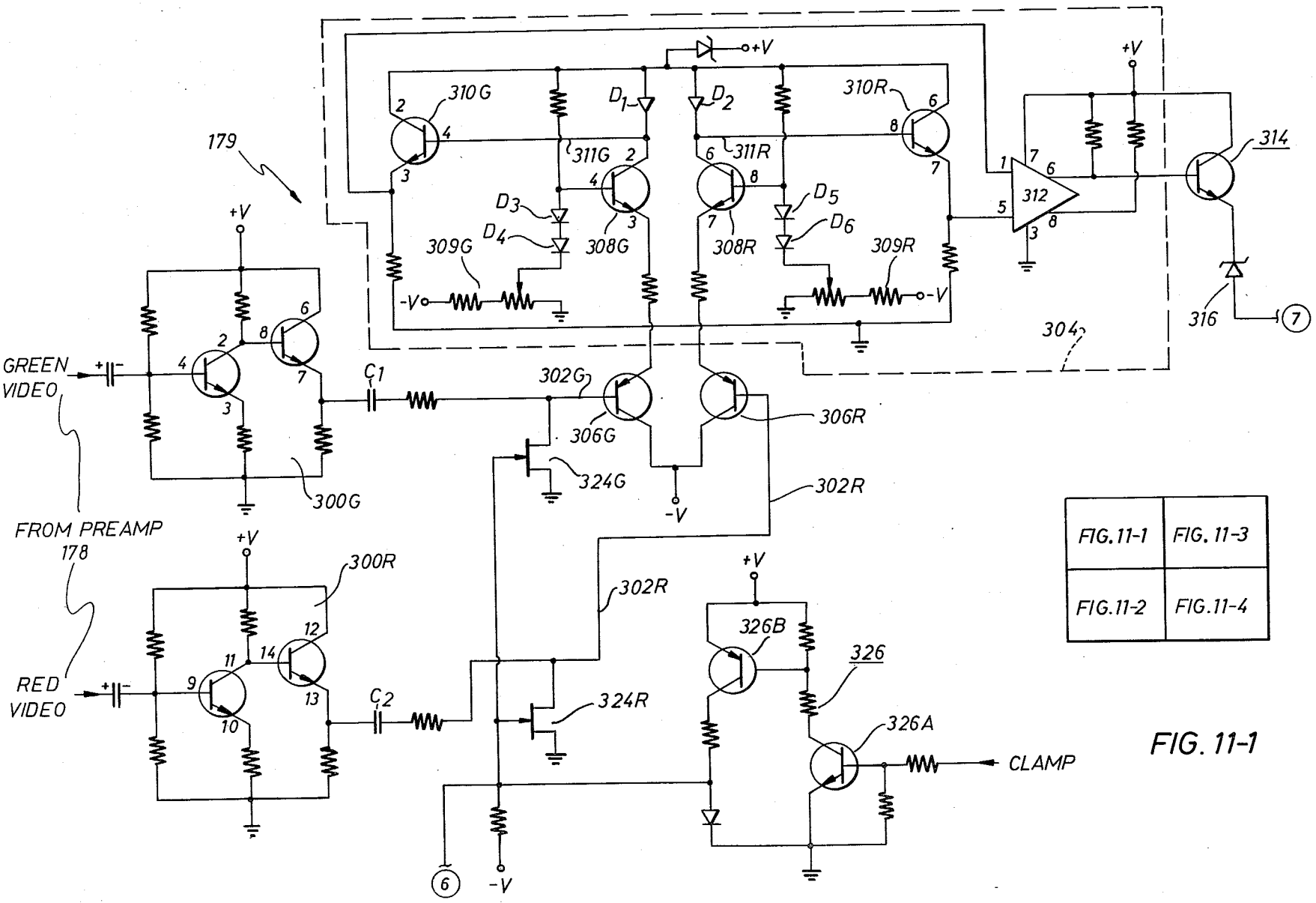
FIG. 11 is a schematic diagram of the characteristic signal generator circuit and the article-detect circuit used in a roll sorting apparatus in accordance with the invention.
Figures 2, 11:
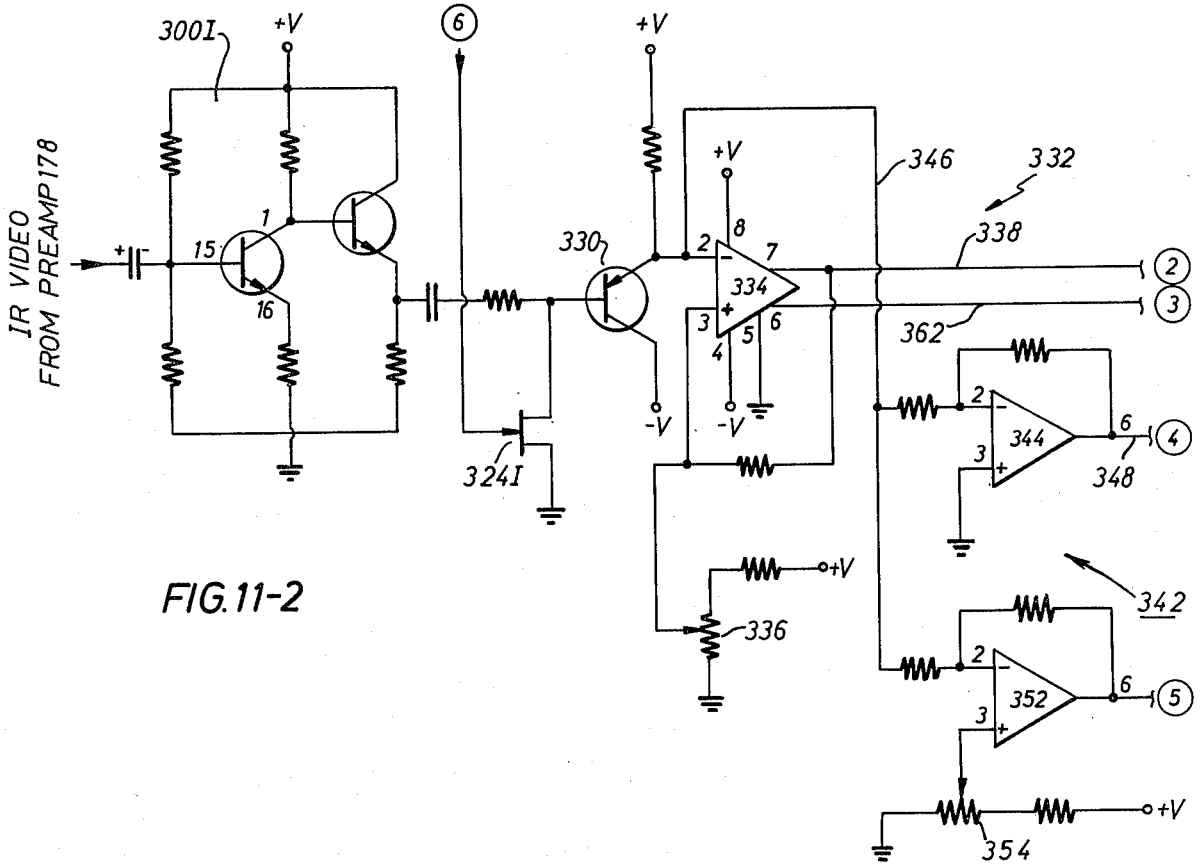
Figures 4, 11:
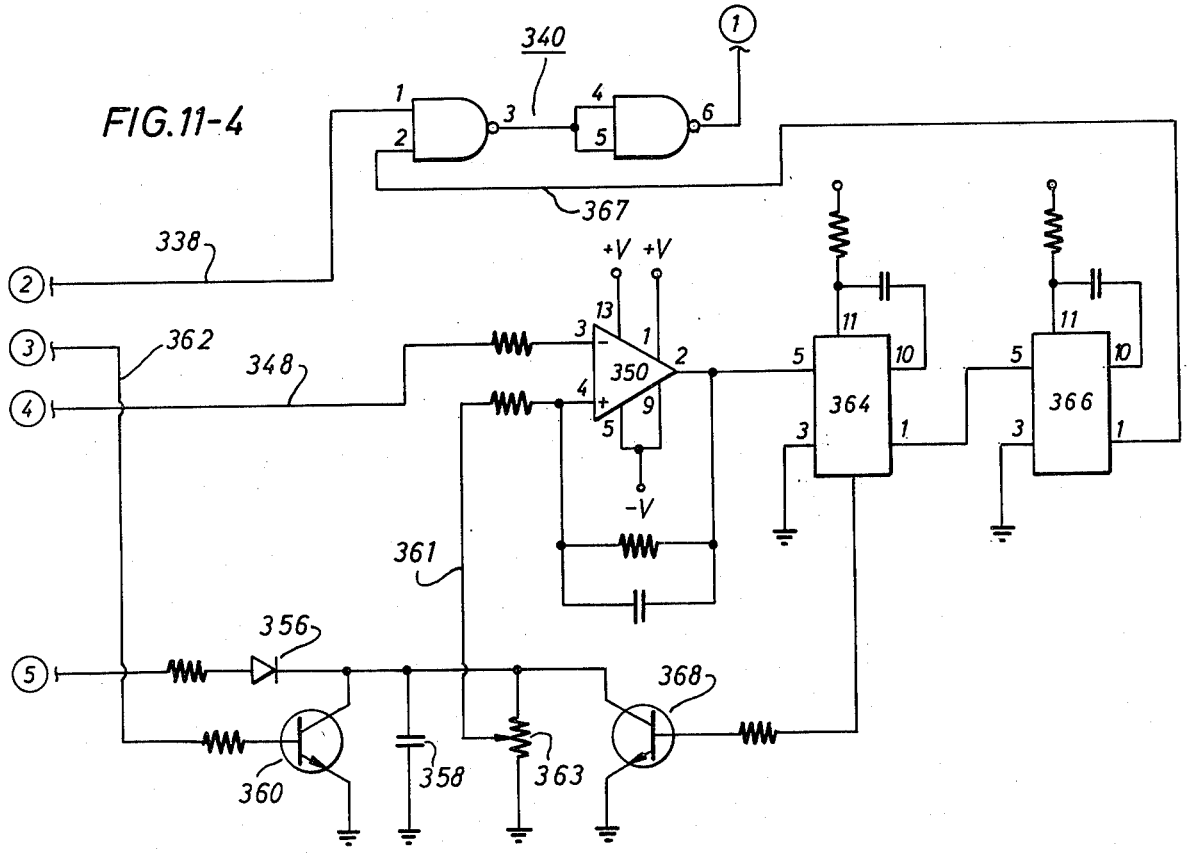
Figures 3, 11:
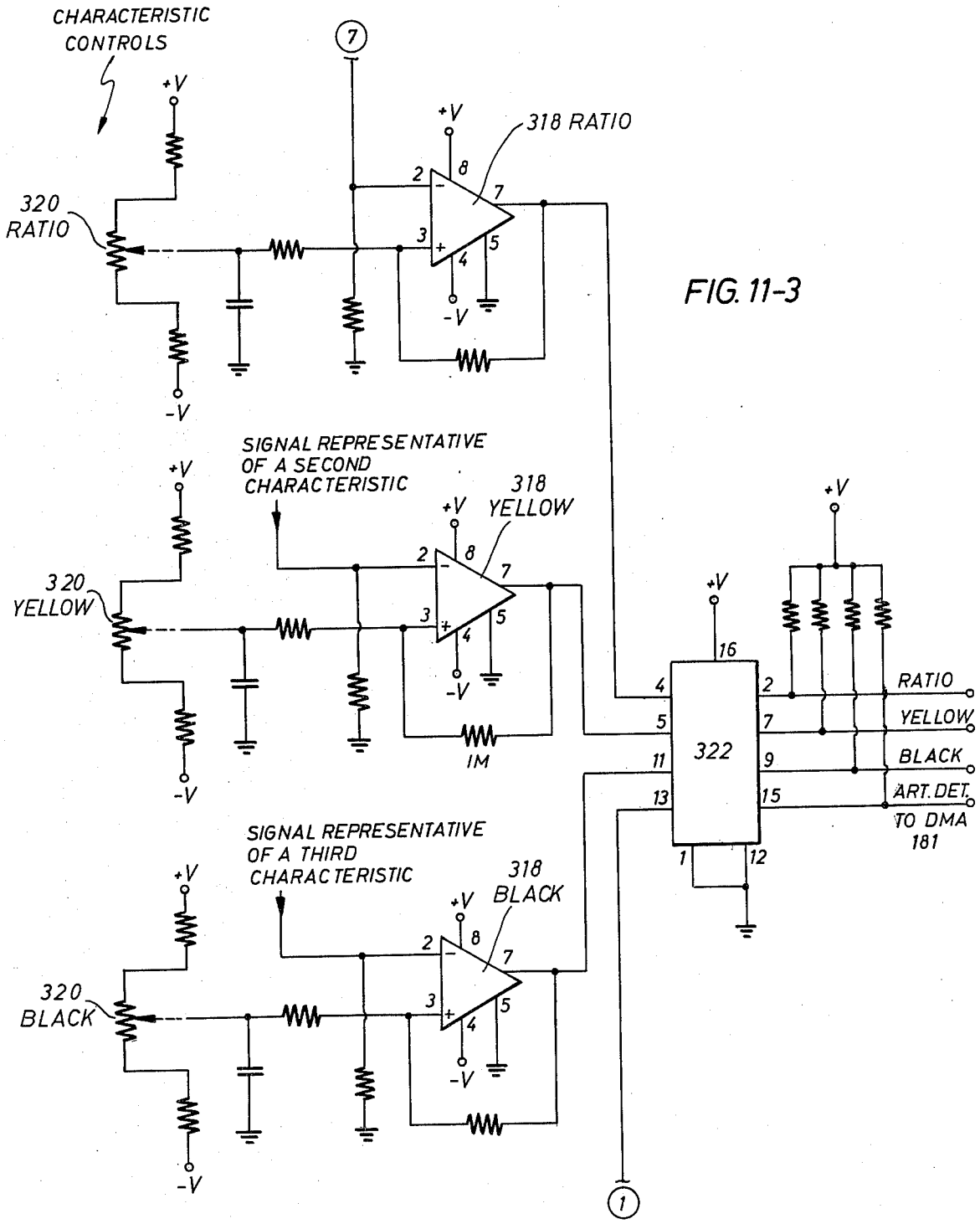

With reference to FIG. 2 the motions imparted to articles being sorted by the apparatus 40 may be more fully understood. In FIGS. 2A and 2B, an article to be sorted T having a defect D is shown as supported in the transverse channel 59 disposed between adjacent rollers 52A and 52B. An imaginary viewing zone VZ is defined substantially intermediate the channel 59 between the rollers 52A and 52B. The viewing zone VZ has a transverse dimension equal to the transverse width of the conveyor's rollers between the bumpers 56R and 56L (preferably thirty-two inches in the embodiment shown). The viewing zone VZ has a predetermined longitudinal dimension (typically one-eighth inch) and is preferably defined centrally in the longitudinal gap between rollers. Since the viewing zone VZ is disposed in a region intermediate the rollers 52, the non-reflective background plate 60 (having a reflectivity substantially equal to zero reflectivity) is visible through the channel 59. Thus, light reflected from the articles in the viewing zone is detected against a nonreflective background. The channel is sized so that a scan across the viewing zone is not affected by the rollers.

With the conveyor 41 in the position shown in FIG. 2A, the viewing zone VZ is centered at a first reference position $X_1$. In this position, a transverse band of the article T falls within the viewing zone VZ. As seen, since the defect D lies on a portion of the surface of the article T outside of the viewing zone VZ, a scan of the viewing zone VZ would not reveal the existence of the defect D on the article's surface. As the conveyor 41 translates in the longitudinal direction 63, the rollers 52A and 52B rotate about their central shafts 54A and 54B in the directions 53A and 53B, respectively. Rotation of the rollers 52 imparts a rotative motion R (in an opposite direction 64) to the article T, causing the article T to rotate such that when the viewing zone VZ occupies the reference position $X_2$ (a translation $\Delta X$ in the longitudinal direction 63) a different transverse band of the article T is presented within the viewing zone VZ. A scan of the viewing zone VZ at this time (when the viewing zone VZ is centered on reference position $X_2$) would reveal the presence of the defect D on the surface of the article.

From the foregoing it may be seen that as the conveyor 41 is translated in the longitudinal direction 63, a viewing zone VZ defined between adjacent rollers 52 is translated in the longitudinal direction 63 from a first to a second reference position. The surface of the article has translated the same distance and has also been simultaneously rotated through the viewing zone VZ defined in the channel 59 between adjacent rollers 52.

The size of the rollers 52 and the spacings therebetween cooperate to define the array of channels 59 which extend transversely to the longitudinal direction of translation 63 of the conveyor 41. It may be appreciated that an article to be sorted when introduced from the hopper 51 may be randomly received within any one of the transverse channels 59 so defined. In this sense the articles to be sorted are channelized as they are moved in transverse arrays through the illuminated region 47 and particularly the viewed area 48. However, it should be noted that the articles to be sorted are not constrained from randomly occupying any transverse location within the transverse channel 59 in which they fall. Thus, the articles to be sorted are randomly arranged across the channels 59 defined between adjacent rollers. The articles may be spaced one from the other or next-adjacent in an abutting relationship across the channels 59 without adversely impacting upon the sorting process being performed. The roller conveyor arrangement 41 described imparts a controlled rotation to the article being viewed so that the entire surface area is scanned as the conveyor 41 is translated through the viewed area 48.

The speed at which the conveyor 41 is longitudinally translated in the direction 63 is accurately controlled by a drive arrangement including a synchronous motor 66 operable from a line current having a predetermined frequency (in the United States, substantially 60 Hz.). The motor 66 is connected through a speed reducing arrangement 67 to drive the sprocket wheel 62. Through the action of the speed reducing arrangement 67 the speed of the conveyor 41 is accurately controlled such that any predetermined location on the conveyor 41 (e.g., a viewing zone defined between adjacent rollers 52) is displaced at a predetermined rate of speed, that is, through a predetermined distance ($\Delta X$) in a predetermined time. In the preferred embodiment, the viewing zone is translated 0.125 inches in 8.33 milliseconds. (This substantially corresponds to the period of a rectified 60 Hz. line signal. As will be seen, to avoid the deleterious beating phenomenon, each video frame is also taken during the period of the rectified 60 Hz. signal, or every 8.33 milliseconds.)

A discharge sprocket 68 is provided in engagement with the chain drive 58. The sprocket 68 is sized so that all articles carried within a given channel 59 are discharged from the conveyor within a predetermined time interval, e.g., one hundred milliseconds. To sort tomatoes, for example, a six-tooth sprocket with an outer diameter of five and seven-sixteenth inches has been found acceptable.

A suitable motor 66 used in connection with the roll sorting apparatus 40 may be a two horsepower, 230 volt A.C., three-phase synchronous motor such as that manufactured and sold under model number P14H5600 by Reliance Electric Company. The gear reducing arrangement 67 may include any sort of timing belt, gear or chain drive such that the synchronous speed of the motor 66 may be reduced to impart a predetermined speed to thereby translate the conveyor 41 the predetermined displacement $\Delta X$ in the predetermined unit of time. In the embodiment of the invention discussed herein, the conveyor is displaced in the direction 63 at a rate of fifteen inches per second.

As will be set out herein, the video signals are taken in predetermined time frames in accordance with the line frequency and, therefore, in synchronization with the displacement of the conveyor 41 by the motor 66. To assist in initiating the operation of the electronics circuitry to generate the useful video signals and operate thereon is a shaft encoder 69. The shaft encoder 69 is connected to the shaft of the sprocket wheel 62 and is operative to generate one output pulse for every full revolution of the wheel 62. This output pulse is hereafter referred to as an "index" pulse and it is transmitted over a line 70I and is utilized to synchronize the operation of the electronic circuitry with the movement of the conveyor 41. (The shaft encoder 69 also outputs a train of pulses known as "A" pulses which are transmitted over a line 70A and which may be used by the electronics only to determine when the conveyor 41 reaches operational speed.)

Figures 1, 8:
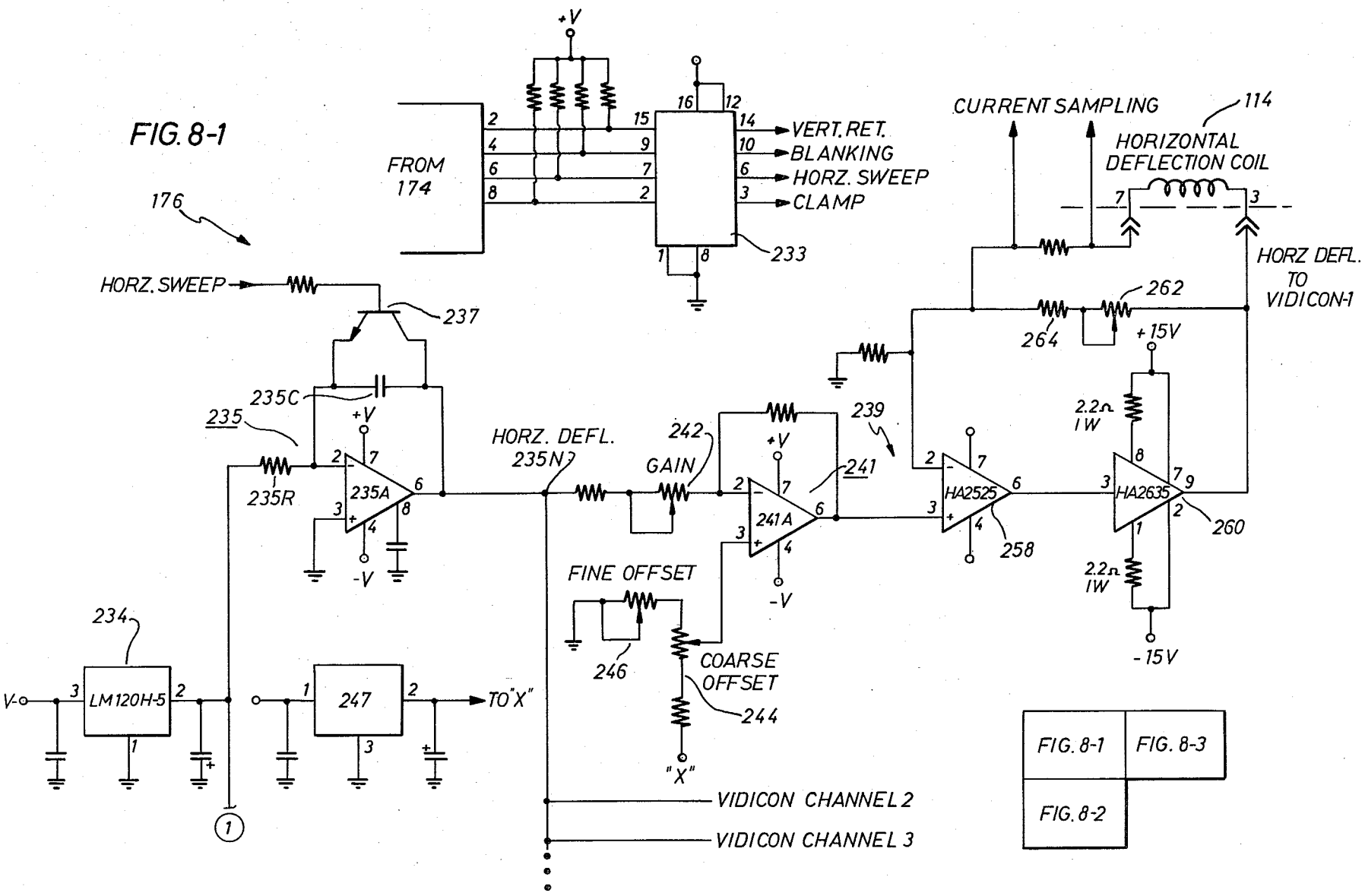
FIGS. 8-1 to 8-3 are schematic diagrams of the vidicon driver control circuit used in a roll sorting apparatus in accordance with this invention.

The conveyor 41 carries the articles to be sorted through the illuminated region 47. The illuminated region 47 contains the viewed area 50 which may define any predetermined size. (The scanned area 48 is electronically defined within the viewed area 48, as discussed in FIG. 6.) In the preferred embodiment of the invention, the viewed area 48 is sized and configured so as to simultaneously accommodate an area containing four viewing zones $VZ_1$, $VZ_2$, $VZ_3$ and $VZ_4$, as indicated in FIG. 1. With the rollers 52 sized and spaced as discussed above, the viewed area 48 is approximately ten and one-half inches in the longitudinal dimension (measured in the direction 63) and has a transverse dimension that is coextensive with the transverse dimension of the exposed portion of the rollers 52 between the bumpers 56L and 56R.

Supported above the conveyor 41 over the viewed area 48 by any suitable central support struts 72M are an electronics module 75 and an optics module 76. The distance Y above the surface of the conveyor 41 at which the optics module 76 is disposed is a function of the size of the viewed area 48 and operating parameters of the optical elements of the system. In the embodiment of the invention discussed herein, the distance Y equals approximately six feet. However, the distance may be modified and adjustably selected by an arrangement 73. For example, the central support struts may be telescoped and locked in any desired elevation by an index collar, or a lock pin engageable with a series of holes or any well-known expedient.

The viewed area 48 is illuminated by an illuminating arrangement including light sources 78 and a reflecting mirror 79. The light sources 78 are utilized to provide a source of light which when reflected by the articles is gathered by the optics module 76 and provides the basis for the classification thereof. In the case of the preferred embodiment herein, the sorting apparatus 40 operates on a ratio classification principle, (the quotient of reflected intensities at two predetermined wavelengths, typically green and red light). The ratio classification technique is used to generate characteristic signals of the articles since a ratio offsets any distortion of the quotient due to the geometrical curvature of an article.

The light sources 78 are selected to provide light output consistent with the basis on which the articles are being sorted. For example, for sorting comestible articles as tomatoes, reflected light in frequency bands centered around red and green light is used. Thus, light sources 78 are selected such that the spectral content of the light output is consistent with these bases of classification. Suitable for use as the light sources 78 are two incandescent tungsten-halogen lamps 78T, each 300 watts, 115 volts A.C., mounted on a front end support strut arrangement 72F in accordance with the arrangement shown in FIG. 1. Suitable for use as the light sources 78T are lamps obtained from General Electric Company under model number Q300T3CL. The illuminating arrangement also includes mercury light sources 78M such as mercury vapor lamps manufactured by General Electric Company and sold under model number H175A39-22. The two mercury light sources 78M, mounted on a crossbar 72C between the front end support strut arrangement 72F as seen in FIG. 1, are used to increase the incident light in the green wavelength region incident on the conveyor in the illuminated region 47. Light from both the tungsten-halogen lamps 78T and the mercury vapor lamps 78M is reflected from a mirror 79 which forms part of the illuminating arrangement. The mirror 79 is inclined to the vertical and is thus supported between the supports of a back support strut arrangement 72B, as seen in FIG. 1.

After passing through the viewed area 48 and having been classified as acceptable or unacceptable in a manner to be discussed herein, the articles are discharged in free fall from the discharge end 49 of the conveyor 41. Selected ones of the articles (e.g., those classified as "acceptable") are permitted to pass in a free fall path to a carry-off conveyor 81 spaced below the conveyor 41.

Articles classified as unacceptable are diverted from the free fall path by the action of an array of ejector elements 84 which form part of ejection means 83. The ejector elements 84 are actuated in response to "article eject" signals output from the electronics to appropriate ejector driver channels (see FIG. 28). A divider plate 86 is provided to insure that deflected articles are conducted into a suitable receptacle 87.

As best seen in FIG. 1B, each of the ejector elements 84 includes an individual solenoid controlled, air-operated ejector controlled by an ejector driver channel. Such ejectors are well-known in the art and are described in detail in U.S. Pat. No. 3,980,181, issued to Hoover et al. and assigned to the assignee of the present invention. Each ejector includes a resilient arm 84A extendable into an ejection zone 88 disposed between the discharge end 49 of the conveyor 41 and the carry-off conveyor 81. Each of the ejectors, when extended, occupies a portion of the transverse dimension of the ejection zone 88. Typically, the width dimension of each ejector arm 84A is one inch. Therefore, to occupy the width of the ejection zone 88, thirty-two ejectors 84 are disposed in a side-by-side relationship. In this way an article disposed on any portion of the transverse dimension of the conveyor 41 may be deflected from its free fall path through the ejection zone 88 prior to the landing upon the carry-off conveyor 81.

The discharge end 49 of the conveyor 41 is spaced a predetermined clearance distance 89 axially past the end of the viewed area 48. Further, the ejection zone 88 into which the arms 84A of the ejector elements 84 are extendable is disposed a predetemined distance 90 below the discharge end 49 of the conveyor 41. The distances 89 and 90 are chosen such that when an article $T_1$ on the conveyor 41 is just leaving the viewed area 48, articles as $T_2$ in the immediately preceding channel have been translated by the conveyor 41 to a position just leaving the conveyor 41 at the discharge end 49 thereof and articles as $T_3$, from the channel preceding the channel carrying the articles $T_2$, are entering into the ejection zone 88 (see also, FIGS. 26A–26E). The distances 89 and 90 are adjustable so that the optimum operating position for the apparatus in any given operating conditions may be used. As will be discussed herein, these physical relationships have relevance in connection with the time delay between transmission of article-reject signals from the processor to a delay circuit and article-eject signals from the delay circuit to the ejector driver channels.

Due to the transverse channelization of articles between the rollers 52 and to the speed of translation of the conveyor 41, articles fall in waves from the discharge end 49 of the conveyor 41 (FIGS. 26B–26F). The time interval between waves is sufficient to activate an ejector driver channel, cause the arm 84A to fully extend to a rest position within the ejection zone 88, remain in position for a selectable dwell time to deflect an article from its free fall path, and return to the rest position. In the preferred embodiment of the instant invention, the interval between successive waves of articles is one hundred seventy-five milliseconds.

Since the articles are randomly movable transversely within the channels 59 between the rollers 52, lateral displacements of articles may occur during longitudinal translation of the conveyor 41. As will be seen, the apparatus 40 is able to "vector" the path of an article so as to activate the appropriate ejector to deflect that article when that article reaches the ejection zone 88. The "track" record of lateral displacement of a given article is taken into account so that when the article reaches the ejection zone 88 the appropriate ejector drivers are activated. It is noted that due to the rotation imparted to the article by the conveyor 41, once the article leaves the discharge end 49 of the conveyor 41, the articles free fall under the influence of gravity into the ejection zone 88.

THE OPTICS MODULE

Figures 3A, 28:
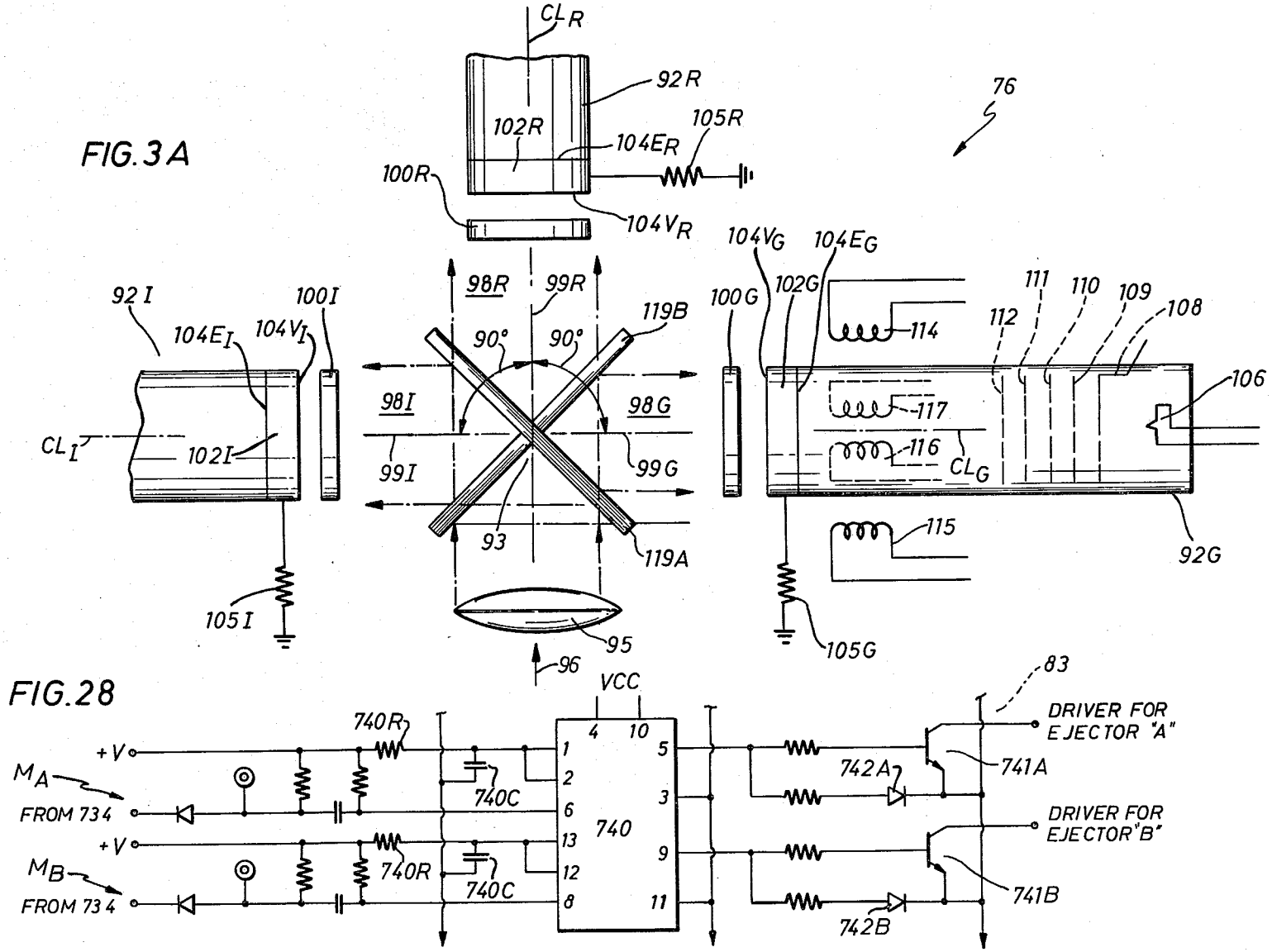
FIGS. 3A and 3B are, respectively, a highly stylized pictorial representation of the optics module and a beam splitter utilized by a roll sorting apparatus in accordance with the instant invention.
FIG. 28 is a schematic diagram of a portion of the ejector driver arrangement.
Figures 3B, 17:
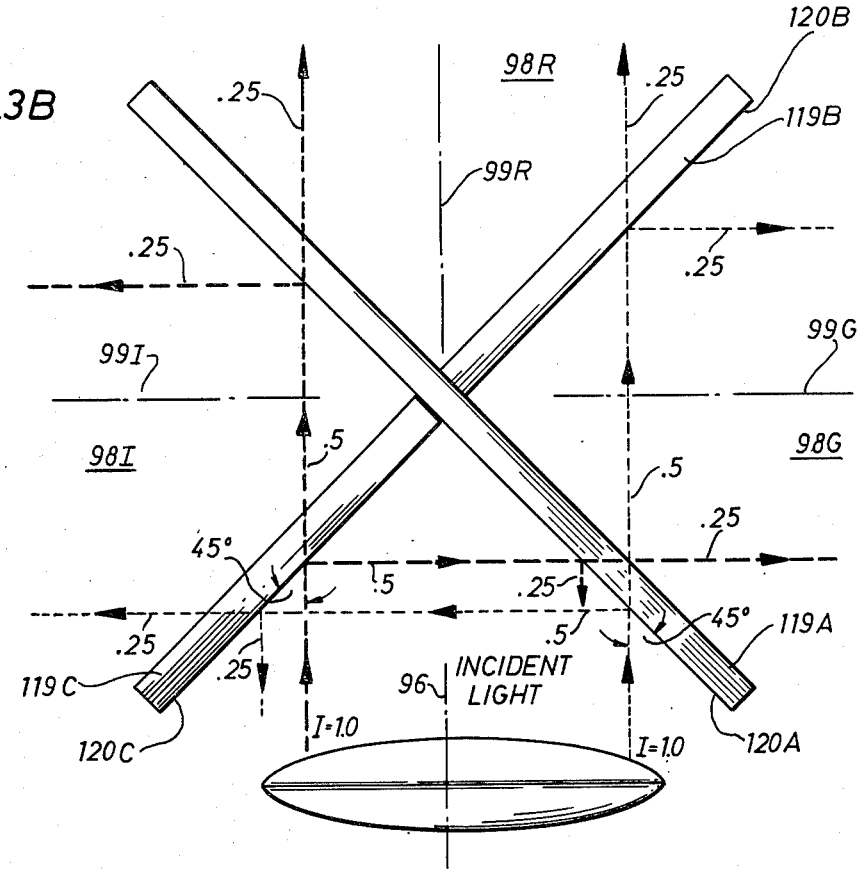
FIGS. 17 and 18 respectively tabulate the sequence of lines of interest occurring during a frame and the order in which the processing units receive information during a cycle as selected by the DMA circuit in accordance with the invention.
Figure 4A:
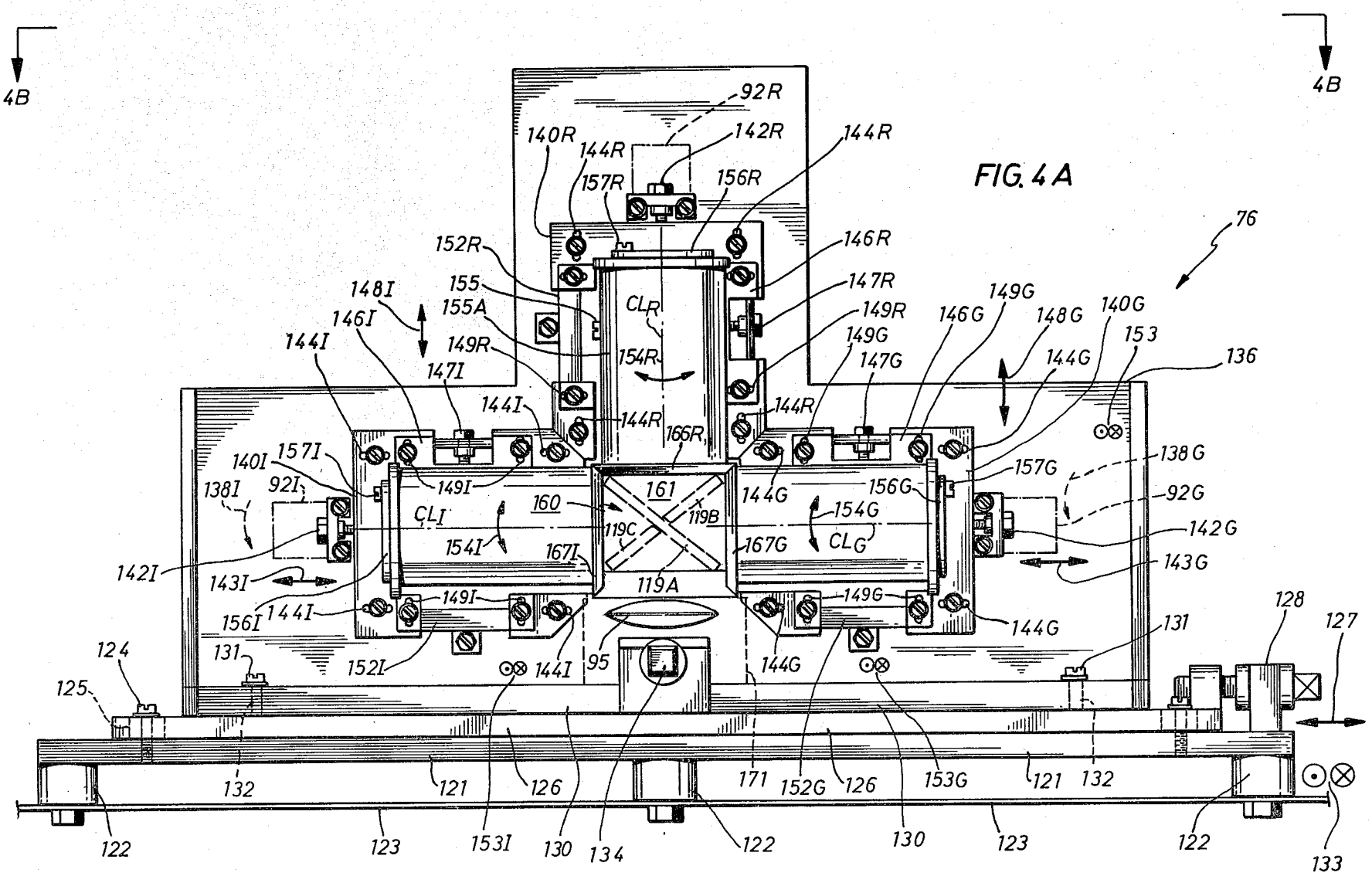
FIGS. 4A, 4B and 4C are, respectively, an end view, a top view and an enlarged end view of the mechanical structure of the optics module utilized in a roll sorting apparatus in accordance with the instant invention.
Figure 4B:
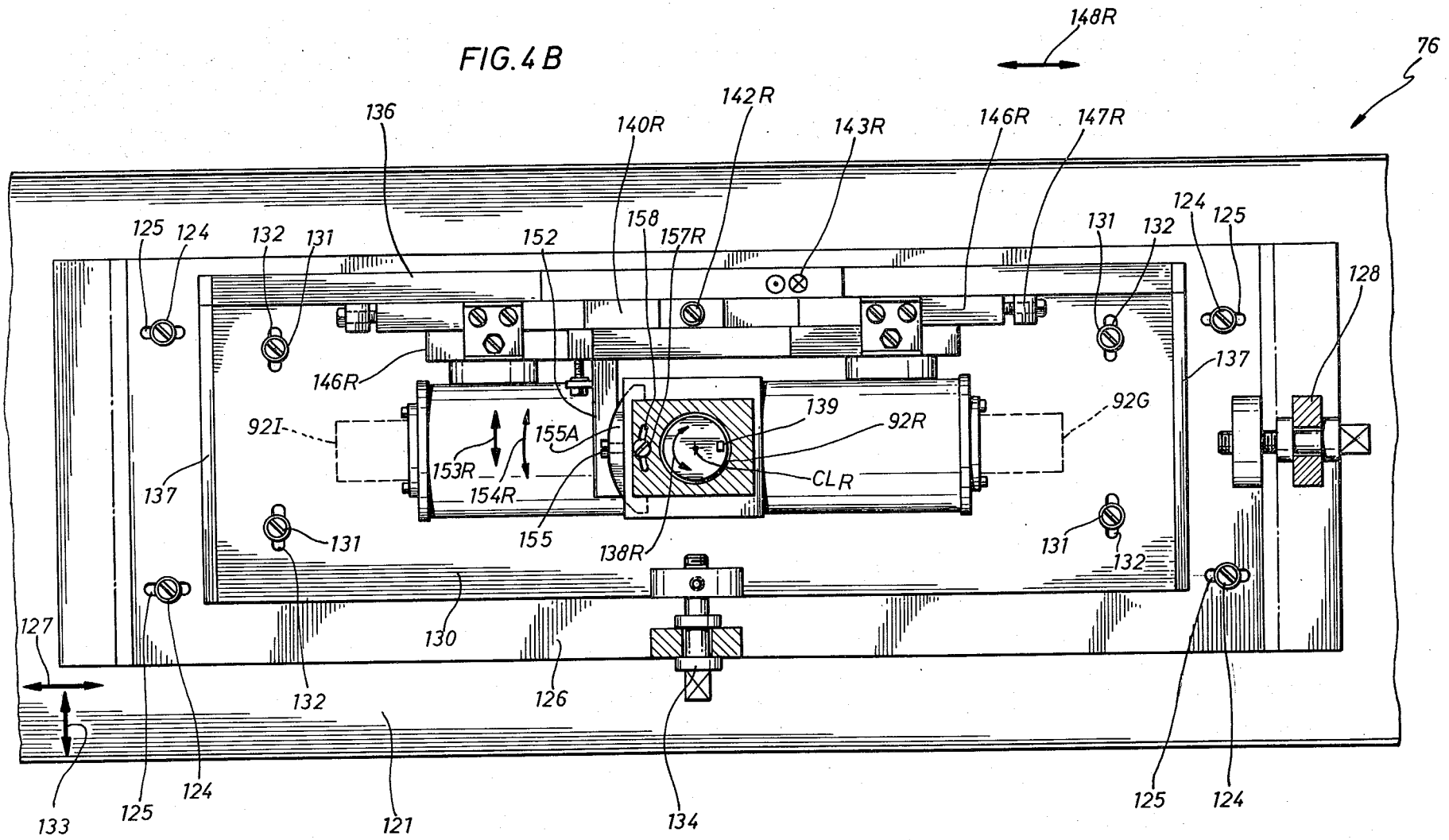

With reference to FIG. 3A, shown is a highly stylized pictorial representation of the optics module 76, including the vidicon tubes 92 used therein. FIG. 3B is a perspective view of the beam splitter arrangement 93 used therein. FIGS. 4A and 4B are, respectively, end and top views of the mechanical support arrangements for the vidicon tubes 92 and the beam splitter arrangement 93.

As the conveyor 41 and articles to be sorted carried thereon are translated through the illuminated region 47 containing the viewed area 48, light reflected therefrom is directed toward the optics module 76. The optics module 76 includes a twenty-four millimeter compound lens 95 such as that manufactured by Vivitar Corporation and sold under model number 37614841. The incident light beam (having an axis 96) reflected from the viewed area 48 of the conveyor 41 is focussed by the lens 94 and trifurcated by a beam splitter 93. The beam splitter 93 is operable to trifurcate light reflected into the optics in mutually orthogonal ray paths 98G, 98R and 98I. One of the ray paths 98 has an axis 99 coincident with the axis of the incident beam. An appropriate filter 100G (green), 100R (red), and 100I (infrared) is respectively disposed in each ray path 98 intermediate the beam splitter 93 and the photosensitive target of the vidicon tubes 92G (green), 92R (red) and 92I (infrared). Suitable for use as vidicon tubes 92 are those tubes manufactured by Panasonic Corporation and sold under model number S4076. Each of the vidicon tubes 92 is oriented along the axis 99 of the ray incident thereon such that the longitudinal centerline CL of the tubes 92 are also mutually perpendicular to each other. As is discussed herein, the photosensitive targets 102 within each vidicon 92 are disposed at equal focal lengths from the lens 95, as a result of the action of the beam splitter arrangement 93.

Another vidicon tube which may be used as the vidicon tube 92 is that manufactured by RCA and sold under model number 4532A. The Panasonic tube is believed to be more useful in some circumstances (e.g., sorting of tomatoes) because it is more sensitive to green light.

The filtered light incident upon the face $104V_G$ of the vidicon 92G generates a visual image representative of the light energy within a predetermined range of green light reflected from the viewed area 48. Similarly, the filtered light incident upon the face $104V_R$ of the vidicon 92R generates an image representative of light energy within a predetermined range of red light reflected from the viewed area 48. The light incident upon the face $104V_I$ of the vidicon 92I generates an image representative of the infrared light reflected from the viewed area 48.

Since it is known that all organic matter reflects light in the infrared range, the detection of articles to be sorted (assuming such articles are organic materials) may be effected using reflected infrared light. Of course, the reflected green and red light is useful to generate a bichromatic ratio characteristic signal of the article. Depending upon the filters selected, any color wavelength of the light reflected from the viewed area 48 may be isolated and permitted to impinge upon the visual target faces 104V of the vidicons 92. It is to be noted that due to the light source 78 used, the filters 100 disposed in the red and infrared ray paths 98R and 98I are required to limit the intensity of reflected light incident on the visual target faces 104V of the vidicons 92R and 92I.

An article by R. G. Neuhauser, *The Silicon-Target Vidicon,* published in 1976 by RCA, generally sets forth the principles of operation behind a tube similar to the referenced RCA tube as well as the referenced Panasonic tube. However, for purposes of explanation it is believed that the description of a silicon target vidicon tube presents a more easily visualized conception of the formation of the charge pattern (electrical image) in the electrical image plane. Thus, it serves as the basis of the model described in FIG. 6. It is understood that when reference is made to a silicon target vidicon, the capacitance type vidicon may also be used.

Basically, the visual target face 104V ("the visual image plane") of the vidicon tube 92 converts the filtered pattern of light incident thereon ("the visual image") into an electrical charge pattern ("the electrical image") on the opposite face 104E ("the electrical image plane"). The electrical charge pattern is stored until an electron scanning beam is displaced across the electrical image plane 104E to "read" the image pattern therefrom.

The visual image plane surface 104V of the vidicon target 102 is a monocrystalline wafer of N-type silicon material. Light impinging upon the surface 104V of the target 102 is absorbed and creates photo-generated positive charge carriers.

Figure 10:
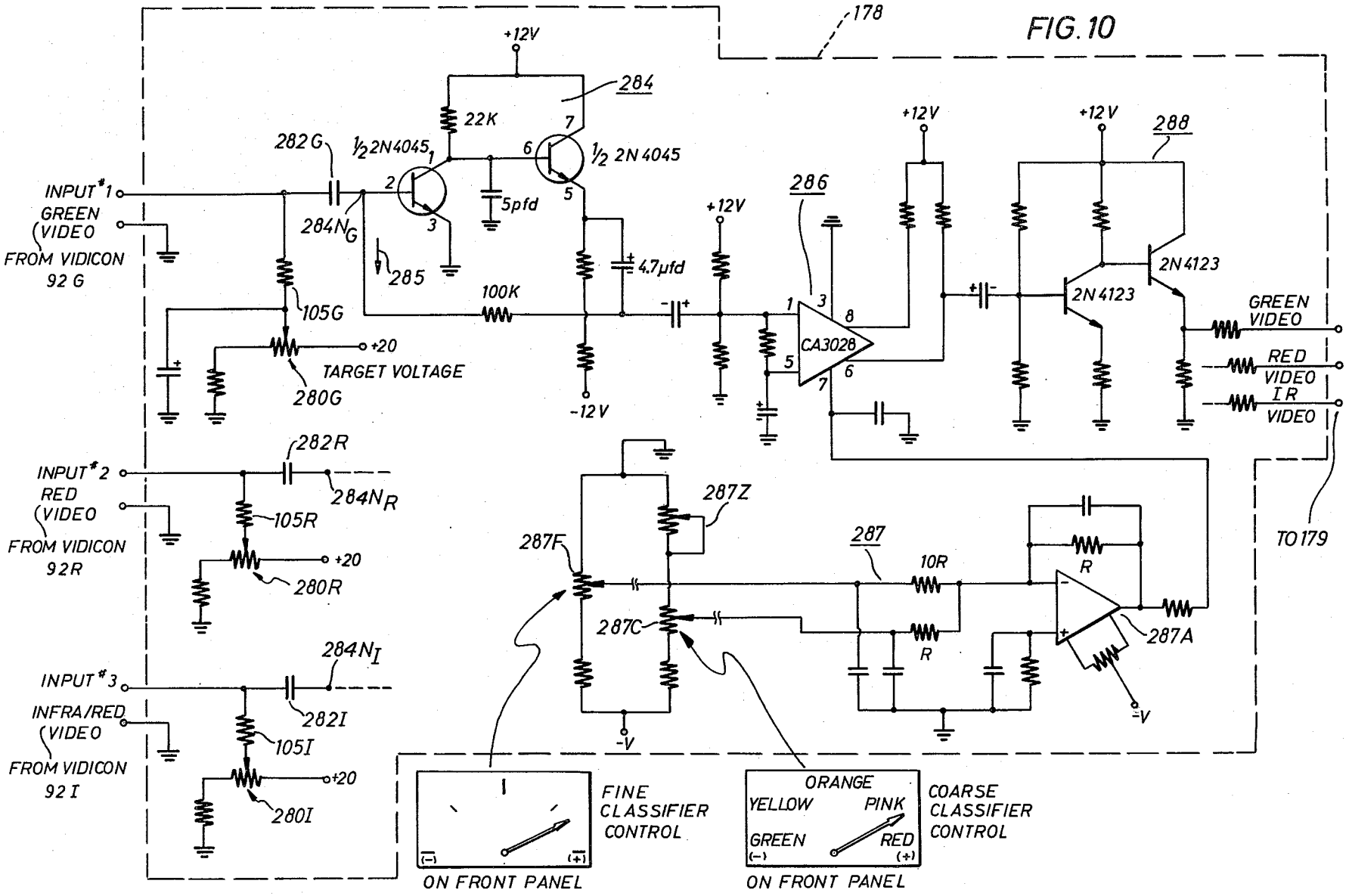
FIG. 10 is a schematic diagram of the preamplifier circuit used in a roll sorting apparatus in accordance with the invention.

The opposite electrical image plane surface 104E of the vidicon target 102 contains a large-scale array of reverse biased diodes which perform the charge storage function. The diodes on this surface 104E of the vidicon target 102 are adapted to store electrons deposited thereon by a scanning electron beam. The positively charged holes generated by the light incident on the vidicon target face 104V reduce the stored charges in the electron-rich region. When the scanning electron beam moves across the diode array and recharges the diodes, a current flows through the video signal nodes 284N$_G$, 284N$_R$ and 284N$_I$ (FIG. 10). The currents are related to the green, red and infrared video signals, respectively. Resistors 105 are used to bias the vidicon targets.

For each vidicon tube 92, the electron scanning beam is generated from a heater/cathode arrangement 106 disposed at the end of the tube 92 opposite the electrical image plane 104E. The heater serves to elevate the surface temperature of the cathode to form a boiling cloud of electrons on the surface of the cathode. It is from this electron cloud that the electrons in the electron scanning beam are derived. If the potential of the cathode is less positive than the potential of the target, the electrons in the cloud are attracted to the target. Of course, if the cathode and target potentials are equal or the cathode is more positive, no attractive forces exist and no scanning beam is generated.

Internally of the tube 92 intermediate the cathode 106 and the diode array on the electrical image plane 104E there is provided a cathode grid 108, a beam cutoff (or "blanking") grid 109, an accelerator grid 110, a beam focus grid 111 and a decelerator grid 112. All but the cathode grid 108 are static voltages (i.e., not varied during operation of the sorting apparatus). Using the Panasonic tube, the beam cutoff grid 109 is typically charged to a −60 volts potential, while the grids 110, 111 and 112 exhibit potentials of approximately +350 volts, +350 volts, and +500 volts, respectively. The cathode grid 108 selectively carries a potential of approximately +20 volts and is asserted in accordance with signals from the electronic circuitry during those periods between horizontal sweeps of the electron beam and during a period known as "vertical retrace" and "horizontal retrace." In these periods, for the reasons set forth herein, it is desirable to prevent the scanning electron beam from reaching the electrical image plane 104E of the photosensitive target 102. During all other periods that the scanning beam is sweeping electrical image plane 104E, the cathode grid 108 is at ground potential.

Each vidicon tube 92 is received within an array of external yokes. A horizontal driver yoke 114 controls the horizontal displacement of the electron scanning beam across the electrical image plane 104E. A vertical driver yoke 115 controls the vertical displacement of the electron scanning beam, while a beam focus yoke 116 assists in controlling the focus of the electron scanning beam on the electrical image plane 104E. The yokes 114, 115, 116, and 117 each receive driving signals from the electronic circuitry as discussed herein. It should thus be appreciated that there is defined means for generating an electron scanning beam and for controlling the movement of the beam across the electrical image plane. The control signals for the grids and yokes which comprise the beam scan control means are generated by a synchronizing circuit meeting the needs of this invention. Suitable for use as the yokes are those sold by RCA as item 6Y1, part number 8770. Suitable for use as the vidicon sockets are those sold by RCA as item 6XV1, part number 8560.

In FIG. 3B, an end view of the beam splitter 93 is shown. The beam splitter arrangement 93 comprises three half-silvered elements 119A, 119B and 119C. The element 119A is inclined at a forty-five degree angle to the axis 96 of the incident beam. The elements 119B and 119C are disposed perpendicularly to opposite surfaces of the element 119A. The surfaces of each element 119 are silvered, as shown at 120. The interfaces between the elements do not adversely affect the images generated on the vidicon targets 102.

The elements 119 are oriented with respect to incident light energy and to each other such that at each point on the silvered surfaces 120 thereof where an incident light beam strikes the mirrored surface, half of the light energy passes through the element while the remainder is reflected ninety degrees with respect to the original direction of the incident beam. The reactions of incident light beam on various faces of the elements 119 of the beam splitter 93, with a representation of the transmitted and reflected energies, is shown in FIG. 3B for two light rays, shown in dotted and dashed lines. The filter 100R is adapted to pass light in a range around 660 nanometers. The filter 100I is adapted to pass light in a range around 750 nanometers. The filter 100G is adapted to pass light in a range around 550 nanometers.

The net result of the beam splitter arrangement 93 is that light energy focused by the lens 95 is trifurcated into three ray paths 98 and directed (through the appropriate filters 100) onto the visual image planes 104V of each of the targets 102 of the vidicon tubes 92. It is noted that each of the targets 102 of the vidicon tubes 92 are disposed at equal focal lengths from the lens 82. In the prior art, various color tubes utilized in color television technology (typically three or four in number) are disposed at varying focal lengths from the lens through an intricate and complicated arrangement of beam splitters and mirrors.

As is discussed herein, there are several electrical adjustments which may be effected to insure that the electron scanning beam falls within precise limits on the electrical image plaen 104E. Complementary alignment ability is provided by the mechanical arrangement of the optics module 76 which is set forth in connection with FIGS. 4A and 4B.

With reference to FIGS. 4A and 4B, an end view (taken in the direction of FIG. 1C) and a top view (along lines 4B-4B in FIG. 4A) of the mechanical support arrangement for the optics module 76 is shown. The optics module includes a support base 121 mounted by suitablle brackets 122 to the housing 123 or main optical case of the optics module 76. Mounted atop the base 121 through bolts 124 received in slots 125 (FIG. 4B) is a first support plate 126. The support plate 126 is adjustably moveable within the slots 125 in directions 127 (to the right and to the left in the plane of FIGS. 4A and 4B) through a threaded adjustement control 128.

The first support plate 126 itself carries a second support plate 130. The second plate 130 is attached through bolts 131 received in slots 132. The second support plate 130 is itself adjustably moveable with respect to the first support plate 126 in direction 133 (into and out of the plane of FIG. 4A and vertically in the plane of FIG. 4B) through the agency of a threaded adjustment control 134. Projecting upwardly from the second support plate 130 is a vidicon mounting plate 136 provided with braces 137 in order to secure the vidicon mounting plate 136 in position.

The yoke assembly for each of the vidicon tubes 92 is disposed within end mounting brackets 140, side mounting brackets 146 and under mounting brackets 152. The vidicon tubes 92 are themselves received within their associated yoke assemblies. As seen in FIG. 4B, each tube 92 is rotatable about its axial centerline CL in a direction corresponding to the directions 138R shown for the tube 92R in FIG. 4B. The tubes 92 are each inserted such that their index pins 139 (shown in FIG. 4B for the tube 92R) occupy a given angular orientation with respect to their centerlines CL.

The end mounting brackets 140 are disposed at the ends of each of the yoke assemblies for each of the tubes 92 and are operable by threaded controls 142 to move the yoke assemblies in directions 143 (with respect to the centerline CL of each of the tubes 92) toward or away from a central housing 160 in slot 144.

The side mounting brackets 146 are disposed along the sides of each of the yoke assemblies and are operable by threaded controls 147 to move the yoke assemblies in directions 148 (with respect to the centerlines CL of each of the tubes 92) in slots 149. The under brackets 152 are disposed beneath each of the yoke assemblies to move the assemblies upwardly and downwardly with respect to the vidicon mounting plate 136 in directions 153.

The yoke assemblies are also rotatable in directions 154 with respect to the centerlines CL of the tubes with which they are associated. Gross adjustments are permitted to the yoke assemblies for each vidicon by the loosening of pins 155 and rotating the bracket 155A girding the yoke assemblies (see FIG. 4B). Fine adjustments are afforded by rotation of a plate 156 connected to the end of each yoke assembly about a pin 157 disposed in a curved slot 158. As a result of the above-described structure fourteen ranges of motion (in directions 127, 133, 138, 143, 148, 153 and 154) are available to assist in locating the image of the viewed area on the target 102 of each of the vidicon tubes 92.

Figure 4C:
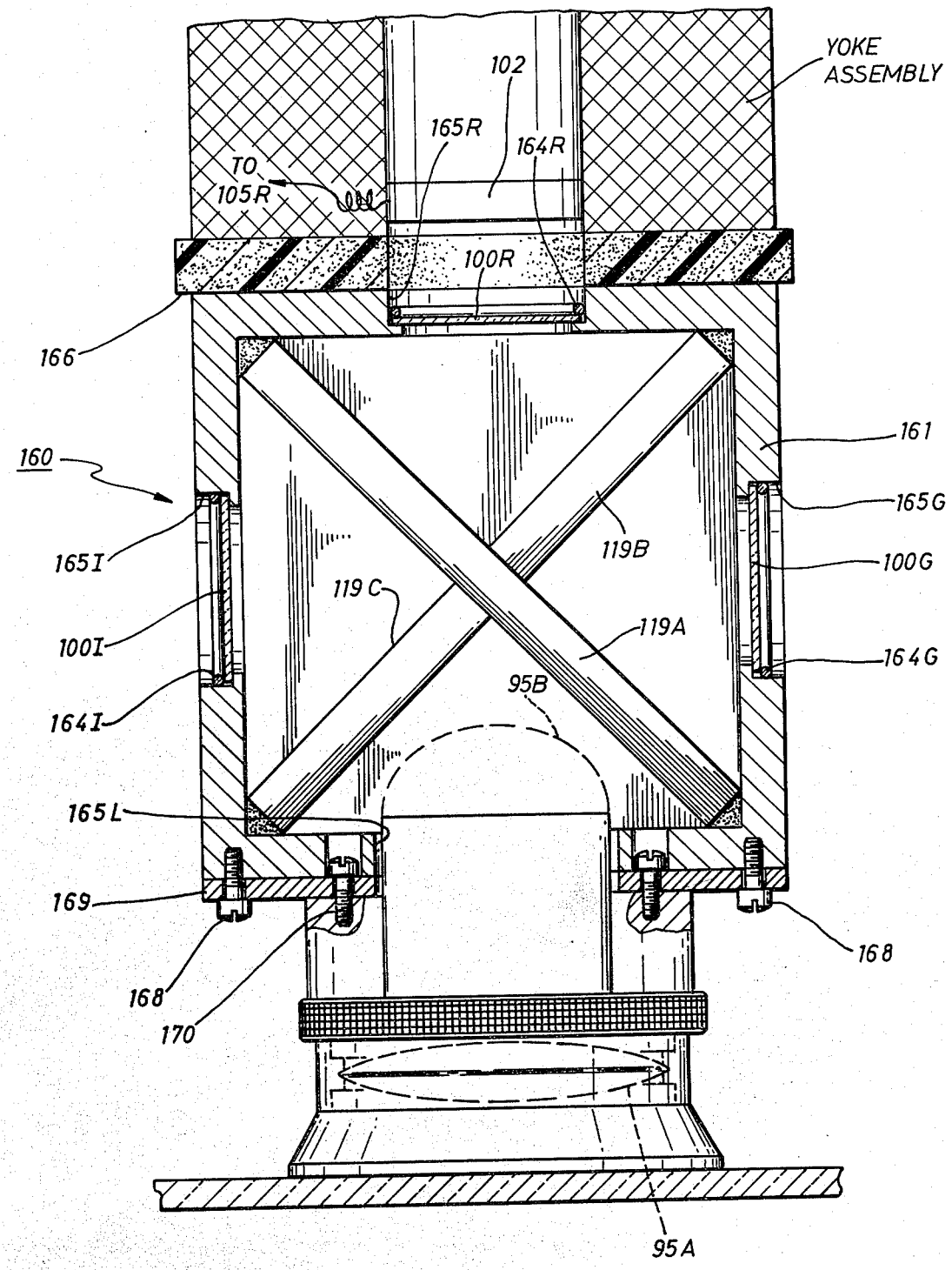

As seen in the enlarged view of FIG. 4C, the central housing 160 includes a beam splitter block 161 having a recess 163 therein, the ends of the recess having slots 163 which receive the elements 119 of the beam splitter. The filters 100 are retained by springs 164 adjacent the apertures 165 in the block 161. A cushioning sponge 166 is disposed on the exterior of the block 161 adjacent the apertures 165 to shield the targets of the vidicons 92 and to cushion movement of the vidicons toward the block 161.

Attached beneath the block 161 by screws 168 is the lens mounting 169. The casing of the lens 95 includes a rotatable depth adjustment and a diaphragm control as are well known in the art. The lens 95 is a compound lens having portions 95A and 95B (as suggested schematically by dot-dash lines). The lens 95B is supported on a suitable tube. The lens is disposed adjacent the lower aperture 165L. The lens casing is secured to the mounting by screws 170.

Light reflected from the viewed area 48 is gathered by the optics module 76 (which thus, in a sense, serves as a viewer arrangement), is focussed by the lens 95, enters through the lower aperture into the beam splitter 93, is trifurcated (as discussed in FIG. 3B) and passes through apertures 166R, 166G and 166I in the ray paths 99 (as defined in FIGS. 3A and 3B) to impinge upon the visual image planes of the targets 102 of each of the vidicon tubes 92.

The classification of the articles being sorted in accordance with this invention occurs as the articles are rotated through the viewing zone defined between adjacent rollers in response to the rotative action of the rollers simultaneously with the translation of the viewing zone through the viewed area. During the time period that a viewing zone is translated through the viewed area, the visual image thereof is incident (after appropriate filtering) upon the visual image plane 104V of each vidicon tube 92. Due to the action of the charge carriers generated by the incident light, an electrical image of the viewed area is formed on the electrical image plane 104E. The electrical image appears in the form of relatively higher or lower charged areas in the diode array. Since the viewing zone is translating through the viewed area, both the visual and electrical image of the viewing zone correspondingly translates across the visual and electrical image planes defined on the faces 104V and 104E of the vidicon target 102.

It is in accordance with this invention to electronically scan the electrical image plane 104E of the vidicon target 102 a predetermined number of times during the interval that the viewing zone lies within the viewed area. Due to the speed at which the electronic components perform their functions, what is perceived by the human eye as a relatively high speed movement of the viewing zone through the viewed area may be segmented into a plurality of "frozen" still frames. That is, just as the perception of motion is imparted to a human eye when a series of still photographs are rapidly exhibited (as in the movie theater or home television), the perception of motion of the articles rotating through a viewing zone as the viewing zone is translated through a viewed area may be resolved from the electrical point of view into a sequence of "still" frames.

Furthermore, if attention were directed to the portion of each "still" frame corresponding to the articles in the viewing zone, information may be complied as to: (1) the location of the articles (with respect to a reference point in the viewing zone); (2) the size (diameter) of the articles; and (3) the infrared light reflectivity characteristic, the red light reflectivity characteristic and the green light reflectivity characteristic of that portion of the surface of each article in each viewing zone within the viewed area. Thus, at the end of the viewing zone's translation through the viewed area, using the characteristics of the article (as compared to a threshold reference) as the basis of the sort, a classification as to the acceptability or unacceptability of each article may be generated.

Since the viewed area encompasses a region on the conveyor accommodating four viewing zones, each "still" frame contains a region or line of primary interest corresponding to each of the four viewing zones. However, these "lines of interest" on the electrical image plane are separated from each other just as the viewing zones are physically separated from each other by the boundaries of the rollers. During any one "still" frame, information regarding each article in each viewing zone may be compiled by analyzing the electrical images on the line of interest corresponding to that viewing zone.

It is in accordance with the invention to provide electrical signals to control the electron scanning beam of the vidicon tubes through the control of the intensity of the magnetic fields in each yoke and the potential of the blanking grid in each vidicon to generate a predetermined number of "still" frames during the time interval required for the translation of a viewing zone through the viewed area. Each frame is scrutinized electrically and the information present on selected lines of interest of each frame (corresponding to each viewing zone) is compiled and provided to a suitable processing unit. Each line of interest may contain information relating to the location, size and color characteristics of the portion of each article rotated into the viewing zone by the action of the rollers when the frame is taken. The information regarding each article on each line of interest is stored in an appropriate "file" in the memory of the processing unit.

Although any suitable processor arrangement may be utilized, it has been found advantageous to assign to one central processing unit the task of compiling and storing information from one line of interest. Thus, during any given frame when the apparatus is in operation (after an initial phase), information regarding one of the four lines of interest (corresponding to one viewing zone) on the frame is compiled and input to one of the four processing units. When the line of interest passes from the electrical image plane (i.e., the viewing zone leaves the viewed area) the accumulated data ("reject" signals) in the corresponding processing unit is output to a delay network. The processing unit is then reassigned to receive and store information corresponding to the next viewing zone entering the viewed area. After a suitable time delay period (to permit the article to translate to the discharge end 49 of the conveyor and free fall to the ejection zone 88) appropriate "eject" signal are provided to the ejection means.

ELECTRONICS BLOCK DIAGRAM

Figure 5:
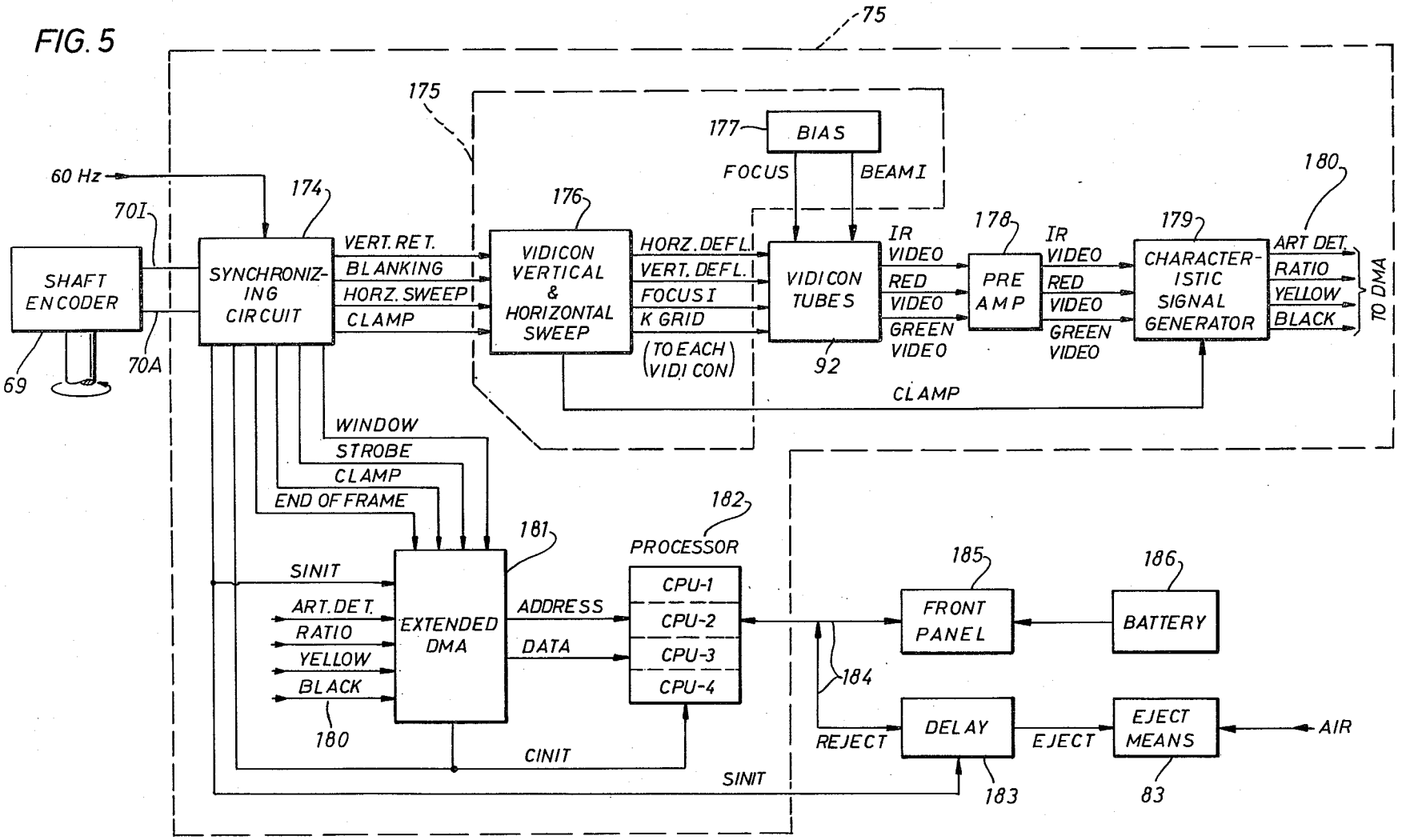
FIG. 5 is a block diagram of the electronic circuitry utilized by a roll sorting apparatus in accordance with the instant invention.

With reference now to FIGS. 5, shown is a block diagram of the electronic circuitry utilized by a roll sorting apparatus 40 in accordance with the instant invention. The circuitry is housed within the electronics module 75 physically located as shown in FIG. 1.

The 60 Hz. line signal, and both the "index" pulse on the line 70I and the "A" pulses on the line 70A from the shaft encoder 69 are input to a synchronizing circuit 174. The index pulse is utilized to initiate the performance of the electronic functions at the beginning of a sort when the first viewing zone of interest is brought by the conveyor into the viewed area 48. Thus, the index pulse provides an indication to the circuitry to initiate the series of "still" frames when the first viewing zone under consideration occupies a predetermined position within the viewed area. The "A" pulses are used by the synchronizing circuit 174 to provide an indication that the conveyor 41 is moving at a predetermined running speed. To generate the timing control signals used throughout the digital and analog components of the electronics and to control the electron scanning beam, the synchronizing circuit 174 makes use of the rectified 60 Hz. line voltage which is input thereto. Thus, the scanning of the electrical image plane is synchronized with the movement of the conveyor by the motor 66.

Several of the output signals from the synchronizing circuit 174 are applied to a vidicon control arrangement 175. Specifically, timing signals which initiate the motion of the electron scanning beam across the electrical image plane 104E of the vidicon target are applied on lines VERT. RET. (vertical retrace), HORZ. SWEEP (horizontal sweep), and BLANKING (cathode blanking) from the synchronizing circuit 174 to a vidicon vertical and horizontal driver control circuit 176.

The vidicon vertical and horizontal driver control circuit 176 outputs analog control signals for each vidicon 92 to the horizontal driver yoke 114 ( HORZ. DEFL.), to the vertical driver yoke 115 (VERT. DEFL.), to the beam focus yoke 116 (FOCUS I), and to the cathode gride 108 (K GRID). Additionally, the vidicon control arrangement 175 includes a bias control circuit 177. The bias control circuit 177 applies predetermined negative potential (approximately −60 volts) to the grid 109 (BEAM I) and a positive potential (approximately +350 volts) to the grid 111 (FOCUS).

In response to the application of the analog signals to the appropriate yokes, the electron scanning beam for each vidicon tube 92 is moved across the electrical image plane 104E to generate each of the plurality of "still" frames generated during the translation of the viewing zone through the viewed area. The current from the target of each vidicon is carried by an appropriate output line IR VIDEO, RED VIDEO, and GREEN VIDEO respectively from the tubes 92I, 92R and 92G.

The video current signal from each of the vidicon tubes 92 is applied to a preamplifier arrangement 178 which acts to produce a video signal voltage amplitude more compatible with further electronic manipulation. The amplified video outputs (IR, RED and GREEN) of the preamplifier circuit 178 are applied to a characteristic signal generator circuit 179. In the characteristic signal generator 179, a signal representative of a predetermined physical characteristic of each article (as the bichromatic ratio of red to green light) is generated and is compared to a threshold reference. The outputs of the characteristic signal generator circuit 179 provide, in a digital form, an electrical signal representative of the presence (and, thereby, the size and location) of each article on a particular line of interest (ART. DET.), and an electrical characteristic signal representative of a physical characteristic of the article (as the ratio of reflected light intensities at given wavelengths) as compared to a given threshold reference (termed the characteristic signal "RATIO"). Other electrical characteristic signals representative of other physical attributes or characteristics of the articles may be generated by comparison to other threshold references.

For convenience these other characteristic signals will be referred to hereafter as YELLOW and BLACK, but it is to be understood that any attribute of the articles being sorted as compared to a threshold reference may be represented thereby. YELLOW and BLACK, as used hereafter, are to be understood to refer to two other characteristic signals each representative of other predetermined physical attributes of the articles being sorted. As such these signals may also be used as a basis of classification.

The characteristic signal generator circuit 179 also receives a black level restore signal (CLAMP) from the driver control circuit 176. The signal CLAMP is generated by the synchronizing circuit 174 and applied through the driver control circuit 176 for convenience in the particular embodiment shown. The CLAMP signal operates to eliminate any spurious voltages which may remain at the inputs to the characteristic signal generator circuit 179 so that the signals generated thereby are representative of the signal intensities on each line of interest.

The digitized electrical characteristic signals from the characteristic signal generator circuit 179 are applied over lines 180 to a direct memory access circuit (DMA) 181. The DMA circuit 181 is extended in function over typical direct memory access arrangements and is operative: (1) to select the appropriate processing unit to which information regarding the particular line of interest will be transmitted; (2) to alert that processing unit that information of interest to it is about to be transmitted; (3) to compile and format characteristic signal information received from the characteristic signal generator circuit 179 regarding that line of interest and; (4) to address the appropriate memory locations within the selected processing unit and to transmit the characteristic data to that processing unit. The DMA circuit 181 is also charged with the responsibility of supervising the correlation of a particular processing unit with a given line of interest and, when that line of interest leaves the viewed area, reassigning ("steering") that processing unit to a new line of interest.

To perform these functions the DMA circuit 181 receives timing signals WINDOW, STROBE, CLAMP and END OF FRAME from the synchronizing circuit 174. The CLAMP signal is identical to that applied to the characteristic signal generator circuit 179. The END OF FRAME signal applied from the synchronizing circuuit 174 to the DMA circuit 181 is a digital signal representative of the occurrence of the analog vertical retrace (VERT. RET.) signal applied from the synchronizing circuit 174 to the vidicon driver control circuit 176.

A processor 182, including an array of central processing units (or "CPU's") is associated with the DMA circuit 181. In accordance with the preferred embodiment of the invention, one central processing unit (CPU) is allocated to process, tabulate and store information regarding the location, size and color characteristics of each article on the line of interest to which the appropriate CPU is assigned. In response to an appropriate request from the DMA circuit 181, the address and data lines of a given CPU are surrendered to the DMA circuit 181 and the appropriately compiled and formatted information regarding the line of interest to which the CPU is assigned is transmitted thereto from the DMA circuit 181. During those periods of time when a CPU has not surrendered its address and data lines to the DMA circuit 181, the CPU computes and updates various "files" associated with each article on the line of interest to which the CPU is assigned in accordance with a sequence of instructions (program) stored within the CPU. These procedures are discussed in detail herein.

The CPU in accordance with its program of instructions generates an "article reject" classification signal representative of the acceptability and unacceptability of each article within the viewing zone to which it is assigned. The processing unit processes, tabulates and stores an indication as to the proportion of the surface of each article whereon the predetermined physical attribute differs from the threshold reference. A classification signal is a comparison of the indication with a predetermined reference standard. At the appropriate time, when the assigned viewing zone leaves the viewed area, the CPU outputs "article reject" information regarding the articles in that viewing zone to a delay circuit 183 over an external bus 184.

The delay circuit 183 is operative to store article reject information for each article on each of a predetermined number of lines of interest. When the articles associated with a given line of interest have traversed the distance from the viewed area 48 to the ejection zone 88 (FIG. 1), appropriate "article eject" signals are applied by the delay circuit 183 to the appropriate ejector driver channels in the ejection means 83. The ejection means 83 in accordance with the article eject signals applied thereto actuates ejector elements 84 to cause the arms 84A thereof to be extended into the ejection zone 88 to deflect unacceptable articles from their fall path to the carry-off conveyor 81.

In addition to generating article reject signals based upon the article's characteristic signals, the CPU's also take into account lateral displacements of the articles within the viewing zone so that the article reject signal is applied to actuate the ejector elements in whose vicinity the articles may be expected. The path of the article is thus vectored and the appropriate ejectors energized on the basis of the "track history" of the article within the viewing zone.

The CPU's are also connected over the bus 184 with a front panel circuit 185. The front panel 185 is disposed on the apparatus 40 (FIG. 1A) and is accessible to the operator. The circuitry associated with the front panel 185 permits the operator to select the "mode" upon which the CPU's will classify articles. For example, the classification may be based on a "%" mode. This means that if the proportion of the surface of the article whereon the physical attribute differs from the threshold reference exceeds the reference standard (the allowable percentage), the article is rejected. Thus, if the operator selects the "%"0 mode, and the reference standards used are 26%, 87% and 14% (all purely hypothetical), an article is rejected if either more than 26% of the total surface area of the article exhibits a RATIO characteristic (i.e., the CPU has tabulated and stored an indication that the quotient of the color wavelengths on more than 26% of the article's surface exceeds a threshold reference), or more than 87% of the surface area of the article exhibits a YELLOW characteristic or more than 14% of the surface area of the article exhibits a BLACK characteristic.

Alternatively, a "COUNT" mode may be selected, whereby an article is classified unacceptable and rejected if a given standard of "spots" or predetermined sections of the surface of the article (approximately one-eighth inch square in the preferred embodiment) exhibit a given characteristic. In the example given, if the CPU has processed and stored an indication that the article has 26 RATIO spots, or 87 YELLOW spots, or 14 BLACK spots, that article would be rejected were the apparatus operating in a COUNT mode.

The front panel 185 also provides an avenue whereby the operator may ascertain at what numerical standards (for each characteristic) the CPU's are classifying articles. The numerical standards for a selected characteristic are displayed on the front panel and are visible to the operator. If appropriate, during operation, through the front panel 185 the operator may modify the classification standards (again, for each characteristic) upon which article reject signals are based. The front panel 185 is also provided with a memory capability in the form of a battery back up 186 so that any given standards on which the CPU's are basing the generation of article reject signals may be retained and utilized again. Typically, this has utility in permitting the classification standard on a given workday to be retained and used as the basis of a sort on the following workday.

The synchronizing circuit 174 also provides a systeminitialize signal (SINIT) to both the DMA circuit 181 and the delay circuit 183. Further, a CPU-initialize signal (CINIT) is provided to the CPU's. Both the system-initialize signal (SINIT) and the CPU-initialize (CINIT) signal are issued when the apparatus is initially powered on and just before the sort begins in order to ensure that all of the appropriate electronic elements and registers are cleared prior to the initiation of a sort.

VIDICON OPERATION AND SYSTEM TIMING

From an understanding of the operation of the vidicon electron beam scanning process, an understanding of the timing of the roll sorting apparatus may be gained.

It is again noted that the following description is given in terms of an RCA silicon target vidicon because it is believed that the manner in which the electrical image is generated in that tube is more easily visualized. However, the Panasonic tube also generates an electrical image on an electrical image plane which is swept in exactly the same manner as the manner in which the electrical image plane of the RCA tube is swept.

To briefly summarize, the electrical image plane 104E of the vidicon target 102 over which the electron scanning beam moves contains a matrix array of diodes. The incidence of light on the visual image plane 104V generates charge carriers which deplete electrons previously deposited on the diodes. The purpose of the electron scanning beam is to replenish the depleted electrons, and thereby create a video signal by causing a current to flow from the vidicon target through nodes 284N (FIG. 10) associated with a given vidicon 102.

The degree of discharge of the diodes is dependent upon the time interval between successive passes of the electron scanning beam and the intensity of light incident on the target. If the interval between scans is too long, the incident reflected light discharges the junctions to such a level ("saturates") that an excessive amount of current will be drawn when the scanning beam is swept over those junctions. If the interval between scans is too short, the junctions will be depleted only minimally, such that the current drawn is too feeble to generate an acceptable video signal. Either condition is, of course, disadvantageous.

Figures 1, 2, 3, 4, 5, 6, 12A, 12B:
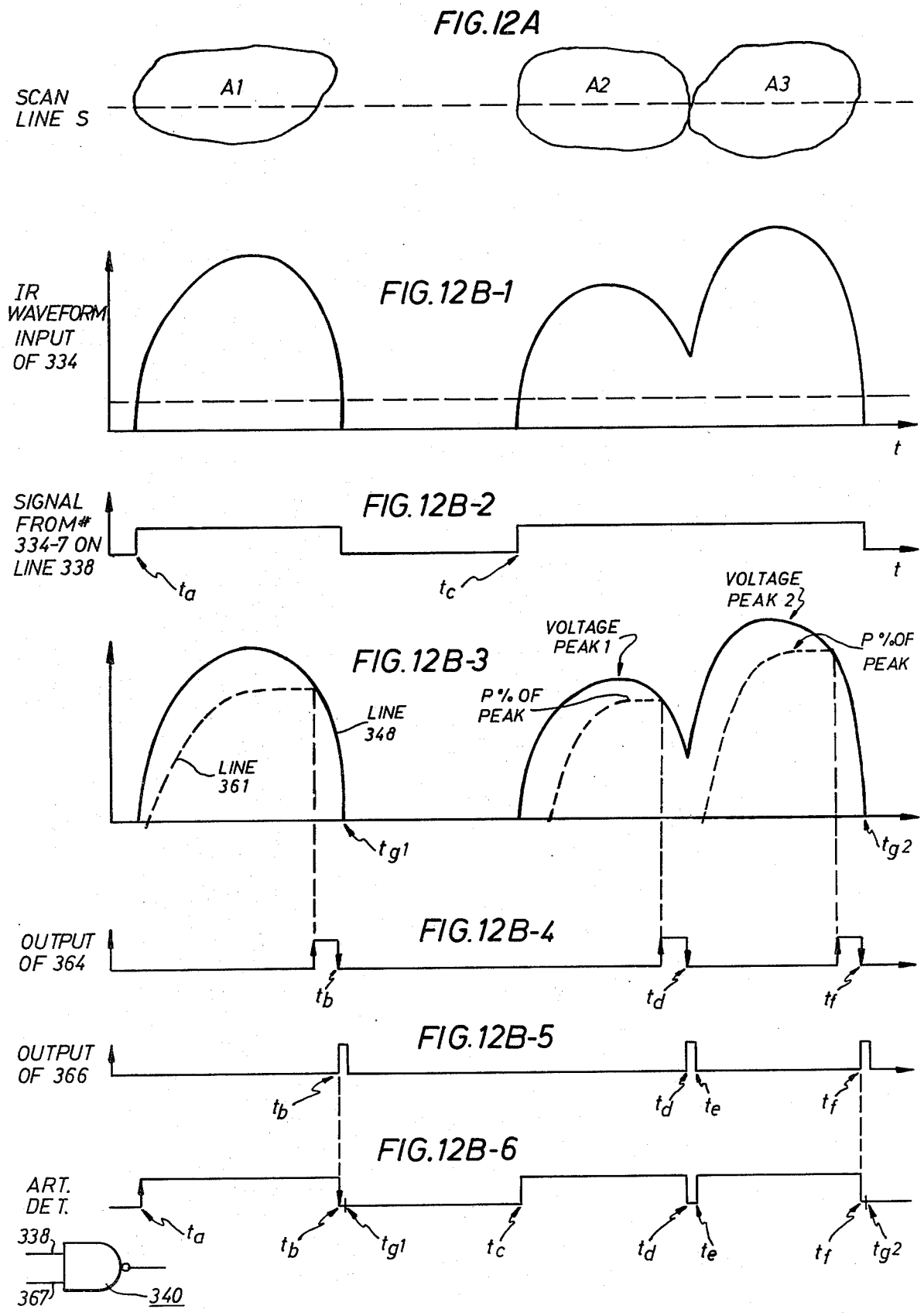

FIG. 6 is a series of highly stylized pictorial representations of the visual image plane 104V and the electrical image plane 104E of the vidicon target and the path of the electron scanning beam over the latter. As seen in FIG. 6A, (the target 102 being split and unfolded for clarity of illustration only) light reflected from the viewed area 48 impinges upon a region of the visual image plane 104V demarcated by the dot-dash lines. Accordingly, as shown in the enlarged view of FIG. 6B, diodes in the corresponding region of the electrical image plane 104E within the dot-dash boundaries have their charges depleted in accordance with the magnitude of the incident light. In accordance with this invention, the optics module 76 is adjusted such that the visual representation of the viewed area 48 is focused within the dot-dash boundaries on the visual image plane 104V (FIG. 6A). Consequently, the electrical image of the viewed area 48 occupies an area on the electrical image plane 104E within the dot-dash boundaries thereon (FIGS. 6A and 6B). The electrical image of the viewed area within the dot-dash boundaries on the electrical image plane is chosen so that it may be completely scanned in ninety-six horizontal sweeps of the electron scanning beam.

To obtain a video signal representation of the electrical image of the viewed area on the electrical image plane 104E, the electron scanning beam is moved in response to varying magnetic fields generated within the yokes from the diode 190 (FIG. 6B) in the upper left corner of the electrical image of the viewed area to the diode 195 in the lower right corner of the electrical image of the viewed area.

The electron beam scanning pattern is indicated in FIG. 6C. Starting at the diode 190, the electron scanning beam is deflected horizontally across the line of the diode array containing the diode 190 to the diode 191. At the right hand edge (the diode 191) of the first scanned line of the diode array ("scan line-1") the electron scanning beam is moved horizontally to the left and downwardly to the vicinity of the diode 192 (below the diode 190). The electron beam is then swept horizontally across the horizontal line in the diode array from the diode 192 to the diode 193. At the diode 193 at the right hand edge of the second scanned line of the array ("scan line-2"), the beam is terminated until it is horizontally retraced to the line beginning with the diode 194 ("scan line-3").

The horizontal sweep and horizontal retrace pattern is repeated ninety-six times including the eighty-four scan lines disposed between the scan line-9 and scan line-92. When the electron beam reaches the right hand edge of "scan line-96" terminating at the diode 195, the electron scanning beam is terminated and begins again at the diode 190 diagonally across the diode array from the diode 195. Thus, the vertical retracing of the electron "beam" (although the beam is terminated during this motion) from the end point (the diode 195) back across the array disposes the beam at a location (the diode 190) where the entire scan sequence may be repeated. In this manner a complete scan of the electrical image plane is completed.

Due to the speed of the electronic components, a scan and return of the entire ninety-six scan lines onto which the electrical image of the viewed area falls may be completed in an incredibly rapid time interval. It should be borne in mind that although the conveyor 41 is never actually stopped, the speed at which the conveyor 41 is translating through the viewed area is excessively slow when compared to the speed at which the electron scanning beam is deflected across the electrical image plane. Thus, the video signal representation generated by a complete scan and return effectively constitutes a "still" frame depiction of those portions of the articles lying within the viewing zones within the viewed area at the time the frame is taken.

Several refinements to the sequence may now be undertaken. Since those regions outside of the dot-dash area on the electrical image plane are not exposed to the electron scanning beam, those regions (indicated by reference character 196) eventually attain a relatively high positive charge. Thus, electron depletion may occur between those diodes within the dot-dash area of the electrical image plane but next-adjacent to the unreplenished, relatively positively charged areas 196. This phenomenon is known as "blooming". In order to avoid the effect of blooming, a buffer region 197 is defined within the dot-dash area swept by the electron scanning beam but from which no article classification data is to be gathered. The remaining area within the solid boundaries (between scan line-9 and scan line-92) in the representation of the electrical image plane shown in FIG. 6C is termed the "scanned area" 50.

The term "scanned area" as used hereafter in this application denotes a 10½-inch by 32-inch portion of the viewed area 48 from which article classification information is gathered. Thus, within the illuminated region 47 (FIG. 6A), is a viewed area 48 falling within the dot-dash boundaries of the electrical image plane (shown also in FIG. 6B). Although the viewed area's image is swept, only information generated by the passage of the electron beam over a scanned area 50 within the solid boundaries of the electrical image plane (FIGS. 6A and 6B) is used to provide article classification information. For reasons discussed herein, the scanned area 50 occupies the eighty-four scan lines disposed on the electrical image plane between scan line-9 and scan line-92 while there are N (equal to ninety-six) scan lines within the electrical image of the viewed area 48.

It should also be noted that due to the effect of the optics on the light reflected from the viewed area, the visual image and, therefore, the electrical image of the viewed area are reversed. The upper right corner of the viewed area when viewed from a given reference occurs at the lower left corner of the electrical image plane when viewed from the same reference. However, since the electron beam scan occurs so that the portion of the electrical image corresponding to the upper left corner of the viewed area is the starting point of the scan, the depiction of the situation provided in FIG. 6 is functionally accurate although optically reversed.

It should also be noted that the electron scanning beam does not, in actuality, proceed from one isolated diode to another isolated diode. In practice, the width of the scanning beam cannot be adjusted so finely that only a single diode on the electrical image plane 104 of the vidicon is covered by the scanning beam. However, if the circle depiction of the diodes in FIG. 6C were envisioned as diode clusters corresponding in dimension to the width of the electron scanning beam, the representation of the physical events is substantially as discussed.

Finally, the scan pattern across the electrical image plane is actually in the form of a parallelogram, not a true rectangle, due to the physics of the beam's reaction to the magnetic fields in the yokes. The electron beam is always moving "downwardly" (as viewed in FIG. 6C) at the same time it is being horizontally deflected. It is to be noted that this results in the beam taking an inclined path as it sweeps across the image in the scanned area, and not the horizontal path generally depicted in FIG. 6C. Thus, it is important that the rollers be sized to define a gap of sufficient width so that the image of either transverse extremity of the viewing zone is not distorted. (Note also that the width of the channel 59 between rollers is sized so that the rollers do not affect the integrity of the video signals from any portion of the scan.)

However, these simplifications aside, the description provided in connection with FIG. 6 imparts a substantially accurate understanding of the physical events occurring during an electron beam scan of the electrical image plane.

Some quantification of the system timing requirements may now be formulated.

The vidicons are adjusted such that the scanned portion (10½" by 32") of the viewed area falls within the scanned area 50 bounded by the solid lines on the electrical image plane shown in FIG. 6B. The video outputs of the vidicon tubes 92 utilized in the preferred embodiment of the invention are optimized if a horizontal line (diode 190 to diode 191, for example) is scanned in approximately sixty microseconds. If a twenty microsecond period is provided to horizontally retrace the "beam" from the diode 191 to the diode 192 (recalling that the electron beam is actually terminated during this retrace), it is seen that the beam may scan a horizontal line and return to a position ready to initiate a scan of another horizontal line in approximately eighty microseconds. If approximately two hundred fifty microseconds is allowed for the "beam" to vertically retrace from the diode 195 to the diode 190 (FIG. 6C, again noting the electron beam is actually terminated), a scanning interval of approximately eight milliseconds is defined.

Recognizing the period of a rectified 60 Hz. voltage signal is 8.33 milliseconds, it may be appreciated that if each video frame is initiated at the zero crossing of a rectified 60 Hz. signal, the vidicons may be operated at substantially their optimum parameters. That is, ninety-six horizontal lines (N) may be scanned and the beam returned within an interval whereby the optimum performance of the vidicons is utilized. Note also that an entire array of ninety-six lines is scanned in a time synchronized with the movement of the conveyor 41 by the synchronous motor 66.

A basic clock frequency for the system may be identified if it is recognized that the horizontal distance between solid boundaries (in FIG. 6B) corresponds to a thirty-two inch transverse width of the scanned area. The resolution capabilities of the vidicons imposes a condition that a one-eighth inch defect is the minimum defect size detectable. Thus, if the transverse width of the second area is defined to contain 256 one-eighth inch segments, and if the electron beam scans these 256 segments in approximately sixty microseconds, a basic clock frequency on the order of approximately 4.2 MHz. may be utilized as the basic clock frequency for the system.

Yet further, if it is desired to generate a new frame every 8.33 milliseconds (in accordance with the zero-crossing of a rectified 60 Hz. signal) and if there are eighty-four frames taken during the translation of one viewing zone through the scanned area 10½" in longitudinal depth, it is seen that a frame may be taken each time the viewing zone translates one-eighth of an inch. To accomplish this result, the conveyor 41 may be translated at a speed of approximately fifteen inches per second.

In summary, through knowledge of the optimum vidicon operating parameters, coupled with a definition of minimum defect size, the conveyor speed (approximately fifteen inches per second), the duration of each frame (substantially 8.33 milliseconds, corresponding to the period of a rectified 60 Hz. line input) and the basic clock frequency (approximately 4.2 MHz.) may be identified. As a result, the basis for several timing signals (VERT. RET., HORZ. SWEEP, WINDOW, STROBE and CLAMP) as well as the vidicon control signals (HORZ. DEFL. and VERT. DEFL.) may be identified.

It has been noted at several points that during the horizontal and vertical retrace movements of the electron beam, the electron beam is inhibited from striking the electrical image plane. This prevents distortion of the electrical image on those regions over which the electron beam would have passed were it not inhibited. Since horizontal retracing between horizontal lines is accomplished in approximately twenty microseconds, and vertical retracing occurs in approximately two hundred fifty microseconds, the duration of the cathode blanking intervals in terms of the system's basic clock frequency may be determined. Thus, the basis for the timing signal BLANKING and the control signal K GRID may also be identified.

THE SYNCHRONIZING CIRCUIT

Having identified the basis behind the system timing in terms of optimization of the operation of the vidicons, the circuit configuration and timing diagram of the synchronizing circuit 174 may now be set forth.

Figure 9:
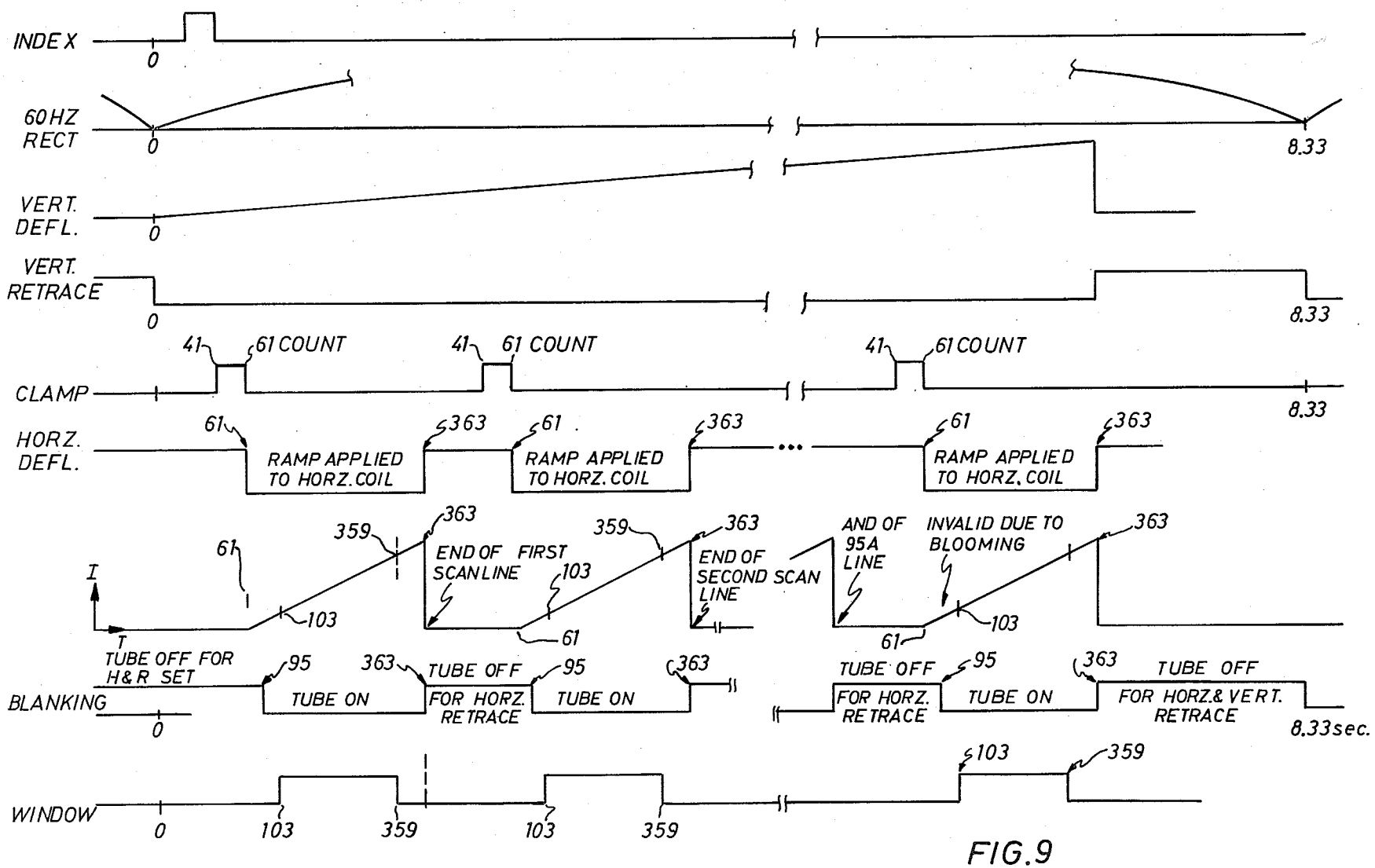
FIG. 9 is a timing diagram for the portion of the synchronizing circuit shown in FIG. 7 and the vidicon driver control circuit shown in FIG. 8.

Referring to the schematic diagram of FIG. 7 and to the timing diagram of FIG. 9, that portion of the synchronizing circuit 174 which generates the vidicon timing signals VERT. RET., HORZ. SWEEP, BLANKING, END OF FRAME, WINDOW, STROBE and CLAMP may be explained and understood. As seen from FIG. 5, the first three mentioned signals are applied to the vidicon driver control circuit 176. The last four signals are applied to the DMA circuit 181. CLAMP is also applied to the characteristic signal generator circuit 179. However, as noted earlier for convenience, the signal CLAMP does not extend directly to the circuit 179, but is wired through the network 176 although it is not used there.

The basic timing signal used by the electronics is derived from an oscillator 200 having a power supply regulator 201 connected thereto. The frequency of the timing signal from the oscillator 200 is approximately 4.108 MHz, derived as discussed above. A suitable device for use as the oscillator 200 is that manufactured by Texas Instruments and sold under model number 74S124. Any suitable five-volt regulator, such as that manufactured by National Semiconductor and sold under model number LM323K may be used.

The oscillator 200 runs in accordance with the signal on the control pin 6 thereof. The signal on pin 6 is derived from the $\overline{Q}$ output of a flip-flop 202. As will be discussed herein, when the signal to pin 6 of the oscillator 200 goes to a logic-0 at the beginning of each frame in accordance with the zero-crossing of the rectified 60 Hz. signal, the oscillator 200 operates to output the basic timing signal STROBE on a line 203. STROBE is used to generate the other timing signals.

STROBE is applied as the input to a counter/decoder arrangement 204 including a units counter 205A, a tens counter 205B and a hundreds counter 205C. Suitable for use as the counters 205 are synchronous counters manufactured by Texas Instruments and sold under model number 74LS192. Associated with each of the counters 205 is a binary-coded-decimal-to-decimal decoder 206A, 206B and 206C, respectively. Suitable decoders are those manufactured by Texas Instruments and sold under model number 74LS42.

Selected ones of the decoder output lines are applied to an array of gates 207. The gate array is comprised of a NOR gate 207A input with the decoded outputs such that an output pulse is produced on the forty-first negative-to-positive transition of the STROBE signal output from the oscillator 200. Similarly, the input pins to the NOR gates 207B, 207C, 207D, 207E and 207F are arranged such that output pulses are generated on the 61-st, 95-th, 103-rd, 359-th and 363-rd negative-to-positive transition of STROBE, respectively.

The output of the gate 207A is applied, through an inverter 208, to preset a flip-flop 209. The output of the gate 207B is applied, through a NOR gate 210, to clock the flip-flop 209. The output of the gate 207B is also applied through an inverter 211 to preset a flip-flop 212.

The output of the gate 207C clocks a flip-flop 213. The output of the gate 207D clocks a flip-flop 214. The flip-flop 214 is cleared by the output of the gate 207E, applied through an inverter 215. The output of the gate 207F, applied through a NOR gate 216, simultaneously clears the flip-flops 212 and 213 and, through an inverter 217, clears the counters 205. The output of the inverter 217 clocks the flip-flop 209 through the NOR gate 210. Suitable for use as the flip-flops 209 and 212 is a device sold by Texas Instruments under model number 74LS76, while devices from the same manufacturer and sold under model number 74LS74 may be used as the flip-flops 213 and 214.

Upon the end of the 41-st pulse on the STROBE line, the output of the gate 207A goes to a logic-1 condition. The falling edge of that output, inverted by the inverter 208, presets the flip-flop 290 and generates a logic-1 at the Q output thereof. This is the CLAMP signal and it is applied by lines 218A to a high speed buffer driver 219, such as a device sold by Texas Instruments under model number 75138. The analog signal outputs from the driver 219 are applied to the vidicon driver control circuit 176. Simultaneously, the CLAMP signal is applied by the line 218B to an opencollector inverting buffer 220, such as that sold by Texas Instruments under model number 74LS06. The outputs from the inverting buffer 220 are applied to the digital electronics of the extended DMA circuit 181. The STROBE pulses are also applied to the driver 220 by a line 221.

At the leading edge of the 61-st STROBE, the output of the gate 210 changes state, from logic-1 to logic-0. At the end of STROBE-61, the output of the gate 210 reverts to a logic-1 state. The negative-to-positive transition of the output of the gate 210 at the end of the 61-st STROBE pulse clears the flip-flop 209 to change the state of the Q output and terminate CLAMP.

The leading edge of the 61-st STROBE, appearing as a negative-to-positive transition by the action of the inverter 211, presets the flip-flop 212. The $\overline{Q}$ output of the flip-flop 212 goes to a logic-0 condition to generate the timing signal $\overline{\text{HORZ. SWEEP}}$, the complement of the signal HORZ, SWEEP. This signal is applied by a line 222A to the driver 219. The $\overline{Q}$ output of the flip-flop 212 is also applied by a line 222B to a counter arrangement 223 including a counter 223A connected in cascade with a counter 223B. Suitable counters may be obtained from Texas Instruments under model number 74LS193. The positive-to-negative transition of $\overline{\text{HORZ. SWEEP}}$ has no effect on the counter 223A.

At the occurrence of the 95-th STROBE pulse, the negative-to-positive transition of the output of the gate 207C clocks the flip-flop 213 and the $\overline{Q}$ output thereof changes to a logic-0 state. This signal, $\overline{\text{BLANKING}}$, the complement of BLANKING, is applied to the driver 219 by a line 224. The transition of the output of the gate 207D clocks the flip-flop 214 and the logic-1 signal at the data input thereof appears at the Q output. This signal, termed WINDOW, is applied to the inverting buffer 220 by a line 225.

The occurrence of the 359-th STROBE generates a signal output from the gate 207E. The falling edge of that output, as inverted by the inverter 215, clears the flip-flop 214, thus terminating WINDOW by clearing the Q output of the flip-flop 214 to a logic-0.

The 363-rd STROBE changes the state of the output of the gate 207F to a logic-1 condition. This transition changes the state of the output of the gate 216. The falling edge of the signal at the gate 216 simultaneously clears the flip-flops 212 and 213 to change the states of the signals $\overline{\text{BLANKING}}$ and $\overline{\text{HORZ. SWEEP}}$ both to a logic-1. This transition is applied by the line 222B and increments the counters 223.

The output of the gate 216, when inverted by the action of the inverter 217, clears the counters 205 through a line 226. The output of the inverter 217, through the NOR gate 210, clears the flip-flop 209.

It should be appreciated that each of the signals thus far discussed—CLAMP, $\overline{\text{HORZ. SWEEP}}$, $\overline{\text{BLANKING}}$, WINDOW, STROBE—has utility in either controlling the movement of the electron scanning beam through one complete horizontal scan and return or in controlling the transmission of data contained in the video signals during that horizontal scan. Since there are ninety-six horizontal scans of the vidicon target by the electron scanning beam during a frame, the above described generation of timing signals repeats ninety-six times. Note that at the termination of each $\overline{\text{HORZ. SWEEP}}$, the counters 223 are incremented.

At the termination of the ninety-sixth horizontal scan of the electron beam (physically corresponding to the electron beam being located at the diode 195, FIG. 6C), the output of a NAND gate 227 changes state, triggering a one-shot 228 over a line 228A. A device manufactured by Texas Instruments and sold under model number NE555 may be used as the one-shot 228. The output of the one-shot is a pulse of a predetermined duration and is applied over a line 229A to the inverter 220. This pulse constitutes END OF FRAME. The END OF FRAME signal on the line 229A is applied by a line 230 to to the flip-flop 202 through an inverter 231 which triggers the oscillator 200. Thus, as a result of the pulse from the one-shot 228 the enabling signal to the oscillator 200 is terminated. The signal at the enabling input pin to the oscillator 200 is carried by a line 232 and is applied through the driver 219 to the analog electronics. This analog signal is termed VERT. RET. and is applied to the vidicon driver control arrangement 176. The output from the one-shot 228, applied over a line 229B, changes the state of the gate 216. The output of the one-shot 228 is also applied over lines 229C to clear the counters 223 (branching from the line 229A at the node 229N).

THE VIDICON DRIVER CONTROL CIRCUIT

With reference now to the schematic diagram of FIG. 8, and to the timing diagram of FIG. 9, the manner in which the vidicon driver control circuit 176 responds to the timing signals generated from the portion of the synchronizing circuit 174 may be seen and understood.

The vidicon driver control arrangement 176 includes circuitry which, in response to the timing signals output from the synchronizing circuit 174, applies control currents to the coils of the vidicon yokes whereby the horizontal and vertical deflection of the electron scanning beam may be effected.

The timing signals VERT. RET., BLANKING, HORZ. SWEEP and CLAMP generated by the synchronizing circuit are received by a buffer 233 operating in the receive-mode and applied to the various components within the vidicon driver control circuit 176. Suitable for use as the buffer 233 is a device manufactured by Texas Instruments and sold under model number 75138.

A voltage regulator 234 such as that sold by Texas Instruments under model number LM120H-5 provides a regulated negative voltage to a horizontal and a vertical deflection signal generator 235 and 236, respectively.

The horizontal deflection signal generator 235 includes an operational amplifier 235A arranged as an integrator to provide an increasing ramp function at the output thereof. The slope of the signal at the output of the amplifier 235A is governed in accordance with the capacitor 235C and resistor 235R. An NPN transistor 237, the base of which is tied to the signal HORZ. SWEEP, shunts the capacitor 235C. So long as the signal HORZ. SWEEP remains a logic-1 (approximately +5 v.), the transistor 237 is conductive and the integrating effect of the capacitor 235C is not asserted. However, when the transistor 237 is rendered non-conductive i.e., when HORZ. SWEEP changes to a logic-0 state (approximately zero volts), the output of the amplifier 235A is an increasing ramp function. This signal, HORZ. DEFL. at the output node 235N, when applied to the horizontal deflection driver yoke 114 of the vidicons, displaces the electron scanning beam horizontally across each of the vidicon targets (FIG. 6C).

The vertical deflection signal generator 236 includes an operational amplifier 236A having an integrating capacitor 236C. A resistor 236R is also provided. The capacitor 236C is shunted by an NPN transistor 238, the base of which is tied to the vertical retrace signal VERT. RET. As long as the signal to the base of the transistor 238 is a logic-0 (approximately zero volts), the output of the amplifier 236A at the node 236N is an increasing ramp function, the slope of which is determined by the capacitor 236C and resistor 236R. When VERT. RET. becomes a logic-1 (approximately +5 v.), the transistor 238 is rendered conductive, and the ramp terminates. The ramp output signal, VERT. DEFL., when applied to the vertical driver yokes 115 of the vidicons, controls the movement of the scanning beam downwardly across the vidicon targets. When the ramp ceases, the field in the coil collapses and the electron beam is retraced across the vidicon target to occupy the appropriate position at the start of the next frame.

A signal conditioning network 239 conditions and applies HORZ. DEFL. to the horizontal driver yokes 114 of each of the vidicons 92G, 92R, and 92I. The network 239 is connected to the output of the amplifier 235A at the node 235N. Similarly a conditioning circuit 240 conditions and applies the VERT. DEFL. signal to the vertical driver yokes 115 of each of the vidicons 92G, 92R, and 92I. The network 240 is connected to the output of the amplifier 236A at the node 236N.

Since each of the vidicons have corresponding circuitry arranged in parallel past the nodes 235N and 236N, only the circuit elements associated with the conditioning networks 239 and 240 for one of the vidicons are discussed. It is understood that each of the other vidicons have identical circuit components.

A horizontal offset and gain control arrangement 241 is connected in series to the output of the horizontal deflection signal generator 235. The offset and gain control arrangement includes an operational amplifier 241A connected as a difference amplifier. The output of the amplifier 235A is applied to the inverting input of the amplifier 241A through a gain control potentiometer 242. The non-inverting input of the amplifier 241A is taken from an offset potentiometer 244 connected between a predetermined positive potential ("X") and ground. A fine adjustment offset potentiometer 246 may also be provided. The positive potential "X" is derived from a regulator 247 as an LM209-H manufactured by Texas Instruments.

It is earlier noted that mechanical and electrical adjustments must be made in order to insure that the images of the viewed area impact on the predetermined region of the visual image plane of the vidicons. The ranges of motion of the vidicons and their mountings permit these mechanical adjustments to be made. In order to insure that the electron scanning beam falls precisely within the confines of the viewed area on the vidicon electrical image plane (dot-dash lines on FIG. 6B), the appropriate adjustments to the gain potentiometer 242 and the offset potentiometer 244 are made. Adjustment of the gain potentiometer 242 insures that the electron beam is deflected horizontally across the vidicon electrical image plane for a deflection distance equal to the distance between the vertical boundaries of the viewed area of the electrical image plane. The offset potentiometer 244 permits lateral adjustment of the beam such that the horizontal scan line (the length of which is controlled by the setting on the gain potentiometer 242) begins and ends substantially on the boundaries of the electrical image of the viewed area.

The vertical offset and gain control arrangement 248, substantially similar in configuration and principle to the horizontal arrangement 242, includes an operational amplifier 251 connected at its inverting input to the output of the amplifier 236A through a vertical gain control potentiometer 253. The non-inverting input of the amplifier is taken from the wiper of a vertical offset potentiometer 255, connected in series with a fine offset potentiometer 257 between a positive potential ("X") from the regulator 247 (FIG. 8-1) and ground. The gain potentiometer 253 insures that the magnitude of the vertical deflection of the scanning beam substantially equals the height of the electrical image of the viewed area on the vidicon electrical image plane, while the offset potentiometers insure that the vertical deflection of the beam begins and ends substantially on the imposed boundaries (dot-dash lines in FIG. 6C) on the electrical image plane.

Of course, the horizontal and vertical adjustments have to be made for each of the vidicons 92G, 92R and 92I. It should be appreciated that the horizontal and vertical adjustments just discussed impart a flexibility of the electrical scanning system in accordance with this invention to scan a wide range of sizes of objects. For example, to modify the apparatus 40 to sort objects sized other than tomatoes, for example, consideration must at least be given to light sources (the distances, types and intensities as opposed to the scanned area), speed of the conveyor and roller size, ejector timing and sizes, and modifications to the processing unit program.

The appropriately amplified voltage signal from the horizontal offset and gain amplifier 241A is applied through a high gain amplifier 258 and a unity gain buffer 260 to the coil of the horizontal driver yoke 114 of the vidicon. In the horizontal control circuitry, the feedback loop to the amplifier 258 includes a peaking potentiometer 262 connected in series to a resistor 264. The appropriately conditioned signal HORZ. DEFL. is applied to the horizontal driver yoke 114 of one of the vidicons 92. (Note that signals from identical circuits 239 are applied to the other of the vidicons.)

The vertical control circuitry includes a high gain amplifier 265 connected to the output of the amplifier 251. A unity gain buffer 267 applies the appropriately amplified and offset voltage signal to the coil of the vertical driver yoke 115 of the vidicon. In the case of the vertical control circuitry, it has been found that only a fixed resistor 269 need be connected in the feedback loop to the amplifier 265. The appropriately conditioned signal VERT. DEFL. is applied in a similar manner to the vertical driver yokes 115 of each of the other vidicons 92.

The focus coil current for each of the vidicons 92 is controlled by a potentiometer 272 (FIG. 8-3) disposed at the output of a regulator 274. Suitable for use as the regulator 274 is that manufactured and sold by Texas Instruments under model number LM209H.

The vidicon driver control circuit 176 includes a K-GRID signal control generator 276 for each of the vidicons 92. This arrangement includes an NPN transistor 276A, the base of which is connected and is responsive to the BLANKING timing signal output from the synchronizing circuit 174. The collector of the transistor 276A is applied to the base of a second NPN transistor 276B that is physically mounted on the individual vidicon mounting plate. The collectors of both the transistors 276A and 276B are tied to a positive potential. So long as the BLANKING signal is a logic-1 (approximately +5 v.), the transistor is conductive, and a signal approximately equal to ground potential is applied to the base of the transistor 276B. The transistor 276B is not conductive, and the positive potential on its collector is applied to the cathode blanking grid 108 (FIG. 3A) in the vidicon 92. This positive potential cuts off the electron scanning beam. When the signal BLANKING changes states (to a logic-0, approximately zero volts), the transistor 276A is turned off. The positive potential at the collector thereof is applied to the base of the transistor 276B, rendering that transistor conductive. A ground potential is thus applied to the cathode blanking grid 108 in the vidicons 92, effectively allowing the passage of the electron beam. Thus, when BLANKING goes to a logic-0 state (BLANKING equaling a logic-1), the signal K GRID is generated and applied to the cathode blanking grid 108 and the electron scanning beam is prevented from striking the vidicon target.

The operation and interaction of the synchronizing circuit 174 and the vidicon driver control arrangement 176 whereby the electron scanning beam is controlled to effect ninety-six horizontal scans and vertical retrace during the time interval between zero-crossings of the rectified 60 Hz. signal may now be discussed. It is recalled that this movement of the scanning beam across the electrical image plane generates what is, in effect, a video image or "frame" of the viewed area. Since the scanning movement of the electron beam is so rapid, and the movement of the conveyor so slow with respect thereto, each "frame" may be conceptualized as a still photograph of the viewed area, showing the disposition of the viewing zones within the viewed area and the disposition of articles within each viewing zone at a given instant. Further, if the frames are synchronized with the conveyor motion, it may be seen that the movement of each viewing zone through the viewed area may be followed. Due to the synchronization of movement of the conveyor and the generation of the grames, during each successive frame each of the viewing zones within the viewed area successively occupies a different one of the N scan lines.

In FIG. 9, a timing diagram for the synchronizing circuit and the vidicon driver control circuit 176 is shown. In a manner to be discussed herein, frames are defined during the interval between successive zero-crossings of the rectified 60 Hz. timing signal. As noted, the period of such a rectified 60 Hz. signal is substantially 8.33 milliseconds.

As the occurrence of the zero crossing of the rectified 60 Hz. signal, indicated as time t=0 in FIG. 9, the oscillator 200 is enabled and the analog signal VERT. RET. applied to the vidicon driver control circuit 176 changes from a logic-1 to a logic-0 (approximately zero volts). This occurrence causes the transistor 238 to be rendered non-conductive and VERT. DEFL. is generated. Physically, the electron scanning beam has been vertically retraced to the scanning position corresponding to the upper left hand corner (the diode 190 in FIG. 6C) of the electrical image plane during the period immediately proceding the zero-crossing (while analog VERT. RET. is a logic-1 and VERT. DEFL. is not asserted).

With the oscillator 200 enabled, a sequence of pulses at the basic system timing frequency (4.108 MHz) is output therefrom. The occurrence of the 41-st STROBE generates a negative-to-positive transition of CLAMP. The CLAMP signal remains asserted until the 61-st STROBE. The generation of CLAMP is discussed earlier and it is utilized in the characteristic signal generator circuit 179 as well as in the DMA circuit 181.

The falling edge of CLAMP generates a positive-to-negative transition of HORZ. SWEEP. This signal, applied to the base of the transistor 237, permits an appropriately conditioned ramp output HORZ. DEFL. to be generated and applied to coils of the horizontal driver yokes 114 of the vidicons 92. The HORZ. SWEEP lasts for a period of approximately sixty microseconds, sufficient time to cause the electron beam to scan from the diode 190 to the diode 191 at the end of the scan line-1. The duration of HORZ. SWEEP (and HORZ. DEFL.), as measured with respect to the number of STROBE pulses, extends between the 61-st and 363-rd occurrences of STROBE.

Although the horizontal and vertical driver yokes 114 and 115 are energized during the HORZ. SWEEP time, no electron beam is generated within the tube to be deflected, due to the assertion of the BLANKING and K GRID signals. These signals had been asserted (a logic-1) during the previous vertical retrace and remain asserted until STROBE-95. At the 95-th STROBE, BLANKING changes state and remains in the logic-0 (K GRID is not asserted) condition until the 363-rd STROBE. With BLANKING a logic-0, the electron scanning beam passes through the cathode blanking grid 108. The beam is thus present within the vidicon and responds to the influence of the magnetic fields in the yokes.

It is earlier noted that the video information from the entirety of the horizontal scan is not utilized. Only that portion of the horizontal scan within the solid boundaries on the electrical image plane representing the scanned area 50 is used as video data. Thus, starting at the 103-rd STROBE, and lasting for 256 counts of STROBE thereafter (each STROBE being equal to a one-eighth segment of the thirty-two inch width of the scan line), the signal designated WINDOW is generated and applied to the DMA circuit 181. WINDOW thus represents that portion of the horizontal scan line within the scanned area 50 from which video data is recorded and transmitted.

Shortly after WINDOW terminates (at STROBE-359), the electron beam reaches the end of the first scan line. At STROBE-363 the signal HORZ. SWEEP changes state, thus terminating the ramp output HORZ. DEFL. from the amplifier 235A. (the vertical ramp VERT. DEFL. is still generated.) The current to the coil of the horizontal driver yoke 114 thus goes to zero.

Simultaneously, at STROBE-363, the signal BLANKING changes state and K GRID is asserted. The cathode blanking grid 108 in the vidicon 92 has a positive potential applied thereto, to thus prevent the electron beam from striking the target during that approximately twenty microsecond interval of horizontal retrace to the diode 192 on the second scan line. This precaution insures that information is not destroyed by the passage of the electron beam over the target.

Figure 7A:
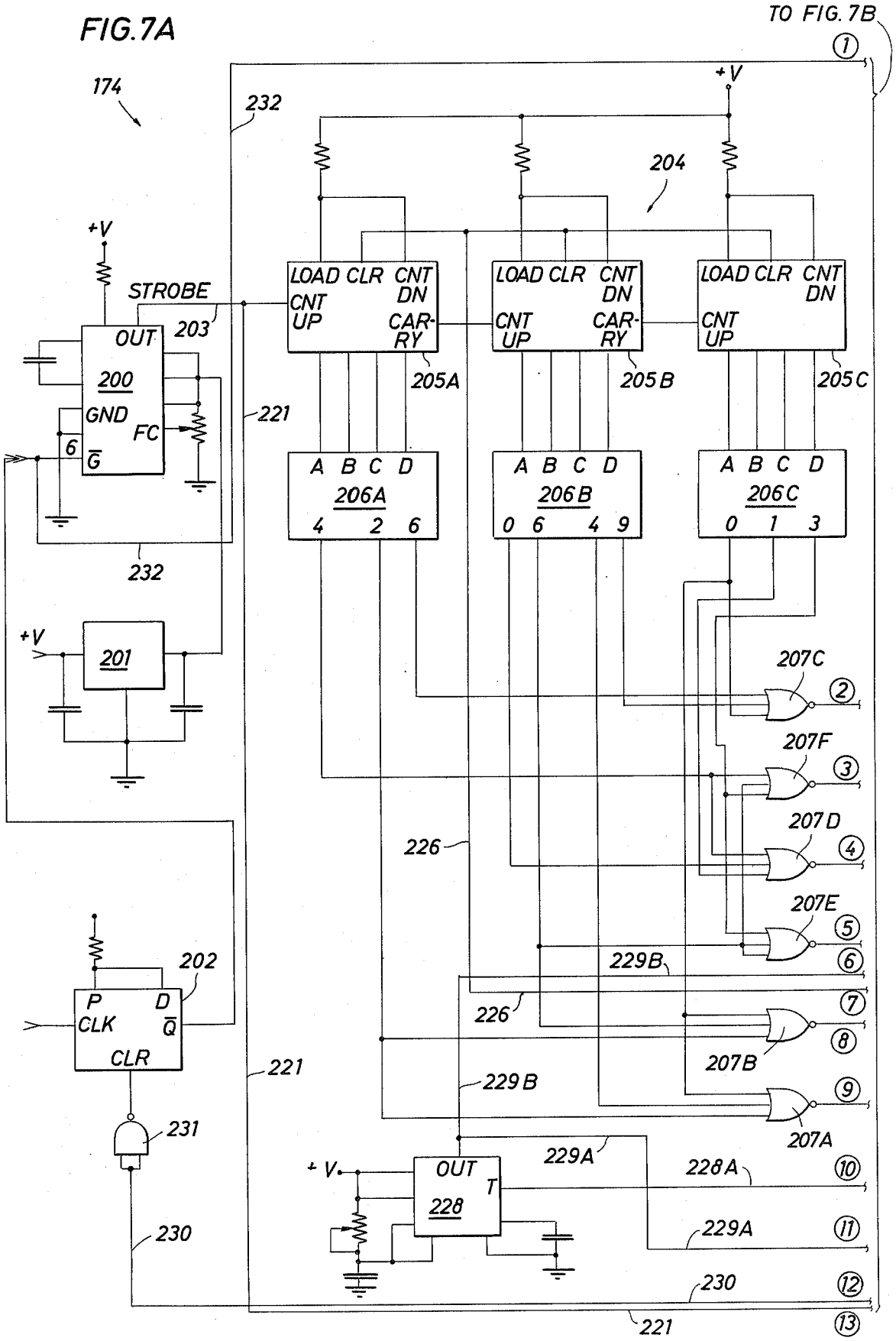
FIGS. 7A and B are schematic diagrams of that portion of the synchronizing circuit used in generating vidicon and DMA circuit timing signals for a roll sorting apparatus in accordance with the invention.
Figure 7B:
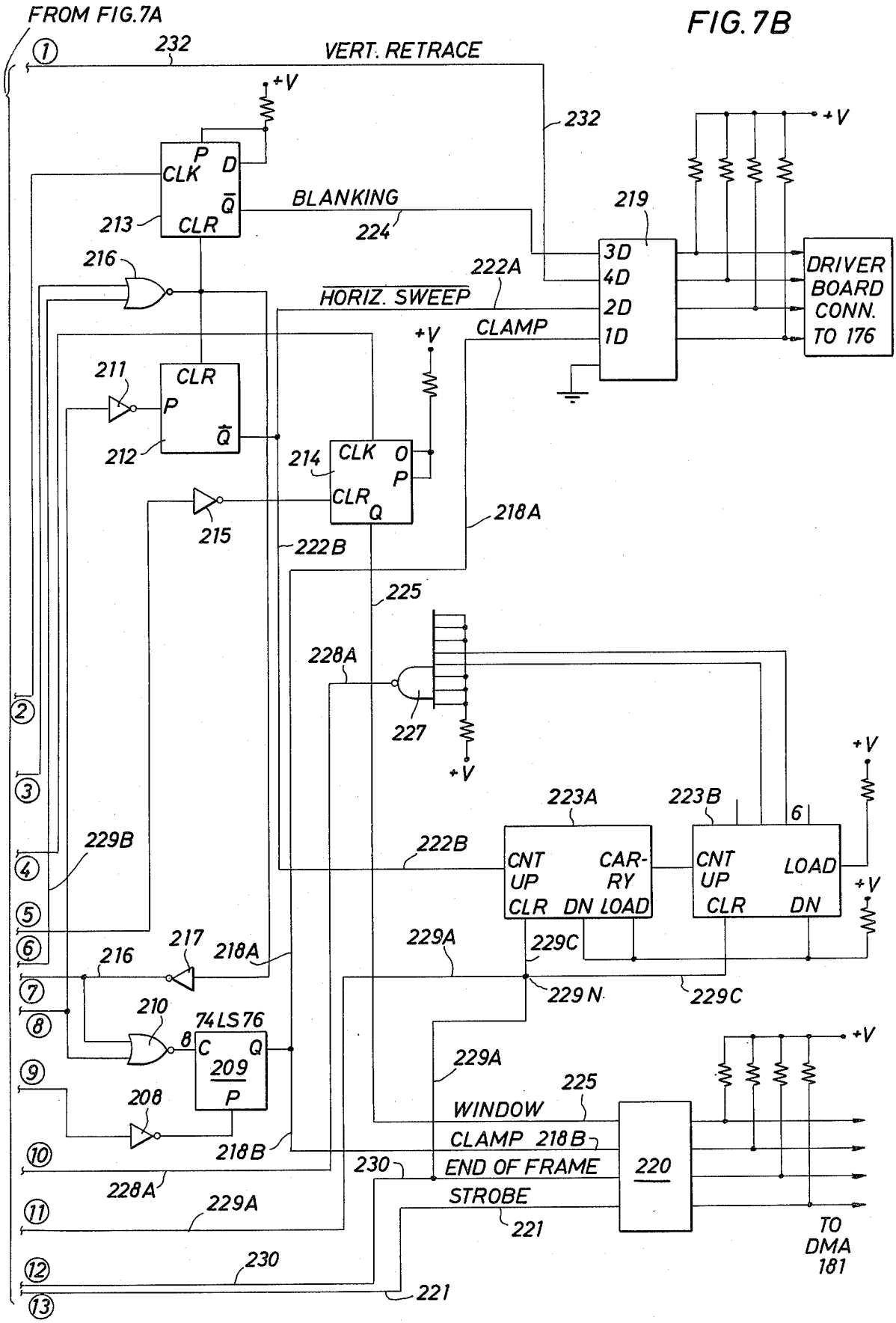

The 363-rd STROBE clears the counters 205 (FIG. 7B). By the occurrence of the next STROBE-41, the "beam" has been horizontally retraced and is in position over the diode 192 on scan line-2. The sequence is then repeated from scan line-2 through each of the N scan lines to scan line-96.

At the end of the scan line-96, the counter 223 generates END OF FRAME from the one-shot 228 (FIG. 7A) and disables the oscillator 200. The analog VERT. RET. generated from the flip-flop 202 changes state. The analog signal VERT. RET., when a logic-1, renders the transistor 238 conductive, thus terminating the current ramp VERT. DEFL. applied to the coil of the vertical driver yokes 115. The electron "beam" is retraced from the diode 195 in the lower right hand corner of the electrical image plane to the vicinity of the diode 190 in anticipation of the initiation of the next frame at the next zero crossing of the rectified 60 Hz. signal. During the vertical retrace, the vidicon tubes are blanked by the assertion of BLANKING and K GRID, to prevent destruction of information on the diodes during vertical retrace of the beam.

During each horizontal scan of the electron scanning beam, the video signal from each vidicon is derived from the current flowing through the video signal nodes 284N connecting the biasing resistors 105 to the vidicon targets (FIG. 10). That video signal is applied to the preamplifier circuit 178.

THE PREAMPLIFIER CIRCUIT

With reference to FIG. 10, the vidicon target biasing resistors 105 are shown as connected in series with the wiper of potentiometers 280 connected between a positive voltage source and ground.

Similar to the situation regarding the vidicon driver circuitry, since three parallel channels are provided, one associated with each vidicon, the description and operation of only one vidicon channel is illustrated, it being understood that each vidicon channel has similar circuitry and operates in a similar manner.

The video signal from the vidicon is applied through a coupling capacitor 282 to a current-to-voltage converter 284 configured as an amplifier. The amplifier 284 includes two NPN transistors with the emitter of the second being fed back to the base of the first. The video current signal is delivered to the node 284N and flows in the direction of the arrow 285. A super low noise vidicon head preamplifier, such as that described at page 32 of Intersil Discrete Semiconductor Guide may be used as the amplifier arrangement 284.

The amplified signal output from the amplifier 284 is applied to an adjustable high gain amplifier 286 (connected single-ended) and then to an amplifier 288 including two NPN transistors, the first connected in a common emitter configuration and the second as an emitter follower for impedance matching. The appropriately amplified and conditioned video signal from each vidicon channel is applied to the characteristic signal generator circuit 179.

A classifier control arrangement 287 is connected to pin 7 of the amplifier 286 provided in the green video preamplifier channel. No similar classifier controls are provided in the red or infrared channels. The network 287 includes an operational amplifier 287A connected at its inverting input to a fine-adjust potentiometer 287F and a course-adjust potentiometer 287C. A zero-adjust potentiometer 287Z is provided.

The potentiometers 287F and 287C are accessible to the operator on the front panel. The function of the classifier control is to select what color a rejectionable area will be (as opposed to the mode controls, which select how much rejectionable area is allowable).

For example, in a tomato sort, colors located to the left of the pointer of the coarse control will be defined as reject area. Colors to the right are accepted. If, as seen in FIG. 10, the pointer is set between orange and pink, any area on a tomato that is "greener" than pink is classified as reject area.

The fine classifier control allows an operator to select finer variations in color. Again in the context of a tomato sort, the fine control will allow for a color selection between light pink ("−") and dark pink ("+"). With the coarse and fine classifier controls set as in FIG. 10, any area on a tomato that is "greener" than dark pink is classified as reject area.

THE CHARACTERISTIC SIGNAL GENERATOR

The characteristic signal generator 179 includes an amplifier 300 (FIG. 11) connected in each of the GREEN, RED and INFRARED video output channels from the preamplifier circuit 178. The amplifiers 300 are similar to the amplifier configuration 284. The outputs of the amplifiers 300G and 300R are applied over lines 302G and 302R to a logarithmic divider 304. The divider 304 includes a pair of PNP transistors 306G and 306R. These present a high input impedance to the capacitors $C_1$ and $C_2$. The bases of the transistors 306G and 306R are respectively tied to the outputs of the green and red amplifiers 300G and 300R through a resistor and a capacitor in series. A set of NPN transistors 308G and 308R is connected emitter-to-emitter with the transistors 306 through a resistor. The collector currents of the transistors 308 vary in accordance with the the base voltage of the transistors 306. The collector currents of the transistors 308 flow through diodes $D_1$ and $D_2$ to convert this current to a logrithmic voltage. This voltage is representative of the logarithm of the green and red video signals, respectively. This voltage is applied by lines 311 to the bases of transistors 310G and 310R. The bases of the transistors 308G and 308R are each connected to the wiper of a potentiometer 309G and 309R, respectively. The potentiometer network 309 includes a resistor in series with a potentiometer. The networks 309G and 309R are provided to bias the transistors 306 and 308. The diodes $D_3$ and $D_4$ offset the base-emitter drops of the transistors 306G and 308G while the diodes $D_5$ and $D_6$ offset the drops of the transistors 306R and 308R. The diodes $D_1$ and $D_2$ and the transistors 310R and 310G are provided on a single chip manufactured by RCA under model number 3127A. The diodes $D_3$ and $D_5$ and the transistors 308G and 308R are provided on a similar chip. The diodes may be defined from such a chip by treating the connected collector-base junction as the anode of the diode and the emitter as the cathode of the diode. The diodes $D_1$ and $D_2$, respectively, match the emitter-base junctions of the transistors 310G and 310 R, while the diodes $D_3$ and $D_5$, respectively, match the emitter-base junctions of the transistors 308G and 308R.

Recognizing that the logarithmic ratio of two quantities may be obtained by the subtraction of the logarithms of those quantities, the signals from the emitters of the transistors 310 are applied to a difference amplifier 312. The output of the amplifier 312 is applied to the base of a level converter 314 which is an NPN transistor. This signal, representative of the logarithmic ratio of the green-to-red signals (or red-to-green signals, if the connection of the amplifier 312 is rearranged), is applied through a zener diode 316 to an array of comparators 318.

The comparator array 318 includes comparators 318A, 318B and 318C. The ratio signal from the level converter 314 (representing the quotient of the reflected red and green light intensities in logarithmic form) is applied to the inverting input of one of the comparators 318A. The noninverting input of the comparator 318A is input with a predetermined threshold reference voltage derived from a potentiometer 320A. (Other potentiometers 320B and 320C are provided for comparators 318B and 318C for the other characteristics.) The potentiometer 320A provides a suitable threshold reference which, if exceeded in a negative (or positive) direction by the ratio signal, provides information regarding the presence of a predetermined physical characteristic of the article being sorted.

If the ratio quotient signal in logarithmic form exceeds the threshold reference, the comparator outputs a RATIO characteristic signal which is applied to the DMA circuit 181 through a line driver 322. A suitable line driver 322 is that manufactured by Texas Instruments and sold under model number 75138.

In the preferred embodiment of the invention only the RATIO characteristic signal is utilized. However, since the apparatus possesses the capability to generate other characteristic signals, these other characteristic signals, termed YELLOW and BLACK, will be discussed so an understanding may be obtained as to how other characteristic signals would be handled by the circuitry and the processing units. Further, in some instances it may be necessary to interpose a logic array between the outputs of comparators 318 and the driver 322.

Field effect transistors 324R, 324G and 324I are respectively connected between the outputs of the amplifiers 300 and ground. The gates of the FET's 324 are connected to the output of a level shifter arrangement 326 comprising an NPN transistor 326A and a PNP transistor 326B. The base of the transistor 326A is tied to the signal CLAMP generated by the synchronizing circuit 174. The CLAMP signal, when applied to the transistor 326A during each horizontal retrace, renders the FET's 324 conductive to drain any excess charges which may be present at the outputs of the amplifiers 300. As a result, at the beginning of each horizontal scan, the video signal generated during that scan is referenced against a predetermined reference voltage, or black level, such that the video information derived during a given horizontal scan is not diluted or altered by spurious charges generated during previous horizontal scans.

The signal present at the output of the amplifier 300I is applied through an isolation amplifier 330 comprising a PNP transistor to an article detect signal generator 332. The article detect signal generator 332 includes a comparator 334 having its inverting input applied with the infrared video signal. The non-inverting input of the comparator 334 has a reference voltage derived from a potentiometer 336 applied thereto. When the infrared video signal exceeds the reference, an output from the amplifier 334 (pin 7) is generated for that period of time during which an article is detected by the scanning electron beam. The output from the comparator 334, on the line 338, is gated through an AND gate 340 to the driver 322 and provides a signal ART. DET. to the DMA circuit 181 that an article is present within the portion of the scan line over which the electron scanning beam is passing.

It may sometimes occur that due to the random disposition of articles within the viewing zone defined between adjacent rollers that two articles will be in abutting contact next to each other. This situation is illustrated in FIG. 12A. Some precautions are necessary to insure that the presence of two distinct articles is indicated to the DMA circuit 181. To this end a peak detector arrangement 342 is disposed within the article detect signal generator 332.

The peak detector arrangement 342 includes a unity gain buffer amplifier 344 provided at its inverting input with the infrared video signal by a line 346. The output of the amplifier 344 is carried by a line 348 to the inverting input of a comparator 350. A peak detector amplifier 352 derives its inverting input from the infrared video signal on the line 346. The non-inverting input is provided with a reference voltage derived from the wiper of a potentiometer 354 connected between a positive potential and ground.

The output of the peak detector amplifier 352 is applied through a diode 356 to the non-inverting input of the comparator 350 by a line 361. A capacitor 358 is connected between the non-inverting terminal of the comparator 350 and ground. The capacitor is shunted by a transistor 360 of the NPN type, the base of which is connected to the complementary output terminal of the comparator 334 (pin 6) by a line 362. The line 361 is connected to a potentiometer 363.

The output of the comparator 350 triggers a one-shot 364, the duration of which is adjusted for a purpose set forth herein. At the termination of the period of the one-shot 364, a second one-shot 366, having a predetermined duration equal to 250 nanoseconds, is triggered. The output of the one-shot 366 is applied to the AND gate 340 over a line 367. The one-shot 364 is arranged to render conductive an NPN transistor 368 connected in parallel between the capacitor 358 and ground. Suitable for use as the one-shots 364 and 366 are devices manufactured by Texas Instruments and sold under model number 74121.

The operation of the article detect signal generator 332 may be understood with reference to the timing diagram of FIG. 12B and the schematic diagram shown in FIG. 11. During the following discussion, it is assumed that across a given scan line-S articles $A_1$, $A_2$ and $A_3$ are present, with the articles $A_2$ and $A_3$ being in next-abutting relationship as shown in FIG. 12A.

As the electron scanning beam sweeps across scan line-S the magnitude of the infrared video signal presented to the inverting input of the amplifier 334 corresponds to the waveform shown in FIG. 12B-1.

The threshold voltage applied from the potentiometer 336 to the non-inverting input of the comparator 334 is indicated by the dotted line extending substantially parallel to the axis in FIG. 12B-1. When the waveform representative of the infrared signal corresponding to the article $A_1$ exceeds the threshold imposed by the potentiometer 336, the comparator 334 generates an output on the line 338 (FIG. 12B-2) which is applied to the AND gate 340. As long as the waveform representative of the article $A_1$ exceeds the threshold 336, an output signal on the line 338 is presented to the gate 340 and a digital signal ART. DET. representative of the presence of the article $A_1$ is transmitted by the driver 322 to the DMA circuit 181. When the electron scanning beam falls off the article $A_1$, the infrared signal representative thereof correspondingly drops below the threshold 336 and the signal representation on the line 338 correspondingly falls.

Continued movement of the electron scanning beam across the scan-line S will generate a second negative-to-positive transition of the signal on the line 338 when the electron scanning beam encounters the left hand edge of the article $A_2$. It is noted that the infrared signal waveform will have an intensity greater than the threshold 336 until the electron scanning beam falls off the right edge of the article $A_3$. However, it is imperative that some mechanism be provided whereby the electronic circuitry is made aware of the presence of the two articles $A_2$ and $A_3$ abutted next-adjacent each other.

The infrared video signal is applied over the line 346 to the inverting unity gain buffer amplifier 344. This signal is amplified (as shown in the solid line in FIG. 12B-3) and applied on the line 348 to the inverting input of the comparator 350. The waveform generated on the line 348 is the same shape as the waveform at the input of the amplifier 334. The output of the amplifier 352 is applied through a peak detector network which includes the diode 356, the capacitor 358 and the NPN transistor 360. A percentage of the charge on the capacitor 358 is applied from the wiper arm of the potentiometer 363 on the line 361 to the non-inverting input of the comparator 350. The signal on the line 361 (shown in dotted lines in FIG. 12B-3) follows the waveform of the signal on the line 348 for the rising portion of that signal. The voltage level to which the capacitor 358 will charge is dependent upon the offset imposed on the amplifier 352 by the potentiometer 354. The voltage on the line 361 thus tracks the rising signal on the line 348 and provides a floating reference (equal to the percentage p % of the peak thereof) to the comparator 350. The change in infrared reflectively between articles (as due to age, for example) is thus accommodated.

The signal on the line 361 is generated as follows. The complementary signal from the device 334 is applied on the line 362 to turn off the transistor 360. The capacitor 358 charges through the diode 356 throughout the rising portion of the waveform output from the amplifier 352. The charge on the capacitor 358 is representative of the peak voltage of the signal from the amplifier 352. When the signal on the line 348 (the IR video) begins to exhibit a negative slope, the diode 356 ceases to conduct and the capacitor is no longer charged. Although some decay of the voltage on the capacitor 358 occurs, it may be readily understood that a voltage substantially equal to the positive peak of the waveform is maintained on the line 361 to the non-inverting input of the comparator 350.

As the representation of the infrared signal on the line 348 falls below the threshold established by the capacitor 358, the comparator 350 generates an output pulse to the one-shot 364 (FIG. 12B-4). The one-shot 364 times out a predetermined duration after which the second one-shot 366 (FIG. 12B-5) is actuated. The duration of the one-shot 364 is selected such that the one-shot 364 times out at substantially the time that the waveform representative of the infrared video signal would fall below the threshold imposed by the potentiometer 336. This period is, however, adjustable. The output signal from the one-shot 366 changes the state of the digital output signal from the gate 340 and imposes a separation in that infrared output signal for a period of greater than or equal to 250 nanoseconds. Due to the timing of the electron scanning beam, a time equal to 250 nanoseconds represents the time necessary for the electron scanning beam to traverse a distance on the electrical image plane equal to one-eighth of an inch of the viewed area. Effectively then, the ART. DET. signal applied to the DMA circuit 181 is forced to define a separation of one-eighth inch between the abutting articles $A_2$ and $A_3$. When the first one-shot 364 is asserted, the transistor 368 is rendered conductive thus draining the charge on the capacitor 358.

As the electron scanning beam then begins to climb a positive slope in response to the movement of the scanning beam over the article $A_3$, the capacitor 358 again charges to a peak level coinciding with the peak of the waveform. The peak signal is again held by the capacitor 358 and applied to the non-inverting input of the comparator 350. As the infrared video signal waveform of the article $A_3$ begins to fall, the diode 356 prevents discharging of the capacitor 358. When the actual infrared signal waveform crosses the peak level imposed by the capacitor 350 the one-shots 364 and 366 are again fired. However, it is noted that in this instance that the right hand edge of the article $A_3$ also falls below the threshold imposed by the potentiometer 336. Thus, the output signal ART. DET. from the gate 340 applied to the DMA circuit 181 goes to zero in any event.

In view of the foregoing it may be appreciated that sorting apparatus in accordance with this invention is provided with a mechanism whereby the electronic circuitry is made aware of the presence of two distinct (although abutting) articles by the comparison of the instantaneous infrared video signal intensity with a predetermined signal intensity determined by the peak amplitude of the infrared video signal. This imposed break in the ART. DET. signal is used in connection with the transmission of information to the CPU's.

GENERATION OF SYSTEM AND CPU INITIALIZE SIGNALS

Figures 1, 2, 3, 13:
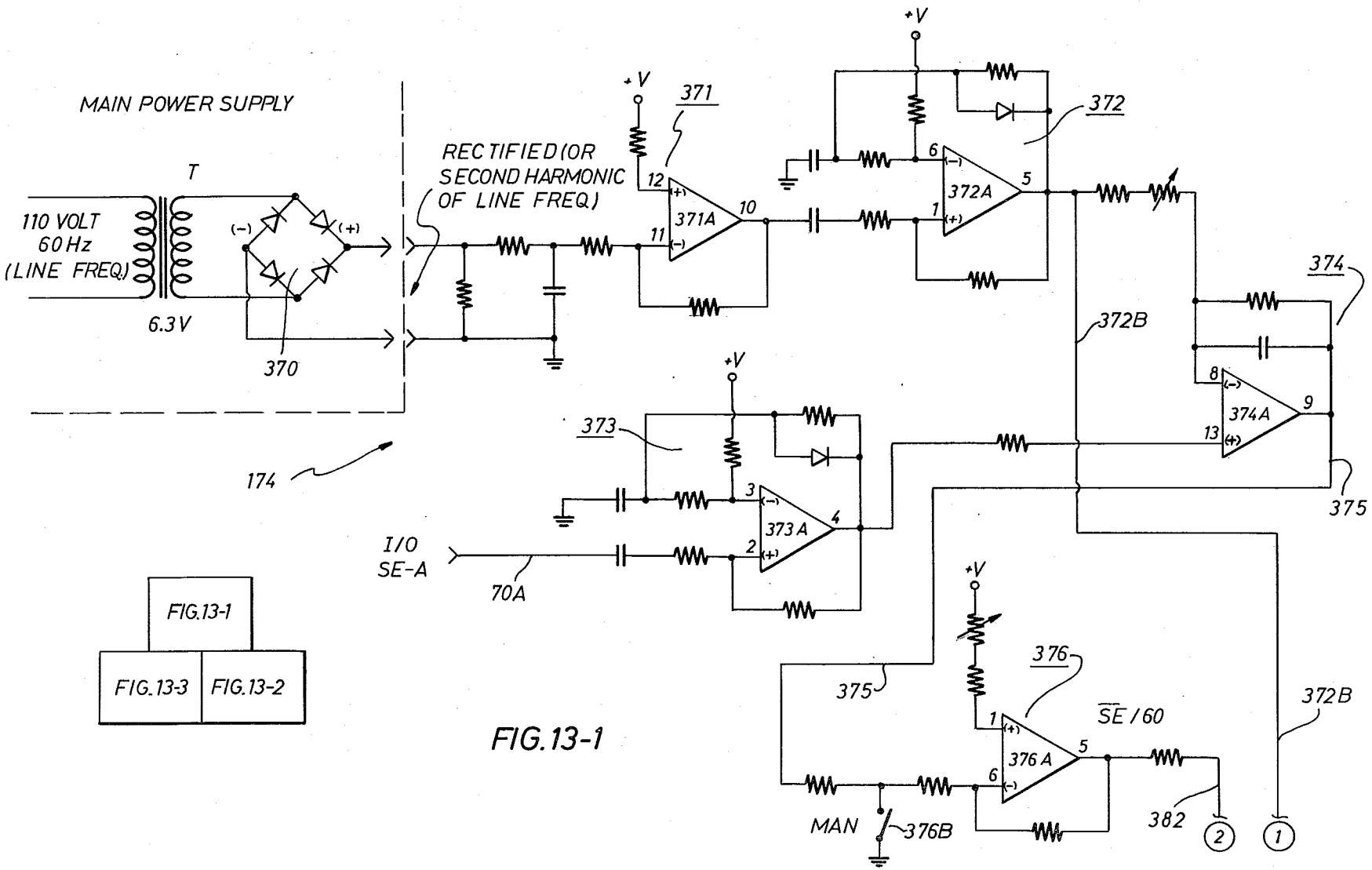
FIG. 13 is a schematic diagram of the portion of the synchronizing circuitry used to generate a system initialize (SINIT) signal and a processor initialize (CINIT) signal used by the circuitry of a roll sorting apparatus in accordance with the instant invention.
Figures 2, 13:
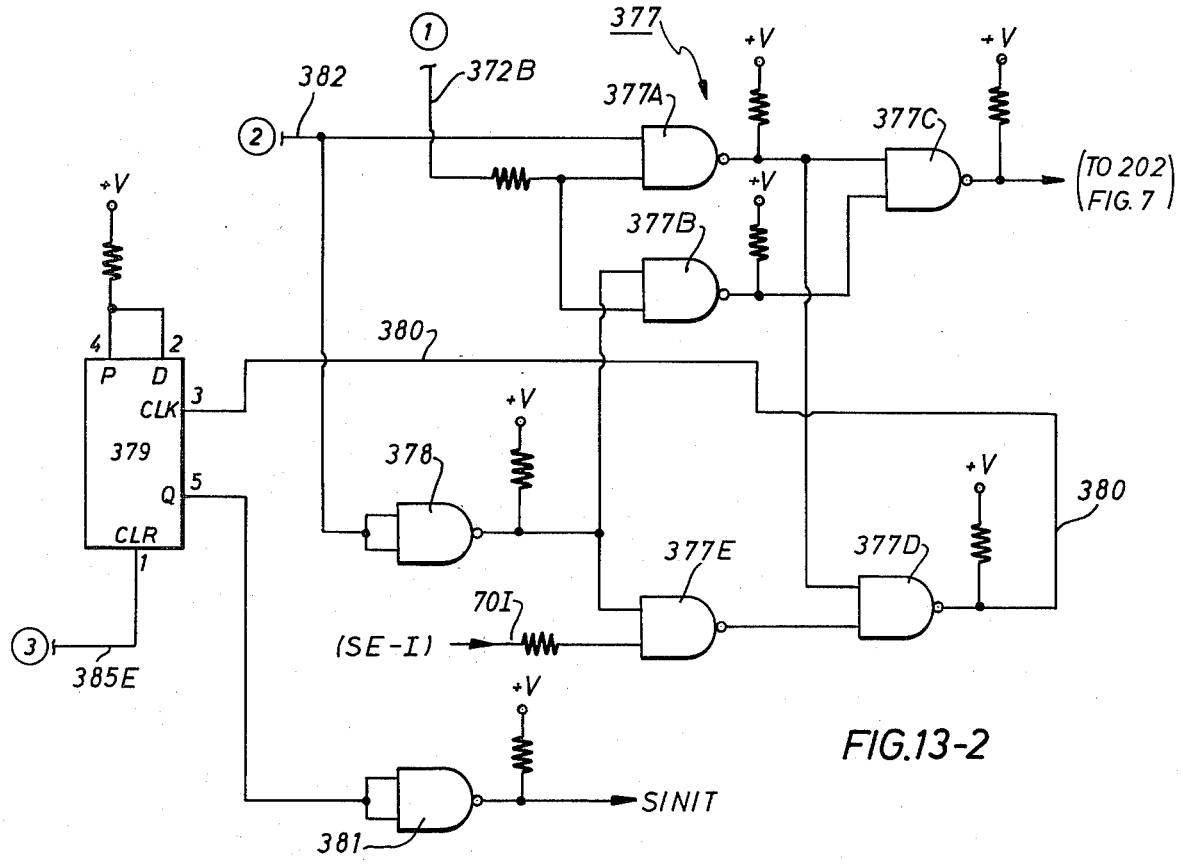
Figures 3, 13:
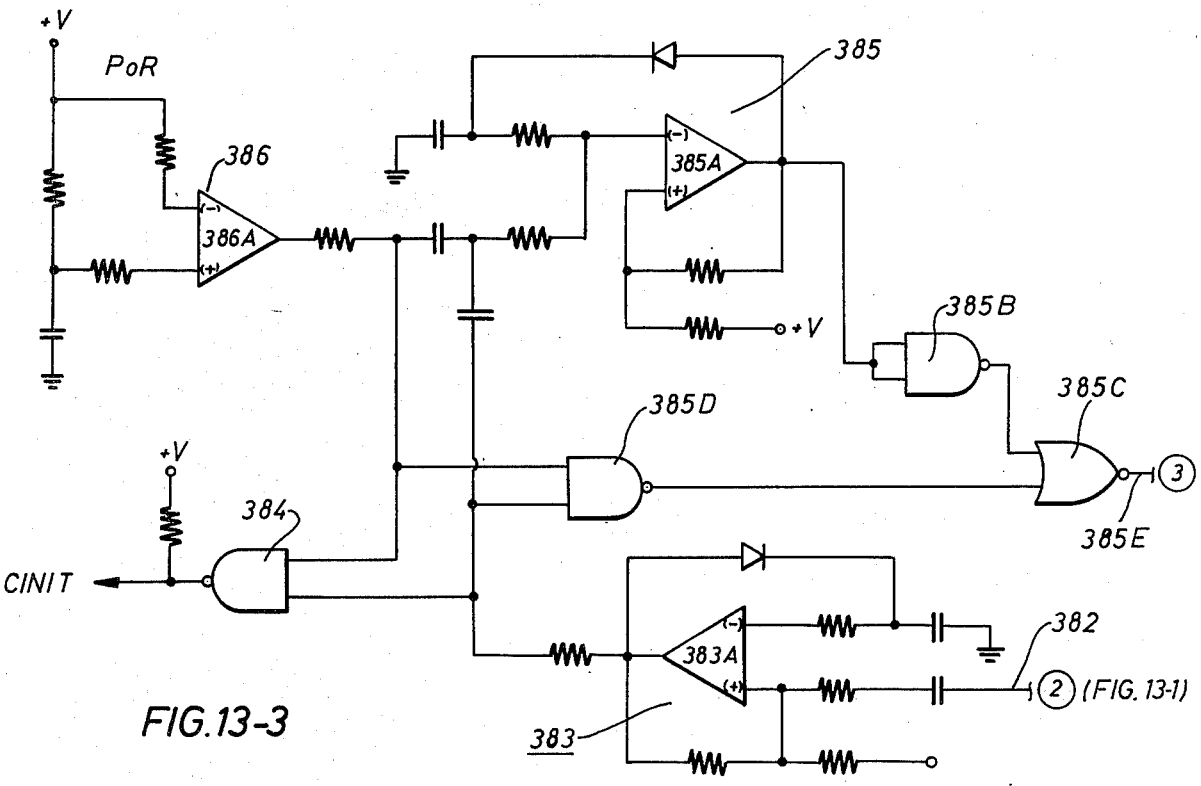
Figure 15:
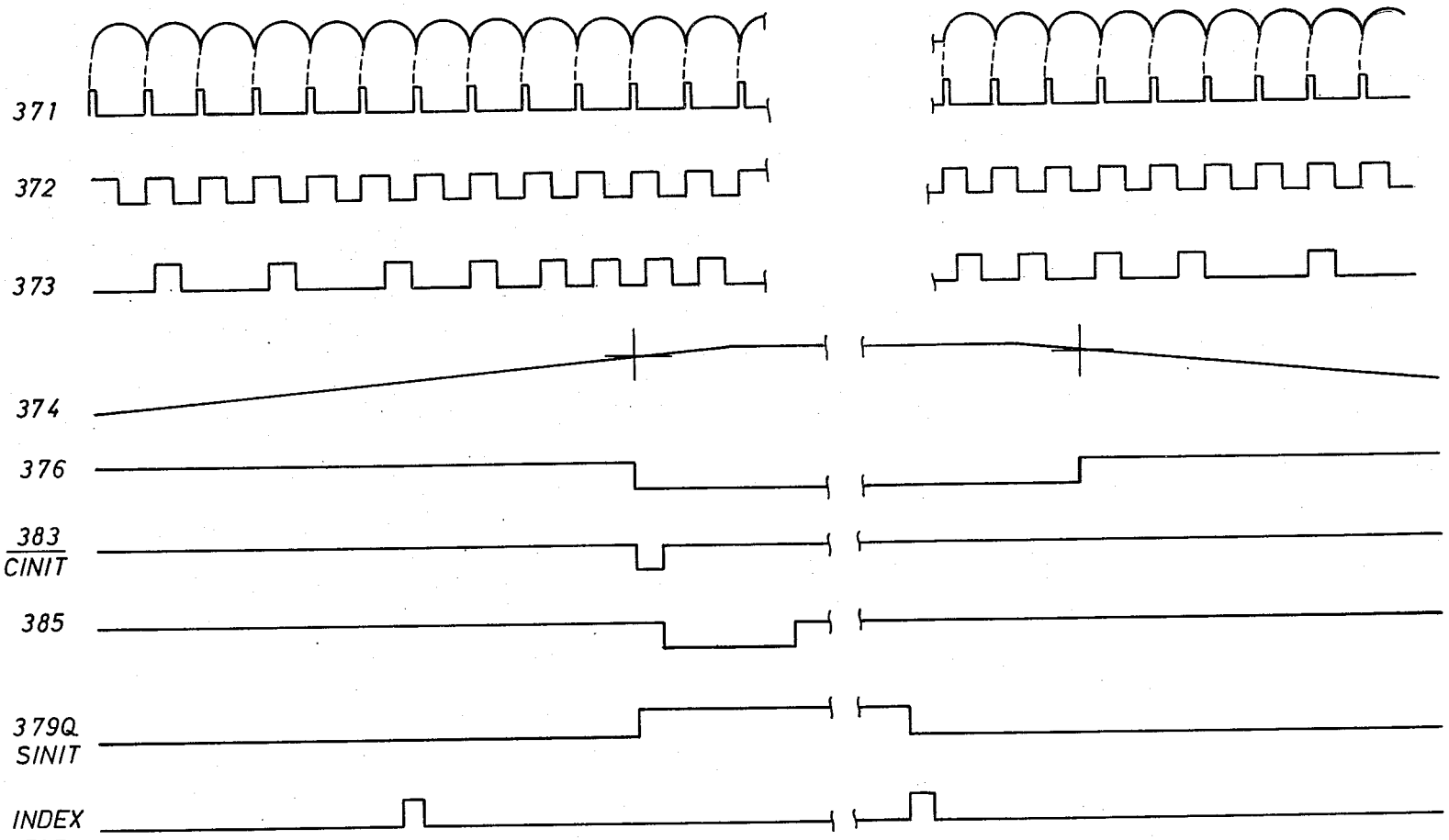
FIG. 15 is a timing diagram for the portion of the synchronizing circuit shown in FIG. 13.

FIG. 13 shows a detailed schematic diagram of the remainder of the synchronizing circuit 174, while FIGS. 14 and 15 are, respectively, a flow diagram of the functions performed by this portion of the circuitry and a timing diagram thereof.

The main power supply for the apparatus 40 is a 220 volt, 60 Hz. line supply. One side of this line signal (110 volts) is applied to a 6.3 volt filament transformer T. The purpose of the step-down transformer T is to keep the 110 V. A.C. signal from the circuit components of the synchronizing circuit 174. The output of the transformer T is applied to a rectifying diode bridge 370. The rectified 60 Hz. signal from the bridge is applied to a comparator 371. The comparator 371 includes an operational amplifier 371A provided with the rectified 60 Hz. signal at the inverting input thereof. The output of the comparator 371, as seen in FIG. 15, is a pulse train the frequency of which corresponds to the frequency of the rectified 60 Hz. signal (i.e., 120 Hz. or the second harmonic of the 60 Hz. line frequency).

A one-shot 372, including an operational amplifier 372A, responds to each negative-to-positive transition of the output of the comparator 371 to produce a positive pulse having approximately a four millisecond duration. A second one-shot 373, including an operational amplifier 373A, responds to each negative-to-positive transition of the "A" pulses on the line 70A generated from the shaft encoder 69 to generate a positive pulse also four milliseconds in duration.

The outputs of the one-shots 372 and 373 are respectively applied to the inverting and non-inverting terminals of an operational amplifier 374A disposed within a tachometer arrangement 374. The output of the tachometer is applied by a line 375 to the inverting input terminal of an operational amplifier 376A disposed within a comparator arrangement 376. A mode select switch 376B is connected to the inverting input of the amplifier 376A for a purpose discussed more fully herein.

A logic arrangement 377 includes NAND gates 377A and 377B. The output of the comparator 376 and its complement via the inverter 378 are respectively applied to the "A" terminals of the gates 377A and 377B. The other terminals of the gates 377A and 377B receive, on a line 372B, the output of the one-shot 372 which is related to the occurrence of the zero-crossing of the rectified 60 Hz. signal.

The output of the gate 377A is applied to the "A" inputs of gates 377C and 377D. The output of the gate 377B is applied to the "B" input of the gate 377C. The "B" input of the gate 377D is derived from the output of a gate 377E, the "A" and "B" inputs of which are obtained from the output of the comparator 376 (applied through the inventor 378) and from the "index" pulse generated by the shaft encoder 69 on the line 70I. The output of the gate 377C is applied to the CLOCK terminal of the flip-flop 202 (FIG. 7).

The output of the gate 377D is applied to the CLOCK input of a flip-flop 379 over a line 380. The Q output of the flip-flop 379 is applied through an inverter 381 and constitutes the system-initialize signal SINIT used throughout the digital electronics. A device suitable for use as the flip-flop 379 is that sold by Texas Instruments under model number 74LS74.

Dependent upon the output of the comparator 376, the logic 377 is operative: (1) to terminate the signal SINIT at the occurrence of the index pulse and, at the occurrence of the next zero crossing of the rectified 60 Hz. signal thereafter, initiate operation of the oscillator 200; or (2) to enable oscillator 200 in accordance with the zerocrossings of the rectified 60 Hz. signal without regard to the occurrence of the index pulse.

The output of the comparator 376 is also applied by the line 382 to a one-shot 383 which includes an operational amplifier 383A. The output of the one-shot 383 is applied to a gate 384 which generates the signal CINIT initializing the CPU array. A delay circuit 385, responsive to the occurrence of the signal from the one-shot 383, inhibits the flip-flop 379 on a line 385E from releasing the SINIT signal for a predetermined time period sufficient to permit the CPU's to clear a selected portion of the CPU's memory (database) before the electronic circuitry may respond to an index pulse. The delay time is on the order of fifteen to eighteen milliseconds.

The delay circuit 385 includes an operational amplifier configured as a one-shot 385A the inverting input of which receives the output of the one-shot 383. The output of the amplifier 385A is inverted by the inverter 385B and applied to the "A" input of the gate 385C. The B input of the gate 385C is derived from the output of a gate 385D. One input of the gate 385D derives from the output of the one-shot 383. The output of the gate 385C is applied to the CLEAR input terminal of the flip-flop 379 on the line 385E. So long as the signal on the CLEAR terminal is a logic-0, the flip-flop 379 is rendered insusceptible to the occurrence of a CLOCK pulse on the line 380 and thus, is inhibited from terminating the signal SINIT.

A Power-on-Reset (PoR) circuit 386, including an operation amplifier 386A is responsive to the initial power-up of the system to generate a predetermined time delay (typically 32 seconds) prior to applying a logic-1 level to the gate 384 to terminate CINIT. The output of the PoR circuit 386 is also applied to the delay 385.

The basic operating functions of the portion of the synchronizing circuit 174 shown in FIG. 13 may be understood with reference to FIG. 14. After the delay following powering of the system, a decision is made concerning the speed of the conveyor as indicated by the output of the comparator 376. If the conveyor is running at the predetermined operating speed (approximately 15 inches/second), a system-initialize signal (SINIT) is terminated at the next index pulse. The electronics then operates in the manner described herein. A portion of the logic 377 permits the vidicon control signals to operate in response to the occurrence of rectified 60 Hz. signals.

If the initial decision regarding the conveyor speed is negative, the synchronizing circuit is operative to release the electronics on the occurrence of the next zero-crossing of the rectified 60 Hz. signal. If at a later time the conveyor reaches operating speed, the signals CINIT and SINIT are generated, and the electronics is released on the occurrence of the next index pulse.

The detailed operation of the portion of the synchronizing circuit 174 shown in FIG. 13 may be understood with reference to the schematic diagram and the timing diagram shown in FIG. 15.

After the initial delay generated by the powering of the apparatus 40 has occurred, when the conveyor 41 is started it is necessary to synchronize the operation of the electronics to the conveyor.

The rectified 60 Hz. signal, shown in the timing diagram FIG. 15, exhibits a periodicity of 8.33 milliseconds. The output of the comparator 371 triggers a square wave output from the one-shot 372, the negative-to-positive transitions of the one-shot corresponding to the zero-crossings of the rectified 60 Hz. signal. The output of the one-shot 373 is less than predictable, due to its derivation from the "A" pulses output from the shaft encoder 69. Slippage in the conveyor movement may have an adverse effect in slowing or speeding the frequency of the "A" pulse train. This reason accounts for the reliance upon the rectified 60 Hz. signal for the control of the electronics.

The output of the tachometer 374 during the period of time when the conveyor is accelerating to the operating speed is a rising ramp function. When the magnitude of the tachometer output exceeds a predetermined threshold level imposed on the operational amplifier 376A, the comparator 376 changes from a logic-1 to a logic-0 state. At this time, when the conveyor has reached the predetermined operating speed of 15 inches/second, the system-initialize signal SINIT and the CPU initialize signal CINIT are generated.

In this circumstance, the signals SINIT and CINIT are generated in the following manner. The change of state of the output of the comparator 376 to a logic-0 condition generates a logic-0 signal of approximately 4-millisecond duration from the one-shot 383. This signal is gated through the gate 384 and the output thereof changes to a logic-1 state representative of the occurrence of CINIT. When the one-shot 383 times out the output signal returns to a logic-0 condition to terminate the signal CINIT. It is at this point, at the transition of CINIT from a logic-1 to a logic-0 state, that the CPU's begin to clear the databases. In order to provide sufficient time for the CPU's to clear the databases, the timing-out of the one-shot 383 triggers the delay 385.

With the return of the output of the one-shot 383 to the logic-1 condition, the one-shot 385A is triggered and the output thereof, inverted by the inverter 385B to a logic-1 state, is applied to the "A" terminal of the NOR gate 385C. The negative-to-positive transition of the "A" input to the gate 385C changes the output state thereof to a logic-0 condition. This logic-0 condition applied to the CLEAR terminal of the flip-flop 379 inhibits the response of the flip-flop 379 to a CLOCK pulse on the line 380. As is discussed herein, the pulse on the line 380 appears in this situation as the result of the occurrence of the index pulse from the shaft encoder 69 to the logic 377. Until the one-shot 385A times out, the CLEAR terminal of the flip-flop 379 is held in a logic-0 condition.

When the one-shot 385 times out, the output thereof is inverted by the inverter 385D to a logic-0 condition. The output of the gate 385C goes to a logic-1 state.

When the conveyor reaches operating speed, as indicated by the positive-to-negative transition of the output of the comparator 376, the signal conditions at the "A" inputs of the gates 377A and 377B are in the logic-0 and the logic-1 condition, respectively. Simultaneously, the "A" input to the gate 377E is in a logic-1 state. The output of the gate 377A remains at a logic-1 condition so that the gate 377D is enabled to pass an index pulse to the CLOCK input of the flip-flop 379. With the conveyor up to operating speed, the occurrence of an index pulse to the "B" input of the gate 377E changes the output state thereof from a logic-1 to a logic-0 condition. This results in a negative-to-positive transition at the output of the gate 377D which is applied over the line 380 to the clock terminal of the flip-flop 379. At the next negative-to-positive transition of the rectified 60 Hz. output of the supply, as indicated by the output of the one-shot 372, the "B" input to the gate 377C changes from a logic-1 to a logic-0 condition. The output of the gate 377C accordingly moves from a logic-0 to a logic-1 state. This transition is applied to the clock of the flip-flop 202 (FIG. 7A). The negative-to-positive transition to the CLOCK of the flip-flop 202 causes the $\overline{Q}$ output thereof to revert to a logic-0 state. This condition enables the operation of the oscillator 200 as described above.

The slowing of the conveyor results in the output of the comparator 376 reverting to a logic-1 condition. Alternatively, if it is desired to operate the system without regard to the speed at which the conveyor is moving, the mode select switch 376B is energized and the output from the comparator 376 remains in a logic-1 condition. Accordingly, the inputs to the "A" terminals of the gates 377A and 377B are, respectively, a logic-1 and a logic-0 condition. Similarly, the "A" input to the gate 377E remains in a logic-0 condition. As a consequence, the gate 377D is enabled to pass a signal from the output of the gate 377A.

At the occurrence of the next negative-to-positive transition of the rectified 60 Hz. signal the output of the oneshot 372, as applied to the "B" input of the gate 377A, changes to a logic-1 condition. This occurrence changes the state of the output of the gate 377A to a logic-0 condition which generates a logic-1 output from the gate 377D. Simultaneously, change of state of the output of the gate 377A to a logic-0 condition generates a transition to a logic-1 condition at the output of the gate 377C, again clocking the flip-flop 202 and enabling the oscillator 200 through the Q output thereof.

It may be advantageous in some instances to eliminate the comparator 371, the one-shots 372 and 373, and the tachometer 374 and generate signals representative of the zero crossings of the rectified 60 Hz. signal in substantially digital format. This would, of course, remain within the contemplation of this invention. The rectified 60 Hz. signal is, as noted above, used to synchronize the video frames with the advancement of the conveyor 41 through the synchronous motor drive 66. Thus, even if the line frequency deviates from 60 Hz., the video signals are still in synchronization with the conveyor, since the synchronous motor 66 is also affected commensurately by the frequency deviation.

SEQUENCE OF LINES OF INTEREST TRANSMITTED DURING A FRAME AND SEQUENCE OF CPU'S

From the foregoing it should be appreciated that the duration of any one frame is defined by the period between successive zero-crossings of the rectified 60 Hz. signal occurring approximately every 8.33 milliseconds. During each frame, the electron scanning beam traverses each of the ninety-six (N) scan lines defining the image of the viewed area 48 on the electrical image plane 104E on the photosensitive vidicon target. The beam is horizontally retraced ninety-five times between adjacent horizontal scan lines. The digital END OF FRAME signal (initiated at the end of the ninety-sixth horizontal scan) disables the oscillator 200 and begins a period during which the beam is displaced from the point on the target corresponding to the lower right hand corner of the viewed area (the diode 195) to the point corresponding to the upper left hand corner of the viewed area 48 (the diode 190). The beam is appropriately blanked during horizontal and vertical retracings. At the beginning of the next frame, the oscillator 200 is enabled and the scanning pattern is repeated.

The electronics is synchronized with the conveyor through the occurrence of the index pulse. The CPU's are initialized and accept meaningful data only if the index pulse occurs within a predetermined time interval. This time interval is less than or equal to the time of one revolution of the main drive sprocket 62 (FIG. 1A). If the index pulse occurs after the beam has scanned the first eight lines of the viewed area, the occurrence of the next frame begins the electronic operations.

During any given frame, after an initialization period discussed herein has occurred, four viewing zones are encompassed within the scanned area 50. The images of each of the viewing zones and of the articles contained therein occupy different portions of the electrical image plane within the scanned area 50. Video signals representative of each viewing zone and the portion of each article therein are thus generated when the electron beam scans across different horizontal scan lines. As each viewing zone is translated through the viewed area, on successive frames each viewing zone occupies a successive horizontal scan line within the scanned area 50 of the electrical image plane.

In accordance with this invention, the information regarding the portion of each article in a given viewing zone is tabulated and stored in a portion of the memory (database) of one of the CPU's assigned to that viewing zone. Information regarding the portion of each article within that viewing zone is transmitted to the appropriate CPU, where it is stored in a "file" generated for each article. As the viewing zone moves from the scanned zone, a decision regarding the acceptability of each article therein is generated and transmitted to the delay circuit 183.

It is believed that once an understanding is obtained as to which scan line in any given frame contains the video signal regarding the articles in a given viewing zone, the electrical circuitry used to monitor the progress of each viewing zone and to transmit data regarding the articles in that viewing zone to the appropriate CPU is more readily understood.

Figure 16A:
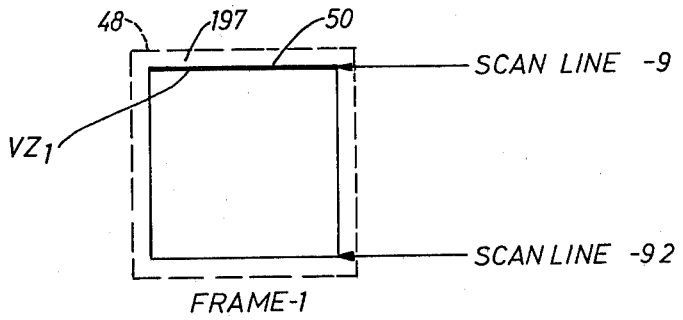
FIGS. 16A through 16J are stylized pictorial representations of the progression of viewing zones through a scanned area and the interrelationship between a viewing zone and the assignment of a processing unit thereto.

Assume, therefore, that at the occurrence of the index pulse the first viewing zone under consideration, $VZ_1$, has just entered the scanned area 50 within the viewed area 48 and occupies that portion of the electrical image plane scanned during the ninth horizontal scan (scan line-9). The information generated when $VZ_1$ occupied scan lines 1-8 is disregarded since it lies in the buffer region 197 and is susceptible to variations due to the "blooming" effect. Information regarding the articles in viewing zone $VZ_1$ is desired to be compiled and stored in the CPU-1. This situation is illustrated in FIG. 16A. No other viewing zones have yet entered the scanned area.

Figure 16B:
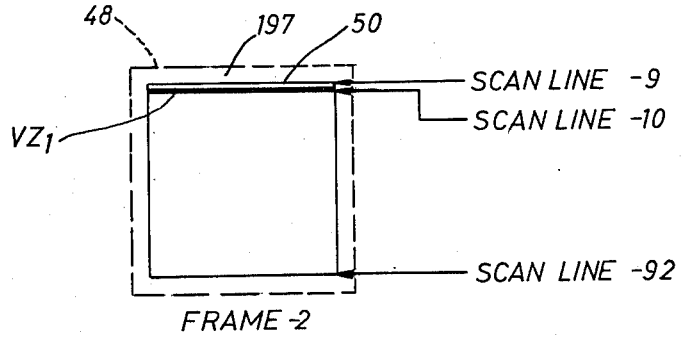

During the next frame, 8.33 milliseconds later, the viewing zone $VZ_1$ has translated one-eighth of an inch. The image of the viewing zone $VZ_1$ now appears on that portion of the scanned area 50 on the electrical image plane corresponding to scan line-10. The information regarding the articles in $VZ_1$ is to be transmitted to CPU-1 for compilation and storage. This situation is depicted in FIG. 16B. As yet, no other viewing zone lies within the scanned area.

Figure 16C:
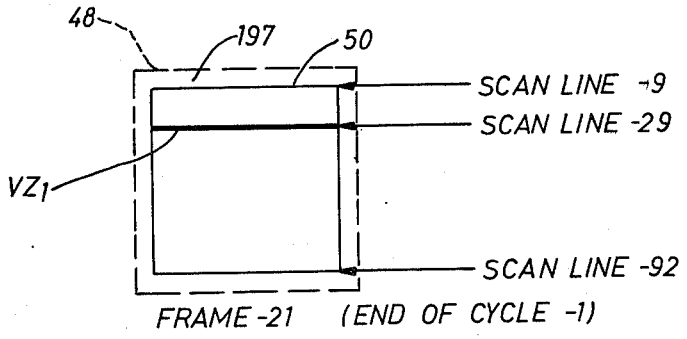

For the first twenty-one frames (after entering the scanned area 50), $VZ_1$ is the only viewing zone within the scanned area. The image thereof appears on successive scan lines during each frame, beginning with scan line-9 during the first frame, continuing with scan line-10 during the second frame, scan line-11 during the third frame and continuing thus. At the time of the twenty-first frame, $VZ_1$ occupies scan line-29 on the electrical image plane. The situation is that depicted in FIG. 16C. No other viewing zone has entered the scanned area, and all information regarding the articles in the viewing zone $VZ_1$ is transmitted to CPU-1.

Figure 16D:
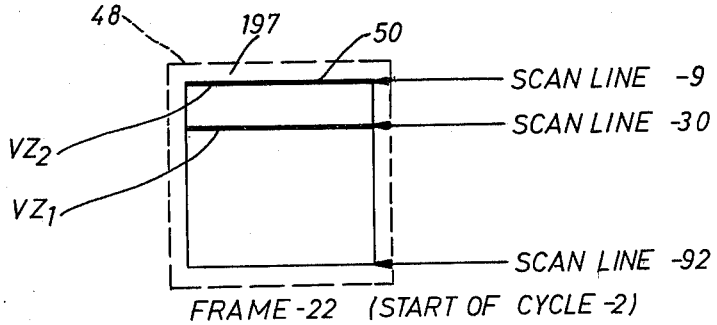

When the twenty-second frame begins, as seen in FIG. 16D, the viewing zone $VZ_1$ occupies the portion of the scanned area 50 on the electrical image plane swept during scan line-30. However, the second viewing zone, $VZ_2$, has now entered the scanned area 50 and its image occupies that portion thereof on the electrical image plane corresponding to scan line-9. Information concerning the articles in $VZ_2$ is to be compiled and stored in CPU-2. However, the information regarding the articles in the viewing zone $VZ_1$ (on scan line-30) is still to be transmitted to CPU-1. Thus, during the twenty-second frame, information from scan line-9 is transmitted to CPU-2, and information from scan line-30 is transmitted to CPU-1.

Figure 16E:
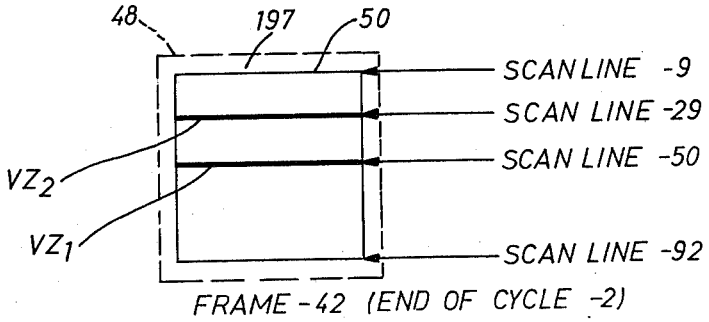

During successive frames, viewing zones $VZ_1$ and $VZ_2$ translate through the scanned area and occupy successive lines of the scanned area 50 on the electrical image plane. At the forty-second frame, as seen in FIG. 16E, $VZ_1$ occupies scan line-50 and $VZ_2$ occupies scan line-29.

Figure 16F:
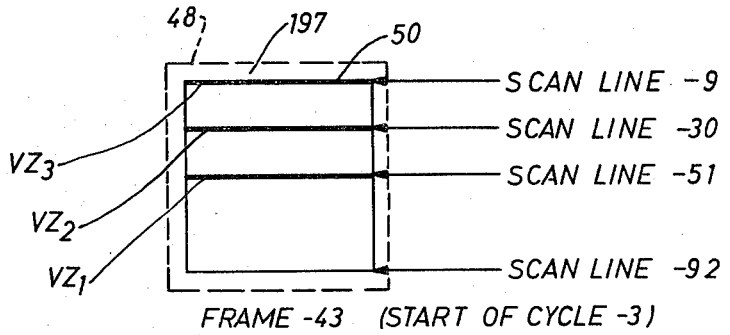

At the beginning of the forty-third frame, the viewing zone $VZ_3$ has entered the scanned area 50 and occupies scan line-9. Viewing zones $VZ_1$ and $VZ_2$ respectively occupy scan line-51 and scan line-30 as shown in FIG. 16F. The information from scan line-51 ($VZ_1$) and scan line-30 ($VZ_2$) is transmitted to CPU-1 and CPU-2, respectively. Information regarding articles in the viewing zone $VZ_3$ on scan line-9 is transmitted to CPU-3. Thus, during the forty-third frame, information from scan line-9 is transmitted to CPU-3, information from scan line-30 is transmitted to CPU-2, and information from scan line-51 is transmitted to CPU-1.

Figure 16G:
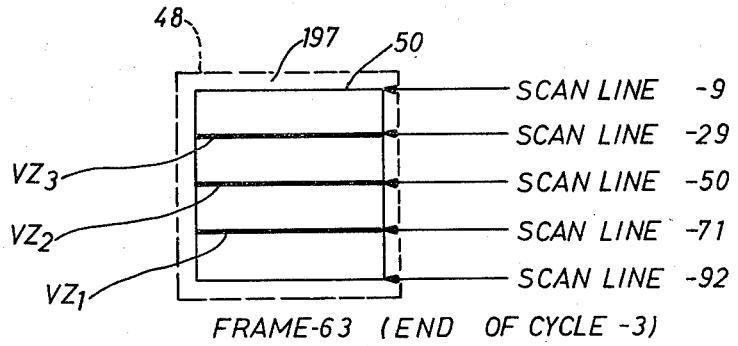

As further frames are taken, viewing zones $VZ_1$, $VZ_2$ and $VZ_3$ translate through the viewed area, successively occupying successive scan lines of the electrical image plane. At the occurrence of the sixty-third scan, as seen in FIG. 16G, $VZ_3$ occupies scan line-29, $VZ_2$ occupies scan line-50, and $VZ_1$ occupies scan line-71, with the information content derived during each of these scan lines being respectively transmitted to CPU-3, CPU-2, and CPU-1.

Figure 16H:
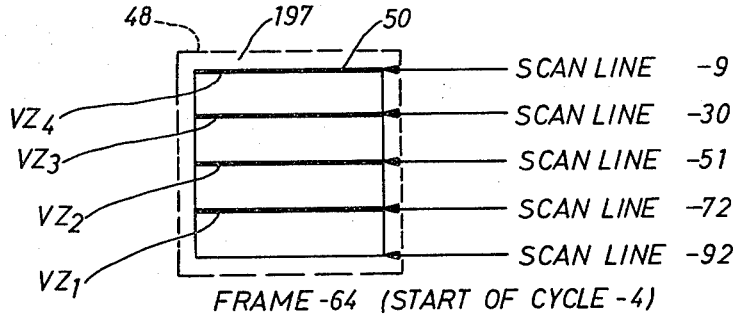

With the onset of the sixty-fourth frame, as seen in FIG. 16H, the fourth viewing zone $VZ_4$ enters the scanned area and occupies scan line-9. Simultaneously, the viewing zone $VZ_3$ is on scan line-30, the viewing zone $VZ_2$ is on scan line-51, and the viewing zone $VZ_1$ occupies scan line-72. During the sixty-fourth frame, information concerning the articles in the viewing zone $VZ_4$ is transmitted to CPU-4. Information from scan line-30 (corresponding to $VZ_3$), from scan line-51 (corresponding to $VZ_2$), and from scan line-72 (corresponding to $VZ_1$) is transmitted to CPU-3, CPU-2 and CPU-1, respectively.

Figure 16I:
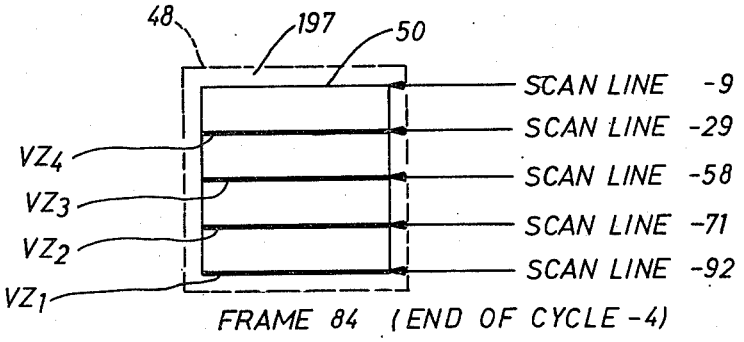

Continued translation of the conveyor ultimately results in the situation that during the eighty-fourth frame $VZ_4$ occupies scan line-29, $VZ_3$ occupies scan line-50, $VZ_2$ occupies scan line-71, and $VZ_1$ occupies can line-92 (FIG. 16I). The information from each scan line is respectively transmitted to CPU-4, CPU-3, CPU-2 and CPU-1.

At the end of the eighty-fourth frame, $VZ_1$ leaves the scanned area. However, the fifth viewing zone VZ-5, is about to enter the scanned area. Therefore, at the end of scan line -92 of the eighty-fourth frame, a classification decision as to the acceptability of articles in $VZ_1$, based on information processed, tabulated, compiled and stored by CPU-1, is output to the delay circuit 183. These decisions, in the form of article-reject signals, are delayed by the delay circuit 183 for a delay time $T_D$ (FIG. 26) until the articles carried in $VZ_1$ reach the ejection zone 88 (FIG. 1A). At substantially that time the delay 183 outputs article-eject signals to the appropriate ones of the ejector drivers and the arms 84A of the ejector elements 84 are presented into the ejection zone 88 to divert those articles classified as unacceptable from the article stream. The now-unoccupied CPU-1 may be used (i.e., is "steered") to monitor the progress and compile information regarding the articles in $VZ_5$.

Figure 16J:
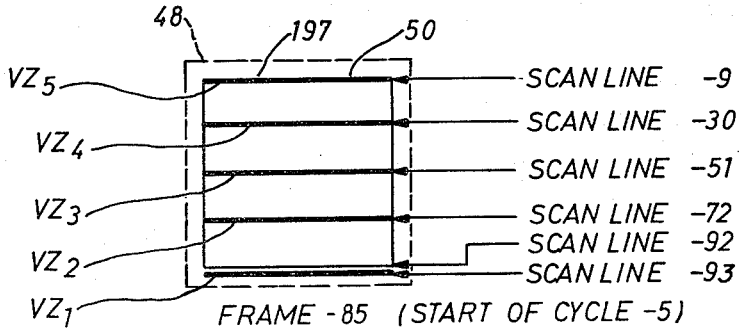

At the start of the eighty-fifth frame as seen in FIG. 16J, $VZ_5$ occupies scan line-9, $VZ_4$ occupies scan line-30, $VZ_3$ occupies scan line-51, and $VZ_2$ occupies scan line-72. Information regarding the articles in $VZ_5$ is transmitted to CPU-1. Information regarding $VZ_4$ (scan line-30), $VZ_3$ (scan line-51) and $VZ_2$ (scan line-72) continues to be transmitted to CPU-4, CPU-3 and CPU-2, respectively.

A pattern has thus emerged. Hereafter, during any one frame, four of the horizontal scan lines contain information which is of particular interest. The information on these "lines of interest" is to be transmitted to the appropriate one of the CPU's. Moreover, the sequence of the lines of interest to be transmitted repeats, or "cycles," every twenty-one frames. Alternatively stated, the sequence repeats after every eighty-four transmissions (or attempts at transmission) of data to the CPU's.

From the foregoing observations, it should be appreciated that circuitry may be utilized which, during each frame of the "cycle", selects the appropriate lines of interest from that frame and transmits the information regarding the appropriate line of interest to the appropriate CPU. The sequence of lines of interest and sequence of CPU's to which the lines of interest are transmitted are set forth in the tables shown in FIGS. 17 and 18.

From the table in FIG. 17 it may be seen that in the first frame of any one cycle (after cycle-3), the lines of interest to be transmitted to the CPU's are scan lines −9, −30, −51 and −72. In the second frame of that cycle, scan lines −10, −31, −52, and −73 constitute the lines of interest and are to be transmitted to the CPU's. Continuing accordingly, during the twenty-first frame in any cycle, the lines of interest are scan lines −29, −50, −71, and −92. During the first three cycles (immediately after the initialization sequence), the transmission of information to certain CPU's is inhibited simply because lines of interest to be assigned to those CPU's are not yet within the scanned area 50 (see FIGS. 16A–16G). The manner in which transmission of information to these CPU's is discussed herein.

Figures 18, 24:
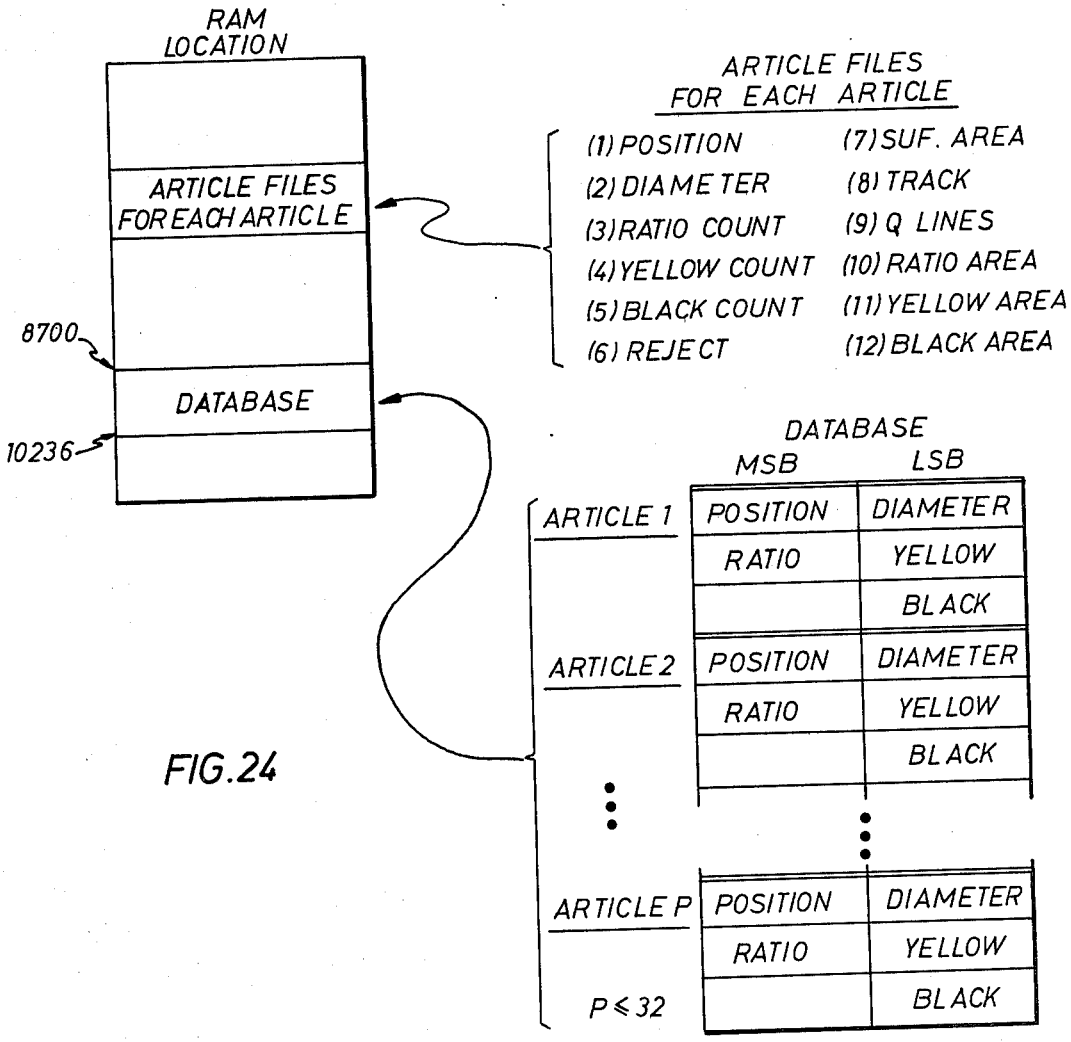
FIG. 24 is a RAM map for the processing unit shown in FIG. 22.

The sequence of the CPU's to which the lines of interest in each frame are transmitted is apparent from the table in FIG. 18. Starting with the Fourth Cycle, the lines of interest in any frame are transmitted to the CPU's in descending numerical order. At the end of that cycle, the CPU's are re-ordered by counting down one digit (in base 4) and adding "1" to that number. The result defines the number of the CPU to which the first line of interest is transmitted during the first frame of the next cycle. Thereafter, during that cycle, the CPU's receive data in descending order.

For example, during the Fifth Cycle (FIG. 18), the order in which the CPU's receive data is "1-4-3-2". This is recognized as descending numerical order in base 4 (where 4 corresponds to the number m of processing units). At the end of the twenty-first frame in that cycle, the number of the last CPU to which data was transmitted is "2". This number is counted down in base 4 to "1". To that digit so produced, (a "1") a "1" is added (producing "2"). Thus, "2" becomes the number of the first CPU to which data is transmitted during each frame of the Sixth Cycle. Thus, during each frame in the Sixth Cycle, the lines of interest in each frame are transmitted to CPU's in the descending order (in base 4) "2-1-4-3".

Due to the staggered manner in which viewing zones enter the viewed area (FIGS. 16A–16G), lines of interest are only transmitted to CPU-1 during the First Cycle, to CPU-2 and CPU-1 in the Second Cycle, and to CPU-3, to CPU-2 and to CPU-1 during the Third Cycle. As is explained herein, the inhibition of transmission to selected CPU's during the first three cycles follows from the lingering effects of the signal SINIT.

The generation of the sequence in which lines of interest are selected for transmission to the selected CPU may be generalized. If the scanned area is sized to accommodate a maximum number m viewing zones during any one time frame, and if there are k lines on the electrical image plane between the electrical images of each of the viewing zones within the scanned area, the lines on the electrical image plane selected for transmission to a processing unit during any time frame in a cycle containing k frames are selected in accordance with the numerical values of the elements E of an m by k matrix. The numerical value of the elements E in the matrix is defined in accordance with the relationship $$E_{x,y}=[i+(x-1)k]+(y-1)$$

where x=1, 2 . . . m, y=1, 2 . . . k i=the numerical value of the line on the electrical image plane corresponding to the initial line of the electrical image of the scanned area.

For the particular preferred embodiment of the invention here discussed, m=4, k=21 and i=9. The matrix shown in FIG. 17, derived empirically above, follows the generalized relationship.

THE DMA HOLD SEQUENCE

In accordance with this invention, during any frame, the appropriate CPU to which data from a line of interest is to be transmitted is provided with a HOLD signal prior to the horizontal scan of that line of interest by the electron scanning beam. In response to the HOLD signal, the CPU to which the HOLD is addressed responds by surrendering its address and data lines to the DMA circuit 181 so that any video information regarding the portion of the articles within the viewing zone occupying that scan line of interest may be transmitted thereto. Thereafter, in accordance with a stored sequence of instructions, the CPU processes the information regarding each article within the viewing zone, ultimately generating a classification decision as to the acceptability or unacceptability of each article within the viewing zone.

Figure 19:
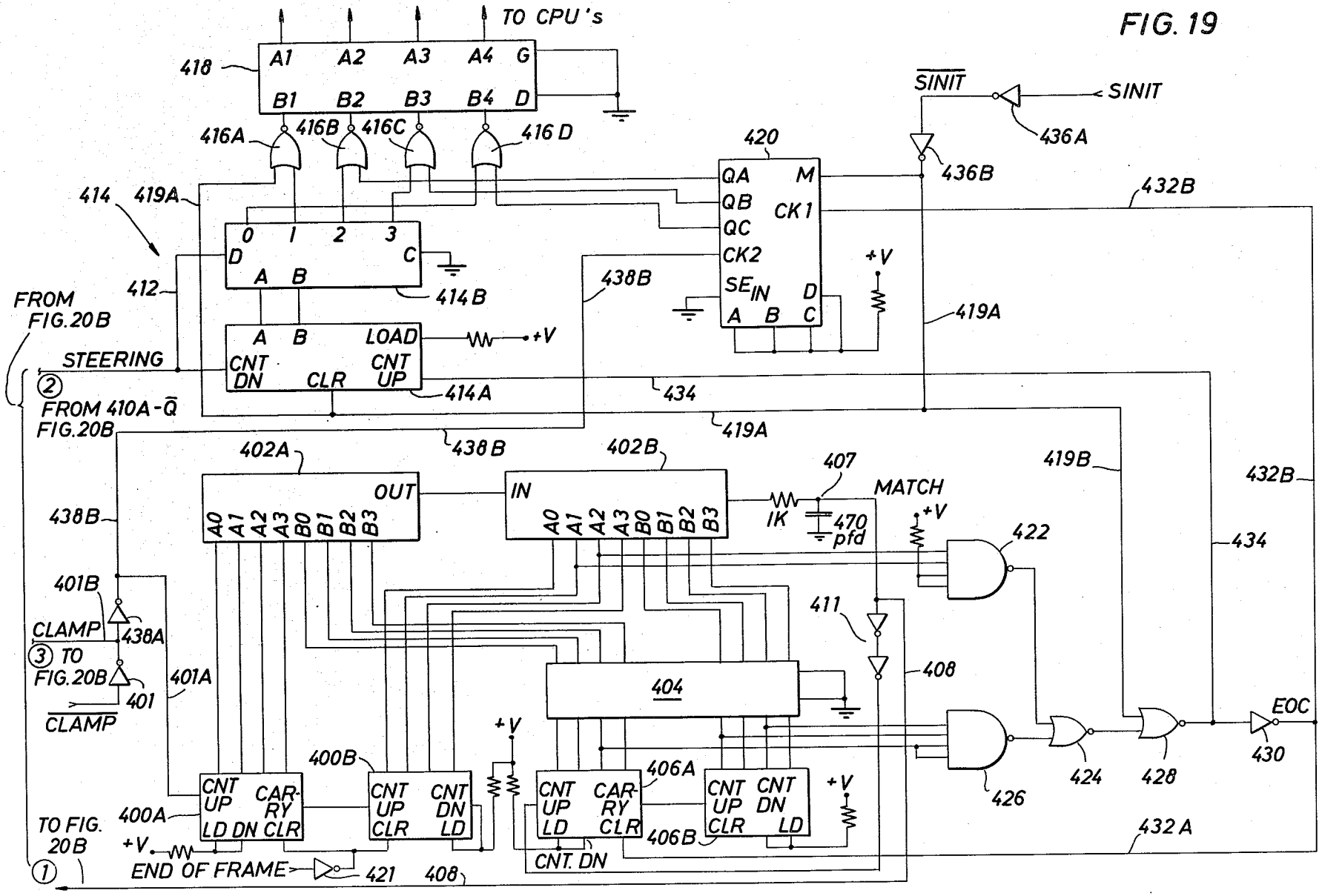
FIG. 19 is a schematic diagram of the portion of the DMA circuit used to generate HOLD signals to the processing units in a roll sorting apparatus in accordance with the invention.

With reference to FIG. 19, the portion of the DMA circuit 181 which generates a HOLD signal to the appropriate CPU prior to the transmission of data on a line of interest is shown.

A counter arrangement 400 includes cascaded counters 400A and 400B which are incremented in response to the CLAMP signal output from an invertor 401 on a line 401A. Suitable counters 400 are those manufactured by Texas Instruments and sold under model number 74LS193. The output of the counter 400 is applied to the "A" inputs of a digital comparator arrangement 402 which includes comparators 402A and 402B, such as those manufactured and sold by Texas Instruments under model number 74LS85.

The "B" inputs of the digital comparators 402 are derived from a read-only memory 404 such as that sold by Texas Instruments under model number 74S471. The memory 404 is addressed in accordance with the output of a counter 406. The counter 406 sequentially addresses the memory 404 such that the number of the next line of interest to be transmitted to the CPU's is input to the "B" side of the comparators 402. For example, the first output from the counter 406 addresses a location in the memory 404 at which is stored the identity of the first line of interest in a cycle, i.e, the scan line-9. The second output of the counter 406 addresses a location in the memory 404 that holds the identity of the second line of interest (i.e., scan line-30). This value is transmitted to the comparator 402. This operation proceeds for each of the eighty-four transmissions occurring in any cycle in accordance with the table in FIG. 17.

When the next line to be scanned by the electron beam (as identified by the output of the counters 400) equals the next line of interest to be transmitted to the CPU's (as identified by the output of the memory 404), a MATCH signal is generated from the comparators 402 and applied through a filter 407 including a 1 Kohm resistor and a 470 pfd. capacitor by a line 408 to clock one flip-flop 410A of a pair of flip-flops 410. The MATCH signal also increments the counters 406 through inverters 411 to address a different location in the memory 404 corresponding to the identity of the next line of interest to be transmitted during the cycle.

A suitable device for use as the flip-flop 410 is that manufactured by Texas Instruments and sold under model number 74LS74. The output signal STEERING from the flip-flop 410 (FIG. 20B), derived from the $\overline{Q}$ terminal thereof, is applied over a line 412 to a steering arrangement 414 (FIG. 19). The steering arrangement 414 operates to maintain the sequence in which the CPU's are to receive data contained on the next line of interest to be transmitted. The steering arrangement 414 includes a counter 414A (identical to the counter 400A). The output of the counter 414A is applied to a four-to-ten level decoder 414B such as that sold by Texas Instruments under model number 74LS42. The STEERING signal is applied to the "D" input of the decoder 414B and when STEERING is in a logic-0 state following a MATCH condition, one of an array of gates 416A, 416B, 416C or 416D is enabled. The output of the enabled gate 416 drives a buffer 418.

The output of the buffer 418 is a HOLD signal applied to one of the CPU's selected in accordance with the input thereof. That CPU responds by surrendering its address and data lines to the DMA circuit 181 so that data regarding the line of interest may be transmitted thereto. A suitable buffer 418 is that manufactured by Texas Instruments under model number 74LS245.

Except during the first three cycles (sixty-three frames), the gates 416 are enabled by the presence of logic-0 signal at the Q outputs of a serial/parallel shift register 420 such as that sold by Texas Instruments under model number 74LS95B. The gate 416A is enabled by a logic-0 signal derived from the SINIT signal on a line 419A.

At the end of each frame, the counters 400A and 400B are cleared by the signal END OF FRAME applied through an inverter 421. The output of the counters 400 is applied through a NAND gate 422 to the "A" input of a NOR gate 424. The inputs to the gate 422 are selected such that the "A" input to the gate 424 changes state to a logic-0 condition for scan line-96 of each frame.

The "B" input to the gate 424 is derived from the output of a NAND gate 426. After the occurrence of the eighty-fourth MATCH condition in a cycle (four transmissions or MATCH conditions per frame multiplied by twenty-one frames), the output of the NAND gate 426 changes to a logic-0 state. This transition of the output of the NAND gate 426 generates a negative-to-positive transition at the "B" input of a NOR gate 428. With the "A" input to the gate 428 derived from the SINIT signal on a line 419B, and thus a logic-0, the gate 428 changes to a logic-0 condition. This signal is inverted by an inverter 430 and appears as a negative-to-positive transition marking the END OF CYCLE (EOC). The EOC signal is applied by a line 432A to clear the counters 406. The output of the counters revert to their first output (addressing a location in the memory 404 having the value identifying scan line-9 stored therein).

The change in the counter output causes the NAND gate 426 to revert to a logic-1 condition, thus changing the output state of the gate 428. The negative-to-positive transition of the output state of the gate 428 is applied over a line 434 to the count-up terminal of the counter 414A. At the end of the cycle, the output of the counter 414A is incremented on digit, as discussed above. Thus, the order in which the CPU's will be steered during the next cycle is altered in the desired manner (in accordance with the table in FIG. 18).

The output of the inverter 430 is also applied by a line 432B to the serial input clock terminal of the device 420. For cycles after the Third Cycle, the application of a negative-to-positive transition to the device 420 has no real effect, inasmuch as the Q outputs of the device 420 are a logic-0. However, during the first three cycles, the positive-to-negative transition applied to the serial clock of the device 420 is significant in eliminating the lingering effects of the SINIT signal. These effects are now discussed.

From observation of the table shown in FIG. 18, it is seen that during the First Cycle it is necessary to generate a HOLD condition directed to CPU-1. Since the viewing zones to be monitored by CPU-2, CPU-3 and CPU-4 have not, as yet, entered the scanned area 50 (FIGS. 16A and 16B), HOLD signals which would otherwise be generated and applied to CPU-2, CPU-3 and CPU-4 are inhibited from occurring. Similarly, in the Second Cycle, only HOLD signals directed to CPU-1 and CPU-2 are necessary. Signals to CPU-3 and CPU-4 are not necessary and are to be inhibited. During the Third Cycle, HOLD signals to CPU-1, CPU-2 and CPU-3 have meaning, while a HOLD signal to CPU-4 is inhibited since the viewing zone $VZ_4$ monitored by CPU-4 is not yet within the scanned area. Of course, thereafter normal operation of the HOLD sequence, as discussed above, may occur.

To permit the desired inhibition of HOLD signals to occur, the circuitry shown in FIG. 19 operates in the following manner. At the occurrence of the SINIT signal, the mode select terminal of the device 420 is asserted through inverters 436A and 436B. The occurrence of the first CLAMP signal thereafter is applied through an inverter 438A and a line 438B to the parallel clock terminal of the device 420, and logic-1 signals present at the "A", "B" and "C" inputs are loaded into the Q outputs thereof. The appearance of a logic-1 signal at the Q outputs of the device 420 effectively disables the gates 416B, 416C and 416D. Thus, even if those gates were addressed by the decoder 414B, no output signal would occur.

During the First Cycle, each MATCH condition output would result in only generating a HOLD to CPU-1 through the gate 416A. During those MATCH conditions when the counter output 414A points to a CPU other than CPU-1, the gates 416B, 416C and 416D are not able to pass a pulse to the buffer 418 to generate a HOLD to those CPU's. Thus, although eighty-four MATCH conditions may occur during the First Cycle, only twenty-one of those MATCH conditions will result in a HOLD signal and in the transmission of data to a CPU.

At the end of the First Cycle, the END OF CYCLE (EOC) pulse applied on the line 432B clocks the serial clock of the device 420 and serially shifts the logic-0 from the serial input terminal to the output $Q_A$. The logic-1 condition from $Q_A$ is shifted serially to $Q_B$ while the logic-1 from $Q_B$ is shifted serially to the terminal $Q_C$. In this instance, gates 416A and 416B are enabled so that MATCH conditions for lines of interest which are to be transmitted to CPU-1 or CPU-2 will succeed in generating HOLD signals to those CPU's. The presence of the logic-1 signals at the terminals $Q_B$ and $Q_C$ of the device 420 inhibit the generation of HOLD signals to CPU-3 and CPU-4 through the gates 416C and 416D.

At the end of the Second Cycle, the EOC pulse serially shifts the logic-1 from the terminal $Q_B$ of the device 420 to the terminal $Q_C$. Thus, during the Third Cycle, only the gate 416D is inhibited. During the Third Cycle, HOLD conditions may be generated to CPU-1, CPU-2, and CPU-3 and information may be transmitted thereto.

Of course, after the Third Cycle, the EOC pulse serially shifts the logic-1 from the terminal $Q_C$ of the device 420. Thereafter, as discussed above, the gates 416 may be enabled in accordance with the output of the decoder 414B and the counter 414A to generate and apply HOLD signals to each CPU in accordance with the sequence of CPU's shown in the table of FIG. 18, so that the sequence of lines of interest as set forth in FIG. 17 may be transmitted.

DMA DATA SEQUENCE

Once the HOLD signal has been applied to the appropriate CPU in accordance with the DMA HOLD sequence discussed above, the selected CPU surrenders its address and data lines to the DMA circuit 181. The DMA circuit 181 accepts these lines, and in a manner now set forth, appropriately formats and provides data on the location, size and physical characteristics of the portion of each article within the viewing zone occupying the line of interest to the appropriately addressed locations in the memory of the selected CPU.

FIG. 20 is the portion of the DMA circuit 181 which is operative to format and transmit data derived from the beam sweep of a horizontal scan line of interest to the CPU selected by the portion of the DMA circuit shown in FIG. 19.

It is earlier noted that the duration of each digital signal WINDOW fell within the duration of each horizontal scan by the electron scanning beam. That is, 256 occurrences of STROBE occur during the sweep of the electron scanning beam over that portion of the electrical image plane corresponding to the 32-inch wide transverse dimension of the scanned area. Thus, during one STROBE pulse the electron beam moves across a portion of the electrical image plane a distance corresponding to a one-eighth inch transverse distance on the conveyor.

It may therefore be appreciated that monitoring the number of occurrences of STROBE may provide a basis for locating the location of an article within a viewing zone, for determining the size of that portion of the article lying within the viewing zone, and for generating an indication as to the number of one-eighth inch square portions of the surface of the article that exhibit an acceptable color reflectivity.

In the event that articles within the viewing zone are abutting one with the other, provision must be made for the transmission of the location, size and physical characteristic data for both articles. It should now be apparent that the peak detector arrangement 342 shown in FIG. 11 and the imposition of a separation in the ART. DET. signal to electrically separate abutting articles within the same viewing zone has particular utility in this regard.

A direct memory access device is typically construed as an apparatus operative to take information from a peripheral device and store it in some location in the memory of the computer with which it is associated. The computer releases its memory and data lines to the direct memory access device so that information from the peripheral may be sequentially loaded into some location in the computer memory. The device then releases the computer's lines at which time the processing unit operates on the data input thereto.

In this system, however, the direct memory access device provides an extended function inasmuch as it does not merely input information from the peripherals into the memories of the CPU's. The DMA circuit 181 in accordance with this invention provides a computing function in the sense that the information relating to the position, diameter and physical characteristics of the each article within a viewing zone is first computed by the DMA and this appropriately formatted information is parallel-loaded into the memory of the CPU.

With reference now to FIG. 20, the signal CLAMP present at the output of the inverter 401 on the line 401B (FIG. 19) is applied over lines 442A to the "B" input of a NOR gate 444. The negative-to-positive transition of the output of the gate 444 clears flip-flops 410A and 410B and sets the $\overline{Q}$ output of the flip-flop 410A to a logic-1 condition. This signal is applied over the line 412 to the steering arrangement 414. Simultaneously, however, the Q outputs of the flip-flops 410A and 410B go to a logic-0 condition. The Q output of the flip-flop 410B is applied over a line 448 to the "B" input of a NAND gate 450. The "A" input of the gate 450 is derived, through an inverter 452, from the STROBE signal generated by the synchronizing circuit 174. The presence of a logic-0 condition on the "B" input of the gate 450 disables that gate and prevents it from passing transitions of the inverted STROBE signal.

The $\overline{Q}$ output of the flip-flop 410A is also applied over a line 412B to the enable terminal of an address buffer 456. Since the buffer 456 needs a logic-0 signal to be enabled, the buffer 456 is disabled during that period of time that the signal on line 412B from the Q output of the flip-flop 410A is in a logic-1 state.

The CLAMP signal is applied over lines 442B and 442C to respectively clear address counters 458A and 458B, thus setting the outputs of those counters to their first position. The initial position of the counters 458 defines the first address location at which data transmitted to a CPU during a line of interest will be loaded into the memory of that CPU.

The CLAMP signal is also applied on a line 442D to clear an ART. DET. flip-flop 460A through the output of a NOR gate 462. This action sets the $\overline{Q}$ output of the flip-flop 460A to a logic-1 condition and places the complementary logic-0 signal at the Q output thereof.

Figure 20A:
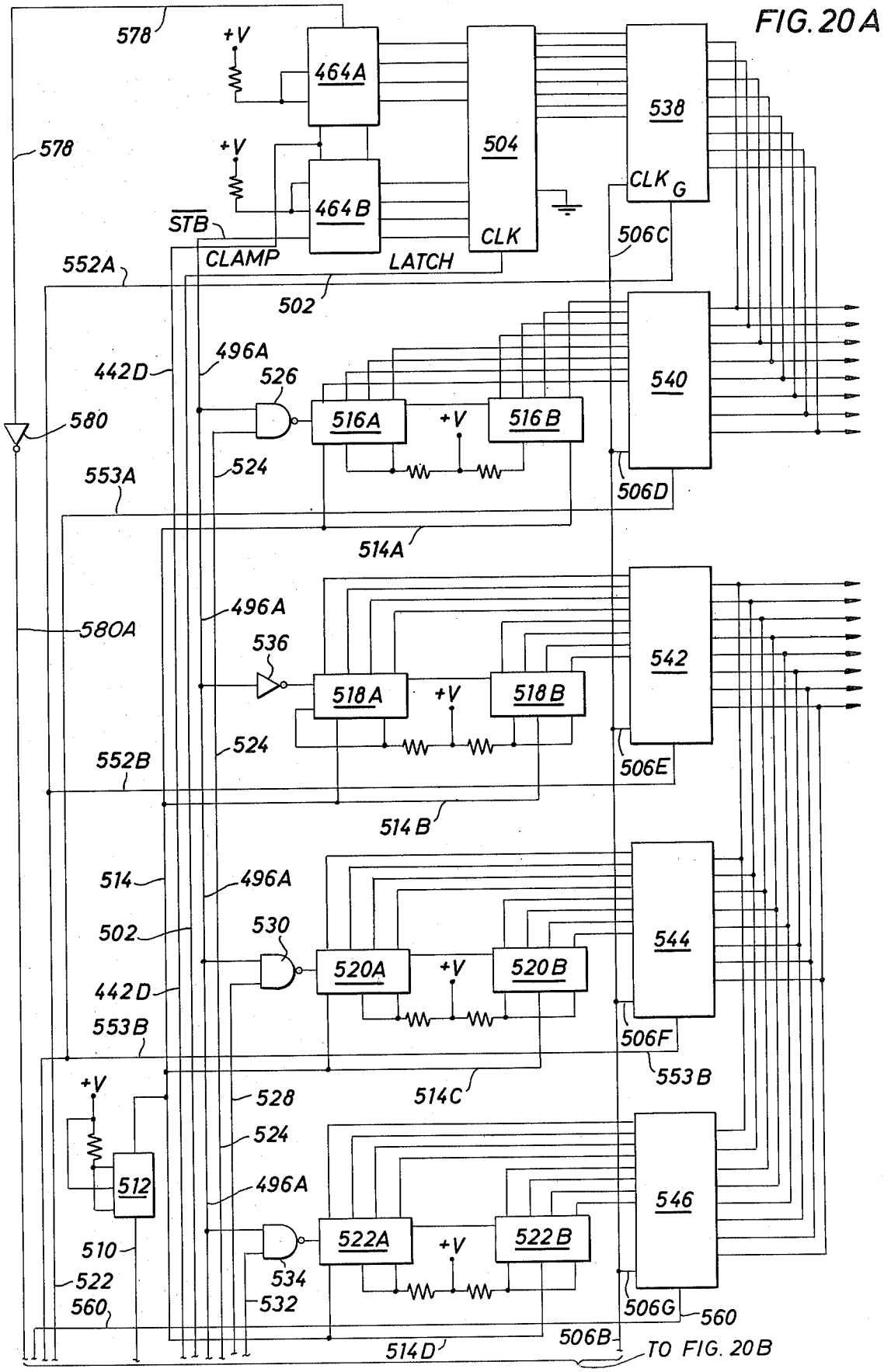
FIG. 20 is a schematic diagram of the portion of the DMA circuit used to transmit information to the processing units in a roll sorting apparatus in accordance with the invention.

The CLAMP signal applied over the line 442D also clears counters 464A and 464B (FIG. 20A). As will be seen herein, the counters 464 operate to generate a signal regarding the position of each article within the viewing zone corresponding to a given line of interest.

CLAMP is inverted by an inverter 466 and applied over a line 468A to clear a BLACK flip-flop 460B. The inverted CLAMP signal is also applied over a line 468B to clear a RATIO flip-flop 470A and a YELLOW flip-flop 470B.

The inverted CLAMP signal is applied over a line 468C to the $\overline{A}$ terminal of a one-shot 472. Suitable for use as the one-shot 472 is that device manufactured by Texas Instruments and sold under model number 74LS121. The application of the inverted CLAMP signal to the one-shot 472 triggers the $\overline{Q}$ output thereof and applies a signal over a line 474 to clear a toggle flip-flop 476A. As a result, the Q output of the flip-flop 476A goes to a logic-0 condition which is applied over a line 478 to preset another toggle flip-flop 476B. The Q output of the one-shot 472 is applied over a line 480 to clear a counter 482 and thus set the output of the counter 482 to a zero state. The output of the counter 482 is applied to a decoder 484 such as that manufactured by Texas Instruments and sold under model number 74LS42.

The inverted CLAMP signal is also applied through a line 468E to preset a flip-flop 486. The $\overline{Q}$ output of the flip-flop 486 goes to a logic-0 condition while the Q output thereof is a logic-1.

Suitable for use as flip-flops 460, 470, 476, and 486 are those devices manufactured by Texas Instruments and sold under model number 74LS74.

When a MATCH condition is generated from the output of the comparators 402 and applied over the line 408 to the clock terminal of the flip-flop 410A, the Q output thereof goes to a logic-1 condition. This places a logic-1 at the data input of the flip-flop 410B. Simultaneously, the $\overline{Q}$ output of the flip-flop 410A applied over the line 412B enables the buffer 456. Suitable for use as a buffer 456 is that device manufactured by Texas Instruments and sold under model number 74LS245.

At the occurrence of the MATCH condition a HOLD is generated to the appropriate CPU and, as discussed in connection with the HOLD sequence, that CPU surrenders its data and address lines to the DMA circuit 181. The address and data lines of the appropriate CPU have thus been surrendered to the DMA, and the DMA is in readiness to prepare and transmit appropriately formatted data corresponding to the location, size and physical characteristics of each article within the viewing zone corresponding to the line of interest.

At the occurrence of the signal WINDOW, as inverted by an inverter 492, the flip-flop 410B is clocked and the logic-1 signal at the D input pin thereof appears at the Q output. This logic-1 signal is applied over the line 448 to enable the gate 450 to respond to the inverted STROBE signals applied at the "A" input thereof through the inverter 452.

Digitized data from the characteristic signal generator 179 is received by a transceiver-driver 494 operating in the receive mode and is applied to the data inputs of the RATIO flip-flop 470A, YELLOW flip-flop 470B, BLACK flip-flop 460B and ART. DET. flip-flop 460A. (Note again that YELLOW and BLACK characteristics are not utilized in the preferred embodiment, but are discussed only to impart an understanding of the capability of the apparatus to utilize more than one characteristic signal). The inverted STROBE signals gated through the gate 450 are again inverted by an inverter 496 and applied to the clocks of each of the flip-flops 460 and 470. The transition of the clock inputs enable the video signals present at the data inputs of those flip-flops to be sampled by the DMA circuit 181.

The inverted STROBE signal is applied by a line 496A and clocks the position counters 464 (FIG. 20A). Thus, the counters 464 are incremented at each negative-to-positive transition of the inverted STROBE signal. The counters 464 are incremented at the negative-to-positive transition of the inverted STROBE signal whether or not an article is detected on the infrared output channel.

The manner in which a signal representative of a location of an article within the viewing zone is generated may be understood with reference to the timing diagram of FIG. 21 taken in connection with the schematic diagram FIG. 20.

Assume that an article is precisely three inches from the left hand boundary of the scanned area. On the electrical image plane the image of that article appears at a location on the appropriate scan line and requires twenty-four STROBES before encountered by the sweeping electron beam. Thus, for the first twenty-four occurrences of STROBE, the ART. DET. signal applied to the flip-flop 460A is a logic-0. Thus, at the occurrence of each negative-to-positive transition applied to the clock terminal, the flip-flop 460A samples a logic-0 on the data input thereof. The counters 464 are incremented one count for each negative-to-positive transition of the inverted STROBE signal applied thereto over the line 496A. The counters are arranged to increment at the negative-to-positive transition of the inverted STROBE signals so that the counters are stable when the ART. DET. flip-flop 460A is sampled at the next occurrence of STROBE.

When an article is detected the ART. DET. signal goes to logic-1. The next STROBE signal clocks the now-true ART. DET. signal at the data input of the flip-flop 460A. As a result, the $\overline{Q}$ output of the ART. DET. flip-flop 460A (which was set at a logic-1 at the occurrence of CLAMP) goes to a logic-0 condition. Simultaneously, the Q output of the ART. DET. flip-flop 460A (which was set a logic-0 condition at CLAMP time) changes state to a logic-1 to generate a signal termed LATCH. LATCH is applied over a line 502 to a buffer 504 (FIG. 20A) such as that sold by Texas Instruments under model number 74LS374. The position count present at the output of the counters 464 (corresponding to a decimal "24") indicates that the article detected is located three inches from the left bumper. This position count is latched into the buffer 504. LATCH is also applied to the "A" input of a NOR-gate 503 on a line 502A.

At the occurrence of CLAMP the $\overline{Q}$ output of the ART. DET. flip-flop 460A is set to a logic-0. This signal termed STORE is applied over a line 506 and NANDed with the inverted STROBE signal on a line 496B at a NAND-gate 508. So long as the STORE signal is in a logic-1 condition (that is no article is detected), the next negative-to-positive transition of the inverted STROBE signal generates an output from the gate 508 on a line 510. Each positive-to-negative transition of the output of the gate 508 on the line 510 generates a twenty nanosecond pulse from a one-shot 512 (FIG. 20A), such as that manufactured by Texas Instruments and sold under model number 74121. The output of the one-shot 512 is applied over lines 514A, 514B, 514C, and 514D to respectively clear a RATIO counter arrangement 516, a DIAMETER counter arrangement 518, a YELLOW counter arrangement 520, and a BLACK counter arrangement 522. Suitable for use as these lastmentioned counters as well as the counters 458, 464, and 482 are devices manufactured by Texas Instruments and sold under model number 74LS193.

When STORE goes to a logic-0 state representative of an article being detected by the ART. DET. output, the oneshot 512 is inhibited due to the disabling of the NAND-gate 508.

During the time that an article is detected data is applied to the respective flip-flops 470A, 470B and 460B representative of the RATIO signal, the YELLOW signal and the BLACK signal provided from the characteristic signal generator 179. The inputs presented at the data terminals of these flip-flops are sampled by a negative-to-positive transition of STROBE applied to the clock terminals thereof. The data is allowed to stabilize at the Q outputs of the flip-flops. The Q output of the RATIO flip-flop 470A (FIG. 20B) is applied over a line 524 to the "B" input of a gate 526 (FIG. 20A). The Q output of the YELLOW flip-flop 470B is applied over a line 528 to the "B" input of a gate 530. Similarly, Q output of the BLACK flip-flop 460B is applied over a line 532 to the "B" input of a gate 534. The data stabilizes at these gates, and at the next negative-to-positive transition of the inverted STROBE signal (occurring approximately 125 nanoseconds after the corresponding transition of the STROBE signal), the state of the gates 526, 530 and 534 (each if appropriate) moves to a logic-0 condition. This transition increments each of the counters 516, 520 and 522. As long as the signal on the appropriate input of the gates 526, 530 and 534 remains true, the associated counter is incremented at the next negative-to-positive transition of the inverted STROBE signal. If one of the characteristic signals (RATIO, YELLOW or BLACK) falls off, as long as an article still is detected the counter will not be cleared due to the action of the gate 508. Conversely, the appropriate counter will not be incremented either.

The DIAMETER counters 518 may be incremented without the need for a logic gate. Once the counter 518 is cleared over the line 514B indicative of an article being detected, each negative-to-positive transition of the inverted STROBE signal increments the DIAMETER counters 518 through an inverter 536. In this manner it may be appreciated that signals representative of the location, size (diameter) and physical characteristics (RATIO, YELLOW and BLACK) may be generated.

When the ART. DET. signal falls off an article, a positive-to-negative transition of the signal occurs. At the next negative-to-positive transition of the STROBE pulse, that absence of signal (a logic-0 at the data input of the ART. DET. flip-flop 460A) is clocked into the flip-flop 460A. At that point, the Q output (LATCH) changes to a logic-0 state and STORE becomes a logic-1. The negative-to-positive transition of STORE is applied to buffers 538 (POSITION), 540 (RATIO), 542 (DIAMETER), 544 (YELLOW), and 546 (BLACK)

through lines 506C, 506D, 506E, 506F, and 506G (all branching from a line 506B). The data respectively relating to the article's position, RATIO, diameter, YELLOW, and BLACK characteristics stored in the latch 504 and in the counters 516, 518, 520 and 522 are thus loaded into the respective buffers.

When STORE returns to a logic-1 state, the next negative-to-positive transition of the inverted STROBE signal generates an output from the one-shot 512 applied over the lines 514 to clear the counters 516, 518, 520 and 522.

It may thus be seen that if the ART. DET. signal falls off an article or, as is described in connection with the peak detector circuitry in connection with FIG. 11, is forced to go to a logic-0 state due to the next-abutment of articles, the ART. DET. signal moves to a logic-0 condition for a minimum of 250 nanoseconds. This insures that a negative-to-positive transition of STROBE will occur to store the data in the buffers and that a negative-to-positive transition of inverted STROBE will clear the counters to ready the system to compile data on the next article.

Figure 20B:
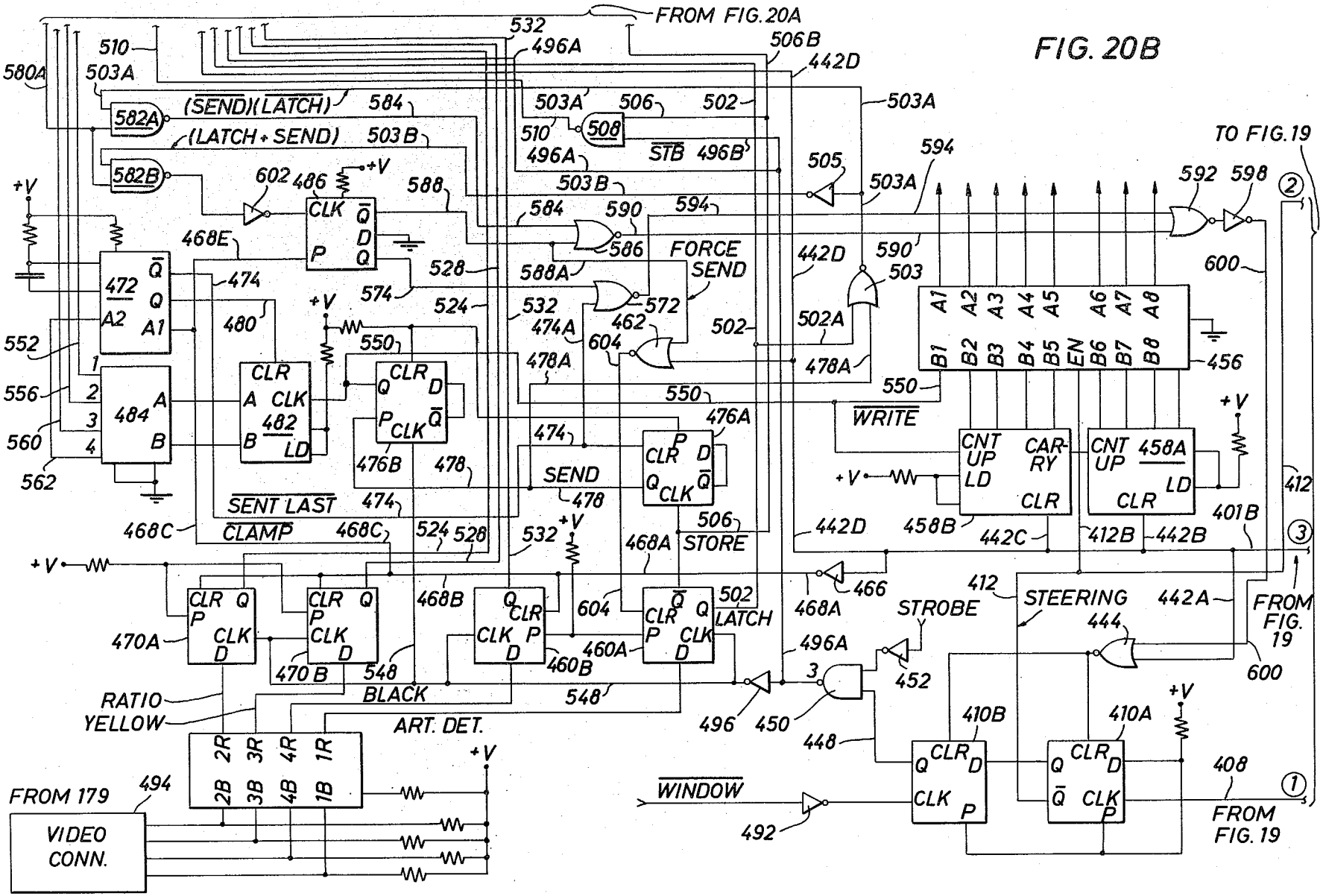

With the data in the output buffers 538 through 546, the information regarding that first article is in a condition to be transmitted to the appropriate CPU. The negative-to-positive transition of STORE clocks the flip-flop 476A (FIG. 20B). Thus, the Q output thereof on the line 478 (termed SEND) goes to a logic-1 state. SEND is also transmitted on a line 478A to the "B" input of the gate 503. It will be recalled that the Q output of the flip-flop 476A is initially set low by the $\overline{Q}$ of the flip-flop 410B at CLAMP time. While the signal on the line 478 (SEND) is a logic-0, the preset input terminal to the flip-flop 476B is held in a logic-0 state and correspondingly, the Q output of the flip-flop 476B is in a logic-1 state.

The transition of the SEND signal from a logic-0 to a logic-1 removes the preset condition of the flip-flop 476B. The Q output thereof (which is a logic-1) is now released. At the next clock to the flip-flop 476B (as provided by the output of the gate 496 over a line 548) the Q output of the flip-flop 476B changes states. Since the flip-flop 476B is set in a toggle mode, at each other successive negative-to-positive transition of STROBE the output of the flip-flop 476B applied over a line 550 to the buffer 456 generates a WRITE pulse. The Q output of the flip-flop 476B is also applied to the clock terminal of the counter 482. The counter 482 when cleared by the one-shot 472 during inverted CLAMP time is set to a zero count. The decoder 484 decodes that zero count and the logic-0 signal at output pin-1 is applied over a line 552 and lines 552A and 552B respectively to enable the buffers 538 and 542 (FIG. 20A).

The information present at the output of the buffers 538 (POSITION) and 542 (DIAMETER) is written into the addressed location of the CPU at the first negative-to-positive transition of STROBE occurring after the SEND signal goes to a logic-1 condition.

Thus, at the next-following negative-to-positive transition of STROBE, the WRITE pulse is again generated and applied over the line 550 to the buffer 456. At this occurrence, the RATIO and YELLOW information latched into the buffers 540 and 544 (by the lines 553A and 553B, respectively) is written into the memory of the appropriate CPU. The next negative-to-positive transition of STROBE terminates the second WRITE pulse, increments the address, changes the counter 482 and enables the decoder 484 to output a signal on the line 560 to enable the buffer 546. Thus, the BLACK information contained in the buffer 546 is written into the memory of the appropriate CPU.

It should be appreciated that during the first WRITE pulse, sixteen bits of information are output on the data lines to the CPU and loaded into the addressed memory location, with the POSITION information from the buffer 538 occupying the eight most-significant-bits while the DIAMETER information from the counter 542 occupies the eight least significant bits. During the second WRITE pulse, the appropriate address in the CPU memory is loaded with the RATIO information present in the buffer 540 and occupying the eight most-significant-bits of data transmitted, while the YELLOW information in the buffer 544 occupies the eight least-significant-bits.

During the third WRITE pulse, the BLACK information in the buffer 546 is carried on the lines corresponding to the eight least-significant-bits. It should be realized, of course, that during the third WRITE pulse any information may be provided in the eight most-significant-bit lines. It is possible, for example, to generate signal information representative of the line being transmitted so as to provide a double-check on the system to insure that the line of data transmitted to the CPU is the horizontal scan line of interest that the CPU is to receive.

After the final WRITE pulse at the next negative-to-positive transmission of STROBE the address counters 458 are again incremented. In addition, the counter 482 is incremented and the decoder 484 outputs a signal on a line 562 to the A2 pin of the one-shot 472. Suitable for use as the one-shot 472 is a device manufactured by Texas Instruments and sold under model 74LS121. The Q output of the one-shot 472 clears the counter 482 over the line 480. Simultaneously, the Q output of the one-shot 472 provides a signal (SENT-LAST) on the line 474 to clear the flip-flop 476A and terminate the SEND signal.

The SENT-LAST signal is applied over a line 474A to the "B" input of a NOR gate 572. The "A" input of the gate 572 is derived from the Q output of the flip-flop 486. The appearance of the SENT-LAST signal at the gate 572 does not generate an output therefrom. Since the inverted CLAMP signal applied to the one-shot 472 to the A1 input thereof is also applied to the preset terminal of the flip-flop 486 on the line 468E, the Q output of the flip-flop 486, applied over a line 574 to the "A" input of the gate 572, remains a logic-1. Thus, despite the transitions of the signal on the line 574 the output of the gate 572 remains in a logic-0 condition. The Q output of the flip-flop 486 on the line 574 inhibits the passage of pulses through the gate 572.

In an analogous manner information regarding the position, size and physical characteristics of other articles contained within the viewing zone is transmitted to the appropriate memory locations in the CPU.

It should also be noted that during the time that the transmission of the information regarding the first article occurred (that is, the time when SEND is in a logic-1 state), the counters and associated circuitry may be acquiring and formatting information regarding the second article in the viewing zone. From an examination of the timing diagram of FIG. 21 it is apparent that the DMA circuit 181 requires the occurrence of six negative-to-positive transitions of the STROBE signal in order to transmit the data concerning the first article.

This timing requirement imposes a physical limitation on the system to the effect that in order to successfully transmit data regarding two abutting articles, the second article encountered during a horizontal scan must exhibit a diameter of at least three-fourths of an inch (the distance necessary to permit STROBE to repeat six times). This is the only condition in which a limitation on article size constrains the system.

For example, if an article less than three-fourths of an inch in diameter is encountered in isolation, that is, without next abutment to another article, the apparatus will successfully detect, compile and transmit information regarding that article. Likewise, if the article exhibiting the diameter less than three-fourths of an inch is in next abutment with a second article greater than three-fourths of an inch data concerning both articles (as a result of the forced separation therebetween) may be successfully transmitted to the CPU's. It is only in the instance that the article exhibiting the diameter less than three-fourths of an inch follows a first article that the system becomes constrained.

At the end of the WINDOW signal, indicating that the electron scanning beam has reached the end of a horizontal scan line, either of three conditions may occur. First, no article may be then present in that portion of the scan line of the electrical image plane. Alternatively, the ART. DET. output signal may remain in a logic-1 state indicating that an article remains at the end of the WINDOW. (This may occur for example, by the presence of an overhang or the like on the article.) The third condition is that all the information concerning the last article has not been transferred to the appropriate CPU, as indicated by the SEND signal having a logic-1 condition at the end of WINDOW.

In the first instance, the electronics straightforwardly terminates operation of the DMA circuit 181 in anticipation of the transmission of the next line of interest. In the second and third instances, however, a FORCE SEND is generated which has the same effect.

Turning to the first possibility, at the beginning of the 256th STROBE, indicating that the 256th one-eighth inch sample is being taken, the output of the counters 464 (which count on the negative-to-positive transition of the inverted STROBE signal) generate a logic-0 signal on the line 578 (FIG. 20A). This signal is inverted by the inverter 580 and applied to the "B" inputs of a pair of NAND gates 582A and 582B. The signal to the "A" input of the gate 582A is the signal derived from a line 503A $(\overline{\text{SEND}})(\overline{\text{LATCH}})$ from the output of the gate 503. When the last of the information regarding the last article in the viewing zone is transmitted, the signal on the line 503A (to the "A" input of the gate 582A) goes to a logic-1 state. Thus, sufficient time has been permitted to transmit all data concerning the last article within the viewing zone. The "A" input of the gate 582B is derived from the signal (LATCH+SEND) applied over a line 503B from an inverter 505.

When the (SEND)(LATCH) signal is logic-1 (indicating the last transmission of data has been made and data is not being sent to a CPU), and when the output of the counters 464 on the line 578 goes to a logic-0 condition, the output of the gate 582A is applied by a line 584 to the "A" input of a NOR gate 586. The "B" input of that gate is derived by a line 588 from the Q output of the flip-flop 486 and is in a logic-0 condition. Thus, the output of the gate 586 carried by a line 590 changes to a logic-1 condition. This signal is applied to the "B" input of a NOR gate 592. The "A" input of the gate 592 is derived from the output of the gate 572 on a line 594. The signal is in a logic-0 condition because the "A" input to the gate 572 from the Q output of the flip-flop 486 is a logic-1. Therefore, the output of the gate 592 changes to a logic-0 state. This signal is inverted by an inverter 598 and applied over a line 600 to the "A" input of the gate 444. At the gate 444 the appearance of the logic-1 signal changes the state of the output of the gate 444 to a logic-0 condition thus clearing the flip-flop 410 and causing the Q output thereof to go to a logic-0 condition. This occurrence disables the gate 450 due to the presence of a logic-0 on the line 448. Thus, no matter what the state of the STROBE signal at the A input of the gate 450, the output thereof is a logic-1. The transmission of the line therefore ceases.

In the alternative situation, when the output of the counters 464 on the line 578 goes to a logic-0 condition and this signal is inverted by the inverter 580, and an article is still within view or data is being sent to the CPU, the LATCH signal on the line 502A remains in a logic-1 state. The negative-to-positive transition at the "B" input of the gate 582B clocks the flip-flop 486 through an inverter 602. The $\overline{Q}$ output of the flip-flop 486 (taken by the lines 588 and 588A to the "A" input of the gate 462) causes a transition of the output of the gate 462 on the line 604. If an article is still within view at the end of WINDOW, the logic-0 condition on the line 602 clears the flip-flop 460A and forces the STORE signal to go to a logic-1 condition. If data is still being transmitted to the CPU, STORE is in a logic-1 condition and SEND is in a logic-1 condition.

When the STROBE signal goes to a logic-1 state, LATCH goes to a logic-0 state. Since the flip-flop 486 has not been clocked, no other changes in the gate conditions occur. When the last data is transmitted the SENT LAST signal on the line 474A goes to a logic-0 condition. This is applied to the "B" input of the gate 572, and the output on the line 594 therefrom changes to a logic-1 condition. This occurrence generates a logic-0 output from the gate 592 which is inverted by the inverter 598 and a logic-1 signal (END OF DATA) is passed over the line 600 to the gate 444. The output therefrom goes to a logic-0 condition which clears the flip-flops 410 and disables the gate 450.

PROCESSOR ARRAY AND PROCESSING UNIT TIMING

Figure 22:
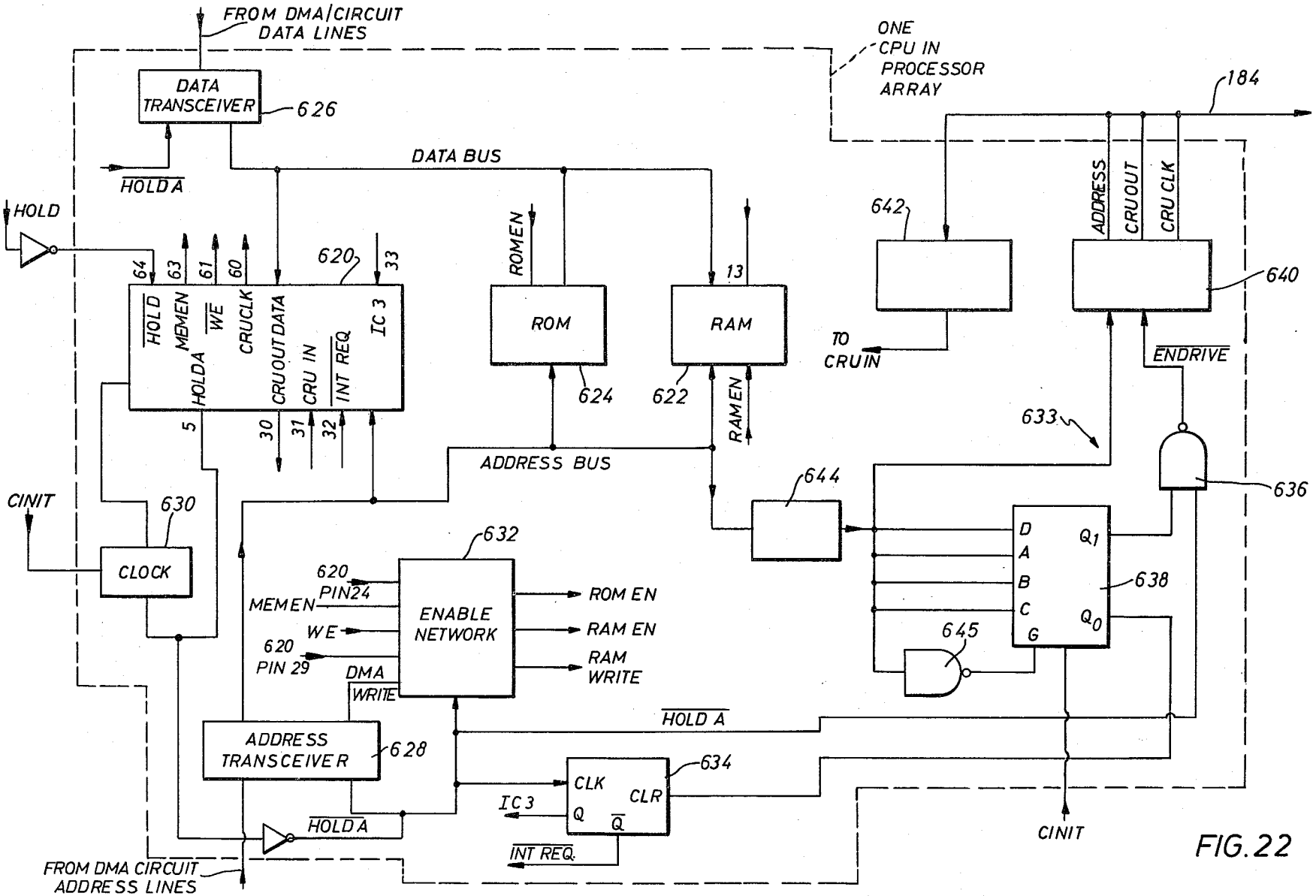
FIG. 22 is a schematic diagram of one of the processing units in the processor array.

With reference now to FIGS. 22 and 23, respectively shown are a schematic diagram of one of the processing units in the processor array and a timing diagram illustrating the sequence of operation of a processing unit.

The processor array includes four processing units, each processing unit being assigned to monitor the progress of a predetermined viewing zone VZ as that viewing zone translates through the viewed area. The sequence of processing units is determined in accordance with the table in FIG. 18 derived as discussed above. The information regarding the location, size and physical characteristics of that portion of each article which lies within the viewing zone during any scan line of interest is transmitted from the DMA circuit 181 to the appropriate processing unit. The processing unit CPU then creates appropriate "files" on each article within the viewing zone to which it is assigned. At the end of the eighty-fourth transmission of information to the processing unit regarding the articles in that viewing zone, as the viewing zone leaves the scanned area, the classification decision whether to accept or reject each article is made by the processing unit assigned to that viewing zone. If an article is to be rejected, information in the form of "article-reject" signals is transmitted from the processing unit to the delay circuit 183. The delay circuit 183 stores that information for a time delay sufficient to permit the articles to fall into the ejection zone 88 (FIG. 1), at which time the appropriate ejectors are fired.

Each processing unit in the processor array takes the circuit form shown in the schematic diagram of FIG. 22. A microprocessor 620 such as that manufactured by Texas Instruments and sold under model number TMS 9900 is connected by an ADDRESS BUS and a DATA BUS to a random acess memory (RAM) array 622 and a read-only memory (ROM) array 624. To provide sufficient memory capability, an array of four 1 K×4 bit memory devices, such as those manufactured by Texas Instruments under model number TMS 4045, may be used as the RAM 622. The stored sequence of instructions, or program, for the processing unit is contained in the ROM 624. Suitable for use as the ROM 624 are two read-only memory devices sold by Texas Instruments under model number TM2716.

The data and address lines from the DMA circuit 181 terminate in line transceivers 626 (DATA) and 628 (ADDRESS) respectively coupled to the DATA BUS and ADDRESS BUS. Suitable for use as the transceivers 626 and 628 are devices manufactured by Texas Instruments and sold under model number 74LS245. Internal timing signals for the processing unit are generated from a 48 MHz. crystal oscillator 630 such as that manufactured by Texas Instruments and sold under model number 74LS362.

A network 632 generates enabling signals in response to selected inputs from the microprocessor 620 (specifically pins 24, 29, 61 and 63 thereof), from the DMA WRITE signal applied from the transceiver 628, and from an inverted output signal $\overline{\text{HOLDA}}$ derived from pin 5 of the microprocessor 620. The outputs RAM ENABLE and ROM ENABLE are respectively applied to the RAM 622 and ROM 624, while a WRITE signal is applied to the RAM 622 so that data may be stored at addressed locations therein.

The $\overline{\text{HOLDA}}$ signal is also applied to the CLOCK terminal of a flip-flop 634, such as a device sold under model number 74LS74 by Texas Instruments. The Q and $\overline{\text{Q}}$ outputs of the flip-flop 634 are respectively applied to the IC3 terminal (pin 33) and the $\overline{\text{INTERRUPT REQUEST}}$ (pin 32) of the microprocessor 620. The signals create an interrupt condition with the processing unit whereby the then-ongoing activity of the processing unit is interrupted. The processing unit surrenders its address and data lines to the DMA circuit 181 in response to the interrupt. To enable the processing unit to receive address and data signals from the DMA, the $\overline{\text{HOLDA}}$ signal is also applied to the line transceivers 626 and 628.

Communication between the processing unit and an appropriately addressed peripheral device over the external data bus 184 is permitted through an input/output network 633, including a NAND gate 636, an addressable latch 638, and transceivers 640 and 642. The $\overline{\text{HOLDA}}$ signal is applied to the "B" input of the gate 636, while the "A" input thereof is derived from the $Q_1$ output of the latch 638. Suitable for use as the latch 638 is a device manufactured by Texas Instruments and sold under model number 74LS259. The inputs to the device 638 are taken from the address lines through an array of buffer/decoders 644, and from the CRUOUT and CRUCLK terminals (pins 30 and 60, respectively) of the microprocessor 620. The latch 638 is enabled through a NAND gate 645 deriving its inputs from the ADDRESS BUS through the buffers 644.

The address lines carrying the hardware address of the peripheral to which the data on the CRUOUT line is to be transmitted, the data line CRUOUT, and the line CRUCLK are applied to the external data bus 184 through the line driver 640. The driver 640 is enabled by the output signal, $\overline{\text{ENDRIVE}}$, from the gate 636. Once the processing unit gains access to the external bus, information from the processing unit is serially transmitted through the driver 640 to the addressed peripheral device. The transceiver 642 is adapted to receive information which may be applied to the processing unit from a peripheral (e.g., the front panel) over the external bus 184. Information input from the peripheral is applied to the CRUIN pin 31 of the microprocessor 620 from the transceiver 642. Suitable for use as the line drivers 640 and the transceiver 624 are devices manufactured by Texas Instruments and sold under model number 75138. The $Q_0$ output from the latch 638 clears the flip-flop 634.

The processing unit initialize signal CINIT generated from the synchronizing circuit 174 (FIG. 3) is applied to the clock 630 and the latch 638. As earlier noted, during the time following the occurrence of the CINIT signal, the portion of the RAM 622 known as the "database" is cleared by the processing unit.

With reference now to the timing diagram of FIG. 23, the sequence of operations performed by each processing unit in the processor array is set forth. The appropriate processing unit to which information regarding articles in a viewing zone occupying a given scan line of interest is selected by the portion of the DMA circuit 181 shown in FIG. 19.

The occurrence of a CLAMP signal (from the synchronizing circuit 174, FIG. 13) and a MATCH condition (from the comparators 402, FIG. 20) generates a HOLD signal applied by the line driver 418 (FIG. 20) to the appropriate processing unit. The $\overline{\text{HOLD}}$ signal is inverted and applied to the HOLD terminal (pin 64) of the microprocessor 620 (FIG. 22). The HOLDA output from the microprocessor 620 (pin 5) is inverted and enables the transceivers 626 and 628. The processing unit terminates its then-ongoing activity and surrenders its data and address lines to the DMA circuit 181. Information regarding the location, size and physical characteristics of that portion of each article within the viewing zone is then transmitted by the DMA circuit 181 to the appropriately addressed portion of the RAM 622, as discussed in connection with FIG. 21.

Figure 25A:
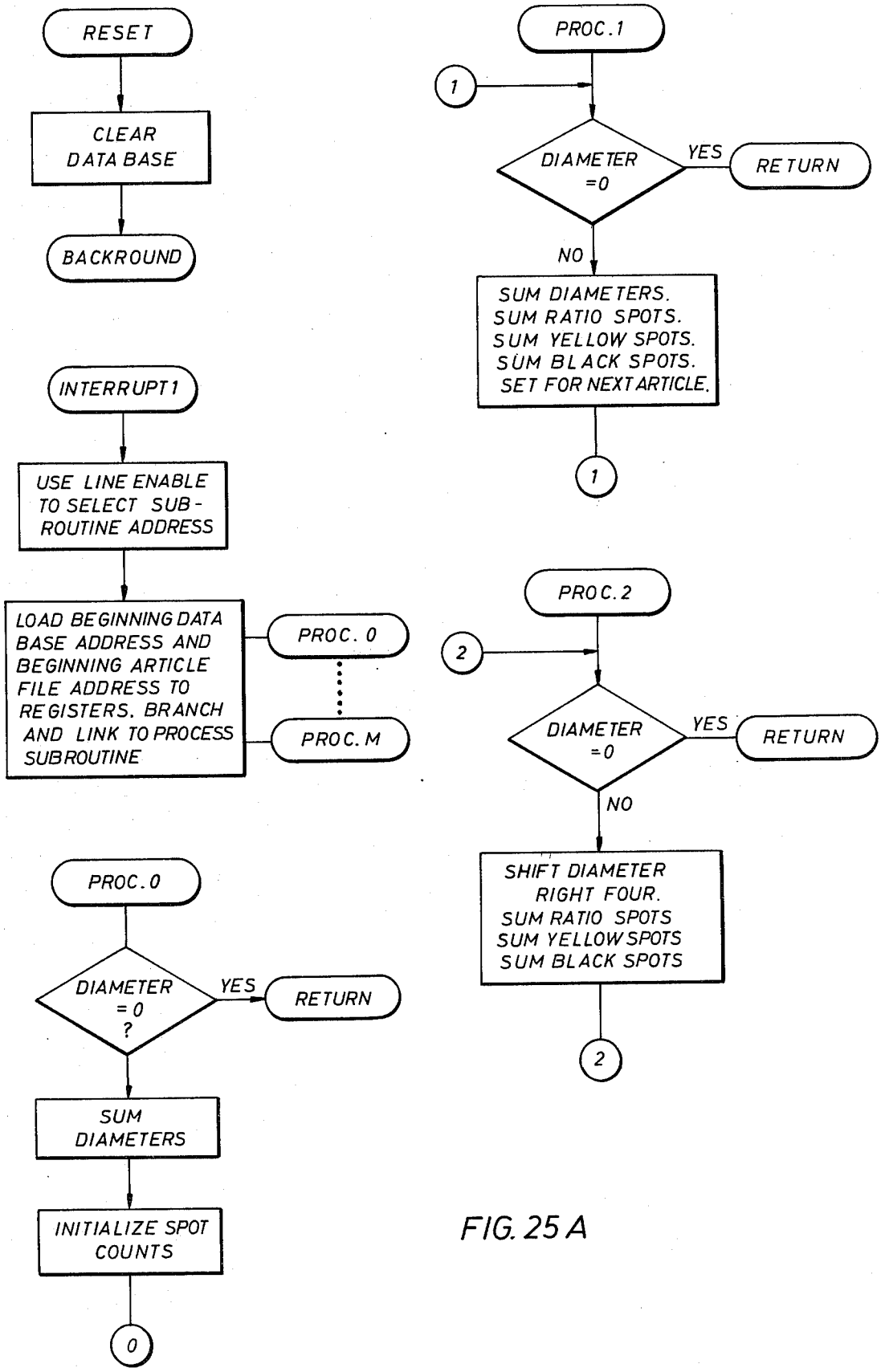
Figure 25C:
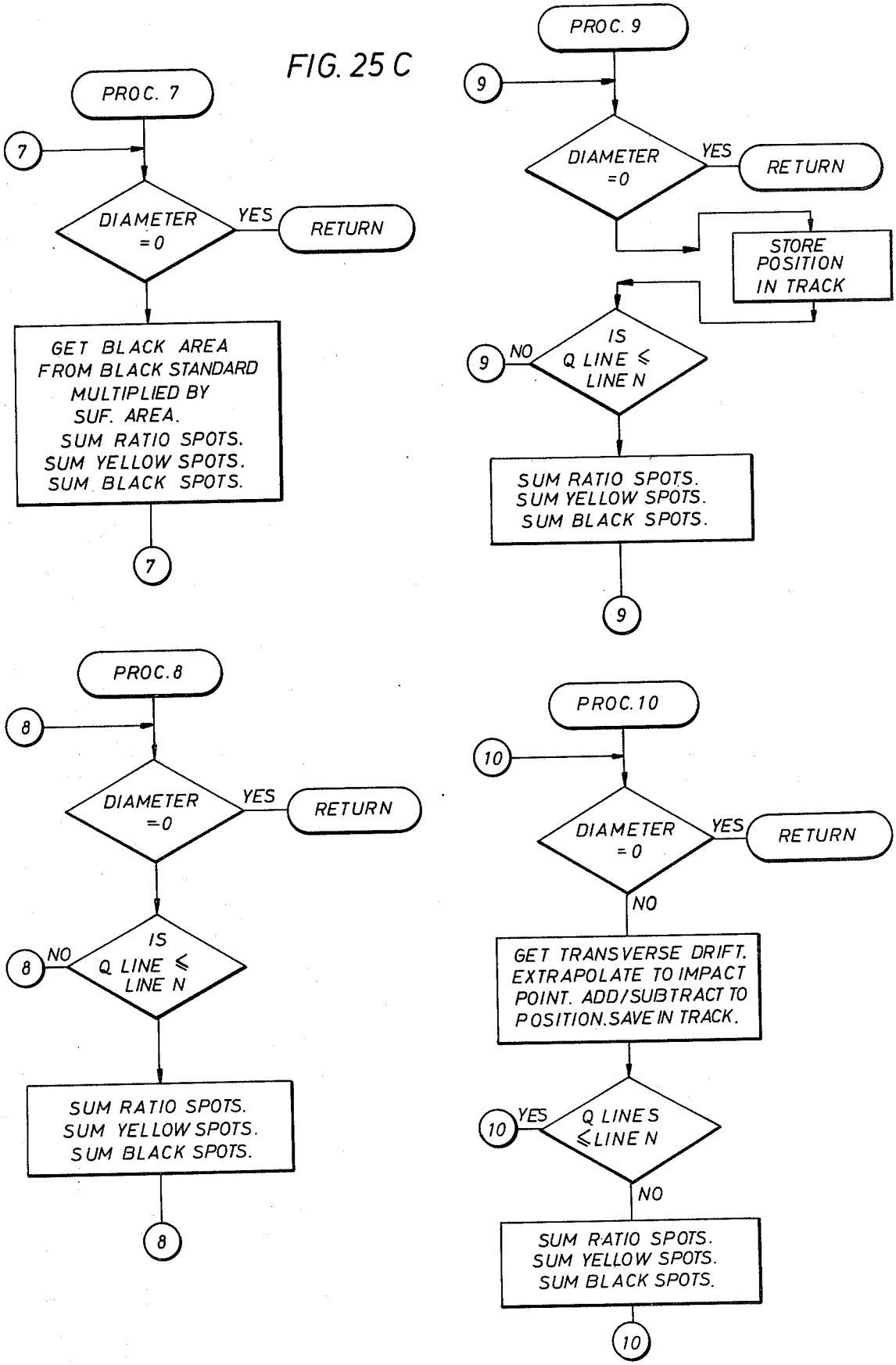
Figure 25E:
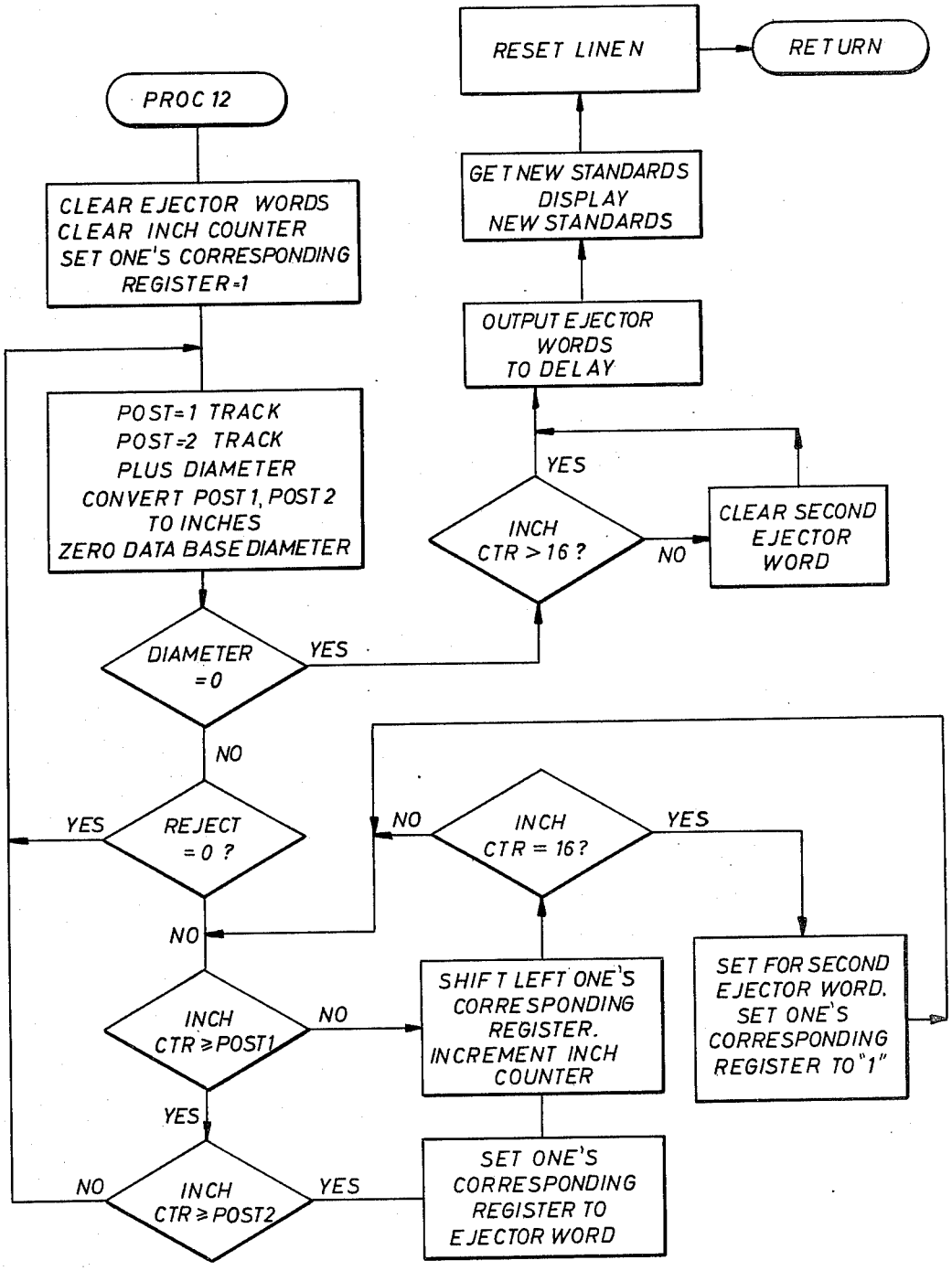

At the termination of the $\overline{\text{HOLD}}$, signal $\overline{\text{HOLDA}}$ changes state, clocking the flip-flop 634. An interrupt condition $\overline{\text{INT REQ}}$ and IC3 is created and the processing unit responds to the interrupt by processing the data received from the DMA circuit in accordance with the program stored in the ROM 624. It will be recalled that eighty-four transmissions to a given processing unit occur as the viewing zone being monitored by that processing unit occupies successive lines of interest during its movement through the scanned area. As will be made clear herein, the processing unit performs different operations upon the data received from the DMA circuit 181 and upon the data being accumulated and compiled in "files" generated in the data-base in accordance with which numbered transmission has been received by the processing unit. The line-by-line processing of data by the processing unit is discussed herein and shown in the flow diagram of FIG. 25.

The end of the HOLD condition also enables the gate 636 and accesses the CPU to the external bus 184 such that the processing unit may communicate over the external bus 184 with the appropriate peripheral. In a typical situation the CPU then either transmits information (serially) to that peripheral (e.g., the delay circuit and the front panel) or receives information (serially) from the peripheral (e.g., the front panel). The $\overline{\text{EN-DRIVE}}$ signal is generated from the gate 636. The hardware address, data line CRUOUT and the signal CRUCLK are applied over the external bus 184 to the addressed peripheral. If transmission to a peripheral is to occur, the appropriate hardware address of the peripheral with which the CPU is to communicate is applied from the ADDRESS BUS through the couplers 644 to the device 638 and to the drivers 640.

The 9900 Family Systems Design and Data Book for the processing unit is available from Texas Instruments.

THE CPU DATABASE and LINE-BY-LINE PROCESSING

The RAM 622 in accordance with the invention follows the RAM map set out in FIG. 24. That portion of the memory 622 having addresses beginning at location 8700 through location 10236 defines the database into which the DMA circuit 181 transmits data relative to the portion of each article within the viewing zone when the electron beam sweeps over the appropriate line of interest on the electrical image plane. The database is sized to provide one hundred twenty-eight sixteen bit memory locations addressable by the DMA circuit 181. Since information concerning one article will occupy three locations, the database can store processing information concerning forty-two articles.

As noted in connection with FIG. 20, the DMA transmits three separate data transmissions for each article in the viewing zone. These transmissions occur in the form of three sixteen-bit words and are applied to the appropriately addressed locations in the database. For each article A(1) through A(P) (where $P \leqq 32$), three sixteen-bit words are transmitted.

In the first word transmitted to the CPU the eight most-significant-bits represent article position (POSITION) data while the eight least-significant-bits represent article diameter (DIAMETER) data. The eight most-significant-bits of the second word transmitted to the CPU contain article RATIO characteristic information (RATIO) while the eight least-significant-bits contain YELLOW characteristic information (YELLOW). The third word transmitted to the CPU contains article BLACK characteristic information (BLACK) in the eight least-significant-bits thereof.

Other portions of the RAM 622 contain article "files", one "file" corresponding to each article in the viewing zone to which the CPU is assigned. The "file" for each article monitors twelve parameters regarding that article. The parameters are as follows:

| | |
|---|---|
| (1) POSITION | (7) SUF AREA |
| (2) DIAMETER | (8) TRACK |
| (3) RATIO COUNT | (9) Q LINES |
| (4) YELLOW COUNT | (10) RATIO AREA |
| (5) BLACK COUNT | (11) YELLOW AREA |
| (6) REJECT | (12) BLACK AREA |

In another portion of the memory are registers which store the standards for classification selected by the operator and entered through the front panel. These registers are RATIO STANDARD, YELLOW STANDARD and BLACK STANDARD. These standards may be adjusted by the operator.

The information in POSITION parameter relates to the lateral position of the article within the viewing zone. The parameter DIAMETER relates to the diameter of the article. The parameter SUF AREA is the approximate total surface area of the article. The information in parameters (3), (4) and (5) is a count (or running total) which respectively relates to the number of one-eighth inch square segments (or "spots") on the article's surface that exhibit RATIO, YELLOW or BLACK characteristics. (Recall that a RATIO characteristic, for example, is generated when the quotient of the divider 304 (FIG. 11) deviates from the threshold reference.)

The information in parameters (10), (11) and (12) represents the maximum percentage of the total surface area of the article (computed in accordance with the article's diameter) that may exhibit a RATIO, YELLOW or BLACK reflectively characteristic. The information in the parameters (10), (11), and (12) is derived from a multiplication of the article's total surface area (SUF AREA, parameter (7)) by the standard in the registers RATIO STANDARD, YELLOW STANDARD and BLACK STANDARD, respectively. The parameter REJECT is the acceptability indicator for the article, derived as discussed herein.

The operator selects the mode (either "%" or "COUNT") as well as the standards for each characteristic on the front panel. The meaning of the numerical value for each characteristic depends upon the mode selected. For example, a RATIO standard of "17" in the COUNT mode means an article is rejected if "17" or more one-eight inch square segments ("spots") having a RATIO characteristic appear on its surface. In the "%" mode, a RATIO standard of "17" means an article is rejected if more than "17%" of the total surface area exhibits a RATIO characteristic.

As the CPU executes its program, it branches to various "processes", each of which is a set of instructions that operates on the database in a different manner.

In the COUNT mode (see FIG. 25D, process 11), a comparison between the count in parameters (3), (4) and (5) and the RATIO STANDARD, YELLOW STANDARD and BLACK STANDARD, respectively, determines the acceptability of the article.

In the % mode, in process 11 a comparison between the count in parameters (3), (4) and (5) and the values in parameters (10), (11) and (12), respectively, determines the acceptability of the article. The values in parameters (10), (11) and (12) are determined during process 5 (FIG. 25B), process 6 (FIG. 25B) and process 7 (FIG. 25C), respectively. The values in the parameters (10), (11) and (12) represent the article's total surface area multiplied by the appropriate standard.

The CPU maintains a register LINEN which maintains a running total of the number of transmissions received from the DMA circuit 181 by that CPU. The parameter (9) Q LINES maintains the number of transmissions from the DMA that the CPU must receive before a classification decision as to that article is generated. Parameter (9) Q LINES is variable in accordance with the article's diameter. Once the entire surface of an article is viewed, the CPU does no further processing on that article.

An EJECTOR WORD is a word sixteen bits wide, each bit representing one ejector 84. Since there are thirty-two ejectors in the array, two ejector words are needed. The INCH COUNTER is a register that tracks the inch number for each ejector word. POST 1 is the beginning position of the article to be ejected in inches with respect to one edge of the viewing zone. POST 2 is the ending position of the article to be ejected. The ejectors in the array between POST 1 and POST 2 are fired (after an appropriate time delay) in order to eliminate an article classified as unacceptable.

The CPU has in a memory location a SET ONES CORRESPONDING register. This register always has at least one bit that is true which is used to set the individual bits in each ejector word. As used in process 12 (FIG. 25E) TRACK is the estimated position at which the article to be ejected will enter the ejection zone if it continues on the same lateral path that it exhibited during a last predetermined portion of its translation through the viewed area.

It should be noted that in process 12 (FIG. 25E) the instruction to "zero data base" clears the register in the data base that stored the diameter for each article. However, since the diameter for the article is loaded into another register at the beginning of process, 12, the decision following that action has meaning.

Shown in FIGS. 25A through 25E is a flow chart for the CPU program. The program is stored in the ROM 624. The various processes listed in the flow chart of FIG. 25 using the parameters and registers noted above are performed in accordance with the following schedule of transmitted lines:

| Line Transmission Number | Process |
|---|---|
| 1 | 0 |
| 2–16 | 1 |
| 17 | 2 |
| 18 | 3 |
| 19 | 4 |
| 20 | 5 |
| 21 | 6 |
| 22 | 7 |
| 23–72 | 8 |
| 73 | 9 |
| 74–81 | 8 |
| 82 | 10 |
| 83 | 11 |
| 84 | 12 |

DELAY CIRCUIT

As is explained in connection with FIG. 16, from the time that a viewing zone first enters the scanned area, the viewing zone is monitored by one of the processing units in the processor array. Information regarding each article within the viewing zone is kept in "files" and, in accordance with the schedule set forth above, the CPU processes the information in those files in accordance with one of a plurality of program subroutines. At the time that a viewing zone exits the scanned area a signal relative to the acceptability of each article is generated. These signals--termed "article-reject" signals—are applied to activate the appropriate ones of the ejector elements to deflect articles determined to be unacceptable from their free fall path to the carry off conveyor 81 (FIG. 1A).

Since the end of the viewed areas 48 (containing the scanned area 50) is spaced a distance 89 from the discharge end 49 of the conveyor 41 and the ejection zone 88 is spaced a distance 90 beneath the discharge end 49 of the conveyor 41, some time must be allowed to pass between the exit of the viewing zone from the scanned area and the entry of articles from the viewing zone into the ejection zone. To provide this delay time period, the delay circuit 183 is provided. The delay circuit 183 is operative to receive and store article-reject information from a predetermined number of processing units until such time as the articles in the viewing zones monitored by those CPU's reach the ejection zone 88. At an appropriate time the article-reject signals stored in the delay circuit 183 are transmitted to actuate the appropriate ejector elements to deflect articles from the ejection zone. The time delay between the exit of a viewing zone from the viewed area until the articles enter the ejection zone is adjustably selectable.

The distance 90 at which the ejection zone is placed below the discharge end 49 of the conveyor is dependent upon a variety of factors, among which are: (1) the size of the articles being sorted; (2) the speed of the conveyor; and (3) the physical space in which the apparatus 40 is disposed.

Figure 27A:
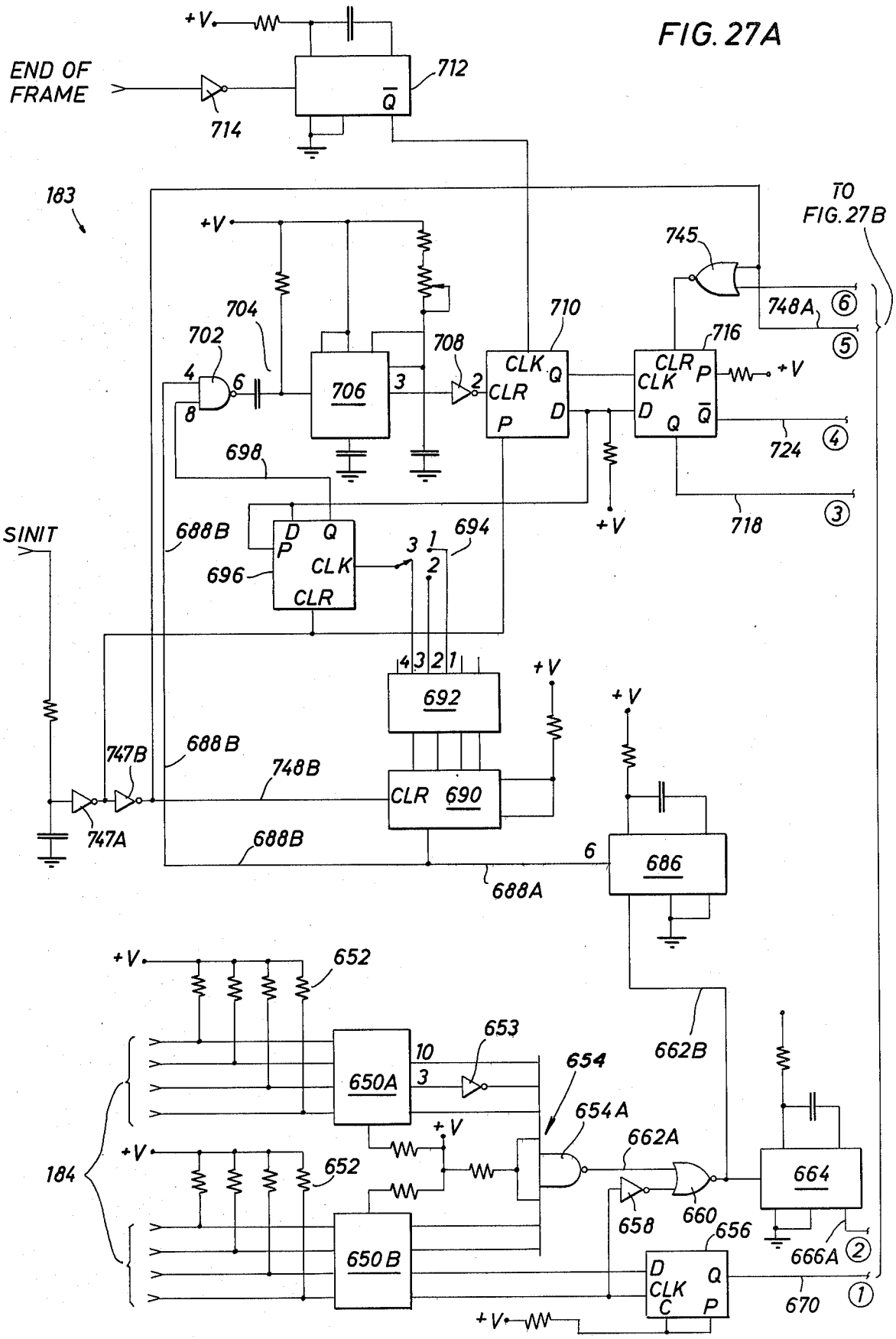
FIG. 27 is a schematic diagram of a delay circuit used in a roll sorting apparatus in accordance with the instant invention.

An understanding of the physical situation is believed helpful in understanding the operation of the delay circuit 183. Accordingly, reference is directed to FIG. 26, which is a series of pictorial representations illustrating the principles of operation underlying the delay circuitry of FIG. 27 and explained in connection with the timing diagrams of a typical sequence shown in FIGS. 28 and 29. Although portions of FIG. 26 are repetitive of FIG. 1, it is believed that the repetition in the context of a specific quantitative example will enhance the understanding of the invention. It is assumed for discussion that each viewing zone contains only one article.

FIG. 26A represents a time line against which the events of FIGS. 26B through 26E may be measured. Assume that the index pulse occurred exactly as article $A_1$ in viewing zone $VZ_1$ entered the scanned area (scan line-9). The time required for article $A_1$ to displace through the portion of the conveyor represented by the scanned area (scan lines-9 through-92) on the electrical image plane, if the conveyor is moving at fifteen inches per second, is seven hundred milliseconds. During those seven hundred milliseconds, eighty-four transmissions of data have occured from the DMA circuit 181 to CPU-1 assigned to monitor $VZ_1$.

At the end of the eighty-fourth transmission, CPU-1 has generated an appropriate classification decision regarding the acceptability of the article $A_1$. As the article $A_1$ leaves the scanned area (FIGS. 26A and 26B) the information is transmitted from CPU-1 to the delay circuit 183. It will be assumed that the article $A_1$ is classified as unacceptable.

One hundred seventy-five milliseconds later, the article $A_2$ from the viewing zone $VZ_2$ exits the scanned area. The article $A_1$ is now just leaving the discharge end 49 of the conveyor. At the time CPU-2 will transmit the data regarding the article $A_2$ (FIGS. 26A and 26C). The article $A_2$ is assumed for purposes of discussion to be classified as acceptable.

As the article $A_3$ (assumed to be unacceptable) exits the scanned area the CPU-3 will transmit data regarding that article to the delay circuit 183 (FIG. 26A). The article $A_2$ is just leaving the discharge end 49 of the conveyor. The article $A_1$ is in free fall (FIG. 26D).

Shortly after the transmission of the data from CPU-3 to the delay circuit 183, the delay circuit 183 transmits the information regarding the article $A_1$ to the ejector driver channel M so that the ejector arm 84A is presented into the path of the article $A_1$ to remove that article from the article stream. It has been found that if the distance 90 is nine inches below the discharge end 49 of the conveyor, the delay circuit must transmit the "article-eject" signals to the driver channel M within then milliseconds of the time that the article $A_1$ strikes the ejector in order for the ejector to have been extended and at rest in the path of the article $A_1$. As is also discussed herein, the driver channel M includes a one-shot of variable duration to permit the arm 84A a dwell time within the ejection zone before the arm is retracted. Thus, after a delay $\Delta t$ between the start of the third transmission of data (from CPU-3 to the delay circuit 183) the delay circuit transmits the data from CPU-1 to the ejector driver channel M. The delay $\Delta t$ is, in this specific example, equal to forty milliseconds. The total delay time $T_D$ that article-reject signals are delayed by the delay 183 is the period between the transmission of article-reject signals by a CPU and the transmission from the delay circuit to the ejectors.

As seen in FIG. 26E, after the transmission of information from CPU-4 to the delay occurs (FIG. 26A), the article $A_2$ is in the same relative position occupied by the article $A_1$ one hundred seventy-five milliseconds earlier. Thus, after a delay $\Delta t$ following the transmission of information from CPU-4 to the delay circuit 183, the delay circuit transmits the article-eject signal for article $A_2$ to the driver channel M. However, in this situation, since the article $A_2$ is acceptable, the ejector is not fired.

Thus, if the number of transmissions of information to the delay circuit 183 were counted and if the ejector driver channel were energized a time $\Delta t$ after the beginning of the third transmission (FIG. 26A) the ejectors would be timely presented to deflect the article $A_1$. Thereafter, if the ejector driver information (article-eject) signal for the article $A_2$ is transmitted from the delay circuit 183 to the driver channel M a time $\Delta t$ after a transmission to the delay circuit 183 occurs, the ejector is presented to remove articles from the article stream.

With reference now to FIG. 27, shown is a schematic diagram of the delay circuit 183. The delay circuit 183 includes transceivers 650 connected over the external bus 184 to the line drivers 640 (FIG. 22) from the appropriate processing unit. Suitable for use as the transceivers 650 are devices sold by Texas Instruments under model number 75138. An array of pull-up resistors 652 is connected to the inputs of the transceivers 650. An address decoder circuit 654 (one input of which is the output of an inverter 653) including a NAND gate 654A is connected to outputs of the transceivers 650. The CRUOUT and CRUCLK outputs of the transceivers are applied to the data and clock inputs of a latch 656 such as that sold by Texas Instruments under model number 7474. The signal CRUCLK is inverted by an inverter 658 and applied to the "B" input of a NOR gate 660. The "A" input of the gate 660 is derived from the output of the gate 654A through a line 662A.

Figure 27B:
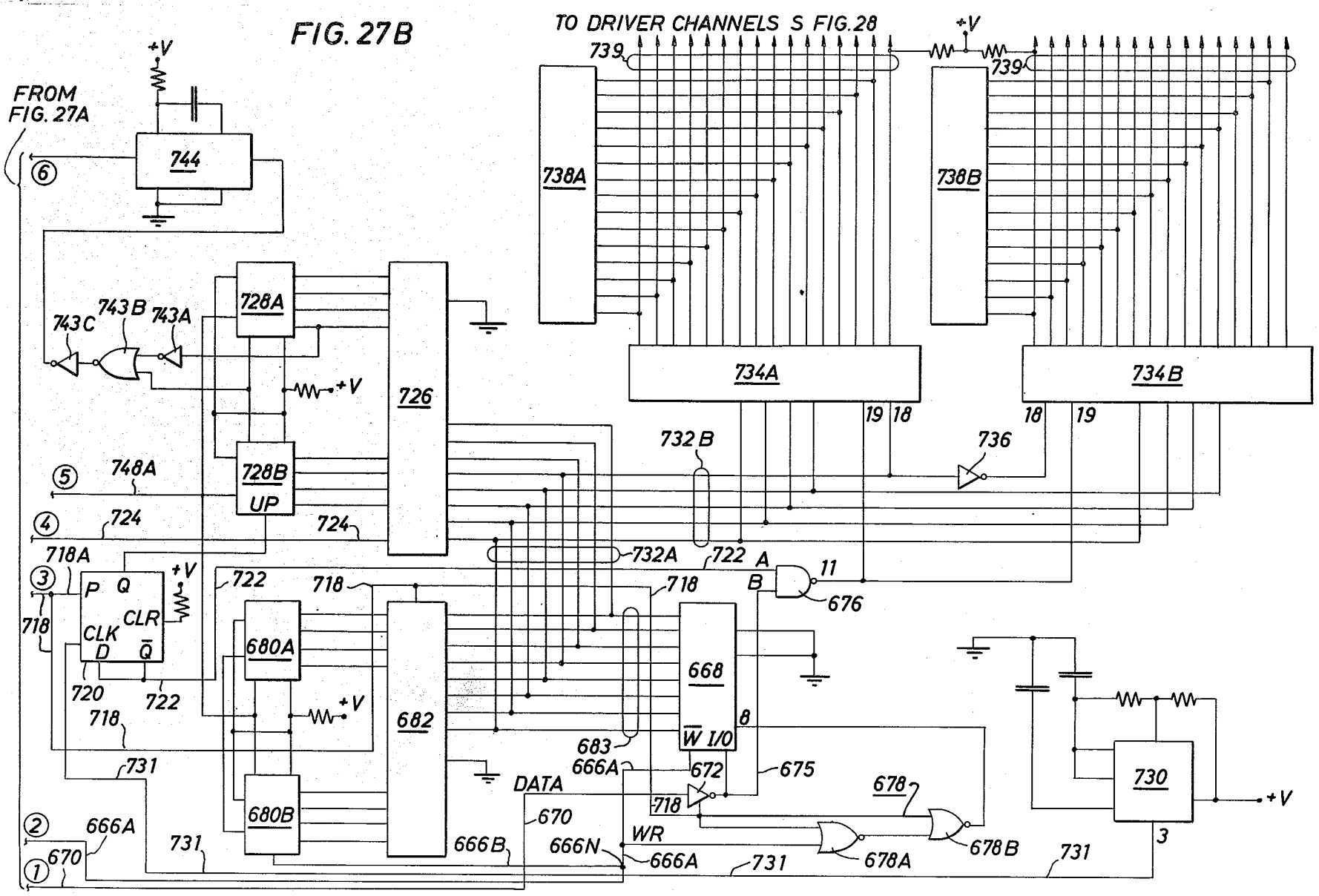

The output of the gate 660 is applied to a one-shot 664, such as that sold by Texas Instruments under model number 74121. The one-shot 664 is adapted to provide a pulse of a predetermined duration (three hundred nanoseconds) which is applied by a line 666A to the WRITE terminal of a 1K ×4 bit random access memory 668 (FIG. 27B). Suitable for use as the memory 668 is a device sold by Texas Instruments under model number TM54045. The output of the latch 656 is applied by a line 670 to the input of a tri-state inverting line coupler 672. The line coupler 672, when enabled by a signal on its control terminal, applies the signal at the Q output of the latch 656 to the input-output terminal of the memory 668. The input-output terminal is also connected by a line 675 to a NAND-gate 676.

An enabling logic network 678 includes NOR gates 678A and 678B the output of which is connected to a memory enable terminal. The network 678 is operable to enable the memory 668 when it is desired to write information into addressed locations thereof or to read information therefrom.

The output of the one-shot 664 is applied by a line 666B (branching from the line 666A at a node 666N) to increment data-in memory address counters 680, including counter elements 680A and 680B. Suitable for use as the counters 680 are devices manufactured by Texas Instruments and sold under model number 74193. The output of the counters is applied through a tri-state bus driver 682 such as a device sold by Texas Instruments under model number 74LS245. The outputs of the driver 682 are applied to the address terminals of the memory 668 over a bus 683.

The output of the gate 660 is applied by a line 662B (FIG. 27A) to a one-shot 686. Suitable for use as the one-shot 686 is a device sold by Texas Instruments under model number 74LS121. The one-shot 686 generates an output pulse of a duration greater than the time required for a CPU to transmit information to the delay circuit 183. The output of the one-shot 686 is applied by a line 688A to increment a transmission counter 690. The counter outputs are decoded by a decoder 692. Suitable for use as the counter 690 is the device sold by Texas Instruments under model number 74193, while a device sold by that manufacturer undel model number 74LS42 may be used as the decoder 692.

The outputs of the decoder 692 are applied to a jumper connector 694 the wiper of which is selectably connectable to the clock input of a flip-flop 696. Depending upon the setting of the wiper of the jumper connector 694, when the decoded output indicates that a desired transmission is occurring (in this instance, the third transmission (see FIG. 26)), the Q output of the flip-flop 696 changes state.

The Q output of the flip-flop 696 is applied by a line 698 to the "B" input of a NAND gate 702. The "A" input of the gate 702 is derived from the output of the one-shot 686 over a line 688B. The output of the gate 702 is coupled through a R-C network 704 to the input of a one-shot 706. The output of the one-shot 706 is inverted by the action of an inverter 708 and applied to the clear terminal of a flip-flop 710. The duration of the one-shot is set to provide a pulse of variable duration for a purpose set forth herein. The data inputs and of the flip-flops 696 and 710 are maintained in a logic-1 condition. The clock terminal of the flip-flop 710 is derived from the $\overline{Q}$ output of a one-shot 712. The one-shot 712 is triggered by the signal END OF FRAME applied through an inverter 714. The duration of the one-shot 712 is substantially equal to four milliseconds. Suitable for use as each of the flip-flops 696 and 710 is a device sold by Texas Instruments under model number 74LS74. Suitable for use as the one-shot 712 is a device sold by Texas Instruments under model number 74121. The duration of the one-shots 706 and 712 cooperate to define an adjustably selectable duration for the delay time $T_D$.

The Q output of the flip-flop 710 clocks a flip-flop 716. The Q output of the flip-flop 716 is applied over a line 718 to enable the control terminal of the line coupler 672. A branch line 718A presets a flip-flop 720, the $\overline{Q}$ output of which is applied over a line 722 to the "A" input of the gate 676.

The $\overline{Q}$ output of the flip-flop 716 is applied by a line 724 to enable a tri-state line driver 726 similar to the driver 682. The driver 726 is connected at its inputs to data-out address counters 728A and 728B, identical to the counters 680. The counters 728 are incremented by the Q output from the flip-flop 720. The flip-flop 720 is clocked in accordance with an oscillator 730 (FIG. 27B), such as a device sold by National Semiconductor under model number NE555, applied to the flip-flop 720 over a line 731. Suitable for use as the flip-flops 716 and 720 is a device manufactured by Texas Instruments and sold under model number 74LS74.

The output of the line driver 726 is applied over a bus 732A to the address terminals of the memory 668. A bus 732B applies the address signals from the counters 728 to decoders 734A and 734B, such as the devices sold under model number 74LS159 by Texas Instruments. The decoders 734A or 734B are enabled in accordance with the state of the signal applied to the terminals 18 thereof, respectively derived from the input and output terminal of an inverter 736. The decoders 734 receive data from the RAM 668 gated through the gate 676 and applied at the input terminals (pin 19) thereof. An array of pull-up resistors 738 are provided to normally maintain the ejector driver connected at the end of a bus 739 in a logic-1 state. Thus, a logic-0 signal applied to a driver actuates a corresponding driver channel and causes the ejector arm associated therewith to be presented into the ejection zone to deflect an article therefrom.

At the opposite end of the bus 739 is an array of ejector channels M which actuate each of the ejector elements 84 disposed within the ejection means 83. A pair of typical ejector channels M is shown in FIG. 28. The lines from the decoder 734 are terminated in pairs at a dual one-shot 740, such as a device sold by Texas Instruments under model number NE556. The one-shot 740 turns on the appropriate transistor 741A or 741B to apply a ground potential to one side of the coil associated with the ejector. The duration of the one-shot 740 defines the dwell time (approximately eighty milliseconds) during which the ejector arm is present in the ejection zone 88. The dwell time is set by the resistor 740R and the capacitor 740C. Thus, the arm 84A is present in the ejection zone 80 such that articles within a range of sizes are deflected from the zone. An LED 742 indicates actuation of the driver. Of course, any suitable configuration for control of the ejector elements may be used.

Referring again to FIG. 27B, the output of the counter 728A is applied through an inverter 743A to the "A" terminal of a NOR gate 743B while the output of the counter 728B is presented to the "B" input of the gate 743B. The output of the gate 743B is inverted by the inverter 743C and triggers a one-shot 744 similar to the one-shot 712. At the end of the one-shot pulse, the flip-flop 716 is cleared through a NOR gate 745.

When the system is initialized by the signal SINIT, an inverter 747A generates the $\overline{\text{SINIT}}$ signal clearing the flip-flop 696 and presetting the flip-flop 710. This sets the Q output of the flip-flop 696 to a logic-0 and the Q output of the flip-flop 710 to a logic-1 condition. The signal $\overline{\text{SINIT}}$ at the output of the inverter 747A is again inverted by the action of the inverter 747B to clear the flip-flop 716 through the gate 745. Thus, a logic-0 condition exists at the Q output of the flip-flop 716 while the complementary signal (a logic-1) is present at the $\overline{Q}$ terminal thereof. The logic-0 at the Q output of the flip-flop 716 enables the tri-state driver 682 and the line coupler 672 and presets the flip-flop 720. The logic-1 condition at the Q output of the flip-flop disables the driver 726. The SINIT signal at the output of the inverter 747B also clears the data-in address counters 680 and the data-out address counters 720 (over the line 748A) and the transmission counter 690 over the line 748B. Suitable for use as the inverters 747 is device 7404 or 74LS04 manufactured by Texas Instruments.

The operation of the delay circuit 183 may now be discussed. When a viewing zone VZ leaves the scanned area, information regarding each article in that viewing zone (in the form of "article-reject" signals) is transmitted to the delay circuit 183. The hardware address for the delay circuit 183, along with the signal CRUCLK and the first of thirty-two serially output data signals CRUOUT are transmitted from the line drivers 642 (FIG. 22) over the external bus 184 to the delay circuit 183.

The thirty-two signals (one corresponding to each ejector) are serially output from the processing unit to the delay circuit 183. Each address space is a block of thirty-two hexa-decimal addresses. For example, the address spaces 3AO through 3CO addresses the delay circuit 183. One hardware address, the signal CRUCLK, and one article-reject signal (logic-1 if the ejector is to be fired) are serially transmitted to the delay circuit 183.

Figure 29:
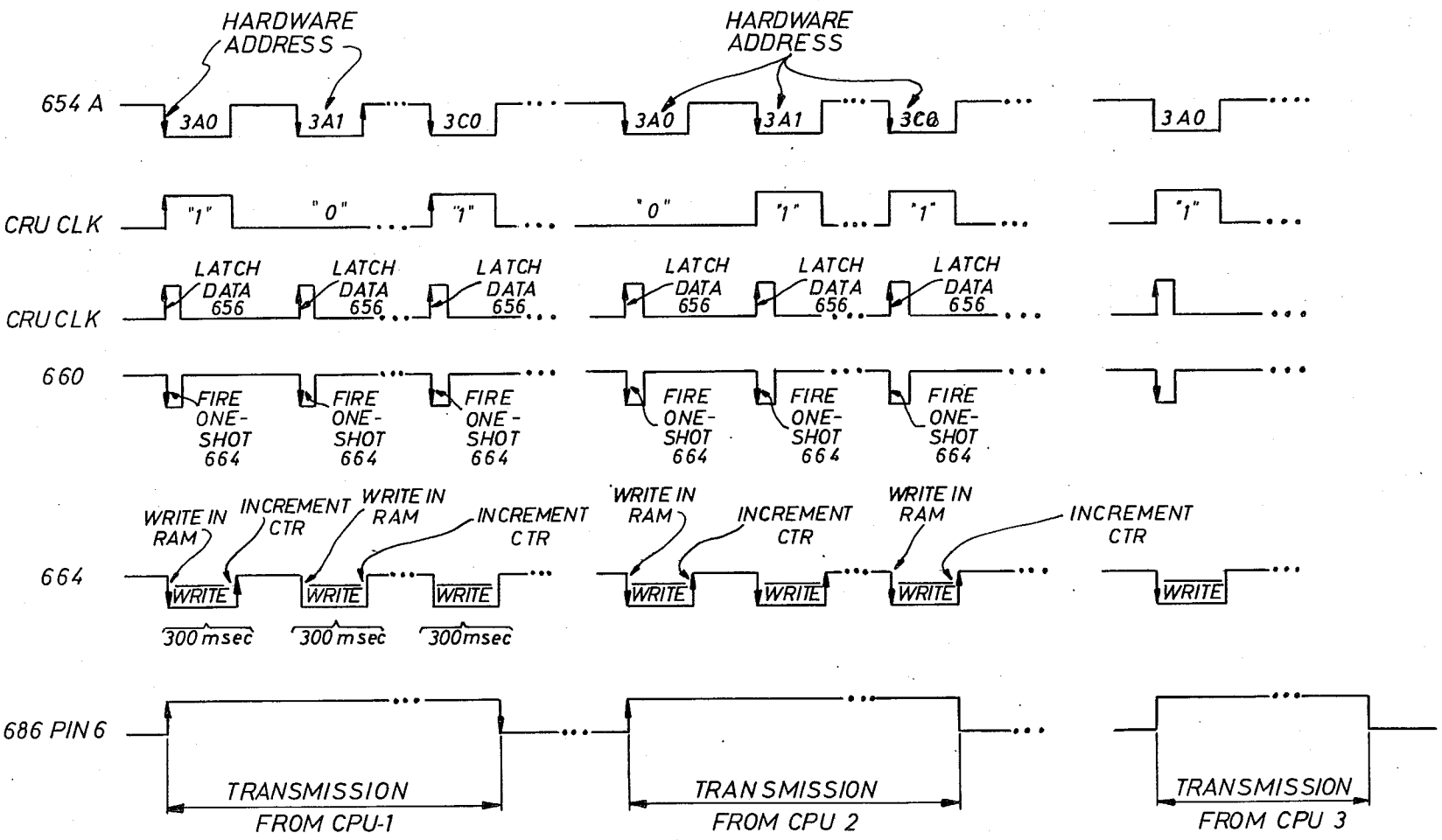
FIG. 29 is a timing diagram of the operation of the delay circuit shown in FIG. 27 when data is received from the processing units.

The timing diagram of FIG. 29 illustrates the timing of the delay circuit 183 while receiving data from a processing unit. When the first hardware address (e.g., 3AO) from the first processing unit transmitting information to the delay circuit 183 is received at the transceivers 650A and 650B, the output of the NAND gate 654A in the decoder changes to a logic-0 state. The first bit of data CUROUT from the a first processing unit is applied to the data input of the latch 656. The appearance of CRUCLK to the clock terminal of the latch 656 latches the signal at the data input to the Q output thereof. The data signal CRUOUT is thus applied on the line 670, through the enabled coupler 672 to the input/output terminal of the RAM668. (Since the flip-flop 720 is preset by SINIT, the $\overline{Q}$ output is a logic-0 and the gate 676 is disabled.)

The appearance of CRUCLK is applied to the inverter 658 and the inverted CRUCLK signal is applied to the "B" input of the gate 660. The output of the gate 660 changes to a logic-1 state and triggers the one-shot 664. The output of the one-shot 664 is a $\overline{\text{WRITE}}$ applied on a line 666A to the $\overline{\text{WRITE}}$ terminal of the RAM 668. The falling edge of that output pulse (three hundred nanosecond duration) writes the data (the first CRUOUT) into the location of the RAM 668 corresponding to the zero count output from the data-in address counters 680 applied to the RAM 668 through the line driver 682. The rising edge of the one-shot output increments thecounters 680 to the next data-in address location.

The change of state (to a logic-1) of the gate 660 is applied over the line 662B to the one-shot 686. The effects of this occurrence are discussed herein.

The appearance of the second hardware address (3A1) from the processing unit to the delay circuit 183 is similarly decoded by the gate 654. The second article-reject signal, CRUOUT, is latched in the Q output of the latch 656 by the appearance of CRUCLK, and a $\overline{\text{WRITE}}$ signal (from the one-shot 664) is generated in a similar manner. The second data bit is written into the RAM on the falling edge of the one-shot output and the rising edge increments the data-in counters.

This sequence repeats until all thirty-two article-reject signals from the first processing unit have been written into the first thirty-two locations in the memory 668. At the termination of the first transmission (from the first processing unit) the output of the data-in counters would decode, of cource, to a decimal "31=.

In the situation described in FIG. 26, the next occurrence is the transmission of the article-reject data from a second processing unit. In an analagous manner to the situation described in connection with the transmission from the first processing unit, the thirty-two bits of data from the second processing unit are written into the next thirty-two addressed memory locations in the RAM 668. As the last data bit is received from the second processing unit, the counters 680 would decode to decimal "63". It is noted that the occurrence of the first hardware address (3A0) from the second processing unit, and at the first CRUCLK therefrom, the output of the gate 660 is again applied over the line 662B to the one-shot 686.

Consistent with the diagram of FIG. 26A, the third transmission of data, this from the next processing unit, is loaded into the RAM 668 in a manner analagous to that described above. All subsequent data transmissions from the CPU's to the delay circuit 183 occur in the manner outlined in connection with the transmission from the first and the second processing units.

Figure 30:
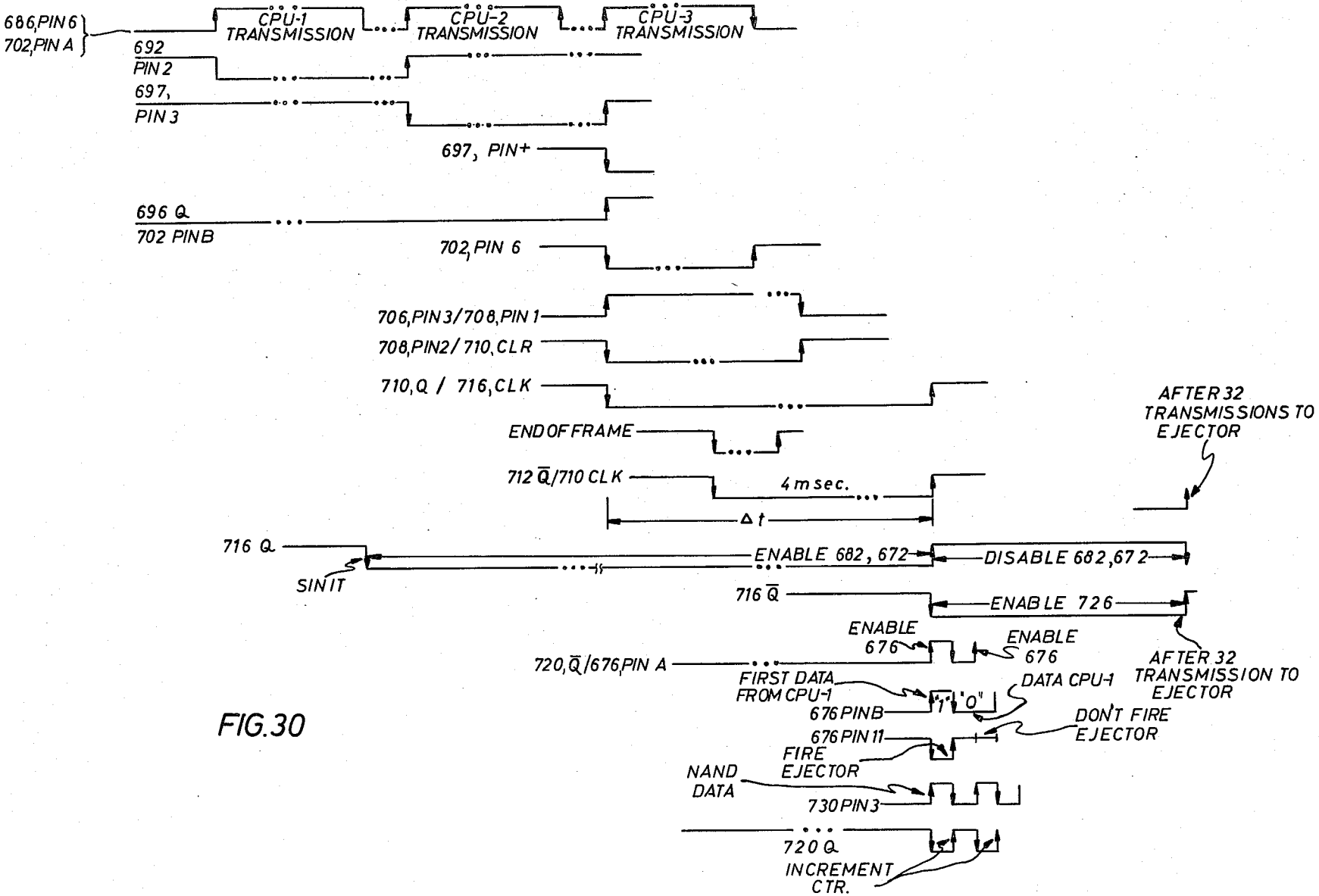
FIG. 30 is a timing diagram of the operation of the delay circuit shown in FIG. 27 when data is transmitted from the delay circuit to the ejector drivers; and, FIG. 31 is a schematic diagram of the front panel used in a sorting apparatus in accordance with the invention.

With reference now to FIG. 30, shown in the timing diagram of the operations when data in the form article-reject signals is transmitted from the delay circuit 183 to the ejector driver channels in the ejector driver circuits.

As seen from FIG. 26A, within a predetermined delay time $\Delta t$ after the beginning of the third transmission to the delay circuit from a processing unit, it is appropriate to transmit data from the delay circuit 183 to the ejector drivers. For reasons which become clear herein, the jumper connector 694 is set with the wiper thereof connected to output pin 3 of the decoder 690, the numerical value ("3") of the decoder 690 corresponding to the number of the transmission within a time $\Delta t$ of which the delay circuit 183 transmits article-reject signals to the ejector drivers.

As seen in FIG. 30, at the occurrence of the first transmission of information from a processing unit to the delay circuit, the first address and the first CRUCLK therefrom changed the state of the output of the gate 660 to a logic-1. This signal, applied over the line 662, fires the one-shot 686. The output of the one-shot 686 changes to a logic-1 state. The rising edge of the signal from the one-shot 686, applied over the line 688A to the transmission counter 690, increments the counter and changes the state of the output terminal 2 thereof to a logic-0. Although the output of the one-shot 686 is applied by the line 688B to the gate 702, no change in output state thereof occurs due to the logic-0 condition imposed at the Q output of the flip-flop 696 by the signal $\overline{\text{SINIT}}$.

The duration of the pulse from the one-shot 686 is set to exceed the time required to write all thirty-two article-reject signals into the RAM 668. Thus, only the first address from the first transmitting processing unit increments the counter 690. The output of the counter 690 and the decoder 692 remain in the conditions described.

At the occurrence of the second transmission of data to the delay circuit 183 from the second processing unit, the first hardware address and CRUCLK therefrom similarly trigger the one-shot 686. The rising edge of the output therefrom increments the counter 690 and the state of output pin 3 from the decoder 692 changes to a logic-0 condition. No further effects occur due to the second transmission from a processing unit to the delay circuit 183. The logic-0 condition at the output pin 3 of the decoder 692 remains until the third data transmission occurs.

As seen in FIG. 30, when the third transmission begins, the first hardware address and the first CRUCLK are applied to the delay circuit 183, and the one-shot 686 is again triggered. The rising edge thereof increments the counter 690. The output terminal 4 of the decoder 692 falls to a logic-0 condition, while the signal at the output terminal 3 returns to a logic-1 state. The rising edge of the signal at the output terminal 3 of the decoder 692 is applied by the wiper of the jumper connector 694 to the clock terminal of the flip-flop 696. The state of the Q output changes to the logic-1 condition present at the data input thereof.

The logic-1 signal at the Q output of the flip-flop 696 is applied on the line 698 to the "B" input of the gate 702. There, the Q output is NAND-ed with the logic-1 from the one-shot 686 applied to the "A" input of the gate 702 on the line 688B. The output of the gate 702 changes state, to a logic-0 condition. This falling edge is differentiated by the R-C network 704 and triggers the one-shot 706. The output of the one-shot 706 goes to a logic-1 condition, which is inverted by the inverter 708 and appears as a logic-0 at the clear terminal of the flip-flop 710.

A logic-0 at the clear terminal of the flip-flop 710 clears the Q output thereof to a logic-0. After the one-shot 706 times out, at the next-rising edge of a clock to the flip-flop 710 the state of the Q output reverts to a logic-1, present at the data input thereof. The rising clock pulse to the flip-flop 710 is supplied from the one-shot 712.

At the occurrence of the first END OF FRAME following the third data transmission and after the one-shot 706 times out the one-shot 712 is triggered and the Q output goes to a logic-0. The duration of the one-shot 712 is set for four milliseconds—approximately one-half the time duration of the next frame.

When the one-shot 712 times out, the rising edge of the signal clocks the flip-flop 710. A logic-1 reappears at the Q output thereof, clocking the flip-flop 716. The clocking of the flip-flop 716 changes the states of the Q and $\overline{Q}$ outputs thereof (set to logic-0 and logic-1, respectively, by SINIT). Thus, a logic-1 appears at the Q output of the flip-flop 716 disabling the driver 682 and the line coupler 672 on the line 718, and removing the preset at the flip-flop 720 on the line 718A. Simultaneously, the $\overline{Q}$ output of the flip-flop 716 goes to a logic-0 condition, enabling the tri-state driver 726 on the line 724.

The data-out address counters are applied on the bus 732A to the RAM 668 and the decoder 734A is set to the first ejector driver. The input to the inverter is a logic-0, thus enabling the decoder 734A and disabling the decoder 734B. The data appearing at the output terminal of the RAM 668 corresponds to the first data bit (an article-reject signal) written into the RAM 668 during the first address (3A0) of the first transmission from a processing unit to the delay circuit. This data is applied on the line 674 to the "B" input of the gate 676.

The appearance of the logic-1 at the output of the flip-flop 716 releases the preset to the flip-flop 720 over the line 718A. Thereafter, the first negative-to-positive transition of the oscillator 730, applied over the line 731 to clock the flip-flop 720, changes the state of the Q output (preset to a logic-0 by the effects of SINIT through the flip-flop 716) and enables the gate 676 by the presentation of a logic-1 at the "A" input thereof.

If the first transmission indicated that the processing unit has decided that the first ejector should be fired when the articles from the viewing zone monitored thereby enter the ejection zone, a logic-1 article-reject signal is loaded into the first data-in memory address location. This logic-1 is the first article-reject signal and is the first bit read from the memory 668 when the memory is addressed by the data-out address counters 728. Thus a logic-0 appears at the output of the gate 676. A logic-0 article-eject signal then, in this scheme, fires the solenoid driver of the first ejector.

The next rising edge of the oscillator signal on the line 731 changes the states of the $\overline{Q}$ and Q outputs of the flip-flop 720. The Q output goes to a logic-0 condition, disabling the gate 676. The $\overline{Q}$ output changes to a logic-1 state, the rising edge of which increments the data-out counters 728. The next-memory location in the RAM 668 and the next decoder location are addressed. The article-reject signal in that memory location (a logic-0 transmitted by the first processing unit during address 3A1) is presented on the line 674 to the "B" input of the gate 676. The next-rising edge of the oscillator output on the line 731 toggles the $\overline{Q}$ and $\overline{Q}$ outputs, changes the Q output to a logic-1, and enables gate 676. However, no article-eject signal is applied to the second ejector driver since the output of the gate 676 is a logic-1 (because the information stored during the second address of the first transmission is a logic-0).

At the end of the first sixteen addresses from the data-out counter 728, the decoder 734B is enabled through the inverter. Data is read out in a similar fashion until the first thirty-two locations in the RAM 668 have been applied to the ejector drivers. At this point, the thirty-two article-reject signals input to the delay circuit from the first transmission have been applied to the ejector drivers in the form of article-eject signals.

The thirty-second address from the data-out address counters 728 triggers the one-shot 744 through the logic 743 and thus clears the flip-flop 716 through the gate 745. When the one-shot 744 times out, the clear to the flip-flop 716 is removed. The Q and $\overline{Q}$ outputs of the flip-flop return to the logic-0 and logic-1 states, respectively. Thus, the tri-state driver 682 and the line coupler 672 are readied for the fourth data transmission from the next processing unit. The count at the data-out address counter remains at the thirty-second address (i.e., a "31") until incremented during the next sequence of transmissions to the ejector drivers.

When the first hardware address and the first CRUCLK from the next CPU appear at the delay circuit 183, the article-reject signals are written into the appropriately addressed locations in the RAM 668. The one-shot 686 is again fired and the logic-1 signal on the line 688B changes the state of the gate 702 to a logic-0. (The Q output of the flip-flop 696 remains in a logic-1 condition.)

The appearance of the logic-0 triggers the one-shot 706, clearing the flip-flop 710. The duration of the one-shot 706 and the duration of the one-shot 712 combine to prevent or inhibit the change of output states of the flip-flop 716 until such time that one is assured that this CPU has fully completed the transmission of data to the delay circuit 183. This is accomplished by withholding the rising edge of the clocking signal from the clock input to the flip-flop 710 until substantially the mid-point of the next-succeeding frame following the transmission of data to the delay circuit. Thus, it is virtually assured that data will not be read from the RAM memory until sufficient time has been allowed to write data thereinto.

The delay circuit continues in like manner to write the data incoming from the CPU's and to read the data from the RAM and apply it to the ejector driver channels so that the appropriate ejectors are actuated when the wave of articles from each transverse viewing zone enters the ejector zone.

FRONT PANEL

Figure 31A:
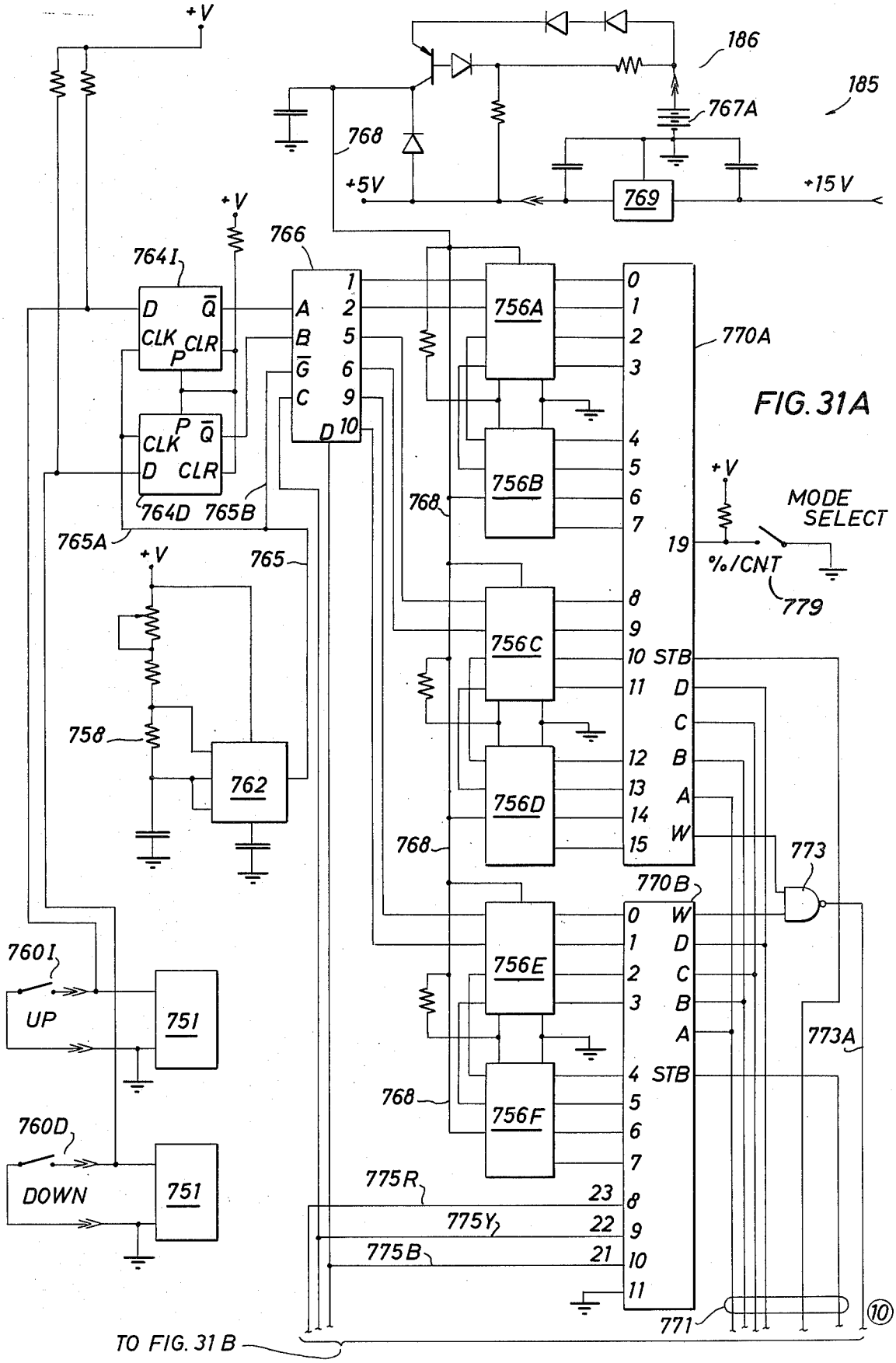
Figure 31B:
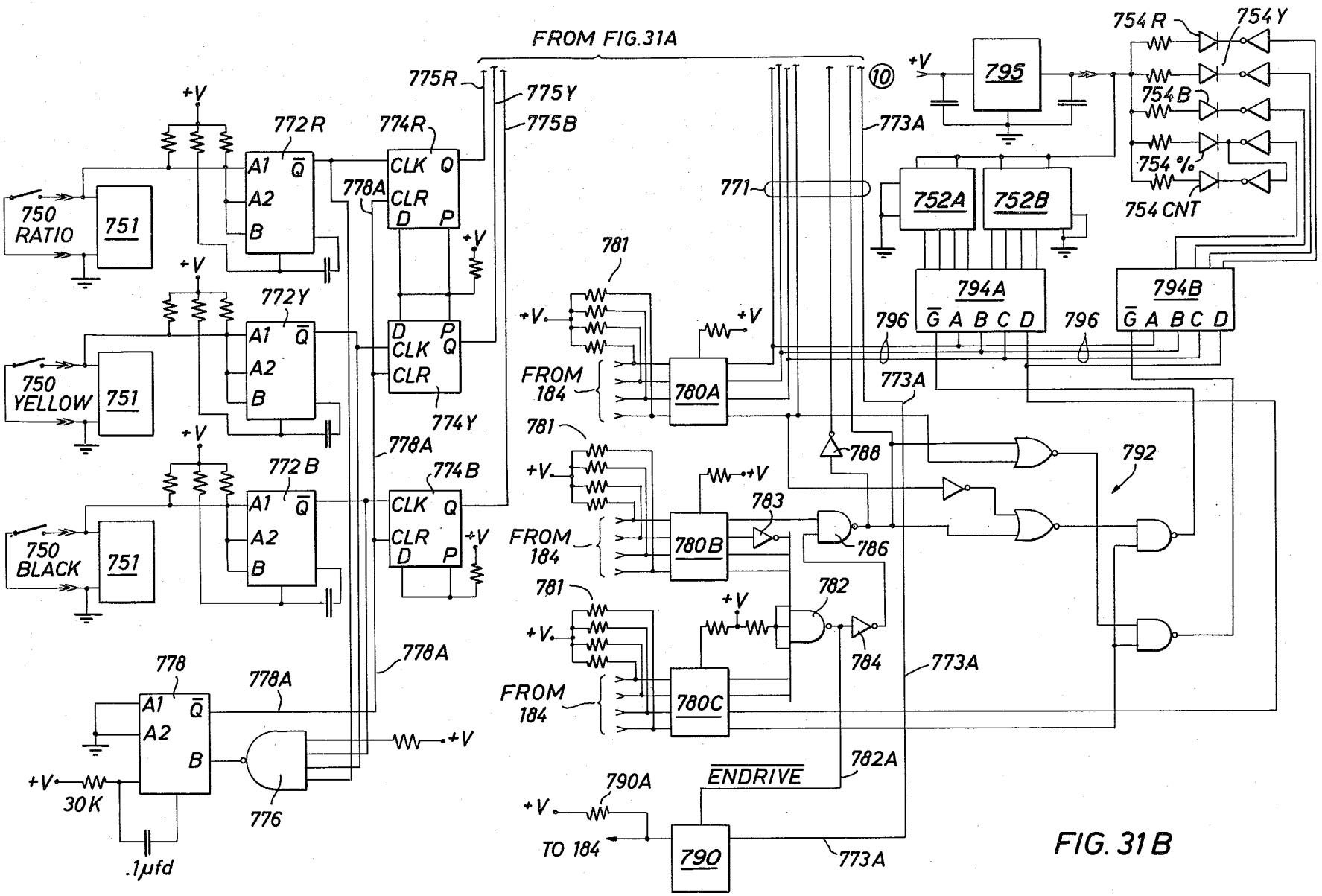

With reference to FIGS. 31A and 31B, a detailed schematic diagram of the front panel 185 utilized in connection with the instant invention is shown. As earlier noted, the front panel 185 firstly provides an avenue through which the operator may select the mode ("%" or "COUNT") upon which the apparatus classifies articles. It is recalled that in a "%" mode articles are unacceptable if the percentage of their surface area exhibiting a characteristic which differs from the threshold reference exceeds a predetermined RATIO standard selected for that characteristic. As an example: If the article has 43% as the proportion of its surface area exhibiting an unacceptable RATIO characteristic (i.e., the ratio quotient differs from the threshold reference) and if the RATIO standard selected is 26%, the article is rejected. A "COUNT" mode causes the processing units to classify articles as unacceptable if the count representing the number of segments on the surface of the article which exhibit an unacceptable characteristic signal exceeds the standard count selected for that characteristic. As an example: If the article has 32 spots on the portion of its surface where the BLACK characteristic is generated and if the BLACK standard count is 26, the article is rejected.

The front panel also provides an avenue for the operator to select the desired standard for each characteristic at which article rejection (in either mode) occurs. (In the example above, the RATIO standard for "%" or "COUNT" mode is "26".) Moreover, the front panel permits the operator to verify that the CPU's are, in fact, classifying at the selected standard. The operator is also able, through the front panel, to change standards or modes during a sort.

Finally, the front panel includes a battery backup to maintain the settings at a desired standards over a period of non-use (e.g., overnight) so that a sort may be resumed at the same standard as on a previous work day. It is noted that the mode select switch terminal is not accessible directly on the front panel. Instead, the operator must open the front panel door in order to alter the setting of the mode select. This minimizes the possibility of inadvertent mode changes during a sort.

The front panel includes an array of switches 750 (FIG. 31B), one for each of the characteristic signals generated for each article. Thus, in FIG. 31B, three switches 750 RATIO, 750 YELLOW and 750 BLACK are provided. As will be seen, actuation of any one of the switches 750 (each connected to a pin header 751) enables the operator to monitor, on a display 752, the numerical value of the standard at which the CPU's are classifying articles in the selected mode. An array of LED's 754, one for each of the characteristics (754R, 754Y, and 754B), as well as for the mode selected (754% or 754 COUNT) is associated with the display 752.

If the operator wishes to vary the numerical value of any standard, a counter array 756 (FIG. 31A) is connected to a low frequency (1 Hz.) oscillator 758 through either a standard increment switch 760I or a standard decrement switch 760D. The switches 760 are also connected through the header 751.

The oscillator 758 includes a one-shot 762 such as an NE555 device manufactured by National Semiconductor. The oscillator 762 is applied over a line 765A to clock flip-flops 764I and 764D normally connected to a logic-1 signal. However, when either of the switches 760 are energized, the data inputs to the appropriate flip-flops 764 are connected to ground potential and change to a logic-0 state. The next positive-going edge from the oscillator 758 clocks a logic-1 from the Q output of the appropriate flip-flop 764 to a decoder 766, such as a device sold under model number 74L154 by Texas Instruments. The decoder is enabled on a line 765B from the one-shot 762.

The outputs of the decoder 766 are applied to the counters 756. Counters 756A and 756B are associated with the RATIO characteristic, counters 756C and 756D are associated with the YELLOW characteristic, and counters 756E and 756F are associated with the BLACK characteristic. Suitable for use as the counters 756 are devices sold by Texas Instruments under model number CD40192.

The counters 756 are connected to a battery backup arrangement 186 over a line 768. The backup 186 includes a regulator 769, as a device sold by National Semiconductor under LM323. During those periods when the sorting apparatus 40 is not in use, the previously set standards upon which the classification of articles was made remain at the outputs of the counters 756 through the application of a potential thereto from the battery 767. Suitable for use as the battery 767 is a 6.75 V. battery sold by Union Carbide Company as an Eveready TR135. Of course, when the apparatus 40 is in operation, the line voltage powers the regulator 769 to maintain the settings on the counters 756. Of course, suitable power supplies are provided for all electronic components in the apparatus 40.

The outputs of the counters 756 are applied as inputs to a decoder arrangement 770 including decoder 770A and 770B. Suitable for use as decoders 770 are devices manufactured by Texas Instruments under model number 74150. The decoders 770 form part of a front panel input/output address network. As is discussed herein, the decoders 770 are addressed in accordance with address lines 771. As is also to be discussed, data output from the decoders 770 is applied to the external bus 184 and to the processing units from a NAND gate 773 over a line 773A.

The switches 750 are respectively applied to one-shots 772R, 772Y and 772B. A switch 750, when selected, actuates its associated one-shot 772 and clocks the appropriate flip-flop 774R, 774Y, or 774B associated therewith. The Q output of the flip-flop 774 associated with the selected switch 750 goes to a logic-1 state. The decoder 766 enables the appropriate counters 756 (in the event the operator wishes to increment or decrement the standard for the characteristic associated with the selected switch 750). The outputs of the flip-flops 774 are also respectively applied to the pins 23, 22 and 21 of the decoder over lines 775R, 775Y and 775B. The outputs of the one-shots 772 are NAND-ed at a gate 776 and trigger another one-shot 778. The Q output of the one-shot 778 is applied over a line 778A to the clear terminal of the flip-flops 774 when the one-shots 772 time out. The one-shots 772 and 778 are devices manufactured by Texas Instruments and sold under model number 74121 while the flip-flops 774 are identical to the flip-flops 764. The mode select switch 779 is connected to the decoder 770A (pin 19). Depression of the switch places a logic-0 on that pin, selecting "COUNT" mode. A logic-1 signal to pin 19 asserts the % mode.

The external data bus 184 from the CPU's terminate in an array of transceivers 780 operating in the receive mode. The inputs of the transceivers 780 are each connected to an array of pull up resistors 781. Appropriate ones of the outputs of the transceivers 780 are connected to an address decoding gate 782. An appropriate one of the outputs of the transceivers 780 is applied through an inverter 783. The output of the gate 782 is inverted at an inverter 784 and applied to one input of a NAND gate 786. The output of the gate 786 is inverted by an inverter 788 and these signals, along with other predetermined outputs of the transceivers 780 are applied over the array of address lines 771 to the decoders 770.

The output of the gate 782 is also applied over a line 782A to enable a transceiver 790 operating in the transmit mode. A pull-up resistor 790A is provided. The serial data output from the decoders 770 through the output of the NAND gate 773 is applied to the transceiver 790 by the line 773A and buffered onto the external bus 184 to the CPU's. This signal serves as the CRUIN signal to the CPU addressing the front panel.

A steering network 792 enables the appropriate one of addressable latches 794. The latches 794 are addressed by signals from an array of address lines 796 branching from the address lines 771. The outputs of the latches 794 drive the display panels 752 and also energize the appropriate LED 754 corresponding to the characteristic under consideration. A regulator 795 supplies power for the LED's 754 and the display panels 752. Suitable for use as the latches 794 are devices manufactured by Texas Instruments and sold under model number 74LS259 while devices manufactured by the same manufacturer and sold under model numbers 75138 are suitable for use as the transceivers 780 and 790.

As discussed in connection with the processing unit schematic diagram (FIGS. 21–25) when a viewing zone monitored by a given CPU exits the scanned area that CPU gains access to the external input/output bus 184 so that the article-reject signals generated thereby may be transmitted to the delay network 183. This occasion presents a suitable opportunity to also permit that CPU to poll the status of the front panel.

Accordingly, once the line drivers 640 (FIG. 23) have been enabled (by the signal ENDRIVE going to a logic-0 condition) and after the article-reject signals have been transmitted to the delay circuit 183, the hardware address of the front panel is presented on the address lines of the CPU and buffered onto the external input/output bus 184.

The gate 782 responds to the hardware address of the front panel carried on the input/output bus 184 and the output terminal thereof changes to a logic-0 condition. The output of the gate 782 enables the transceiver 790 and, as inverted by the inverter 784, simultaneously enables the gate 786. The complementary outputs of the gate 786 together with other of the addresses from the CPU are applied over the address lines 771 and sequentially poll each of the terminals of the decoders 770. Decoders 770 are enabled by the presence of a logic-0 and, due to the action of the inverter 788, only one of the decoders 770A or 770B is enabled for a given address.

The numerical standard applied to the RATIo characteristic (from the counters 756A and 756B), to the YELLOW characteristic (from the output of the counters 756C and 756D) and to the BLACK characteristic (from the counters 756E and 756F) are serially addressed from the decoder 770, through the gate 773, and applied over the bus 184 to the CPU. At the CPU, this information is carried on the line CRUIN. Internally to the CPU, these numerical values are loaded into appropriate registers and are utilized by the CPU in arriving at an appropriate classification signal for each article in accordance with the programmed instructions. Thus, during each polling, the CPU loads the numerical standards to be applied in generating an article classification signal under each characteristic. If no change in the numerical standard has occurred since the previous poll by the CPU, the outputs of the counters 756 are the same as during the previous poll and the appropriate registers internal to the CPU are again loaded with the previous numerical standards.

Thereafter, the CPU tests the appropriate inputs to the decoder 770B to determine which of the three characteristic standards the operator desires to have displayed on the display panel 752. If it is assumed that the RATIO characteristic standard is to be displayed, the signal input at terminal 23 of the decoder 770B is a logic-1 condition. The CPU responds to this request that the numerical standard at which the CPU is classifying is the RATIO characteristic, and the data in the appropriate register is transmitted over the bus 184 to the front panel. This data appears as CRUOUT signals which, along with a hardware address and a CRUCLK signal, are applied to the bus 184.

In the front panel, the address lines 796 are applied to the latches 794. The contents of the selected register is serially received by the front panel as CRUOUT data. At each CRUCLK, through the action of the steering network 792, the CRUOUT is latched into the appropriately addressed locations in the latches 794 and applied to the panels 752. Similarly, the latches 794 enable the LED 754R.

Of course, if the operator had selected another switch 750Y or 750B, the testing of the inputs to the decoder 770B by the CPU would have continued until the CPU encountered a logic-1 condition corresponding to the energized switch. The contents of that register (either the YELLOW characteristic or the BLACK characteristic) would have been serially output as CRUOUT data together with a CRUCLK signal and applied with the appropriate addresses to the latches 794.

It should also be noted that there may be some hardware address overlap inasmuch as the addresses to the decoders 770 and the latches 794 are derived from the same outputs of the transceivers 780. However, even though the gate 773 would present an appropriate output when the CPU is transmitting information to the front panel, and even though this signal is buffered onto the external bus 184 through the transceiver 790 and appears on the computer's CRUIN line, the computer is programmed to disregard data present on the CRUIN line during those periods of time when the computer is transmitting data for display over the bus 184. Conversely, although the latches 794 may be addressed when the computer is polling the decoders 770, since no CRUCLK output is provided from the CPU the latches 794 are not enabled.

If the operator desires to increment or decrement the numerical standard at which the classification is occurring the operator energizes the appropriate ones of the characteristic select switches (either switch 750R, 750Y or 750B). Thereafter, manipulation of the increment or decrement switch 760I or 760D increments or decrements the standard at the frequency of the oscillator 762.

It should be appreciated that every 175 msec. one of the CPU's is accessing the external data bus 184, transmitting information to the delay circuit 183 and to the front panel 185 and polling the front panel. The frequency of the oscillator 762 is extremely slow when compared to the frequency at which the front panel is being accessed by one of the CPU's. However, this low frequency of oscillation is necessary in order to permit the operator to have control over the incrementation or decrementation of the numerical standards. For example, the numerical standard (in the counters 756) is incremented or decremented one count every second. Thus, if seven counts are to be added or subtracted from the numerical standard of any given characteristic, a period of seven oscillations from the oscillator 762, or seven seconds, is required. However, from the point of view of the front panel, a CPU is accessing that panel every 175 msec. (A particular one of the CPU's is accessing the front panel every 700 msec.) Thus, in the time necessary to increment or decrement a numerical standard seven counts, the front panel has been accessed twenty-eight times by all processing units in the processor array and on four separate occasions by any one CPU. Once the desired numerical standard has been reached, within one second thereafter each of the four processing units in the processor array will be classifying articles on the basis of the updated numerical standard.

It will be apparent that modifications and variations of the subject matter disclosed herein may be effected without departing from the spirit or the scope of the invention. It is not intended in setting forth the specific embodiments herein disclosed to limit in any way the legitimate scope of the patent rights issuing hereon, as these have been included only to meet the statutory requirements of specific disclosure. Rather, it is intended that the following claims be interpreted to the full extent permitted by law.

For example, the counter array 205, the decoder array 206 and the NOR gates 207 (FIG. 7A) may be replaced by two counters connected to a programmable read-only memory with the output of the PROM being connected to a quad-D latch. The counters change the address of the PROM and, after the data is stabilized, it is clocked into the latch. An inverter may be used to provide a rising clock edge to clock the latch.

As another example, the electrical image plane may be defined by an array of charge-coupled diodes which, when exposed to light reflected from the viewed area, generate the electrical image.

What is claimed is:

1. Apparatus for sorting articles comprising:

a roller conveyor for carrying a random array of articles in transverse channels, each channel being defined between two adjacent rollers, and for rotating the articles in each channel through a viewing zone defined therein as the conveyor is moved longitudinally a predetermined distance through a viewed area during a predetermined time frame;

means for generating an electrical image of the viewed area on an electrical image plane;

a scanner for scanning the electrical image plane once during every predetermined time frame;

means associated with the scanner for generating, during each time frame, an electrical characteristic signal representative of a predetermined physical characteristic on the portion of the surface of each article within each viewing zone during that time frame;

means for selecting, during each time frame, the part of the electrical image plane corresponding to a predetermined viewing zone within a predetermined channel and for transmitting the electrical characteristic signals representative of the portion of each article within that viewing zone during that time frame to a processor;

a processor operable under the control of a program for processing, tabulating and storing information as to what proportion of the surface of each article within the predetermined channel exhibits the predetermined physical characteristic and for generating, after a predetermined number of time frames, an electrical classification signal for each article in the channel whereon the proportion of the surface thereof differs from a predetermined reference standard; and, means associated with the processor and responsive to the electrical classification signal to eject articles classified as unacceptable by the processor.

2. Apparatus according to claim 1 wherein:

the electrical characteristic signal contains information regarding the presence of each article within each channel;

the electrical characteristic signal generator comprises:

a comparator for comparing the characteristic signal with a predetermined reference level and for generating an article-detect signal representative of the presence of an article within a viewing zone so long as the characteristic signal exceeds the reference level.

3. Apparatus according to claim 1 wherein a predetermined portion of the surface area of each article is present within the viewing zone associated therewith during each time frame and wherein the predetermined number of time frames before a classification signal regarding that article is generated by the processor is functionally related to the number of time frames following the entry of the viewing zone having that article into the viewed area that are required for the entire surface of that article to rotate through the viewing zone.

4. Apparatus according to claim 1 wherein the electrical image of each viewing zone is generated on the electrical image plane by light reflected from articles therein as detected against a non-reflective background member disposed beneath the conveyor.

5. Apparatus according to claim 1 wherein:

the portion of the surface of each article within each viewing zone during each time frame is subdivisible into a predetermined number of segments, each segment corresponding to a predetermined area of the surface of that article;

the selecting and transmitting means includes a counter for counting the number of segments on the portion of the surface of each article within the viewing zone associated therewith during each time frame, the selecting and transmitting means being operable to transmit the counter output for each article to the processor; and the processor is operable in accordance with its program to process, tabulate and store the total number of counts associated with each article and to generate an unacceptable classification if the count exceeds a predetermined reference standard count.

6. Apparatus according to claim 1 wherein:

the portion of the surface of each article within each viewing zone during each time frame is subdivisible into a predetermined number of segments, each segment corresponding to a predetermined area of the surface of that article;

the selecting and transmitting means includes a counter for counting the number of segments on the portion of the surface of each article within the viewing zone associated therewith during each time frame, the selecting and transmitting means being operable to transmit the counter output for each article to the processor; and the processor is operable in accordance with its program to process, tabulate and store the percentage of the total surface area of the article exhibiting the predetermined physical characteristic and to generate an unacceptable classification if the percentage exceeds a predetermined reference standard percentage.

7. Apparatus according to claim 1 wherein the electrical image generating means comprises an array of charge-coupled diodes.

8. Apparatus according to claim 1 wherein the processor stores tabulated information as to each article in the predetermined channel in a predetermined location, the information stored in that location bein updated during each of the predetermined time frames before an article classification signal is generated.

9. Apparatus according to claim 1 further comprising:

a delay network electrically interposed between the processor and the eject means for storing, for a predetermined delay time, an electrical classification signal generated by the processor and for applying the electrical classification signal to the eject means after the predetermined delay time to actuate the eject means and eliminate the unacceptably classified article from the random array of articles.

10. Apparatus according to claim 9 wherein:

the processor transmits the classification signals to the delay network each time a viewing zone leaves the viewed area; and the delay time is of a duration that includes the time interval required for a predetermined number of viewing zones to leave the viewed area following the transmission of classification signals from the processor regarding articles carried in a predetermined channel.

11. Apparatus according to claim 1 wherein:

the eject means comprises an array of ejector elements each corresponding to a portion of the transverse dimension of each viewing zone; and the electrical characteristic signal contains information regarding the location of each article within the channel; and the processor actuates the appropriate one of the ejector elements in accordance with the location of the article classified as unacceptable thereby.

12. Apparatus according to claim 11 further comprising:

a delay network electrically interposed between the processor and the ejector elements for storing, for a predetermined delay time, an electrical classification signal generated by the processor and for applying the classification signal to the appropriate one of the ejector elements after the predetermined delay time to actuate that ejector to eliminate the unacceptably classified article from the array.

13. Apparatus according to claim 12 wherein:

the processor transmits classification signals to the appropriate ejector elements to eliminate articles from the random array of articles carried in a predetermined channel when the viewing zone therein leaves the viewed area;

and wherein the delay network comprises:

a memory having a plurality of locations therein, each location corresponding to one of the ejector elements;

an input address counter for sequentially addressing each memory location, the classification signal from the processor being stored in the memory location corresponding to the appropriate ejector element;

an output address counter which, when enabled, sequentially addresses each memory location such that the addressing of the memory location corresponding to the appropriate ejector actuates that ejector to eliminate an article from the array of articles carried in the predetermined channel; and, a transmission counter for counting the number of transmissions from the processor to the delay network and, after a predetermined delay following a predetermined transmission, enabling the output address counter.

14. Apparatus according to claim 1 further comprising a front panel network accessible to an operator of the sorting apparatus, the front panel including a display arrangement operable to display to the operator a signal from the processor representative of the standard utilized by the processor as the basis of classification of articles.

15. Apparatus according to claim 14 wherein the front panel further comprises a network through which the operator may selectably increment or decrement the standard utilized by the processor as the basis of classification of articles.

16. Apparatus according to claim 15 wherein the incrementing or decrementing network is polled by the processor during each time frame to ascertain if the standard has been incremented or decremented by the operator since the preceding time frame.

17. Apparatus according to claim 16 wherein the front panel further comprises a counter for maintaining the standard selected by the operator during the last previous incrementation or decrementation thereby.

18. Apparatus according to claim 17 wherein the front panel further comprises battery backup maintaining the count in the counter.

19. Apparatus according to claim 1 further comprising a front panel network accessible to an operator for the sorting apparatus, the front panel including a network through which the operator may selectably increment or decrement the standard utilized by the processor as the basis of classification of articles.

20. Apparatus according to claim 19 wherein the incrementing or decrementing network is polled by the processor during each time frame to ascertain if the standard has been incremented or decremented by the operator since the preceding time frame.

21. Apparatus according to claim 20 wherein the front panel further comprises a counter for maintaining the standard selected by the operator during the last previous incrementation or decrementation thereby.

22. Apparatus according to claim 21 wherein the front panel further comprises a battery backup maintaining the count in the counter.

23. Apparatus according to claim 1 wherein the viewed area is sized to accommodate m viewing zones and the electrical image plane contains N lines and wherein the electrical image of each viewing zone occupies a different one of the N lines during each time frame, the selecting and transmitting means being operative to select the appropriate ones of the N lines of the electrical image plane corresponding to the image of each viewing zone during each time frame.

24. Apparatus according to claim 23 wherein the processor comprises an array of m processing units, each unit being adapted to process, tabulate and store information regarding each article in a predetermined one of the m viewing zones to which one of the processing units is assigned.

25. Apparatus according to claim 24 wherein the selecting and transmitting means further comprises:

a steering network for steering the characteristic signals from articles in a predetermined one of the viewing zones to the processing unit assigned to that predetermined one of the viewing zones.

26. Apparatus according to claim 1 wherein:

the electrical image plane contains N lines;

the viewed area is sized to accommodate m viewing zones, the electrical image of each viewing zone occupies a different one of the N lines during each time frame, the electrical image of each of the viewing zones being separated by k lines on the electrical image plane such that during any time frame the product of m and k is less than or equal to N;

wherein the selecting and transmitting means selects m lines from the electrical image plane during each frame in a cycle containing k frames in accordance with a predetermined sequence, the numerical value of the lines sequentially selected during the cycle being in accordance with the numerical values of the elements of an m by k matrix, the values of each element in the matrix being governed by the relationship $$E_{x,y}=[i+(x-1)k]+(y-1)$$

where $x=1, 2 \ldots m$, $y=1, 2 \ldots k$, i = the numerical value of the scan line on the electrical image plane corresponding to the initial scan line of the electrical image of the viewed area.

27. Apparatus according to claim 26 wherein the selecting and transmitting means further comprises:

a counter associated with the scanner for generating a signal representative of the numerical value of each line on the electrical image plane being scanned during each time frame;

a memory for storing the numerical value of each line in the sequence to be selected during each cycle; and, a comparator for comparing the numerical value of the line of the electrical image plane to be next-scanned by the scanner with the numerical value of the next line in the sequence to be selected and, if the values are equal, for enabling the transmission of the characteristic signal from the next-scanned line and for incrementing the address of the memory.

28. Apparatus according to claim 25 wherein the processor comprises an array of m processing units, each processing unit being adapted to process, tabulate and store information regarding each article in a predetermined one of the m viewing zones to which each of the processing units is assigned and wherein the selecting and transmitting means further comprises:

a steering network for steering the characteristic signals from articles in one of the viewing zones to the processing unit assigned to that predetermined one of the viewing zones.

29. Apparatus according to claim 28 wherein only a predetermined portion intermediate the extremities of each of the N lines on the electrical image plane is transmitted to the processor.

30. Apparatus according to claim 1 wherein:

the electrical image generating means comprises a photosensitive target, the target being responsive to light energy incident thereon to generate a charge stored thereby until scanned by an electron scanning beam to produce a video signal representative of the portion of the viewed area scanned by the electron scanning beam; and wherein:

the scanner includes means for generating an electron beam and for controlling the movement of the beam across N scan lines of the target during each time frame.

31. Apparatus according to claim 30 wherein the N lines of the electrical image plane are sequentially scanned by the electron scanning beam.

32. Apparatus according to claim 30 wherein the predetermined time frame is selected such that the scanning beam is passed over a predetermined point on the target before the target is exposed to an amount of light reflected from the viewed area sufficient to saturate the target.

33. Apparatus according to claim 30 wherein only a predetermined portion intermediate the extremities of each of the N lines on the electrical image plane is transmitted to the processor.

34. Apparatus according to claim 30 wherein the electron scanning beam scans a predetermined number of lines of the electrical image plane before the first and after the N-th line thereon to thereby define a buffer region around the portion of the target scanned by the electron scanning beam.

35. Apparatus according to claim 30 wherein the electron beam is inhibited from striking the target as the beam is horizontally retraced from the end of one of the N scan lines to the beginning of the next-sequential scan line.

36. Apparatus according to claim 30 wherein the electron beam is inhibited from striking the target as the beam is vertically retraced from the end of the N-th scan line to the beginning of the first scan line in preparation for a scan of the N lines during the next-successive time frame.

37. Apparatus according to claim 36 wherein the electron beam is inhibited from striking the target as the beam is horizontally retraced from the end of one of the N scan lines to the beginning of the next-sequential scan line.

38. Apparatus according to claim 30 further comprising:

a drive arrangement coupled to the conveyor for advancing the viewing zone the predetermined distance through the viewed area during each time frame, the drive arrangement including a synchronous motor operable on a line current of a predetermined frequency; and wherein:

the predetermined time frame during which the electrical image plane is scanned by the electron scanning beam is functionally related to the predetermined line frequency such that during each time frame the movement of the conveyor the predetermined distance through the viewed area is synchronized with the scanning of the N lines of the electrical image plane by the electron scanning beam.

39. Apparatus according to claim 38 wherein the N lines of the electrical image plane are sequentially scanned by the electron scanning beam.

40. Apparatus according to claim 38 wherein the predetermined time frame is selected such that the scanning beam is passed over a predetermined point on the target before the target is exposed to an amount of light reflected from the viewed area sufficient to saturate the target.

41. Apparatus according to claim 38 wherein only a predetermined portion intermediate the extremities of each of the N lines on the electrical image plane is transmitted to the processor.

42. Apparatus according to claim 38 wherein the electron scanning beam is inhibited from striking the target as the beam is horizontally retraced from the end of one of the N scan lines to the beginning of the next-sequential scan line.

43. Apparatus according to claim 39 wherein the electron scanning beam scans a predetermined number of lines of the electrical image plane before the first and after the N-th line thereon to thereby define a buffer region around the portion of the target scanned by the electron scanning beam.

44. Apparatus according to claim 43 wherein only a predetermined portion intermediate the extremities of each of the N lines on the electrical image plane is transmitted to the processor.

45. Apparatus according to claim 38 wherein the electron beam is inhibited from striking the target as the beam is vertically retraced from the end of the N-th scan line to the beginning of the first scan line in preparation for a scan of the N lines during the next-successive time frame.

46. Apparatus according to claim 45 wherein the electron beam is inhibited from striking the target as the beam is horizontally retraced from the end of one of the N scan lines to the beginning of the next-sequential scan line.

47. Apparatus for sorting articles comprising:

a conveyor having a plurality of longitudinally spaced rollers, each roller being rotatable about its central axis and cooperating with a next-adjacent roller to define a plurality of transversely extending channels, each channel being adapted to carry a plurality of randomly disposed articles therein, a viewing zone being defined within each channel;

a drive arrangement for advancing the conveyor through predetermined portion of a viewed area during a predetermined time frame, the drive arrangement simultaneously rotating the rollers to cause the articles carried in each transverse channel to rotate through the viewing zone defined therein;

a viewer for viewing the viewed area and for detecting light reflected therefrom;

means associated with the viewer for generating, on an electrical image plane, an electrical image of light reflected from the viewed area, the electrical image plane having N lines therein;

a scanning arrangement associated with the electrical image generating means for scanning a predetermined number of lines of the electrical image plane during each time frame, including the scan line corresponding to the electrical image of each viewing zone within the viewed area during that time frame;

a characteristic signal generator associated with the scanning arrangement for generating, for each viewing zone within the viewed area during each time frame, a first electrical characteristic signal representative of the presence and location of each article within that viewing zone and a second electrical characteristic signal representative of the presence of a predetermined physical characteristic on the portion of each article within that viewing zone;

a line selector network for selecting, during each time frame, the line on the electrical image plane corresponding to each viewing zone;

a line transmitting arrangement associated with the line selector for transmitting electrical characteristic signals representative of each article in the viewing zone corresponding to the line on the electrical image plane selected by the line selector network;

a processor adapted to receive and process characteristic signals representative of each article within each viewing zone and, after a predetermined number of time frames, to generate an electrical classification signal representative of the acceptability of each article within each viewing zone, and, if an article is classified as unacceptable, to actuate the appropriate one of a plurality of ejector elements in accordance with the location of each unacceptable article; and, a plurality of ejector elements substantially coextensive with the transverse dimension of each viewing zone and responsive to the processor to eliminate articles classified as unacceptable thereby.

48. Apparatus according to claim 47 wherein the electrical image of each viewing zone is generated on the electrical image plane by light reflected from articles therein as detected against a non-reflective background member disposed beneath the conveyor.

49. Apparatus according to claim 47 wherein:

the portion of the surface of each article within each viewing zone during each time frame is subdivisible into a predetermined number of segments, each segment corresponding to a predetermined area of the surface of that article;

the selecting and transmitting means includes a counter for counting the number of segments on the portion of the surface of each article within the viewing zone associated therewith during each time frame, the selecting and transmitting means being operable to transmit the counter output for each article to the processor; and the processor is operable in accordance with its program to process and store the total number of counts associated with each article and to generate an unacceptable classification if the count exceeds a predetermined reference standard count.

50. Apparatus according to claim 47 wherein:

the portion of the surface of each article within each viewing zone during each time frame is subdivisible into a predetermined number of segments, each segment corresponding to a predetermined area of the surface of that article;

the selecting and transmitting means includes a counter for counting the number of segments on the portion of the surface of each article within the viewing zone associated therewith during each time frame, the selecting and transmitting means being operable to transmit the counter output for each article to the processor; and the processor is operable in accordance with its program to process and store the percentage of the total surface area of the article exhibiting the predetermined physical characteristic and to generate an unacceptable classification if the percentage exceeds a predetermined reference standard percentage.

51. Apparatus accordig to claim 47 wherein the electrical image generating means comprises a plurality of arrays of charge-coupled diodes.

52. Apparatus according to claim 47 wherein each processing unit stores information as to each article in the predetermined viewing zone to which it is assigned in a predetermined location, the information in that location being updated during each of the predetermined time frames before an article classificaton signal is generated.

53. Apparatus according to claim 47 wherein the scanned area is sized to accommodate a maximum of m viewing zones therein during any time frame and wherein the line selector is adapted to select scan lines from the electrical image plane in accordance with a predetermined sequence such that during each time frame m scan lines are selected.

54. Apparatus according to claim 53 wherein there are k scan lines on the electrical image plane between the image of each viewing zone on the electrical image plane such that, during any time frame, m times k is less than or equal to N, and wherein each line of the electrical image plane selected by the line selector network during any time frame in a cycle containing k frames is selected in accordance with the numerical values of the elements E of an m by k matrix, the numerical values of the elements E in the matrix being defined in accordance with the relationship $$E_{x,y}=[i+(x-1)k]+(y-1)$$

where $x=1, 2 \ldots m$, $y=1,2 \ldots k$, $i$=numerical value of the scan line on the electrical image plane corresponding to the initial line of the electrical image of the scanned area.

55. Apparatus according to claim 54 wherein the line selector network comprises:

a counter associated with the scanning arrangement for generating an electrical signal representative of the numerical value of the current scan line on the electrical image plane being scanned by the scanning arrangement during each time frame;

a memory for storing the numerical value of each scan line of the sequence of scan lines to be selected during each cycle;

a comparator for comparing the numerical value of the current scan line with the numerical value of the next scan line to be selected during the cycle and for generating an enabling signal to the line transmitting arrangement when the numerical values are equal.

56. Apparatus according to claim 47 wherein the scanned area is sized to accommodate a maximum of m viewing zones during any time frame and wherein the processor comprises an array of m processing units, each processing unit being assigned to receive electrical characteristic signals from one of the scan lines in the electrical image plane for so long as the viewing zone corresponding to that line remains within the scanned area.

57. Apparatus according to claim 56 wherein the line selector is adapted to select scan lines in accordance with a predetermined sequence and further comprising:

a steering arrangement associated with the line selector for selecting the appropriate one of the m processing units assigned to receive characteristic signals from the viewing zone corresponding to each scan line selected by the line selector and, when a viewing zone leaves the scanned area, for re-assigning that processing unit to the viewing zone mostrecently entered into the scanned area.

58. Apparatus according to claim 56 wherein the images of each viewing zone are spaced k lines apart on the electrical image plane and wherein the line selector selects a number m times k of scan lines during a cycle and, for each cycle having a numerical value greater than or equal to m, the steering arrangement selects processing units to receive scan lines in accordance with a predetermined numerical sequence such that the processing unit selected by the steering arrangement during the last frame in any predetermined cycle is the first processing unit selected by the steering arrangement during the first frame of the next-successive cycle.

59. Apparatus according to claim 58 wherein the steering arrangement selects processing units in decreasing numerical order in a base m number system.

60. Apparatus according to claim 56 wherein the images of each viewing zone are spaced k lines apart in the electrical image plane and wherein the line selector selects a number (m times k) of scan lines during a cycle and, for each cycle having a numerical value less than m, the steering arrangement selects processing units during each frame in accordance with a predetermined numerical sequence, provided that during any cycle the steering arrangement selects as the processing unit to receive information from the viewing zone most recently entering the scanned area a processing unit which is not selected during the previous cycle.

61. Apparatus according to claim 60 wherein the steering arrangement selects processing units in decreasing numerical order in a base m number system.

62. Apparatus according to claim 47 further comprising a delay circuit interposed between the processor and the ejector for storing, for a predetermined time delay period, signals from the processor regarding the acceptability of articles within the viewing zones and for applying the signals to the ejectors after the time delay.

63. Apparatus according to claim 62 wherein the processor transmits the classification signals to the delay network each time a viewing zone leaves the viewed area; and the delay time corresponds to the time interval required to pass for a predetermined number of viewing zones to leave the viewed area following the transmission of classification signals from the processor regarding articles carried in a predetermined channel.

64. Apparatus according to claim 47 wherein:

the ejecting means comprises an array of ejector elements each corresponding to a portion of the transverse dimension of each viewing zone; and, the electrical characteristic signal contains information regarding the location of each article within the channel; and, the processor actuates the appropriate one of the ejector elements in accordance with the location of the article classified as unacceptable thereby.

65. Apparatus according to claim 64 further comprising:

a delay network electrically interposed between the processor and the ejector elements for storing, for a predetermined delay time, an electrical actuating signal generated by the processor and for applying the actuating signal to the appropriate one of the ejector elements after the predetermined delay time to actuate that ejector to eliminate the unacceptably classified article from the array.

66. Apparatus according to claim 65 wherein the processor transmits actuating signals to the appropriate ejector elements to eliminate articles from the random array of articles carried in a predetermined channel when the viewing zone therein leaves the viewed area;

and wherein the delay network comprises:

a memory having a plurality of locations therein, each location corresponding to one of the ejector elements;

an input address counter for sequentially addressing each memory location, the actuating signal from the processor being stored in the memory location corresponding to the appropriate ejector element;

an output address counter which, when enabled, sequentially addresses each memory location such that the addressing of the memory location corresponding to the appropriate ejector actuates that ejector to eliminate an article from the array of articles carried in the predetermined channel; and, a transmission counter for counting the number of transmissions from the processor to the delay network and, after a predetermined delay following a predetermined transmission, enabling the output address counter.

67. Apparatus according to claim 47 further comprising a front panel network accessible to an operator of the sorting apparatus, the front panel including a display arrangement operable to display to the operator a signal from the processor representative of the standard utilized by the processor as the basis of classification of articles.

68. Apparatus according to claim 67 wherein the front panel further comprises a network through which the operator may selectably increment or decrement the standard utilized by the processor as the basis of classification of articles.

69. Apparatus according to claim 68 wherein the incrementing or decrementing network is polled by the processor during each time frame to ascertain if the standard has been incremented or decremented by the operator since the preceding time frame.

70. Apparatus according to claim 69 wherein the front panel further comprises a counter for maintaining the standard selected by the operator during the last previous incrementation or decrementation thereby.

71. Apparatus according to claim 70 wherein the front panel further comprises battery backup maintaining the count in the counter.

72. Apparatus according to claim 47 wherein:

the electrical image generating means, comprising a plurality of photosensitive targets, each target being responsive to light energy incident thereon to generate a charge stored thereby until each target is scanned by an electron scanning beam to produce a video signal representative of the portion of the viewed area scanned by each electron scanning beam; and wherein the scanner includes means for generating an electron beam and for controlling the movement of the beams across the N scan lines of the targets during each time frame.

73. Apparatus according to claim 72 further comprising:

a drive arrangement coupled to the conveyor for advancing the conveyor the predetermined distance through the viewed area during each predetermined time frame, the drive arrangement including a synchronous motor operable on a line current of a predetermined frequency; and wherein:

the predetermined time frame during which the electrical image plane on the targets are scanned by the electron scanning beams is functionally related to the predetermined line frequency such that during each time frame the movement of the conveyor the predetermined distance through the viewed area is synchronized with the scanning of the N lines of the electrical image planes by the electron scanning beams.

74. Apparatus according to claim 73 wherein the N lines of the electrical image planes are sequentially scanned by the electron scanning beams.

75. Apparatus according to claim 73 wherein the predetermined time frame is selected such that the scanning beams are passed over a predetermined point on the targets before the targets are exposed to an amount of light reflected from the viewed area sufficient to saturate the targets.

76. Apparatus according to claim 73 wherein only a predetermined portion intermediate the extremities of each of the N lines on the electrical image planes are transmitted to the processing units.

77. Apparatus according to claim 73 wherein the electron scanning beams scan a predetermined number of lines of the electrical image plane before the first and after the N-th line on each to thereby define buffer regions around the portion of the targets scanned by the electron scanning beams.

78. Apparatus according to claim 73 wherein the electron beams are inhibited from striking the targets as the beams are vertically retraced from the end of the N-th scan line to the beginning of the first scan line in preparation for a scan of the N lines of each target during the next-successive time frame.

79. Apparatus according to claim 78 wherein the electron beams are inhibited from striking the targets as the beams are horizontally retraced from the end of one of the N scan lines to the beginning of the next-sequential scan line.

80. Apparatus according to claim 47 wherein the first electrical characteristic signal is also representative of a predetermined physical characteristic on the portion of each article within the viewing zone; and wherein the characteristic signal generator further comprises:

a divider operative to generate during each time frame a signal representative of the ratio of the first and second characteristic signals.

81. Apparatus according to claim 80 wherein the divider comprises:

a first (308G) and a second (308R) transistor respectively having the first and the second characteristic signals applied thereto;

a first ($D_1$) and a second ($D_2$) diode connected to the first and second transistors such that the voltage across each diode is functionally related to the logarithm of the first and the second characteristic signal, respectively;

a third (310G) and a fourth (310R) transistor respectively coupled to the cathode of the first and the second diode;

a matching diode ($D_3$ and $D_5$) respectively connected to the first and the second transistors; and, a difference amplifier (312) connected to the outputs of the third and fourth transistors operative to generate a signal functionally related to the logarithmic difference of the first and second characteristic signals.

82. Apparatus according to claim 81 wherein the first and second diodes are respectively selected to match the emitter-base voltage drop of the third and fourth transistors and wherein the matching diodes are respectively selected to match the emitter-base voltage drops of the first and second transistors.

83. A method for sorting articles comprising the steps of:

rotating an article through a viewing zone while simultaneously longitudinally displacing the viewing zone through a viewed area;

generating, on an electrical image plane, an electrical image of the viewed area;

scanning the electrical image plane once during every predetermined time frame;

generating during each time frame an electrical characteristic signal representative of a predetermined physical characteristic on the portion of the surface of each article in each viewing zone during that time frame;

selecting, during each time frame, the part of the electrical image plane corresponding to a predetermined viewing zone;

generating an electrical classification signal for each article if the proportion of the surface area thereof exhibiting the predetermined physical characteristic exceeds a predetermined reference standard; and, removing articles classified as unacceptable.

84. The method for sorting articles according to claim 83 further comprising the step of delaying an article classification signal for a predetermined time interval sufficient to permit the article to move from the viewed area to an ejection zone.

85. A method for sorting articles comprising the steps of:

randomly depositing an array of articles on a roller conveyor;

rotating the articles through a viewing zone while simultaneously and longitudinally displacing the viewing zone through a viewed area;

generating, on an electrical image plane, an electrical image of the viewed area;

scanning the electrical image plane once during every predetermined time frame;

generating during each time frame an electrical characteristic signal representative of a predetermined physical characteristic on the portion of the surface of each article in each viewing zone during that time frame;

selecting, during each time frame, the part of the electrical image plane corresponding to a predetermined viewing zone;

generating an electrical classification signal for each article if the proportion of the surface area thereof exhibiting the predetermined physical characteristic exceeds a predetermined reference standard; and removing articles classified as unacceptable.

86. The method for sorting articles according to claim 85, further comprising the step of delaying an article classification signal for a predetermined time interval sufficient to permit the article to move from the viewed area to an ejection zone.

* * * * *

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

Col. 3, line 59 - "throughout" should read --throughput--.

Col. 11, line 53 - "94" should read --95--.

Col. 14, line 38 - "plaen" should read --plane--;

line 47 - "suitablle" should read --suitable--; and line 53 - "adjustement" should read --adjustment--.

Col. 15, line 38 - please delete "163"; and line 39 - please delete "163".

Col. 17, line 28 - "FIGS." should read --FIG.--

Col. 20, line 23 - please delete "0"; and line 60 - "systeminitialize" should read --system-initialize--.

Col. 24, line 26 - "second" should read --scanned--.

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

Col. 27, line 28 - please delete "to" (first occurrence).

Col. 30, line 32 - "BLANKING" should read --~~BLANKING~~--;

line 57 - "grames" should read --frames--; and line 67 - "As" should read --At--.

Col. 31, line 10 - "proceding" should read --preceding--; and line 66 - "the" (second occurrence) should read --The--.

Col. 33, line 47 - "logrithmic" should read --logarithmic--.

Col. 38, line 36 - "inventor" should read --invertor--.

line 53 - "zerocrossings" should read --zero-crossings--.

Col. 41, line 7 - "oneshot" should read --one-shot--; and line 15 - "Q" should read --$\overline{Q}$--.

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

Col. 43, line 49 - "can" should read --scan--;

line 53 - "VZ-5" should read --$VZ_5$--; and line 55 - "line -92" should read --line- 92--.

Col. 46, line 20 - "Kohm" should read --K ohm--; and line 22 - "410" should read --410 (FIG. 20B)--.

Col. 47, line 25 - "on" should read --one--.

Col. 49, line 36 - "of the each" should read --of each--.

Col. 51, line 52 - "a" should read --at a--.

Col. 52, line 18 - "oneshot" should read --one-shot--.

Col. 54, line 36 - "Q" should read --$\overline{Q}$--.

Col. 55, line 58 - "(SEND) (LATCH)" should read --($\overline{SEND}$) ($\overline{LATCH}$)--; and

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

line 64 - "Q" should read --$\overline{Q}$--.

Col. 56, line 53 - "procssing" should read --processing--.

Col. 57, line 14 - "acess" should read --access--.

Col. 58, line 21 - "624" should read --642--;

line 26 - "FIG. 3" should read --FIG. 13--;

line 40 - "FIG. 20" should read --FIG. 19--;

line 41 - "FIG. 20" should read --FIG. 19--;

line 42 - "$\overline{\text{HOLD}}$" should read --HOLD--; and line 43 - "HOLD" should read --$\overline{\text{HOLD}}$--.

Col. 59, line 33 - "sixteen bit" should read --sixteen-bit--.

Col. 60, line 24 - "reflectively" should read --reflectivity--; and line 38 - "one-eight" should read --one-eighth--.

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

Col. 61, line 27 - "process,12," should read --process 12--.

Col. 64, line 52 - "a" should read --an--; and line 57 - please delete "and".

Col. 65, line 53 - "80" should read --88--.

Col. 66, line 11 - "Q" should read --$\overline{Q}$--;

line 32 - "addresses" should read --address--;

line 44 - "CUROUT" should read --CRUOUT--; and line 65 - "thecounters" should read --the counters--.

Col. 67, line 15 - ""31=" should read --"31"--;

line 35 - "transmission" should read --transmissions--;

line 37 - "in" should read --is--;

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

line 38 - "form" should read --form of--;

line 39 - "reject" should read --eject--; and line 51 - "reject" should read --eject--.

Col. 69, line 10 - "Q" should read --$\overline{Q}$--;

line 27 - "Q" should read --$\overline{Q}$--;

line 28 - "$\overline{Q}$" should read --Q--;

line 36 - "$\overline{Q}$" (first occurrence), should read --Q--; and line 37 - "Q" should read --$\overline{Q}$--.

Col. 71, line 25 - "Q" should read --$\overline{Q}$--.

Col. 72, line 9 - "Q" should read --$\overline{Q}$--; and

UNITED STATES PATENT AND TRADEMARK OFFICE

CERTIFICATE OF CORRECTION

PATENT NO. : 4,308,959

DATED : January 5, 1982

INVENTOR(S) : Michael C. Hoover

It is certified that error appears in the above—identified patent and that said Letters Patent is hereby corrected as shown below:

line 65 - "ENDRIVE" should read --ENDRIVE--.

Col. 73, line 16 - "RATIo" should read --RATIO--.

Signed and Sealed this

Eleventh Day of January 1983

[SEAL]

Attest:

GERALD J. MOSSINGHOFF

Attesting Officer

Commissioner of Patents and Trademarks